US011680400B2

(12) United States Patent
Espinosa

(10) Patent No.: US 11,680,400 B2
(45) Date of Patent: Jun. 20, 2023

(54) CONCRETE BOSS ANCHOR

(71) Applicant: CETRES HOLDINGS, LLC, Jackson, WY (US)

(72) Inventor: Thomas M. Espinosa, Snohomish, WA (US)

(73) Assignee: CETRES HOLDINGS, LLC, Jackson, WY (US)

( * ) Notice: Subject to any disclaimer, the term of this patent is extended or adjusted under 35 U.S.C. 154(b) by 0 days.

(21) Appl. No.: 16/417,021

(22) Filed: May 20, 2019

(65) Prior Publication Data

US 2019/0352900 A1 Nov. 21, 2019

Related U.S. Application Data

(60) Provisional application No. 62/678,944, filed on May 31, 2018, provisional application No. 62/673,425, filed on May 18, 2018.

(51) Int. Cl.
*E04B 1/41* (2006.01)
*E04C 5/16* (2006.01)
*E04B 1/26* (2006.01)

(52) U.S. Cl.
CPC ..... *E04B 1/4157* (2013.01); *E04B 1/4121* (2013.01); *E04C 5/16* (2013.01); *E04B 2001/2684* (2013.01)

(58) Field of Classification Search
CPC ..... E04B 1/4157; E04B 1/4121; E04B 2001/2684; E04B 1/4114; E04B 1/4107; E04C 5/16; E04G 21/185
USPC ..... 52/295
See application file for complete search history.

(56) References Cited

U.S. PATENT DOCUMENTS 1,185,765 A * 6/1916 Brooks ..... F16B 13/141 52/704
1,218,378 A * 3/1917 Dippel ..... E04B 1/4121 52/699
1,726,286 A * 8/1929 Bennet ..... E04B 1/4157 52/699
3,284,973 A * 11/1966 Ames ..... E01C 23/01 52/155
3,579,938 A * 5/1971 Hanson ..... E04F 21/05 52/365
3,646,982 A * 3/1972 Cushman ..... F16B 33/004 411/82.5
3,884,008 A * 5/1975 Miller ..... E04B 1/4121 52/699
5,096,350 A * 3/1992 Peterson ..... F16B 37/044 411/108

(Continued)

FOREIGN PATENT DOCUMENTS

EP 0784127 A1 * 7/1997
JP 2007-255149 10/2007

OTHER PUBLICATIONS

Notification of Transmittal of the International Search Report and the Written Opinon of the International Searching Authority, or the Declaration for PCT/US2019/033067.

*Primary Examiner* — Christine T Cajilig
(74) *Attorney, Agent, or Firm* — Fresh IP PLC

(57) ABSTRACT

An anchor assembly for being embedded in concrete includes a metal plate including an opening, the metal plate including a top surface and bottom surface; the opening including a wall extending from the top surface or the bottom surface; and a threaded rod operably attached to the metal plate.

49 Claims, 150 Drawing Sheets

(56) References Cited

U.S. PATENT DOCUMENTS

| | | | | | |
|---|---|---|---|---|---|
| 5,347,777 | A | | 9/1994 | Sudduth | |
| 5,375,384 | A | * | 12/1994 | Wolfson | E04B 1/0007 52/295 |
| 5,428,936 | A | * | 7/1995 | Roth | E04B 1/4157 248/327 |
| 5,609,005 | A | | 3/1997 | Schierloh et al. | |
| 5,960,689 | A | * | 10/1999 | Warren | B23B 13/123 414/14 |
| 8,281,531 | B2 | | 10/2012 | Dent | |
| 8,672,281 | B2 | * | 3/2014 | Ernst | F16B 9/052 248/327 |
| 9,982,427 | B2 | * | 5/2018 | Grahek | E04B 1/4157 |
| 2002/0078657 | A1 | * | 6/2002 | Zambelli | E04B 1/4107 52/710 |
| 2002/0129570 | A1 | | 9/2002 | Sorkin | |
| 2004/0234356 | A1 | * | 11/2004 | Parker | F16B 37/068 411/181 |
| 2007/0134972 | A1 | | 6/2007 | Hoy | |
| 2011/0041449 | A1 | * | 2/2011 | Espinosa | E04B 1/4157 52/698 |
| 2011/0041450 | A1 | * | 2/2011 | Espinosa | E04C 5/125 52/698 |
| 2013/0067849 | A1 | * | 3/2013 | Espinosa | E04B 1/4121 52/699 |
| 2017/0342706 | A1 | | 11/2017 | Espinosa | |

* cited by examiner

CONCRETE BOSS ANCHOR

RELATED APPLICATIONS

This is a nonprovisional application of Provisional Application Ser. No. 62/673,425, filed May 18, 2018 and 62/678,944, filed May 31, 2018, hereby incorporated herein by reference.

This application is also related to application Ser. No. 15/429,345, filed Feb. 10, 2017, hereby incorporated herein by reference.

FIELD OF THE INVENTION

The present invention is generally directed to an anchor embedded in a concrete structure for transferring load to the concrete structure and for concrete reinforcement.

BACKGROUND OF THE INVENTION

Concrete embedded anchors are known in the prior art. Examples of concrete anchors are disclosed in U.S. Pat. Nos. 8,806,835, 8,943,777, 9,062,452, 9,097,001, 9,222,251, 9,416,530, 9,447,574 and 9,567,741, hereby incorporated by reference. These anchors are embedded in concrete structures, such as concrete foundations, concrete slabs, concrete walls and concrete columns and connected to a hold down system to reinforce a building wall against forces generated by earthquakes and/or high winds. Examples of hold down systems are disclosed in U.S. Pat. Nos. 6,161,350, 7,762,030, 8,136,318, 8,380,470, 8,511,019, 9,097,000, 9,097,001, 9,447,574 and 9,874,009, hereby incorporated herein by reference. Other examples of hold down systems are disclosed in applicant's application Ser. No. 62/641,142 and Ser. No. 15/265,613, hereby incorporated herein by reference.

SUMMARY OF THE INVENTION

The present invention is directed to concrete embedded anchor bodies and anchor assemblies using components with boss openings.

The present invention provides an anchor for being embedded in concrete, comprising a metal plate including an opening, the metal plate including a top surface and bottom surface; and the opening including a wall extending from the top surface or the bottom surface.

The present invention provides an anchor assembly for being embedded in concrete, comprising a metal plate including an opening, the metal plate including a top surface and bottom surface; the opening including a wall extending from the top surface or the bottom surface; and a threaded rod operably attached to the metal plate.

The present invention provides an anchor assembly for being embedded in concrete, comprising a metal support including a base with a threaded first opening, the base including a top side and bottom side; the first opening including a first wall extending from the base; and a threaded rod attached to the first opening.

The present invention provides a holder for a plurality of threaded rods, comprising a base wall including a top side and a bottom side; the base wall including a plurality of threaded openings for holding a plurality of threaded rods, each of the openings including a wall extending from the top side; and the openings are arranged in a pattern.

The present invention provides a stud rail for being embedded in concrete, comprising a longitudinal metal base including a plurality of openings, the base including a top surface and bottom surface; each of the openings including a wall extending from the top surface; and a plurality of threaded rods attached to the respective openings.

The present invention provides a stud rail assembly for being embedded in concrete, comprising a longitudinal first metal plate including a plurality of first openings, the first metal plate including a first top surface and a first bottom surface; each of the first openings including a first wall extending from the first top surface or the first bottom surface; a plurality of first threaded rods attached to the respective first openings; a longitudinal second metal plate including a plurality of second openings, the second metal plate including a second top surface and a second bottom surface; each of the second openings including a second wall extending from the second top surface or the second bottom surface; a plurality of second threaded rods attached to the respective second openings; and the first metal plate is disposed transversely over the second metal at an intersection.

The present invention provides an anchor assembly for being embedded in concrete, comprising a first metal plate including a plurality of first threaded openings, the first metal plate including a top surface and bottom surface; a second metal plate intersecting the first metal plate at a 90° angle, second metal plate including a plurality of second threaded openings, the second metal plate including a top surface and bottom surface; each of the first threaded openings including a first wall extending from the first metal plate; each of the second threaded openings including a second wall extending from the second metal plate; a plurality of threaded rods attached to the respective first threaded openings and second threaded openings; and an anchor disposed inside the 90° angle and a threaded rod attached to the anchor.

The present invention provides an anchor assembly for being embedded in concrete, comprising a first geometric ring plate including a plurality of first openings, the first geometric ring plate including a top surface and bottom surface; a plurality of first threaded rods attached to the respective first openings; and an anchor disposed inside the first geometric ring plate and a second threaded rod attached to the anchor.

The present invention provides an anchor assembly for being embedded in concrete, comprising a circular ring plate including a plurality of first openings; a plurality of first threaded rods attached to the respective first openings; a hollow cylindrical member disposed above the circular ring plate, cylindrical member having a side wall, top wall and bottom wall, the cylindrical member having an opening through the bottom wall and the top wall, the cylindrical member being attached to the threaded rods; and an anchor is disposed inside the cylindrical member and a second threaded rod is attached to the anchor.

The present invention provides a stud wall, comprising a bottom plate disposed over a concrete structure; a rod anchored in the concrete structure, the rod including a threaded end portion extending through the bottom plate; a bearing plate including a threaded opening attached to the threaded end portion, the bearing plate including a top surface and bottom surface; and the threaded opening including a wall extending from the bearing plate.

The present invention provides a stud wall, comprising a metal channel recessed into a concrete structure, the metal channel including a base wall including a plurality of threaded openings, each of the openings including a wall extending from the base wall; a bottom plate disposed over the metal channel; a plurality of rods anchored in the concrete structure, the rods including respective threaded end portions attached to respective openings; a plurality of screws attaching the bottom plate to the metal channel.

The present invention provides a stud wall, comprising a metal channel recessed into a concrete structure, the metal channel including a base wall including a plurality of threaded openings, each of the openings including a wall extending from the base wall; a bottom plate disposed in the metal channel; and a plurality of screws attaching the bottom plate to the metal channel and the concrete structure.

The present invention provides a stud wall, comprising a metal channel recessed into a concrete structure, the metal channel including a bottom wall; a bottom plate disposed inside the channel; a coupler attached to the bottom wall; a first rod anchored in the concrete structure, the rod including a threaded first end portion attached to the coupler; a second rod extending through the bottom plate, the second rod including a threaded second end attached to the coupler and a threaded third end extending above the second bottom plate; and a nut attached to the third end for attaching the second rod to the bottom plate.

The present invention provides an anchor assembly for being embedded in concrete, comprising a hollow metal member including a base portion having a top surface and bottom surface, the metal member including a first opening in the base portion; the first opening including a first wall extending from the base portion; a first plug supporting the metal member above a formboard, the first plug including a first base portion and a first stem portion extending from the base portion, the first stem portion being threaded into the first opening.

The present invention provides an anchor assembly for being embedded in concrete, comprising a hollow metal member including a base portion, the base portion including a top surface and bottom surface, the metal member including a first opening in the base portion; a first plug supporting the metal member, the first plug including a first base portion and a second stem portion extending from the first base portion, the first stem portion extending through the opening; and a first threaded body attached to the first stem portion.

The present invention provides an anchor assembly for being embedded in concrete, comprising a hollow metal member including a base portion with an inside surface and an outside surface, the hollow metal member wall including a first opening; the first opening including a first wall extending from the bottom surface, the wall including an outer edge for pressing onto a formboard when the hollow metal member is attached to the formboard; and a cover disposed inside the hollow metal member over the first opening to seal the first opening from wet concrete.

The present invention provides an anchor assembly for being embedded in concrete, comprising a hollow metal member including a base portion with an inside surface and an outside surface, the hollow metal member wall including a first opening and a second opening; the first opening including a first wall extending from the bottom surface; the second opening including a second wall extending from the inside surface; an insert supporting the metal member above a formboard, the insert being threaded into the first opening, the insert including a first base portion and a first stem portion extending from the first base portion, the first stem portion including a first central threaded opening; a plug supporting the metal member above a formboard, the plug including a second base portion and a second stem portion extending from the second base portion, the second stem portion being threaded into the second opening; and a cover disposed inside the hollow metal member over the first opening to seal the first opening from wet concrete.

The present invention provides an anchor assembly for being embedded in concrete, comprising a hollow metal member including a base portion, the base portion including a top surface and bottom surface, the metal plate including an opening in the base portion; the opening including a wall extending from the top surface, the opening including a collar on the bottom surface around the opening, the collar for pressing against a formboard to seal the opening from below; and a cap covering the opening from above.

The present invention provides anchor assembly for being embedded in concrete, comprising a hollow metal member including a base portion for laying on a formboard, the base portion including a top surface and bottom surface; a foam extending from the top surface and between the side walls; and a screw attached to the base portion for securing a load to the hollow metal member.

The present invention provides an anchor assembly for being embedded in concrete, comprising a metal plate including a first opening, the metal plate including a top surface and bottom surface; the first opening including a first wall extending from the bottom surface; and c) a first support for elevating the metal member above a formboard, the first support including a first base portion and a first post portion extending from the first base portion, the first post portion including a first end portion attached to the first opening.

The present invention provides an anchor assembly for being embedded in concrete, comprising a hollow metal member including a base portion having a top surface and bottom surface, the metal plate including an opening in the base portion; a plug supporting the metal plate on a formboard, the plug including a base portion and a stem portion extending from the base portion, the stem portion extending through the opening above the top surface; an enclosure disposed over the opening and the stem portion, the enclosure is operably attached to the base portion; and a bolt disposed inside the enclosure, the bolt including a bottom end operably supported by the stem portion.

The present invention provides an anchor assembly for being embedded in concrete, comprising a metal plate including a first opening and a second opening, the metal plate including a top surface and bottom surface; the first opening including a first wall extending from the bottom surface; a first threaded rod extending downwardly from the metal plate, the first threaded rod having one end being attached to the first opening and a second end attached to a threaded body; the second opening is threaded for receiving an anchor rod; and a first plug including a first base portion and a first stem portion extending from the first base portion, the first stem portion being threaded to the second opening, the first plug being removable after from the concrete in which the anchor assembly is embedded to expose the second opening for attachment of the anchor rod.

The present invention provides an anchor assembly for being embedded in concrete, comprising a first metal plate including a first opening and a second opening, the first metal plate including a top surface and bottom surface; a coupler disposed below the first opening, the coupler including a first end and a second end; a first plug including a first base portion and a first stem portion extending from the base portion, the first stem portion extending through the first opening beyond the bottom surface, the first stem portion including a threaded end portion attached to the first end of the coupler; a second plug attached to the second end of the coupler; and a second metal plate including a third opening, the second metal plate including a second top surface, the third opening including a first wall extending from the second top surface; and a threaded first rod having a third end attached to the second opening and a fourth end attached to the third opening.

DETAILED DESCRIPTION OF THE INVENTION

Figure 1:
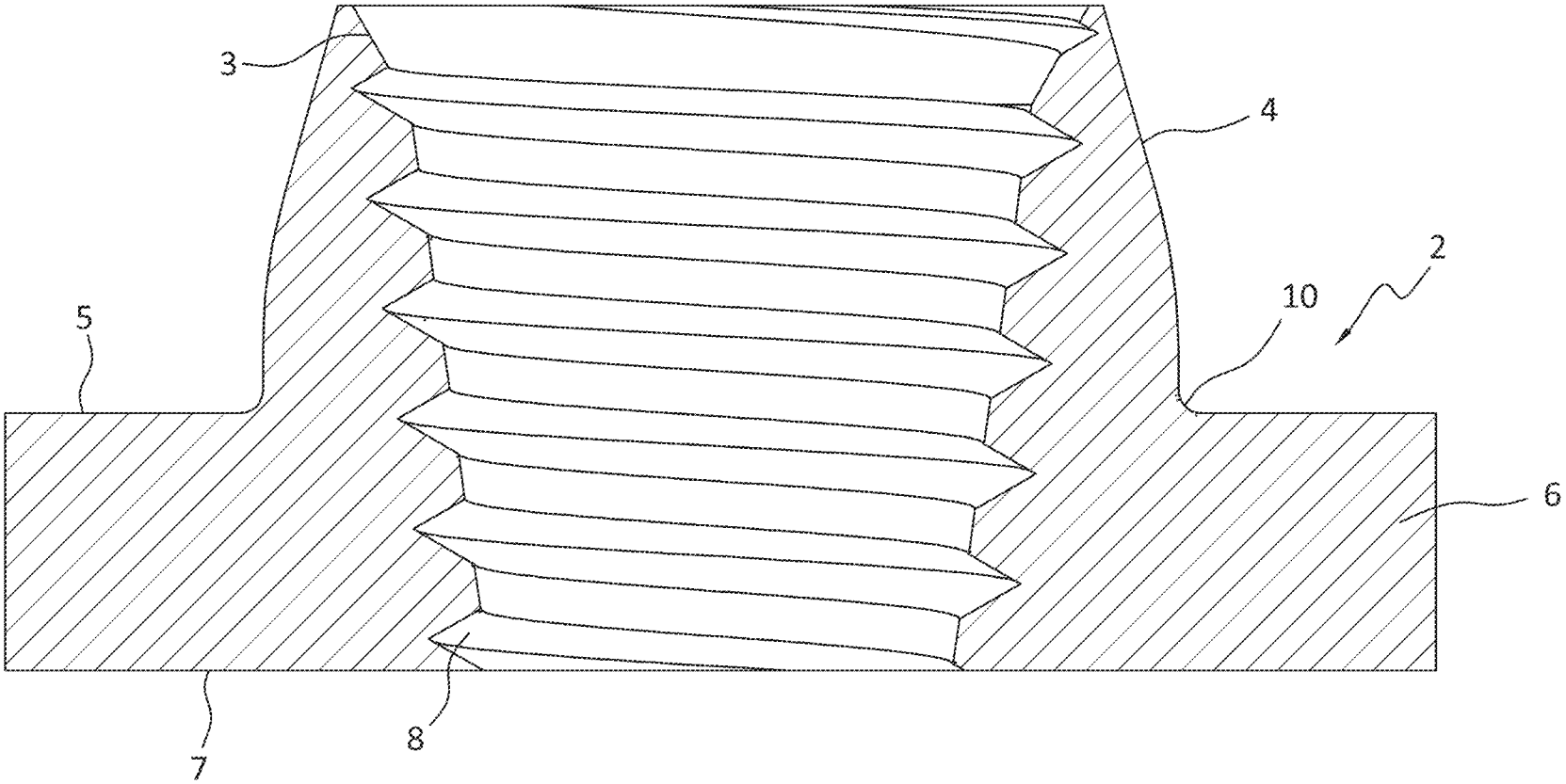
FIGS. 1-5D illustrate an anchor body with a boss opening.

FIG. 1 shows an anchor body 2 formed from a metal flat plate or bar. Through form drilling, friction heats up, softens and displaces material through the thickness of the plate, forming an opening 3 through the plate with a boss section 4 as one piece with the base section 6. The boss section 4 is a wall around the opening 3 that extends from the top surface 5 or bottom surface 7 of the base section 6. Tapered thread 8 inside the boss opening 3 is made by form threading. A radius 10 is provided where the boss section meets the base section. The boss section 4 is tapered and circular in cross-section. When threaded, the opening 3 may be referred to as a threaded boss opening.

Figure 2:
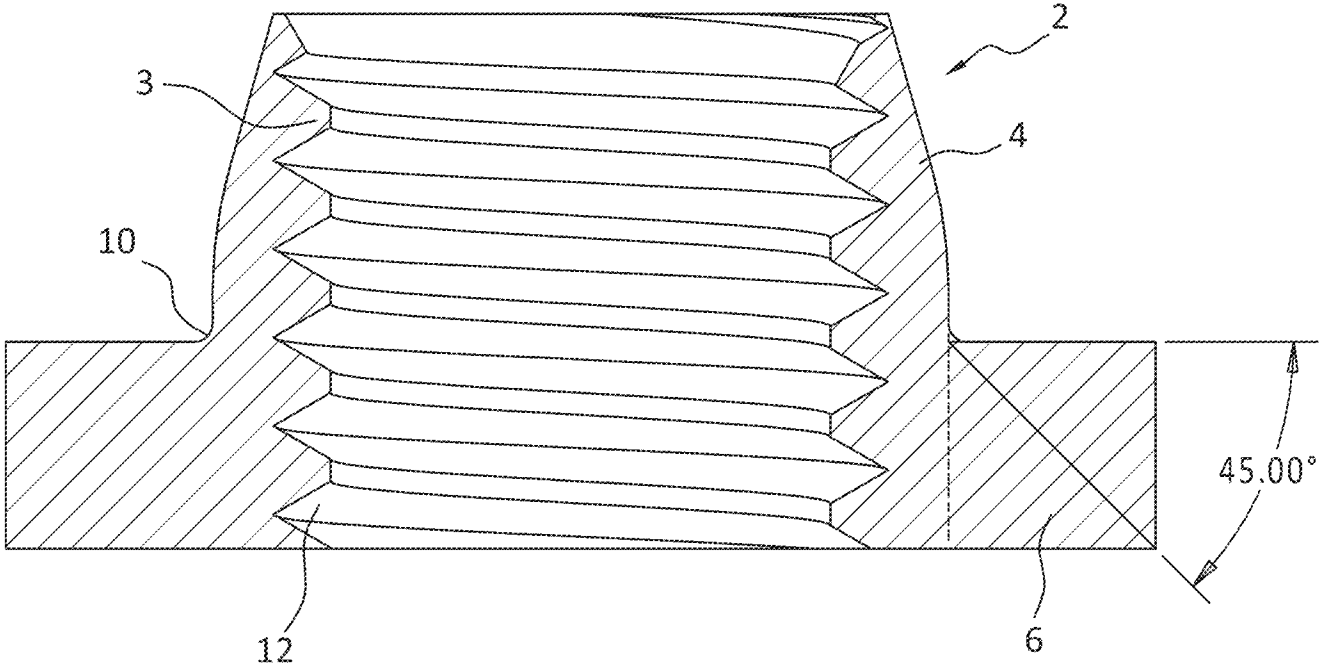

FIG. 2 shows the anchor body 2 of FIG. 1 with straight thread 12. The base section 6 at the bottom of the boss section makes a 1:1 ratio with the thickness of the base section. However, it should be understood that the extent of the base width from the bottom of the wall 4 may be larger than the thickness of the plate, as will be shown throughout this disclosure. The anchor body is a single piece anchor, the threaded portion and the bearing portion being in one piece. The anchor body 2 works with the boss section 4 facing any direction, either toward or away from the direction of the load. The anchor 2 advantageously provides the thread 12 to be long enough to create the required thread bearing area without increasing the thickness of the base section 6. The anchor body 2 advantageously provides thread engagement length greater than the thickness of the base section 6.

Figure 3:
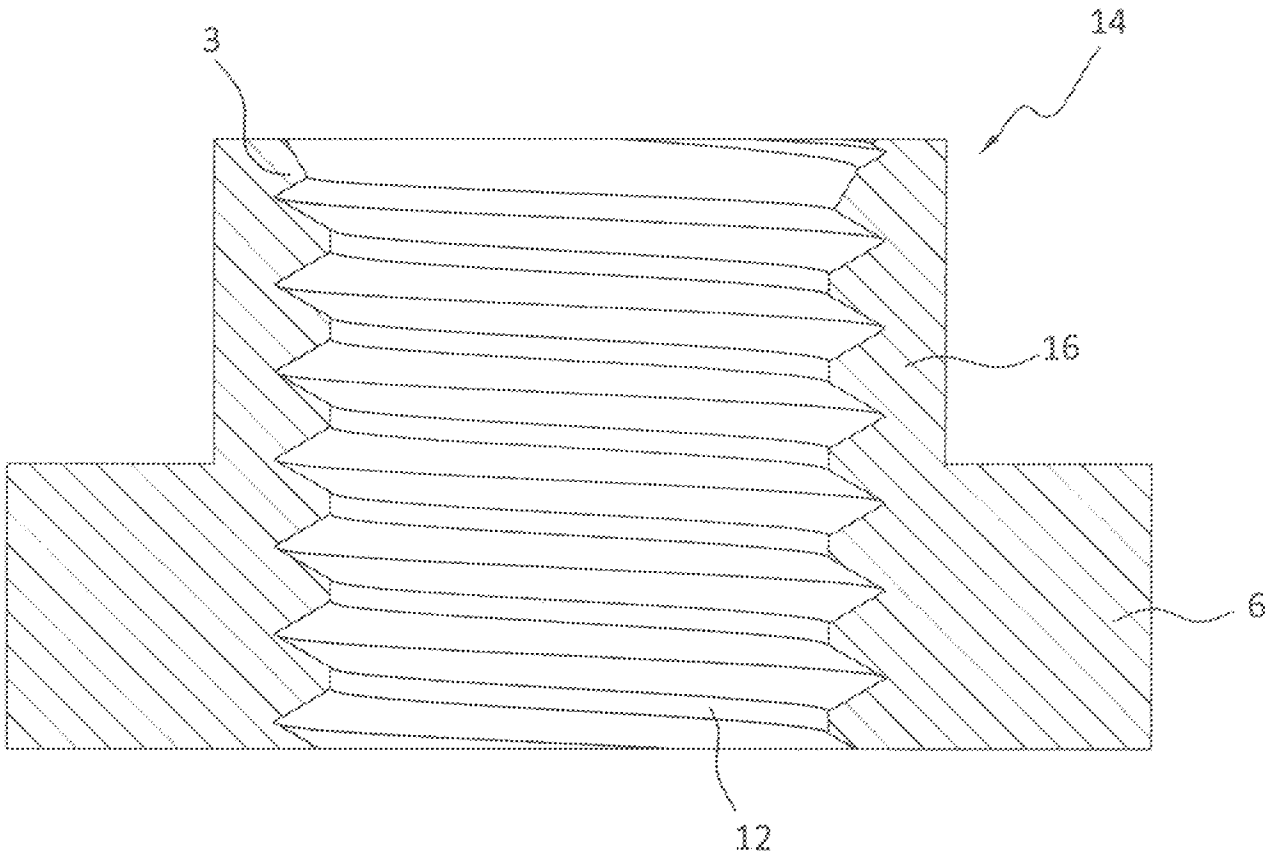

FIG. 3 shows an anchor body formed from form drilling and form threading, as in the anchor 2. The wall or boss section 16 is non-circular in cross-section and is not tapered. A right angle transition (no radius) is formed at the corner of the boss section and the base section 6. Straight thread 12 is formed from form threading.

Figure 4:
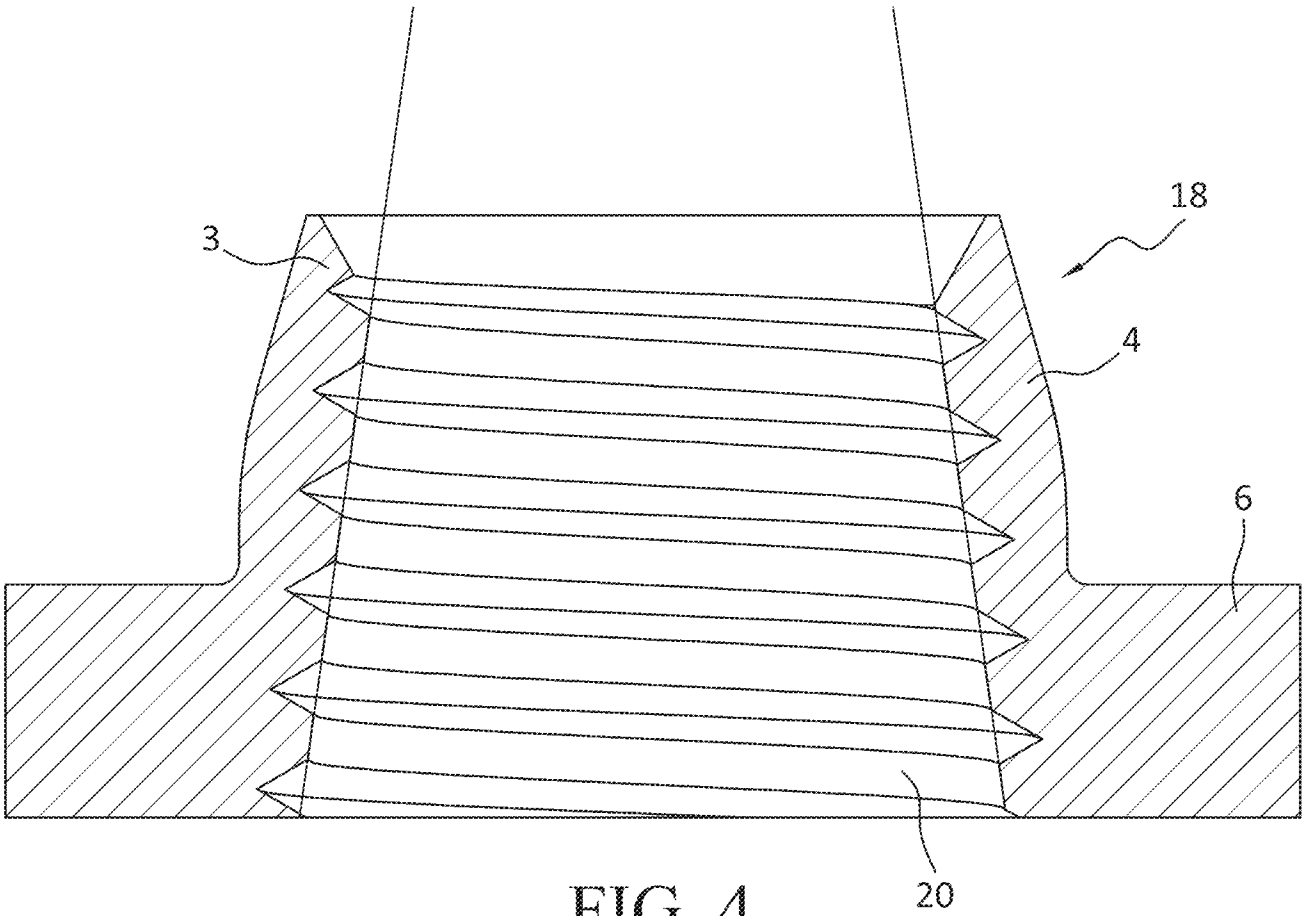

FIG. 4 shows an anchor body 18 similar to the anchor 2 but with reverse tapered thread 20.

Figure 5B:
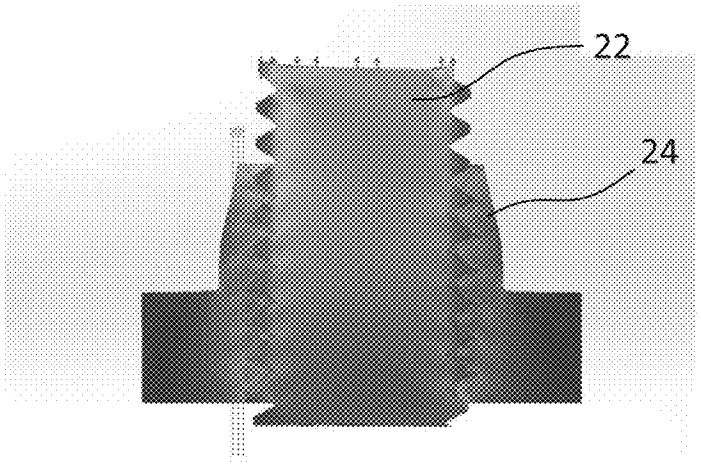
Figure 5D:
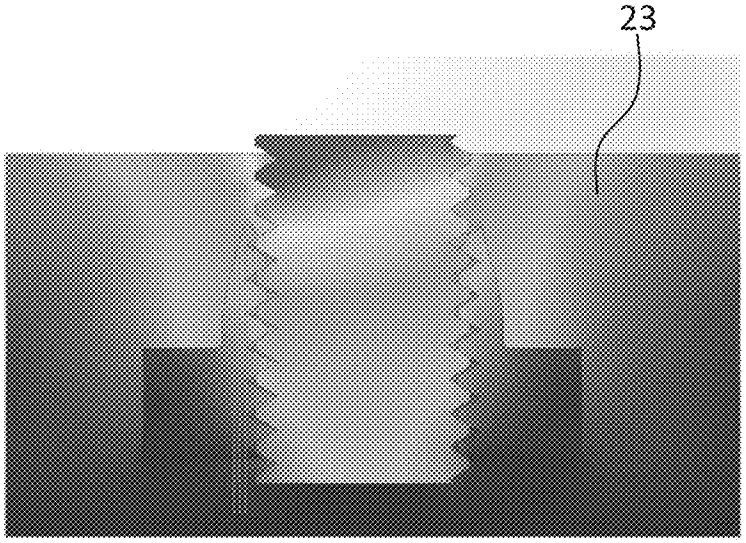
Figure 5A:
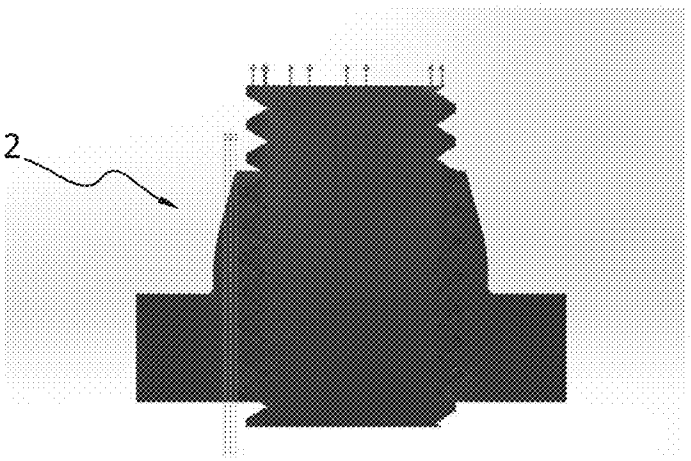
Figure 5C:
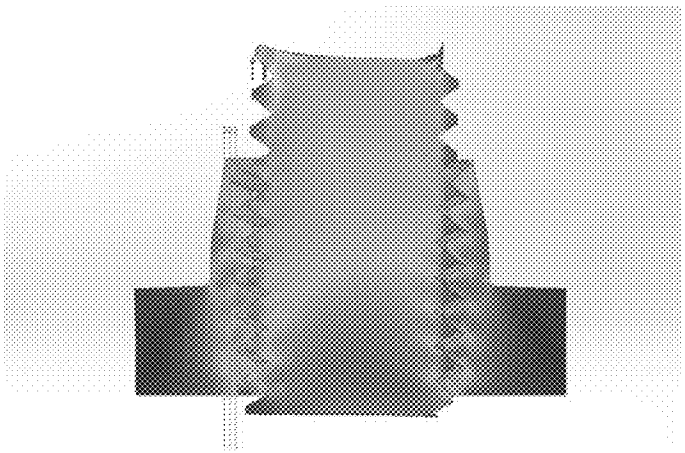

FIGS. 5A-5C show the anchor body 2 with straight thread 12 attached to a threaded rod 22, which is subjected to tensile force. The thin wall portion 24 tends to spread radially outwardly, decreasing the area of engagement of the thread 12 with threaded rod 22.

FIG. 5D shows the thin wall portion 24 being subject to compression force within the concrete 23 toward the threaded rod due to the tapered shape of the boss section 4, thereby maintaining full contact of the thread 12 with the threaded rod 22.

Figure 6:
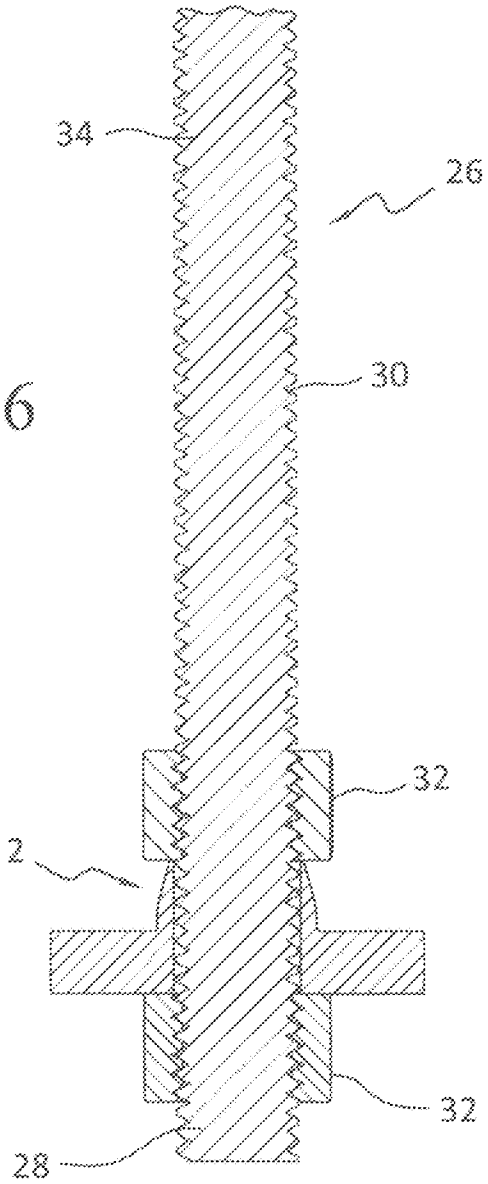
FIGS. 6-14 show several anchor assemblies for being embedded in concrete.
Figure 7:
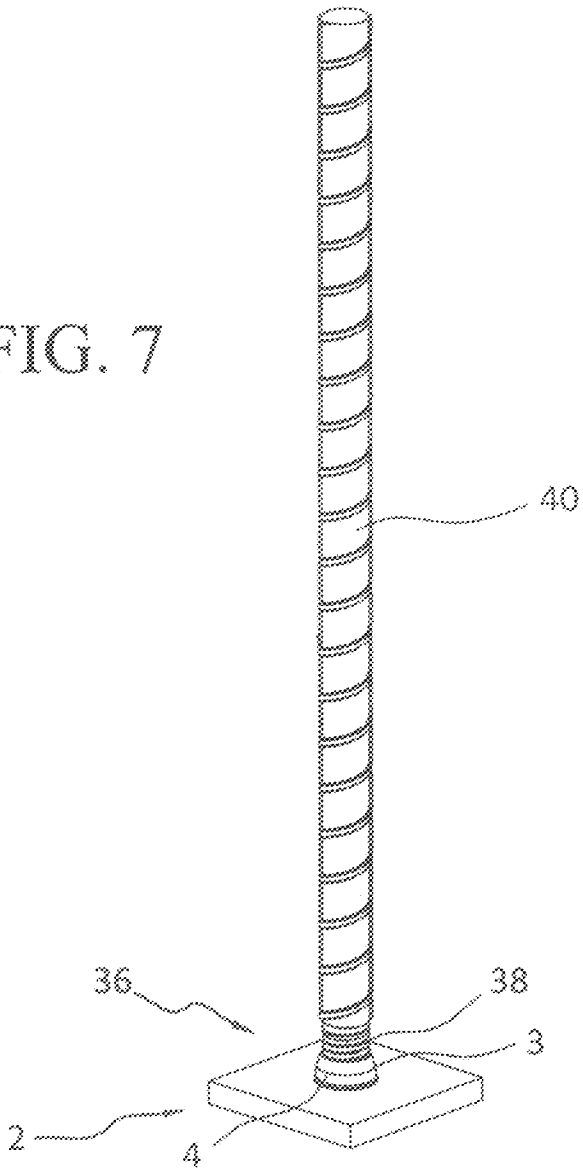
Figure 8:
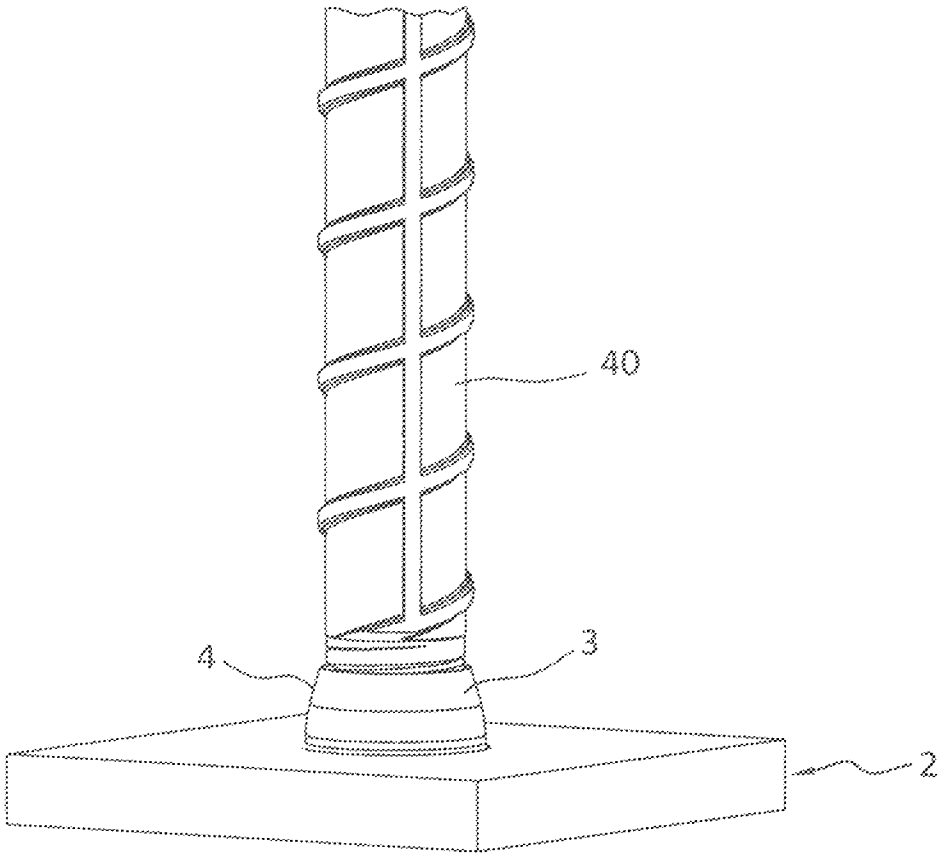

Referring to FIG. 6, an anchor assembly 26 is disclosed. The anchor body 2 without the thread 12 (see FIG. 2) is attached to an end portion 28 of a threaded rod 30, a hex nut 32 above the anchor body 2 and another hex nut 32 below. Both hex nuts 32 are threaded to the rod 30 and bear on the anchor body 2. The threaded rod 30 may be replaced with a rebar (see FIG. 7) with a threaded end. In use, the end portion 28 of the rod 30, along with the anchor body 2 and the hex nuts 32 are embedded in concrete. The other end portion 34 may be connected outside the concrete to a load, such as a base plate of a stud wall, a hold down system, such as disclosed, for example, in U.S. Pat. Nos. 8,943,777, 9,874,009, 9,097,000 and 8,511,019, hereby incorporated herein by reference, or inside the concrete to rebars or other reinforcing steel.

Figure 9:
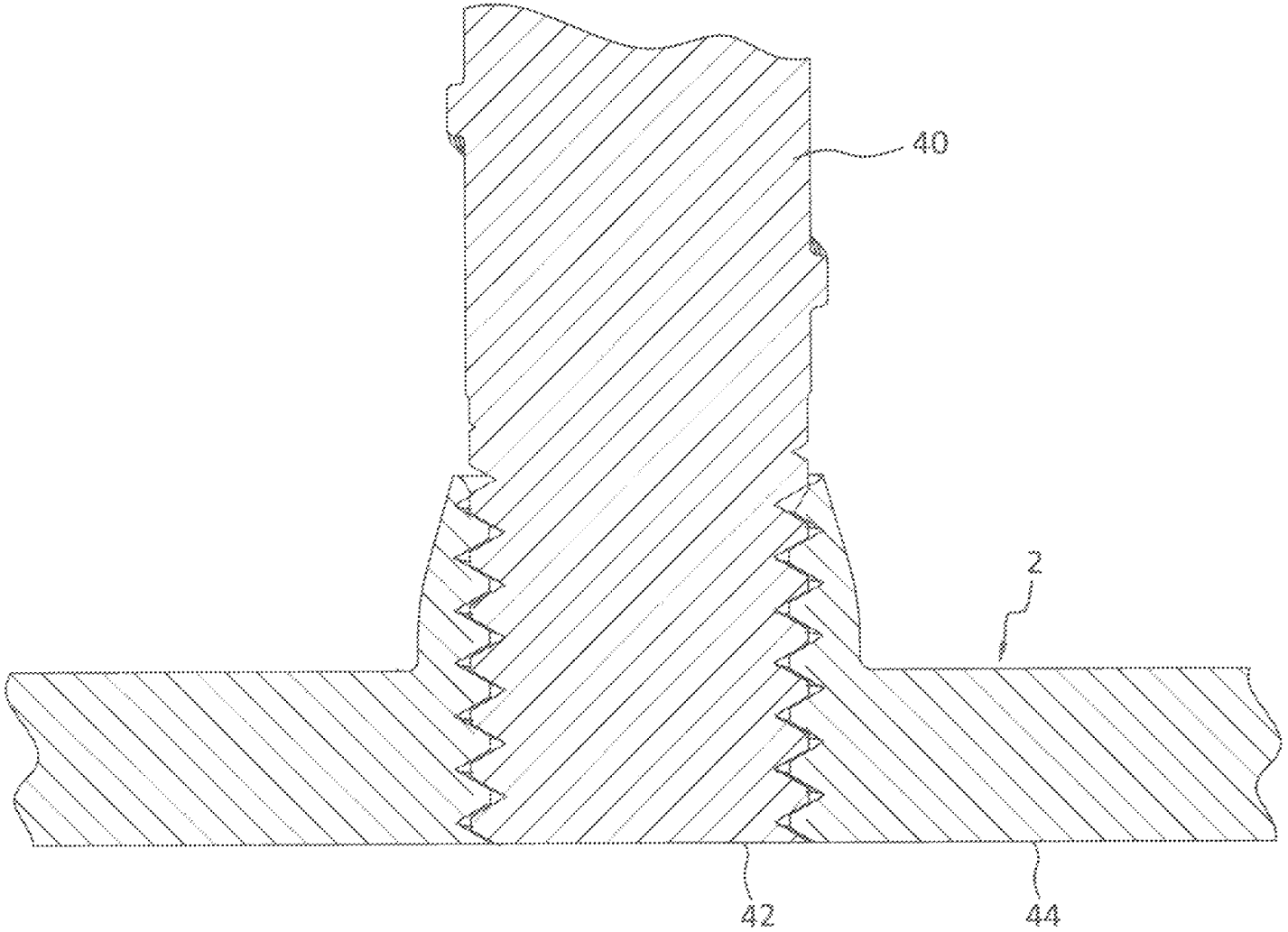
Figure 10:
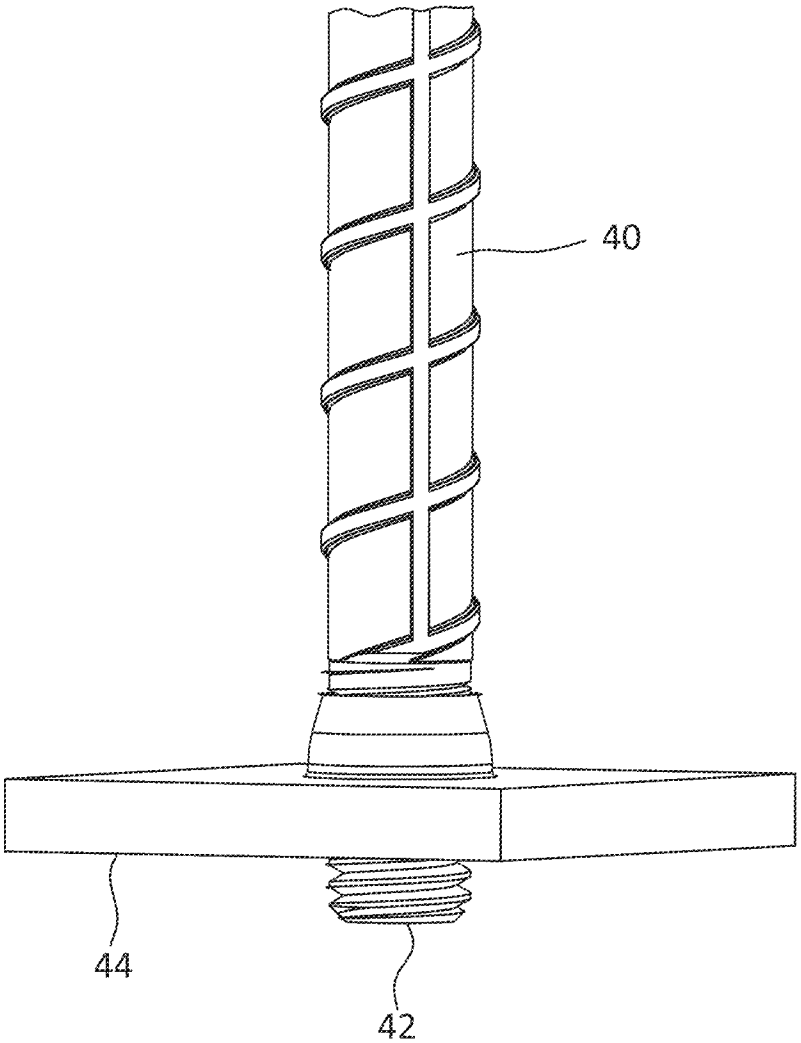

Referring to FIGS. 7-10, an anchor assembly 36 is disclosed. The anchor body 2 is threaded to an end portion 38 of a rod 40, such as a rebar (reinforcing bar) used in reinforcing concrete. The boss section 4 is directed to an opposite end of the rod 40. The anchor body 2 may have the tapered thread 8 of the straight thread 12. The end portion 38 is correspondingly, threaded with a tapered thread or straight thread. The end portion 38 is provided with sufficient amount of thread so that it will engage completely with the thread of the anchor body 2, with the bottom 42 of the rod flush with the bottom 44 of the anchor 2 as shown in FIG. 9, or extend beyond the bottom as shown in FIG. 10.

Complete engagement of the thread of the anchor body 2 advantageously provides a strong connection with the rod 40.

Figure 11:
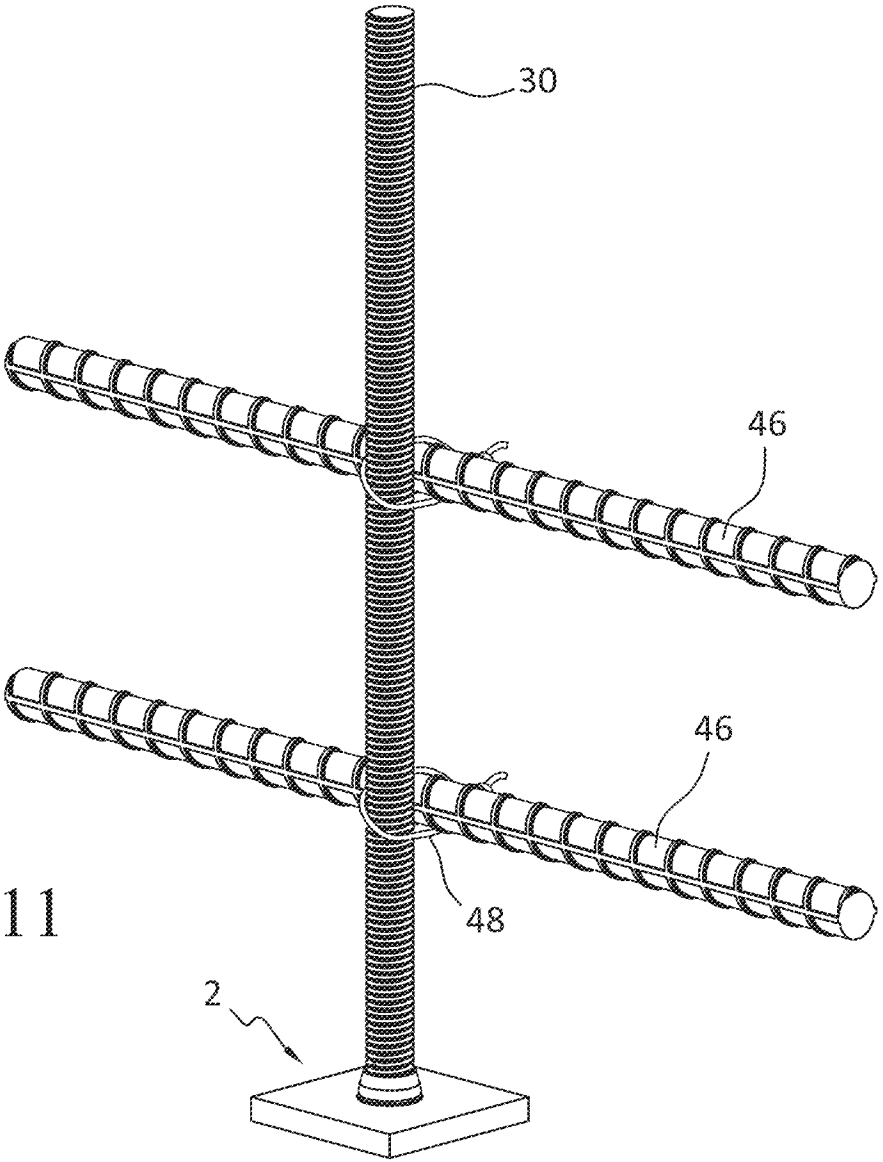

Referring to FIG. 11, the rod 40 is shown as the threaded rod 30. The anchor assembly 26 or 36 may be positioned in place prior to concrete pouring by attaching to rebars 46 with tie wires 48.

Figure 12:
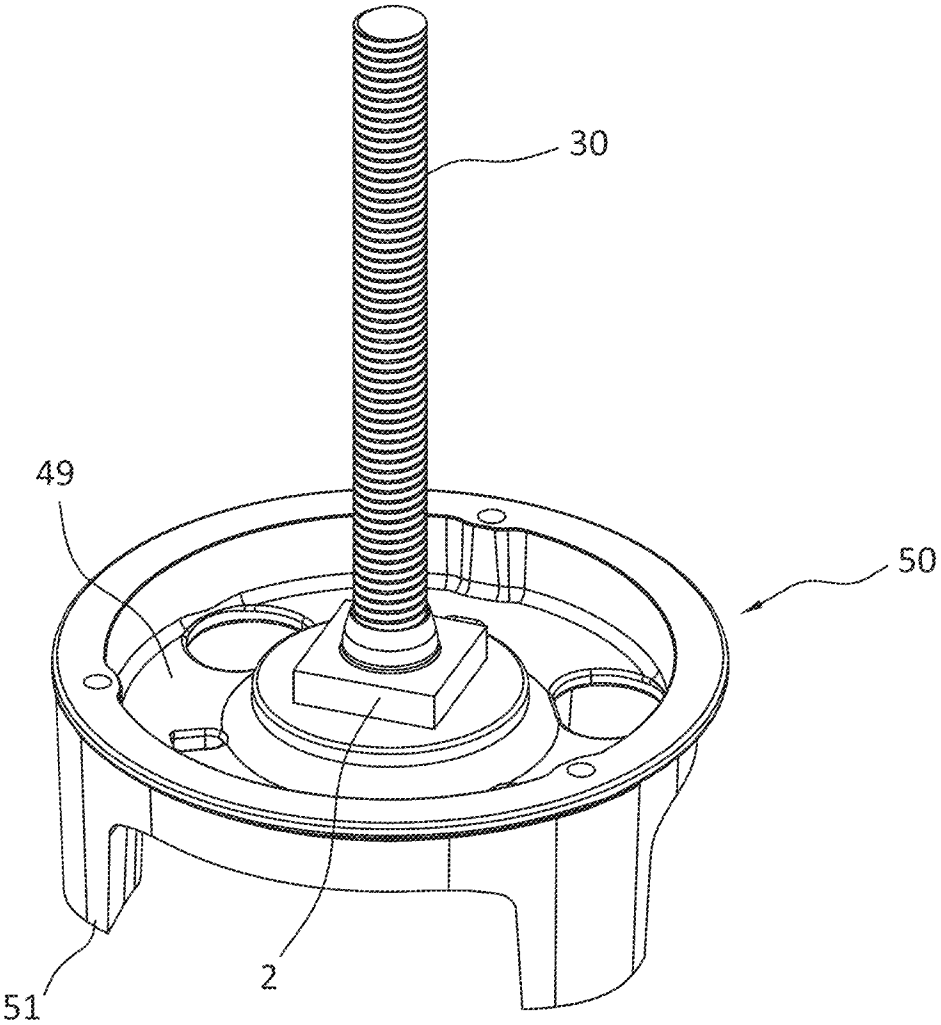

Referring to FIG. 12, a holder or support 50 is used to position the anchor body 2 with the threaded rod 30 or the rebar 40 on a surface of a concrete form prior to concrete pouring. The support 50 is disclosed in U.S. Pat. No. 8,943,777, hereby incorporated herein by reference. The support 50 is preferably molded plastic with a central threaded opening (not shown) into which the end of the rod 30 that extends beyond the bottom of the anchor body 2 thread. The support 50 elevates the bottom end of the rod 30 above the concrete formboard to seal the anchor body 2 in the concrete for corrosion protection. The support 50 includes a base 49 and a number of legs 51. The anchor body 2 functions both as a nut to stabilize the rod 30 to the support 50 and as an anchor.

Figure 13:
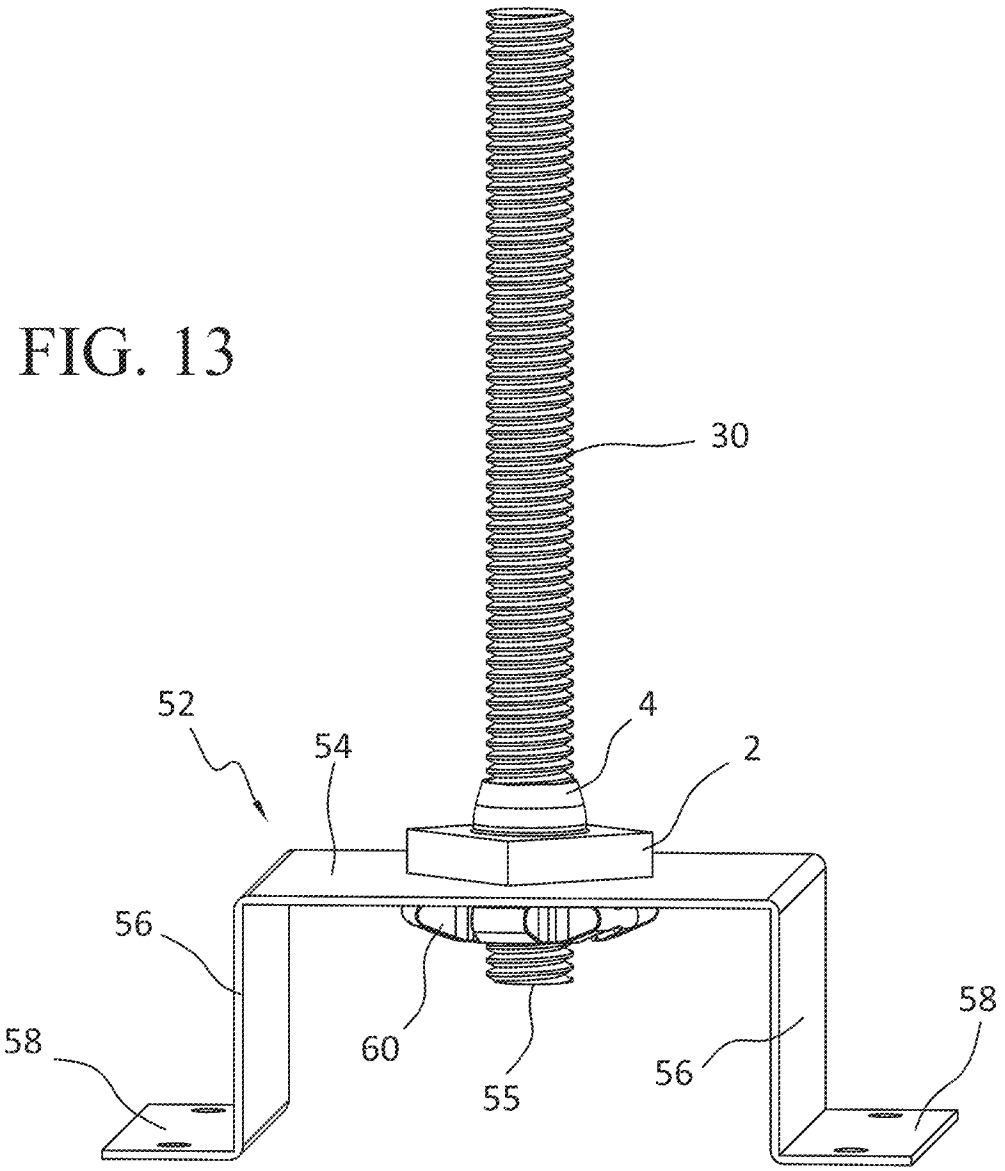

Referring to FIG. 13, a U-shaped holder or support 52 preferably made of sheet metal with a base 54, legs 56 and feet 58. The anchor body 2 is disposed on a top side of the base 54 with the boss section 4 pointing upwardly. The rod 30 extends through an unthreaded opening in the base 54 and held in place by a plastic nut 60, such as one disclosed in U.S. Pat. No. 8,806,835, hereby incorporated herein by reference. The nut 60 ensures complete engagement of the rod 30 with the threaded boss opening 3. The bottom end portion 55 of the rod 30 extends past the plastic nut 60. Holes 62 in the feet 58 are for nails or screws used to attach the support to the form board.

Figure 14:
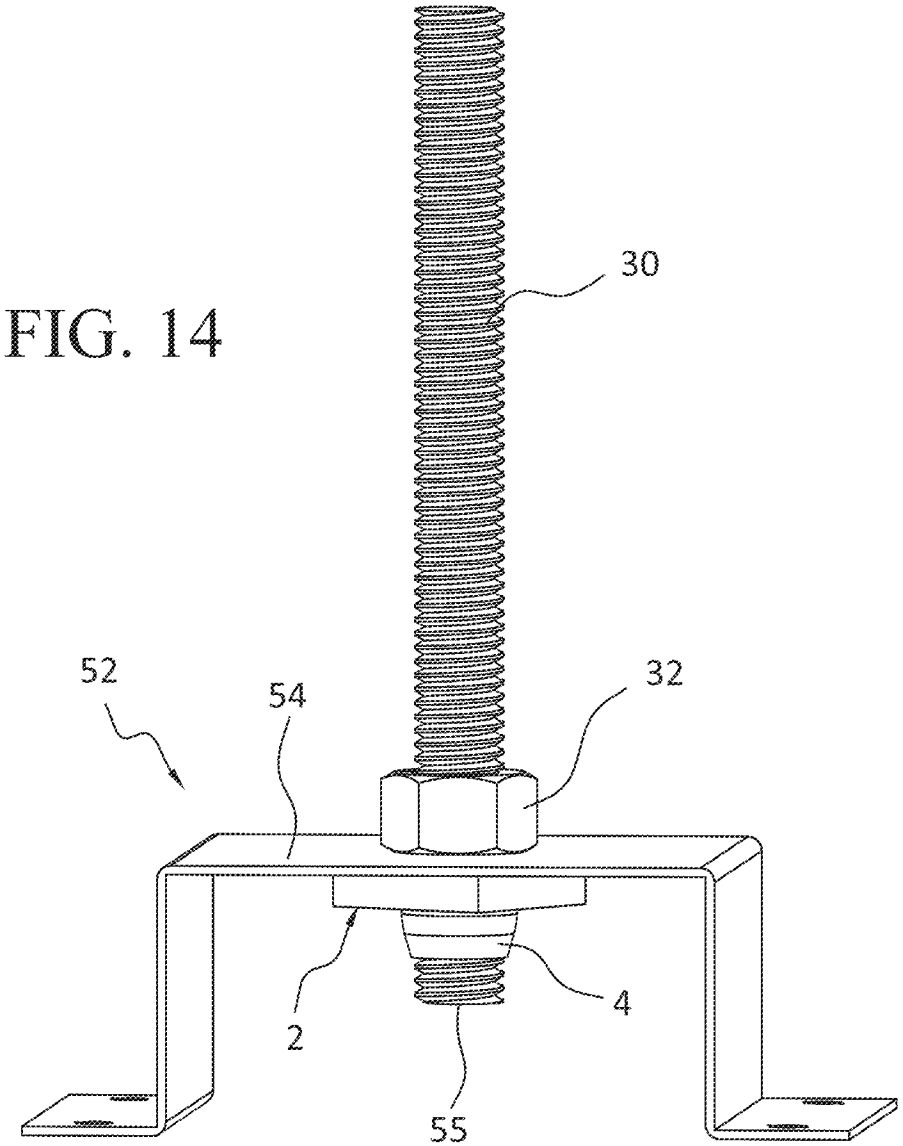

Referring to FIG. 14, the anchor body 2 is installed on the bottom side of the base 54 of the support 52 with the boss section 4 pointing downwardly away from the base 54. A hex nut 32 locks the rod 30 to the support 52 to prevent the rod 30 from turning while being attached to a structure such as a wall. The bottom end portion 55 of the rod 30 may extend past the threaded boss section 4 to ensure complete thread engagement of the rod 30 with the threaded boss opening 3.

Figure 15:
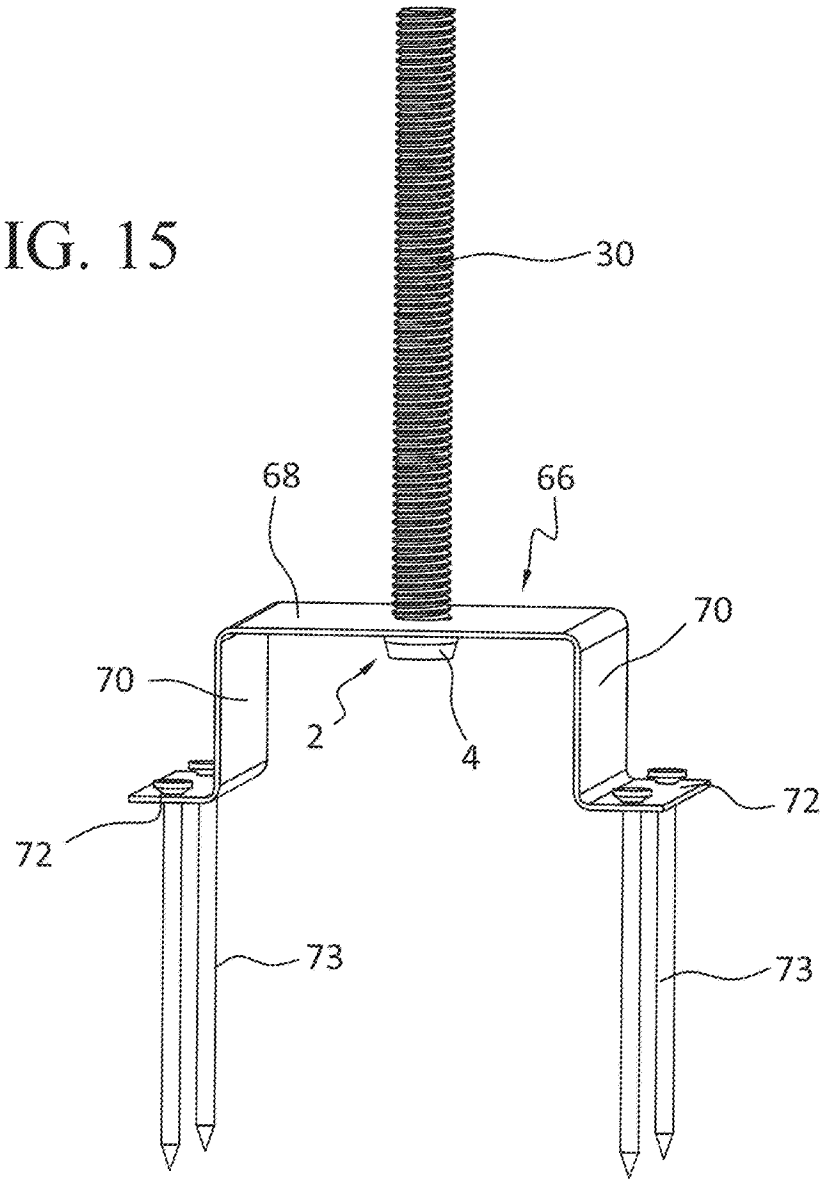
FIGS. 15-28 show several anchor assemblies for being embedded in concrete using sheet metal holders or supports for threaded rods.
Figure 16:
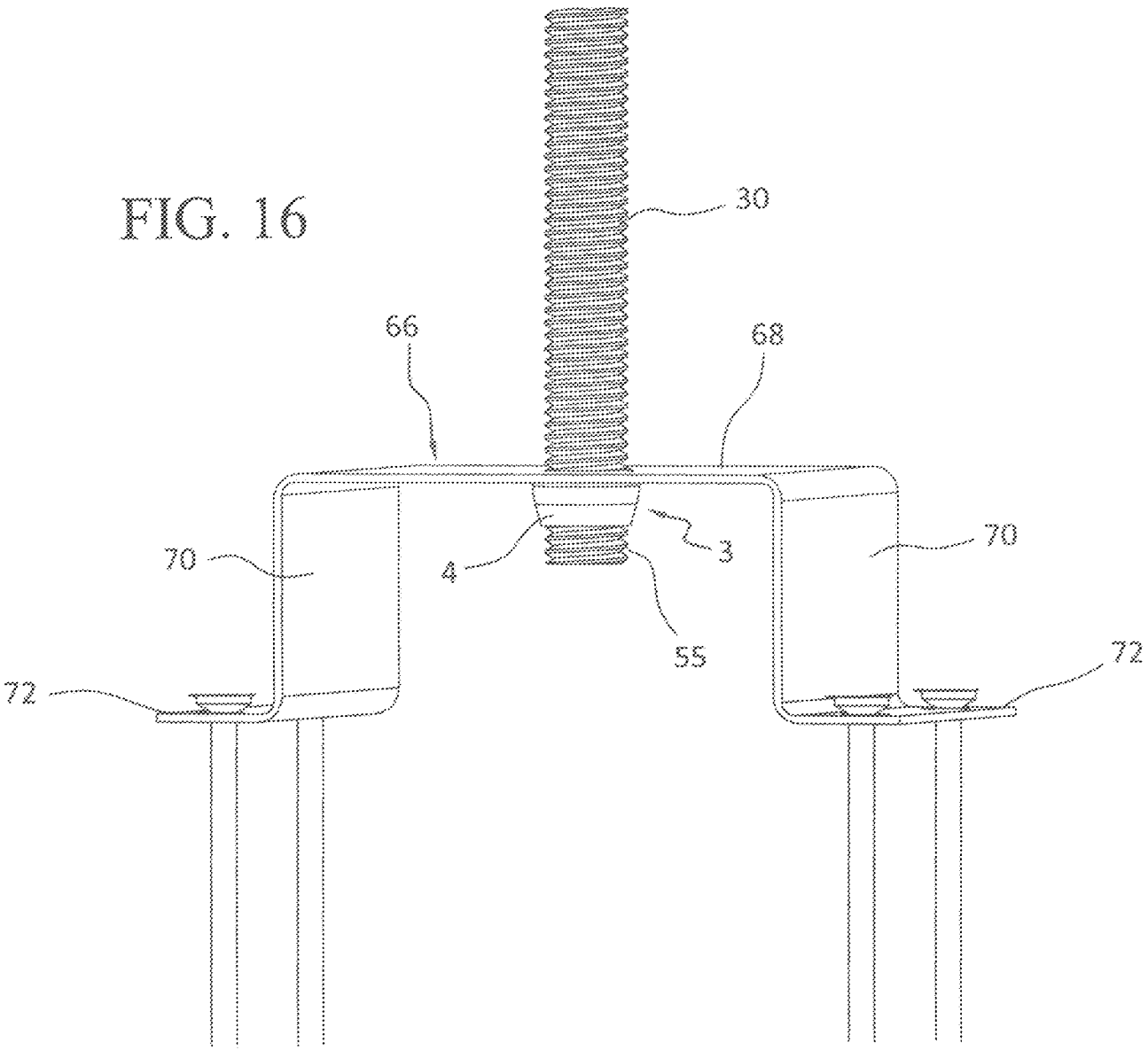
Figure 17:
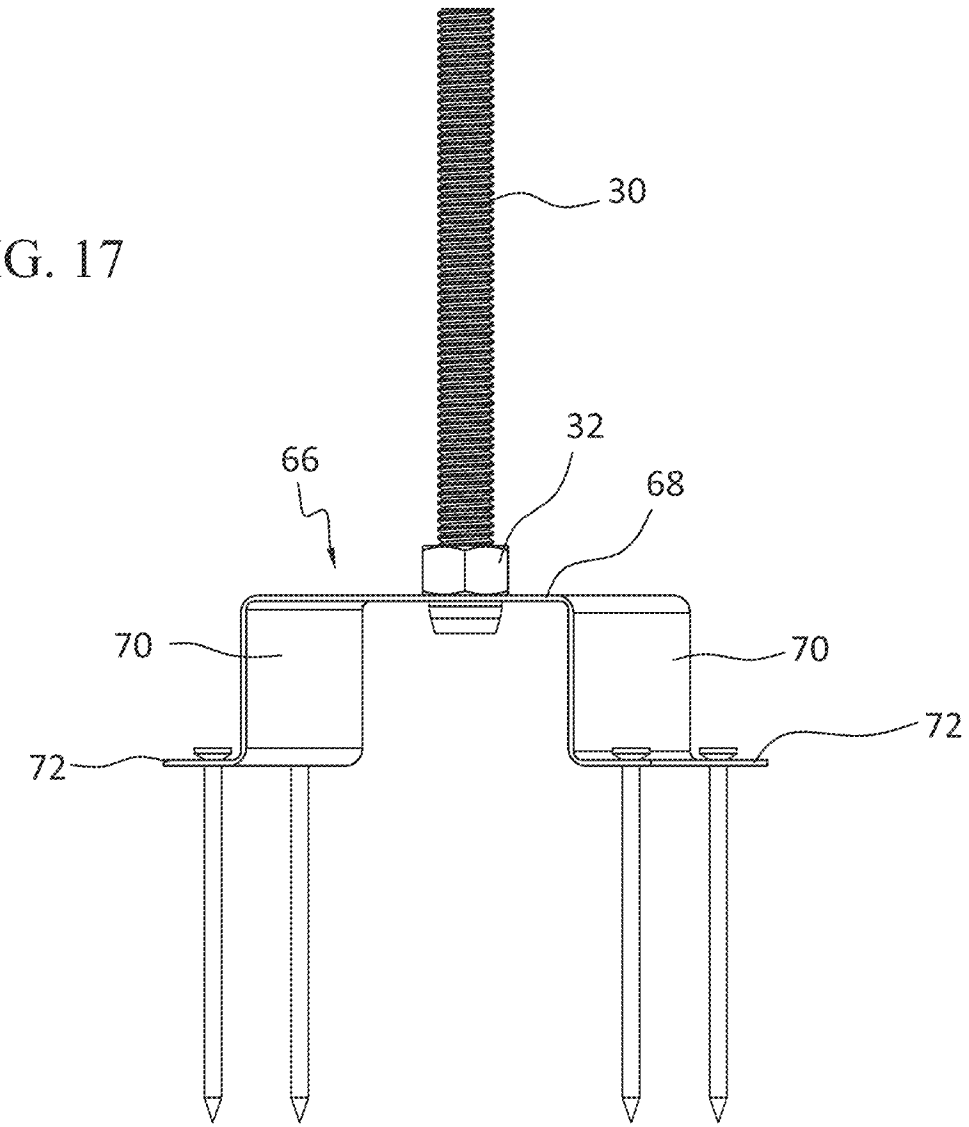

Referring to FIGS. 15-17, the anchor body 2 is incorporated in a holder or support 66. The support 66 includes a base 68, legs 70 and feet 72. The threaded boss opening 3 with the boss section 4 is disposed on a bottom side of the base 68. The boss section 4 is directed downwardly. Nails 73 or screws for attaching the support 66 to a form board are carried by the feet 72 through openings in the feet 72. The rod 30 is screwed to the threaded boss section 4. The bottom end portion of the rod 30 may be flush with threaded boss section 4, as shown in FIG. 15. The support 66 advantageously provides the function of an anchor body and anchor rod holder. The bottom end portion 55 of the rod 30 may extend past the threaded boss section 4. A hex nut 32 may be used to lock the rod 30 to the support 66 and provide an additional anchor body.

Figure 18:
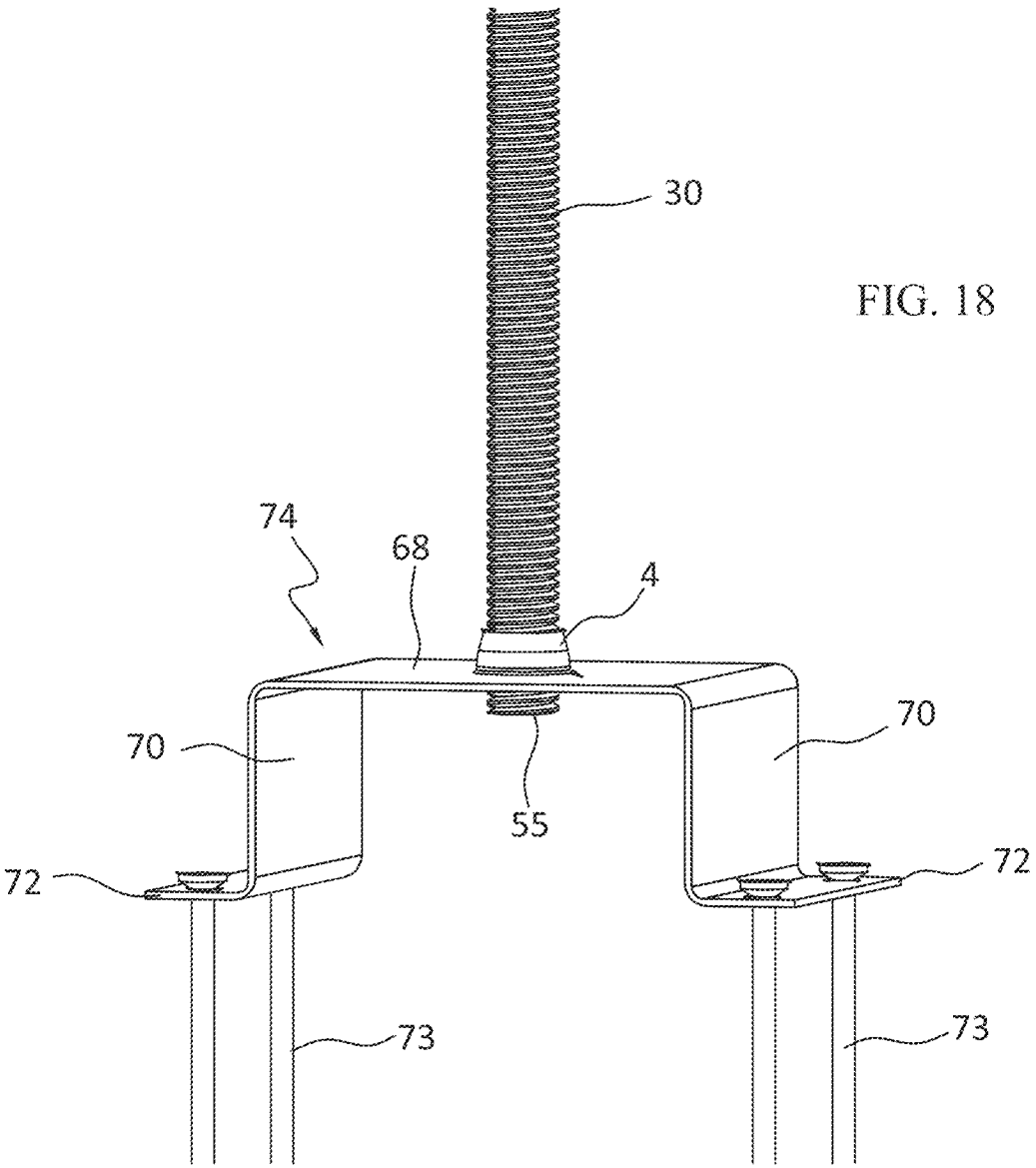
Figure 19:
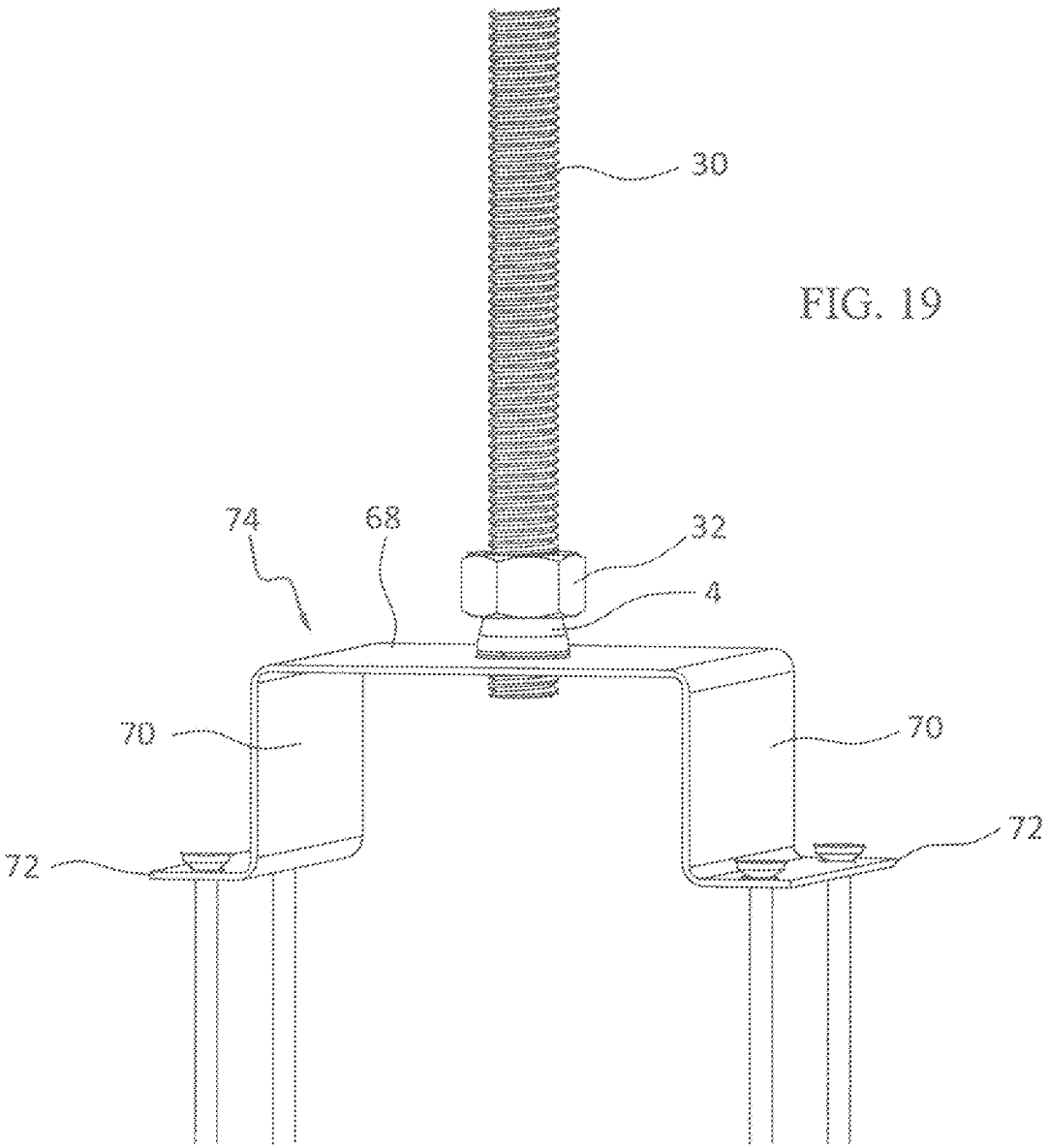

Referring to FIGS. 18 and 19, the support 66 shown in FIG. 15 is modified as a holder or support 74 with the threaded boss section 4 disposed on the top side of the base 68. The threaded boss section 4 is pointed upwardly so that when encased in concrete, the concrete will prevent it from spreading out when an upward load is applied to the rod 30 (see FIG. 5D). The bottom end portion 55 may extend past the base 68 to ensure complete thread engagement between the rod 30 and the threaded boss 4, as shown in FIG. 18. A hex nut 32 may be used to lock the rod 30 to the support 74 and provide an additional anchor body, as shown in FIG. 19.

Figure 20:
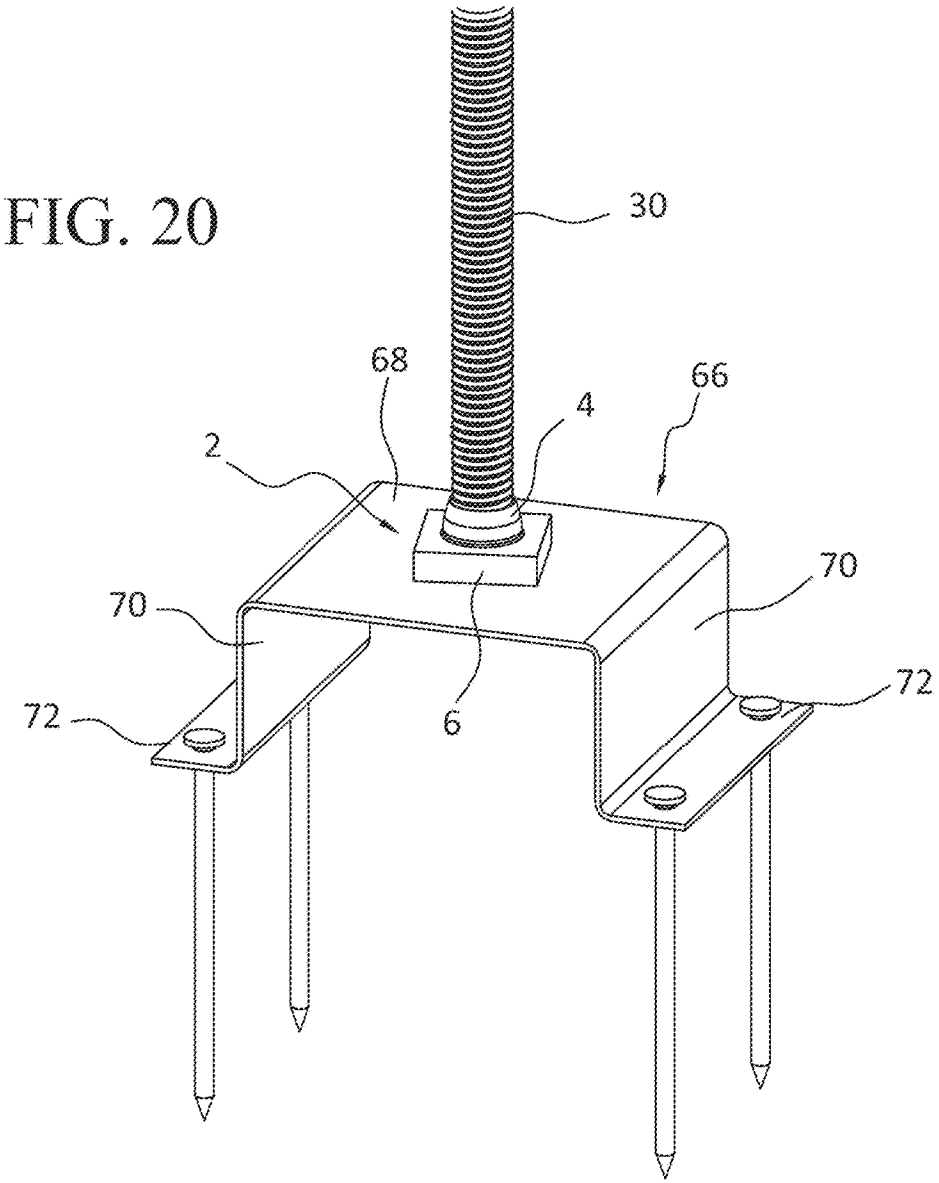
Figure 21:
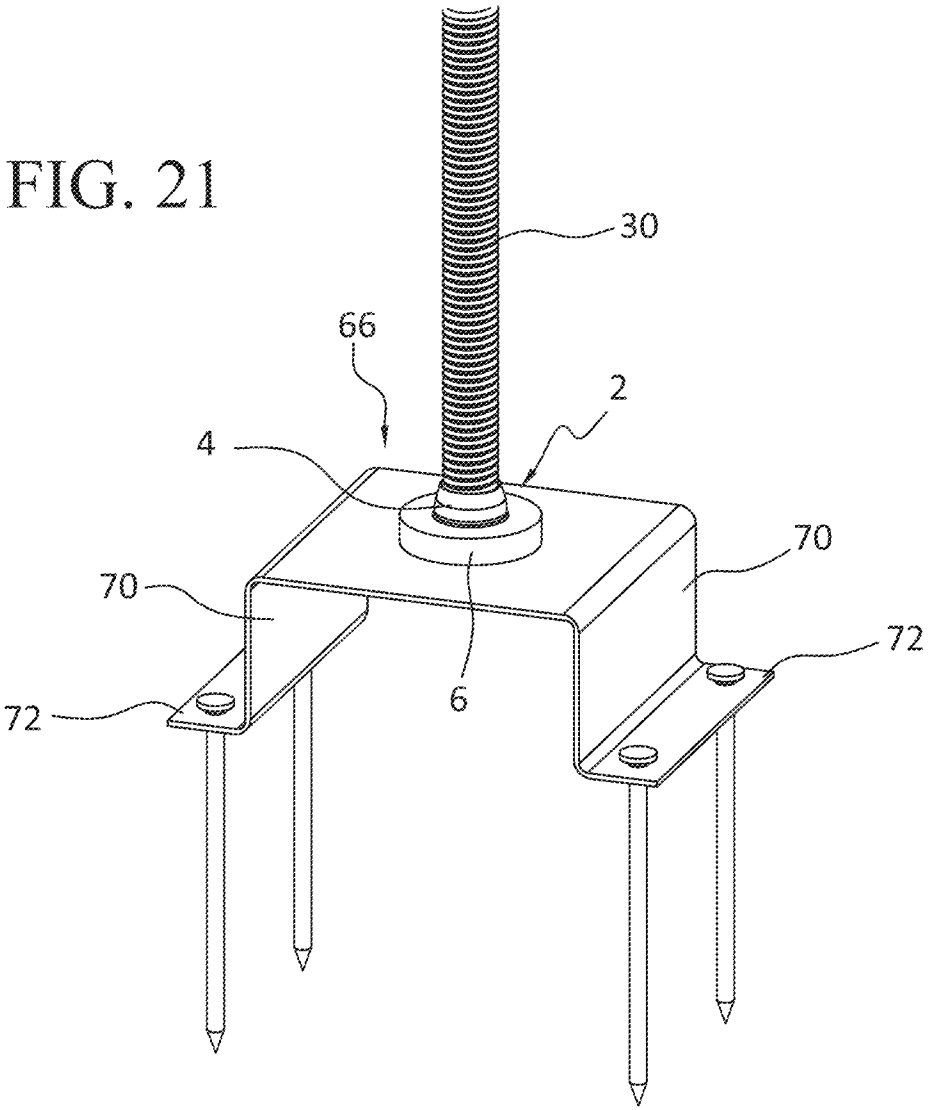
Figure 22:
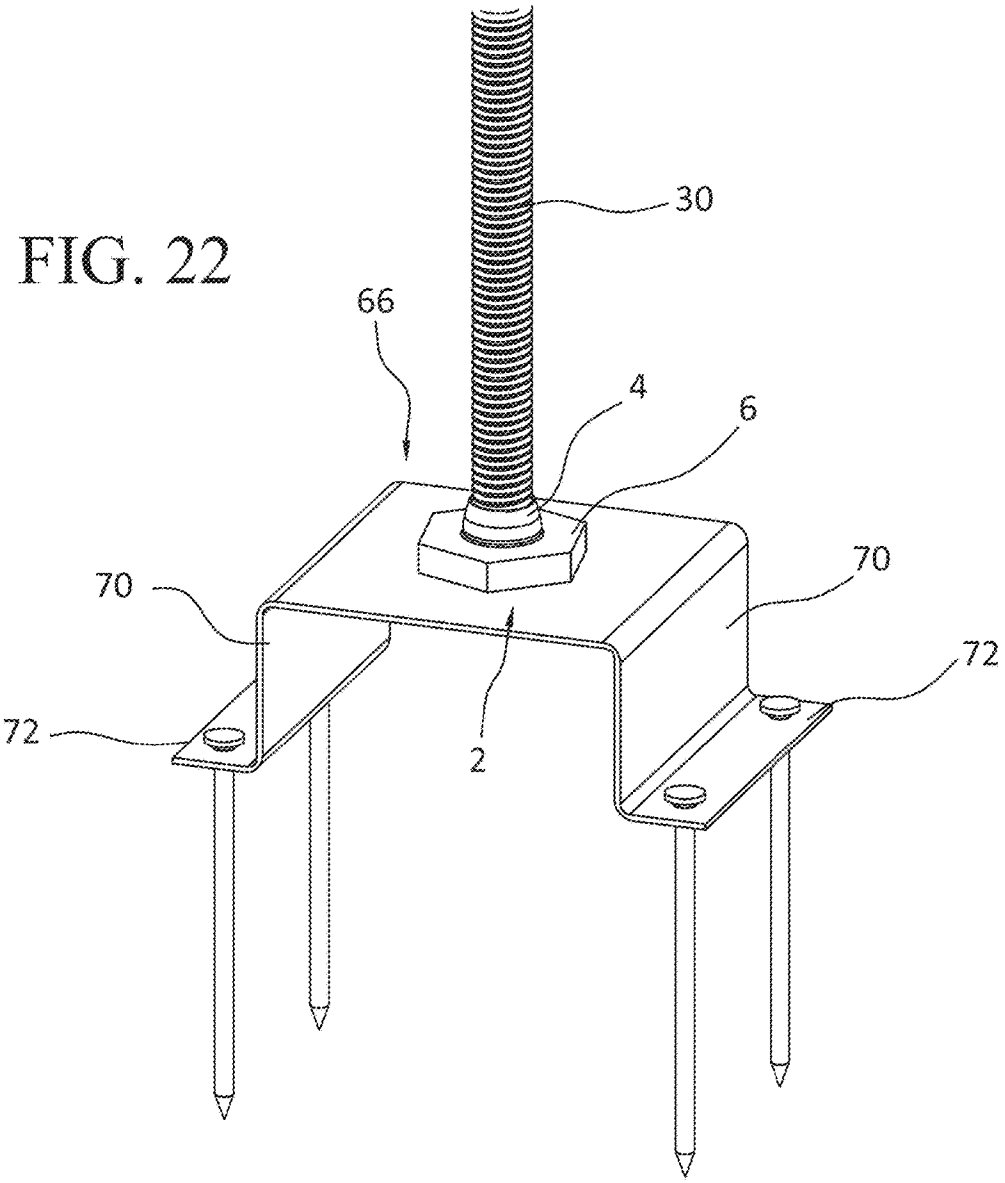

Referring to FIGS. 17 and 20-23, the hex nut 32 may be replaced by an anchor body 2 with a square base section 6, as shown in FIG. 20, or an anchor body 2 with a round base section 6, as shown in FIG. 21, or an anchor body 2 with a hexagonal base section 6, as shown in FIG. 22, may be provided to the support 66 to provide an additional anchor body and to lock the rod 30 to the support 66. The rod 30 may be threaded only at the end portions 76 and 78, with the middle portion being unthreaded.

Figure 24:
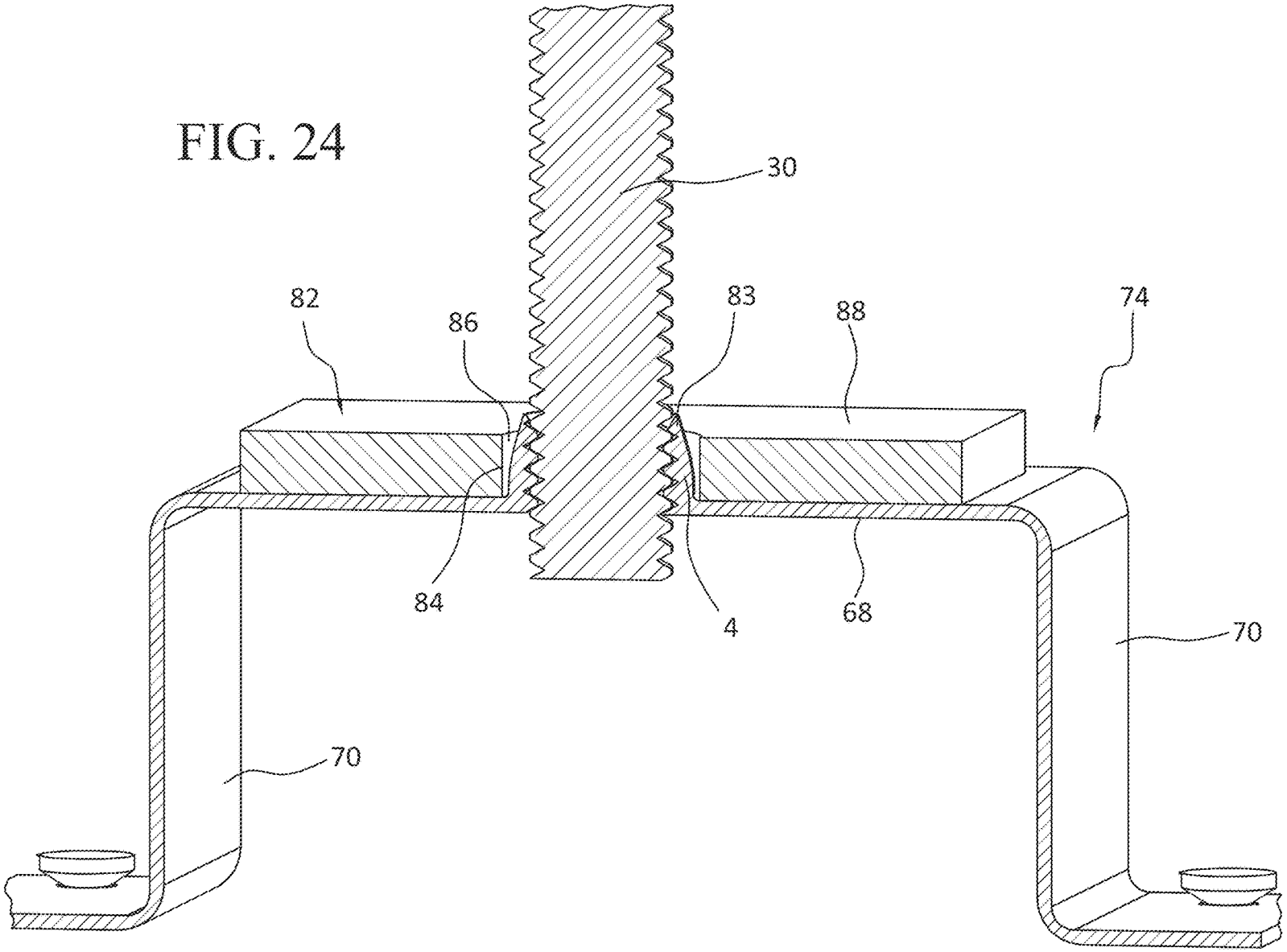

Referring to FIG. 18 and FIG. 24, a flat metal plate 82 with a center opening 84 is disposed on the base 68 of the support 74 with the boss section 4 extending through the opening 84 and the top 83 of the boss section 4 being above the top surface 88 of the metal plate 82. The opening 84 is cylindrical, providing a gap 86 between the wall of the opening 84 and the outside surface of the boss section 4. The metal plate 82 provides an additional anchor body.

Figure 25:
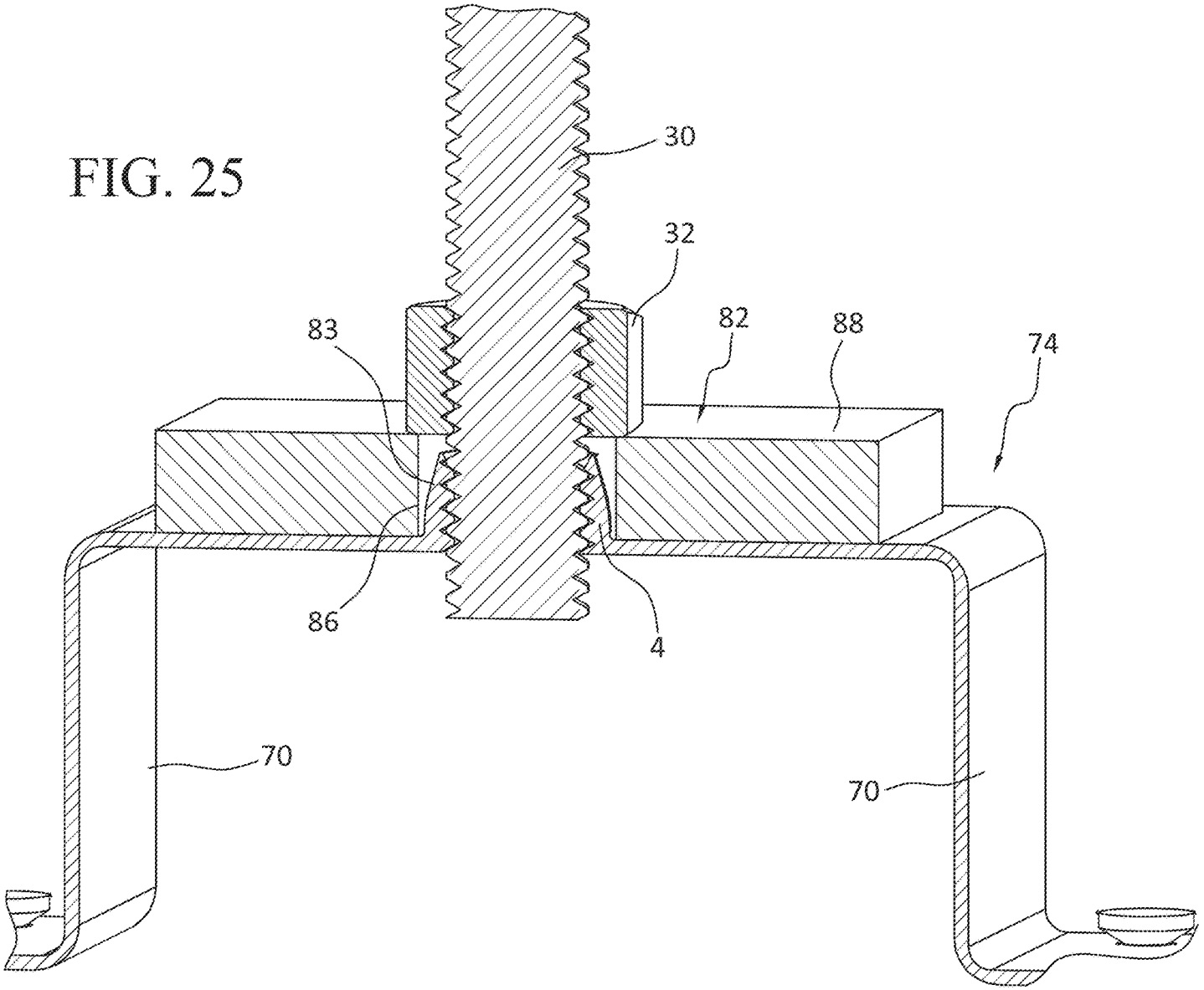

Referring to FIG. 25, the top surface 88 of the metal plate 82 is above the top 83 of the boss section 4. A hex nut 32 threaded to the rod 30 bears against the metal plate 82 to secure the rod 30 in place and prevent the rod 30 from turning while being attached to a structure such as a wall.

Figure 26:
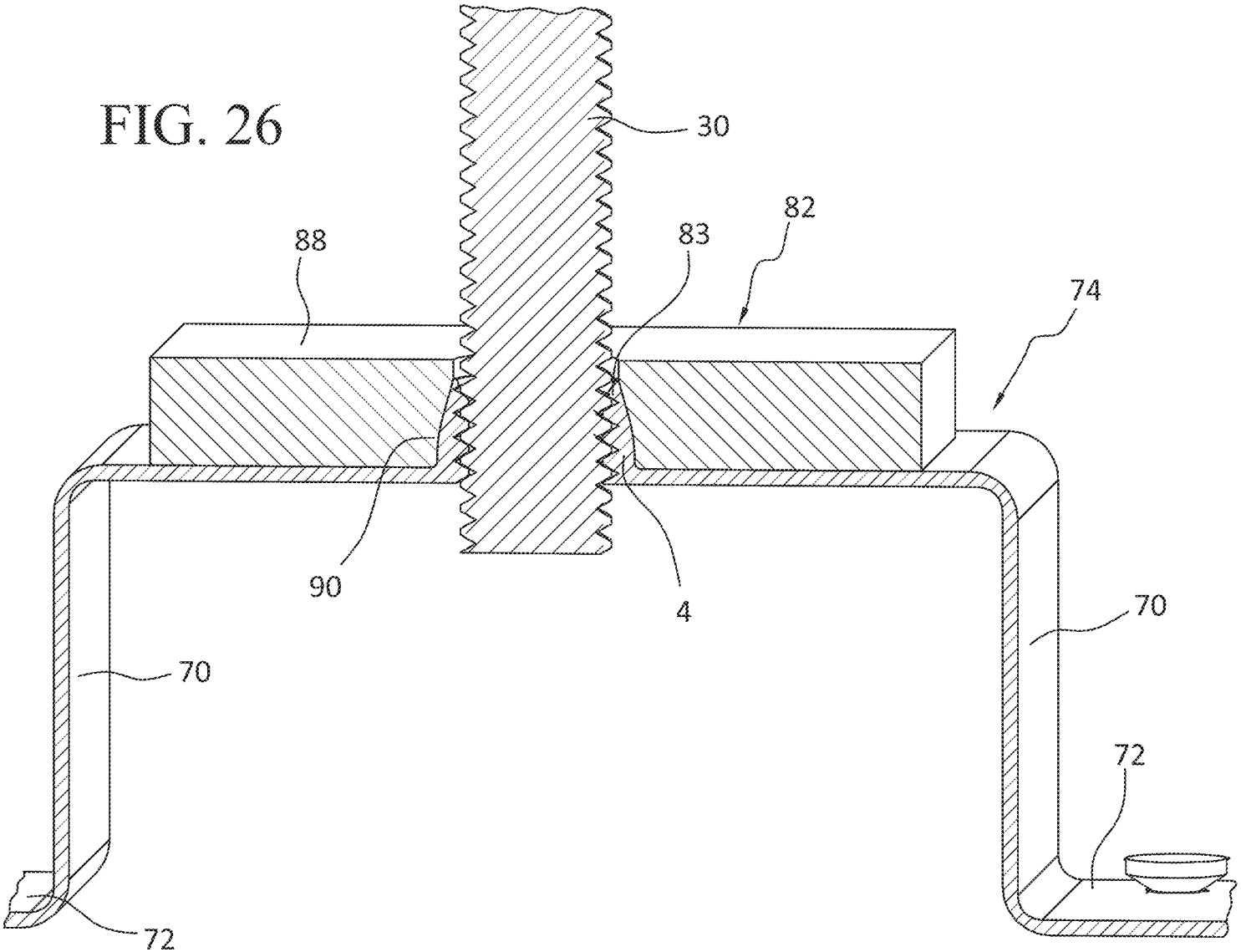
Figure 27:
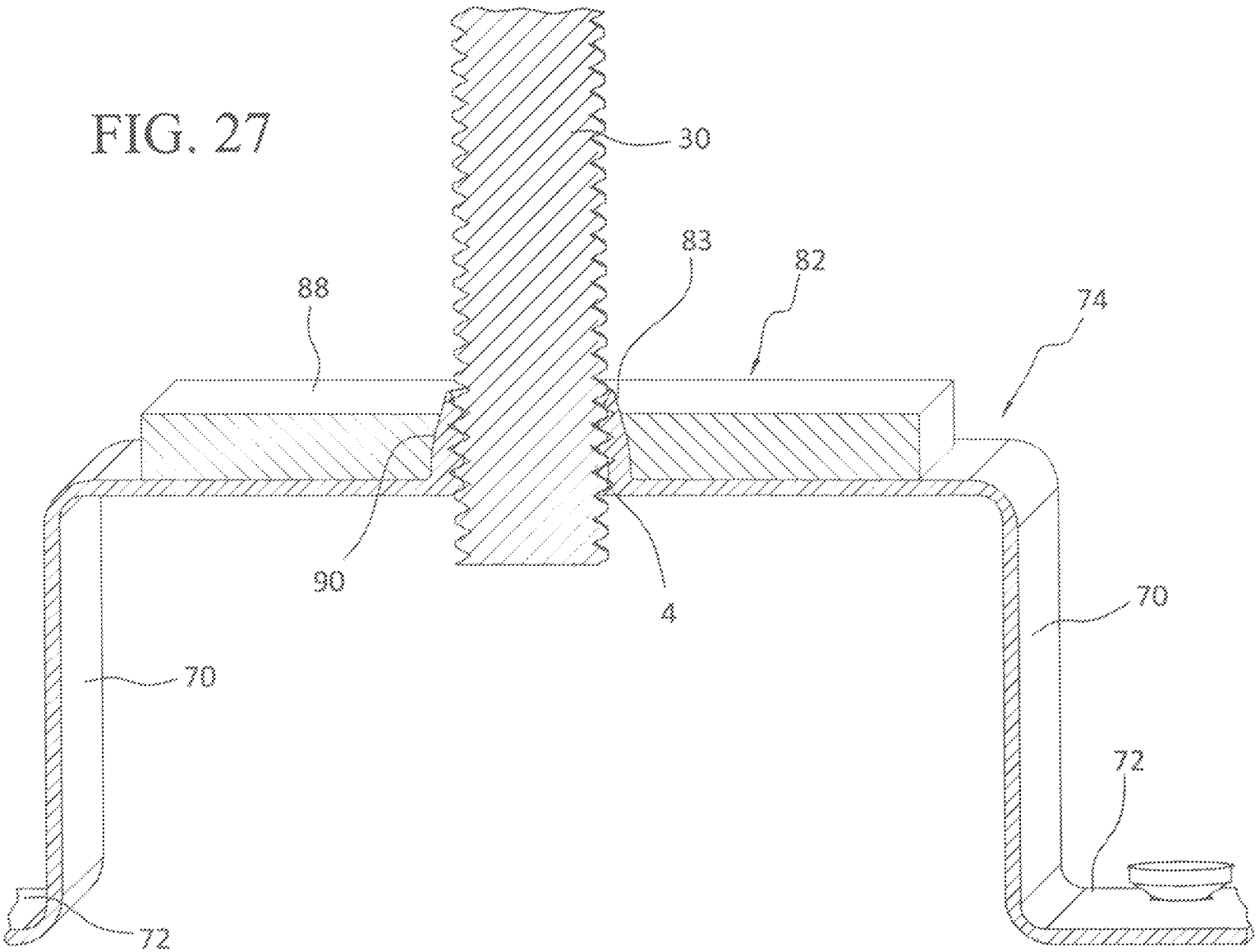

Referring to FIGS. 26 and 27, the metal plate 82 includes an opening 90 with a complementary shape to support the boss section 4. The top surface 88 of the metal plate 82 is above the top 83 of the boss section 4 as shown in FIG. 26. The top surface 88 of the metal plate 82 is below the top 83 of the boss section 4 as shown in FIG. 27.

Figure 28:
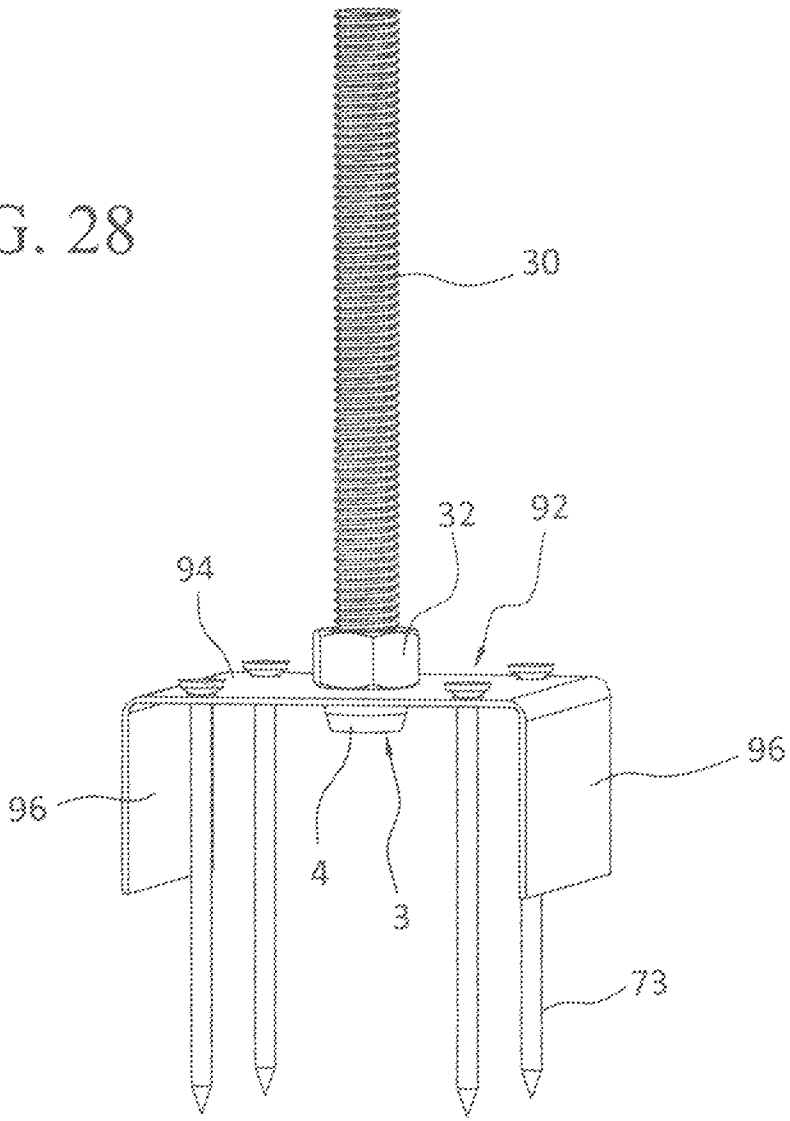

Referring to FIG. 28, a holder or support 92 includes a base 94 an legs 96. The base 94 has a threaded opening with the boss section 4. The rod 30 is threaded to the bossed opening. The hex nut 32 locks the rod 30 to the support 92 to prevent the rod 30 from turning while being attached to a structure such as a wall. The nails 73 extend through the base 94 in respective holes.

Figure 29:
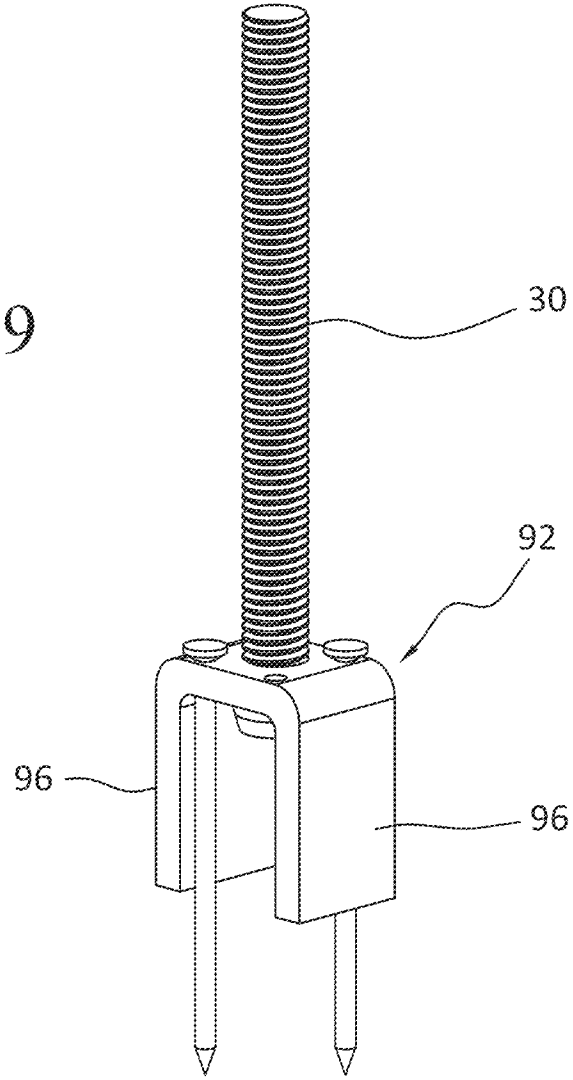
FIGS. 29-32 show several anchor assemblies for being embedded in concrete, using thick metal holders or supports for threaded rods where the holders also function as anchor bodies.
Figure 30:
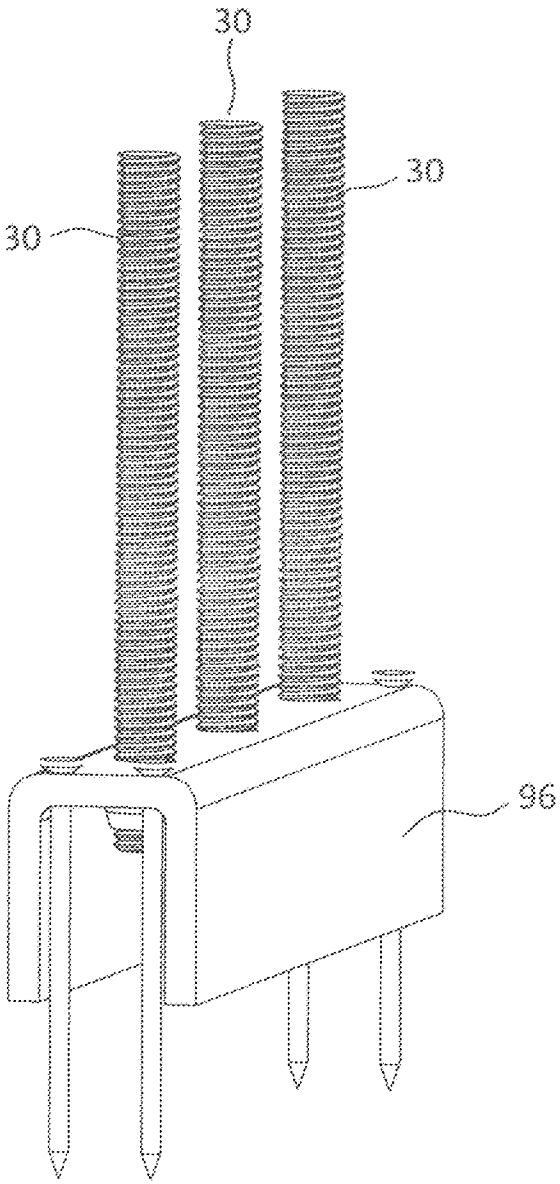

Referring to FIGS. 29 and 30, the support 92 may be made of thicker metal and configured to hold a single bolt or rod 30 or multiple bolts or rods 30 in a row.

Figure 31:
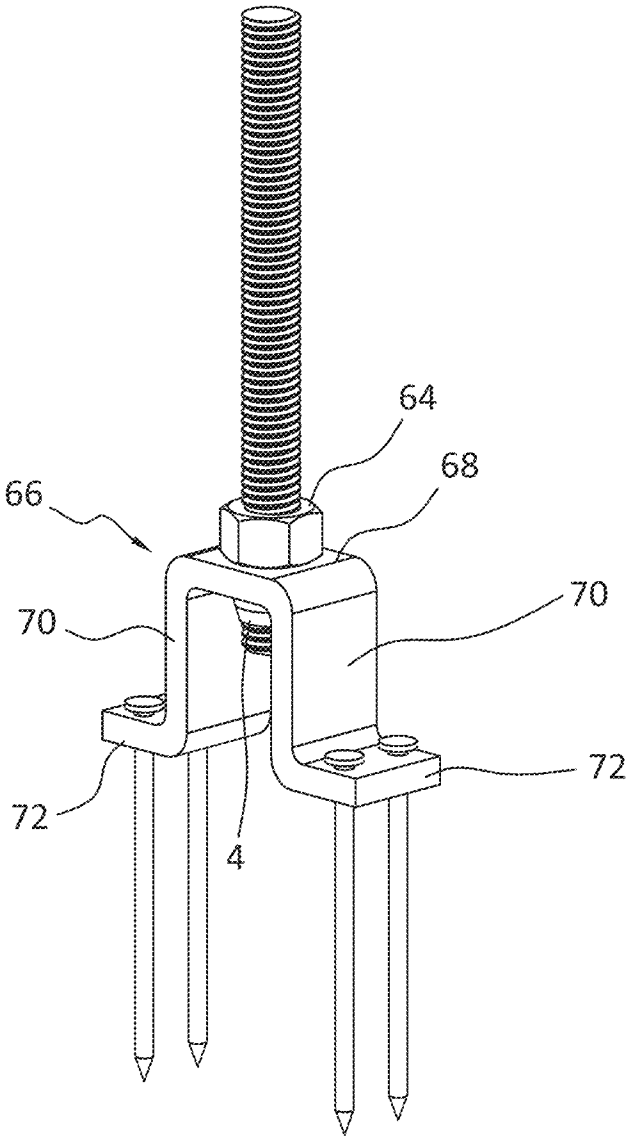
Figure 32:
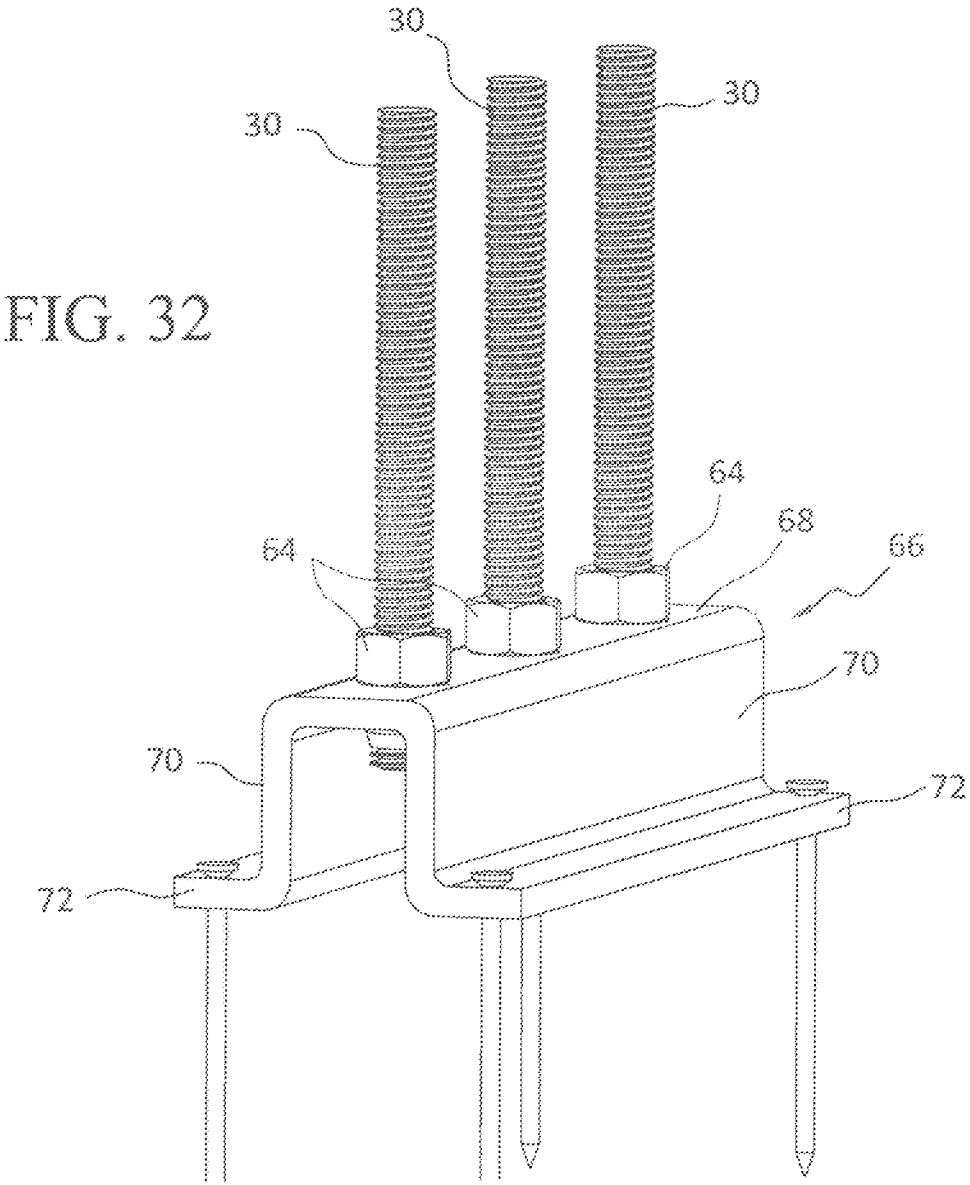

Referring to FIGS. 31 and 32, the support 66 shown in FIG. 17 may be made of thicker metal and may be configured with a single or multiple bolts or rods 30 in a row.

Figure 33:
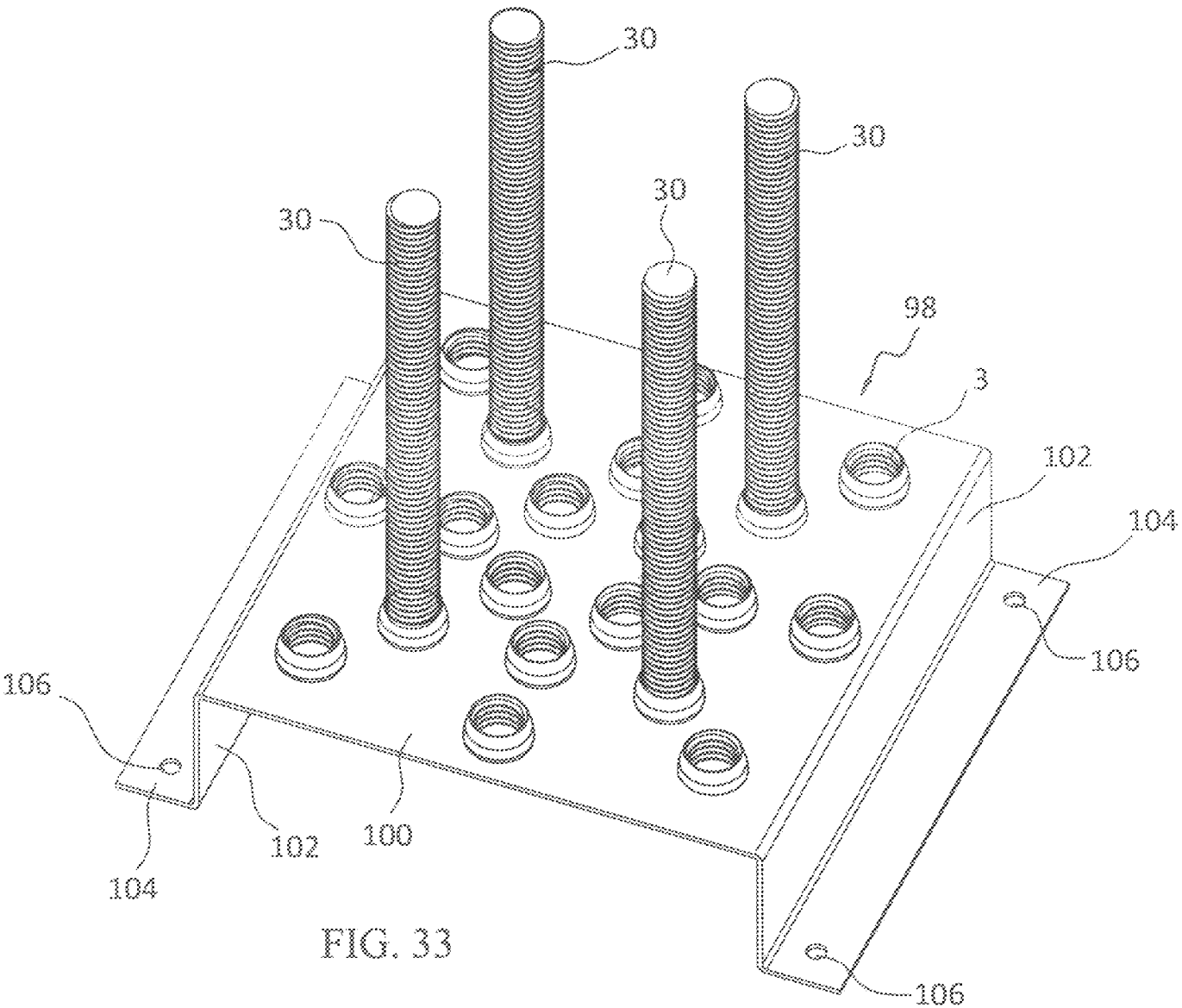
FIGS. 33-43 show several anchor assemblies for being embedded in concrete, using holders or supports with multiple threaded openings for a plurality of threaded rods.

Referring to FIG. 33, the support 74 shown in FIG. 18 is modified as a holder or support 98 with multiple threaded boss openings 3 in a predetermined pattern to advantageously provide multiple configurations for the bolts or rods 30 in a single support. The support 98 advantageously provides the proper spacing between the rods 30 required for the specific application. The support has a base wall 100 with sufficient space for the multiple threaded boss holes 3 on the top side of the base wall 100. The base wall 100 is preferably square. The support 98 has side walls 102 to advantageously elevate the bottom of the rods 30 from the bottom of the resulting concrete structure to prevent exposure to the elements that can cause corrosion. A concrete structure may include a concrete foundation, a concrete slab, a concrete column, a concrete wall or any concrete structure for supporting a load. Bottom walls 104 extend transversely from the bottom portion of the respective side walls 102. The bottom walls 104 may be used to secure the support 98 to the formboard with nails through the holes 106. In construction, it is well known that concrete forms are molds which are used to hold concrete in place while it hardens, ensuring that the concrete sets in a specific shape. Formboards made of plywood or similar sheet material make up the concrete forms.

Figure 34:
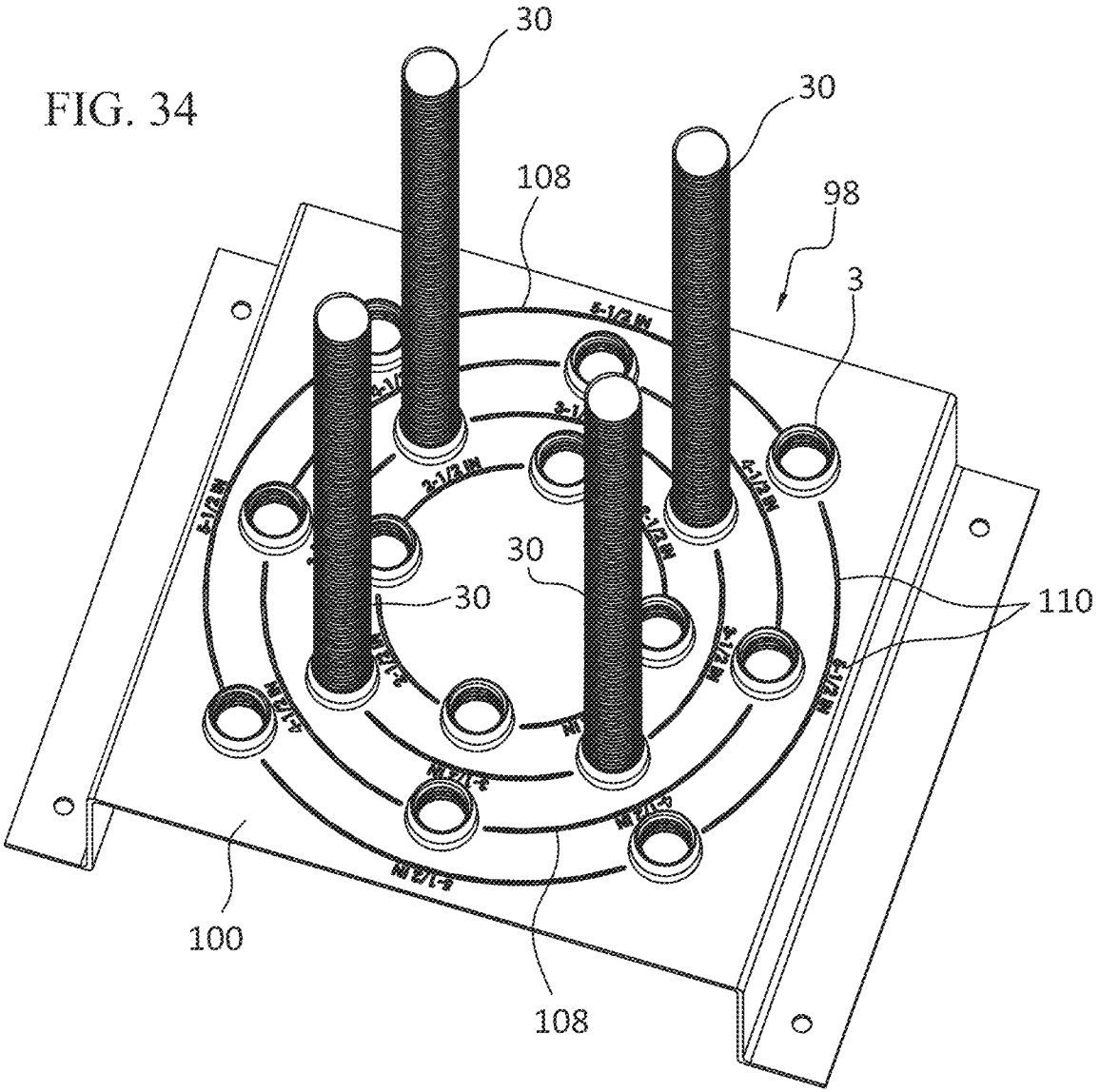

Referring to FIG. 34, the support 98 shown in FIG. 33 may be modified by arranging the threaded boss openings 3 along concentric circles 108 with four threaded boss openings 3 on each circle 108 arranged preferably equidistant from each other. The four openings 3 on each circle 108 preferably define the four corners of a square. Each square is preferably rotated 45° about the center of the concentric circles 108 in respect to its adjacent square. Four threaded boss openings 3 may lie on a diametrical line extending from the outermost circle to the innermost circle. The top surface of the base wall 100 preferably has markings 110, such as by stamping, showing the circumferences or traces of the circles 108 and their corresponding radii.

Figure 35:
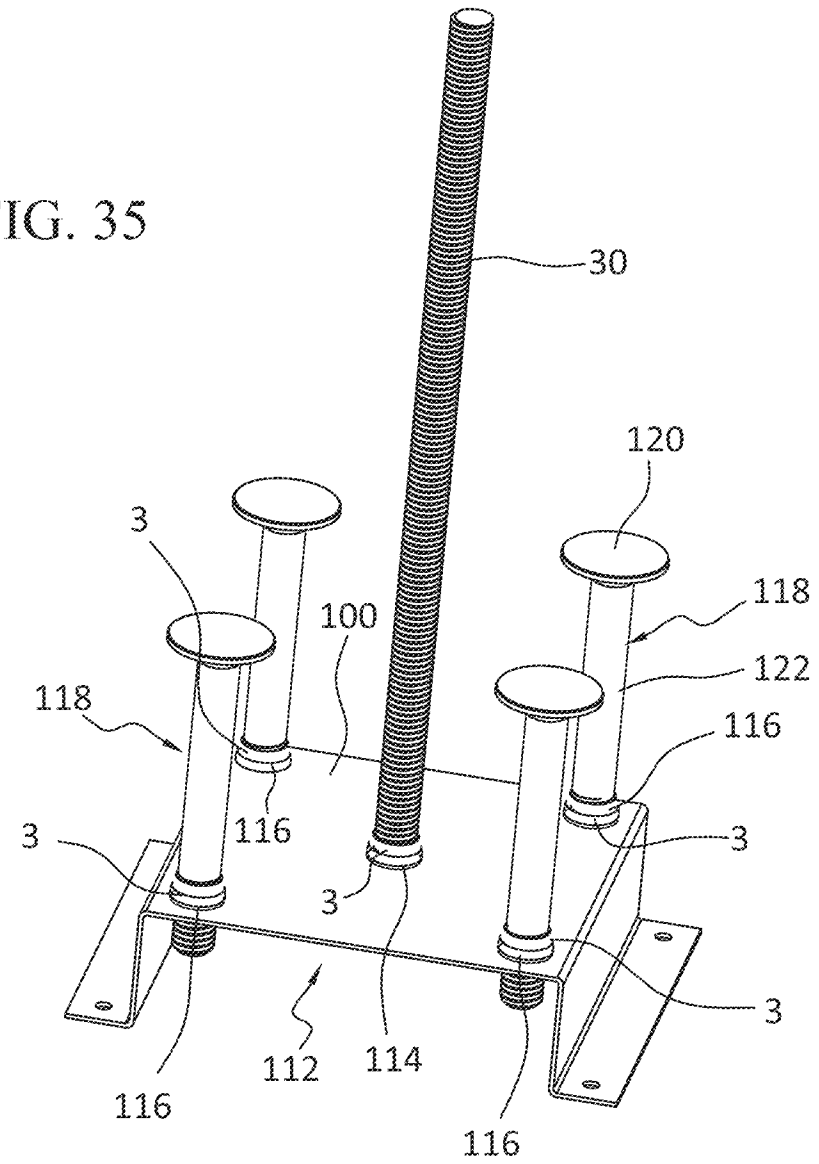

Referring to FIG. 35, the support 98 shown in FIG. 33 is modified as support 112 with a threaded boss opening 3 located at central location 114 and four threaded boss openings 3 at the corners 116 of the base wall 100. The anchor bolt or rod 30 is threaded to the threaded boss opening 3 at the central location 114. Anchor studs 118 are threaded to the respective threaded boss openings 3 at the corners 116. The anchor studs 118 preferably define the four corners of a square with the anchor bolt or rod 30 being at the center of the square. The anchor studs 118 are disposed at the same distance to the central anchor bolt or rod 30.

Figure 36:
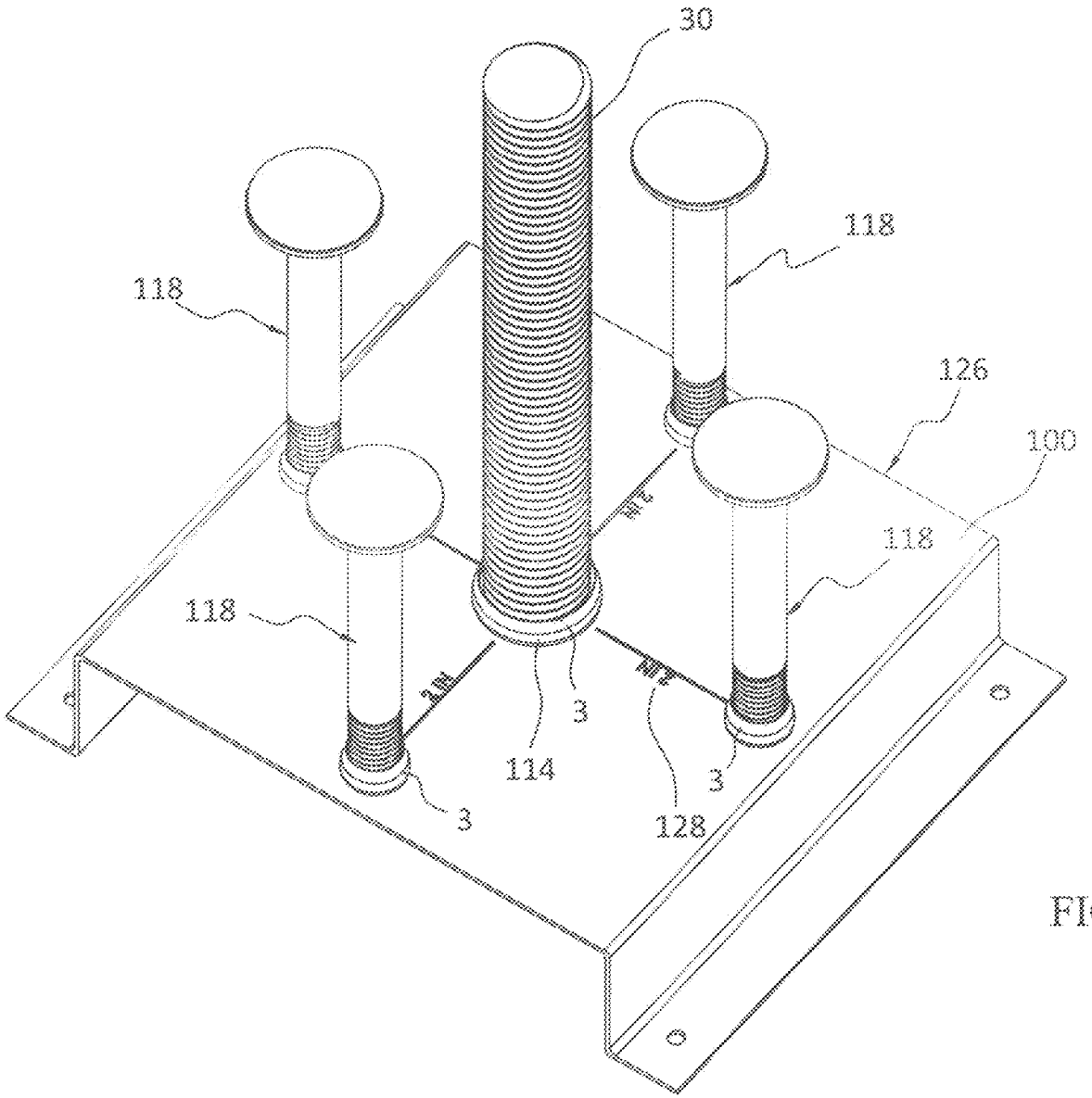

Referring to FIG. 36, the support 112 shown in FIG. 35 is modified as support 126 wherein the threaded boss openings 3 for the anchor studs are displaced 45° about the central location 114 from locations shown in FIG. 36. The studs 118 are preferably disposed at the same distance to the central anchor bolt or rod 30. The top surface of the base wall 100 preferably has markings 128, such as by stamping, showing the distance between the anchor studs 118 and the central anchor bolt or rod 30. The opening 3 at the central location 114 may be of a larger diameter than the other openings.

Figure 37:
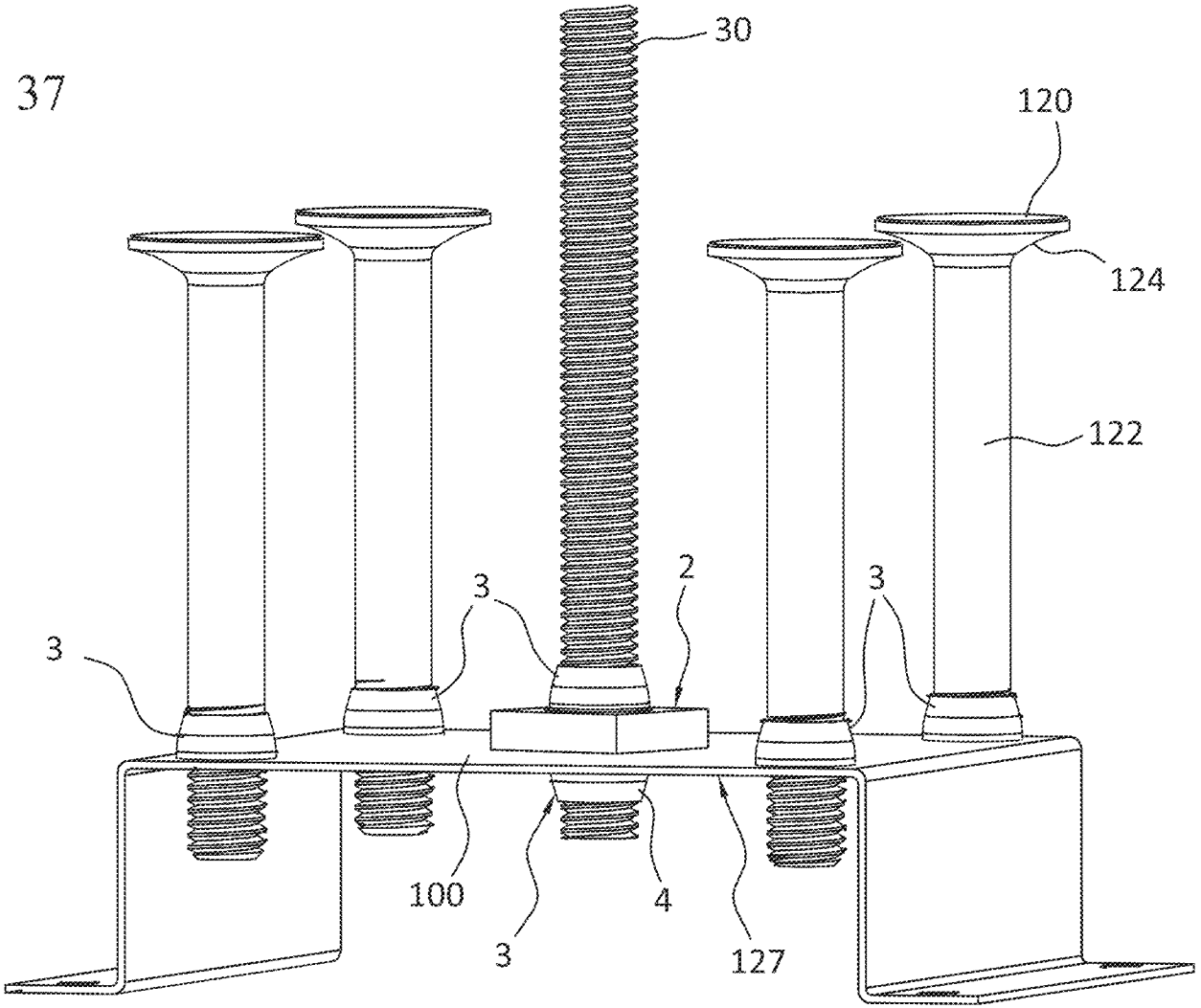

Referring to FIG. 37, the support 112 shown in FIG. 35 is modified as holder or support 127 with a central threaded boss opening 3 disposed at the bottom of the base wall 100. An anchor metal plate 2 is disposed on the top surface of the base wall 100 and threaded to the anchor bolt or rod 30. The anchor metal plate 2 advantageously locks the anchor bolt or rod 30 to the support 127 to prevent it from turning while the anchor bolt or rod 30 is being attached to the load or structure such as a wall.

Each of the anchor studs 118 shown in FIGS. 35-37 includes a head portion 120 joined to a rod portion 122. The head portion 120 is disposed at one of the rod portion 122. The other opposite end of the rod portion 122 is threadedly attached to one of the threaded boss openings 3 at the corner locations 116. The head portion 120 extends laterally of the rod portion 122 to define a circumferential shoulder 124 to resist a tension load on the anchor bolt or rod 30. The shoulder 124 is preferably wedge-shaped in side view.

Figure 38:
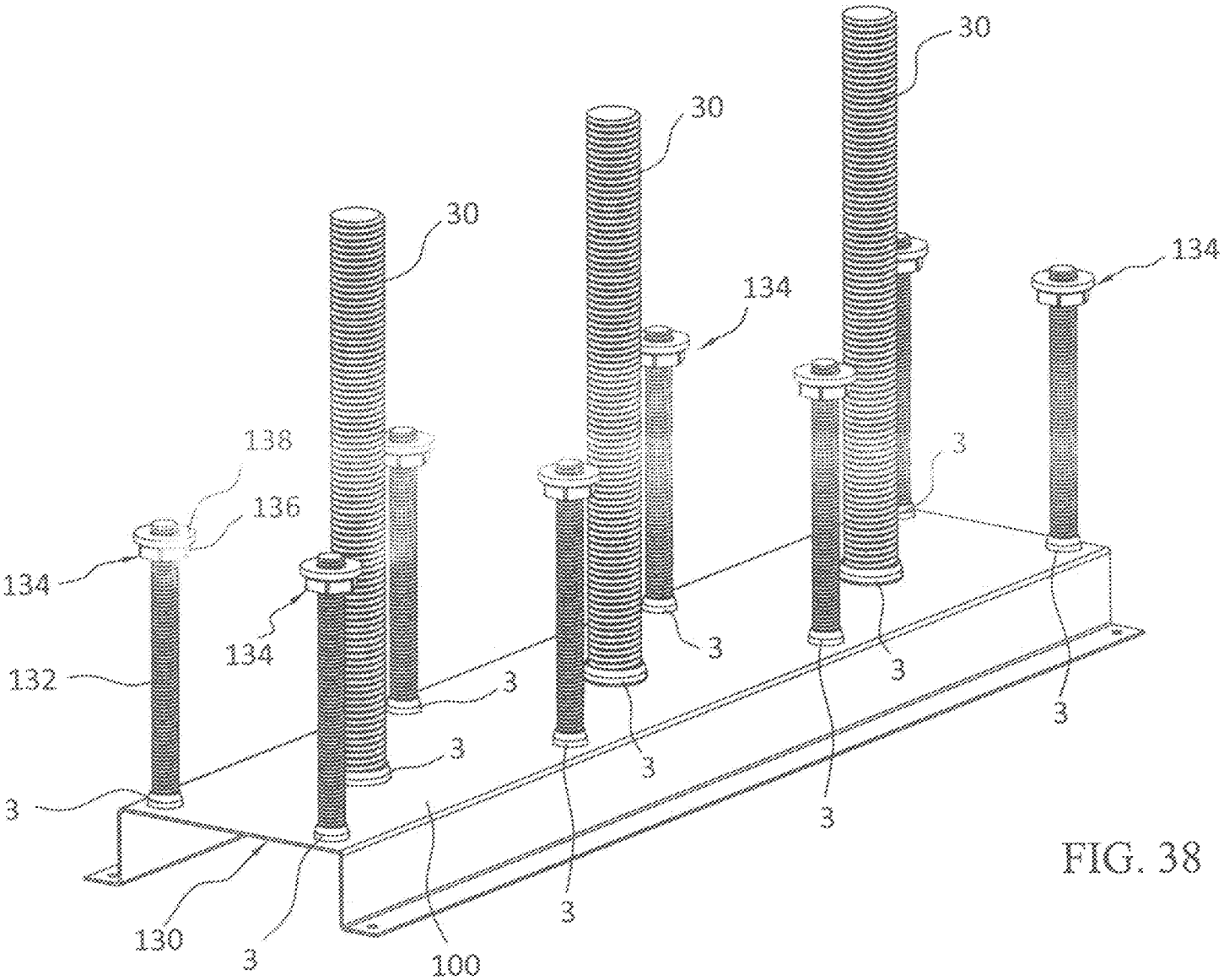

Referring to FIG. 38, the support 112 shown in FIG. 35 is modified as holder or support 130 to accommodate multiple anchor bolts or rods 30. Stud bolts 132 are arranged in a square configuration centered around each anchor bolt or rod 30. An anchor body 134 is threaded to one end of each stud bolt 132. The other end of each stud bolt 132 is threaded to a respective threaded boss opening 3. The anchor bodies 134 includes a hexagonal portion 136 and a cylindrical portion 138. The anchor bodies 134 are available from Earthbound Corp., https://www.chubbysmack.com. The anchor bodies 134 are also disclosed in U.S. Pat. No. 9,097,001.

Figure 39:
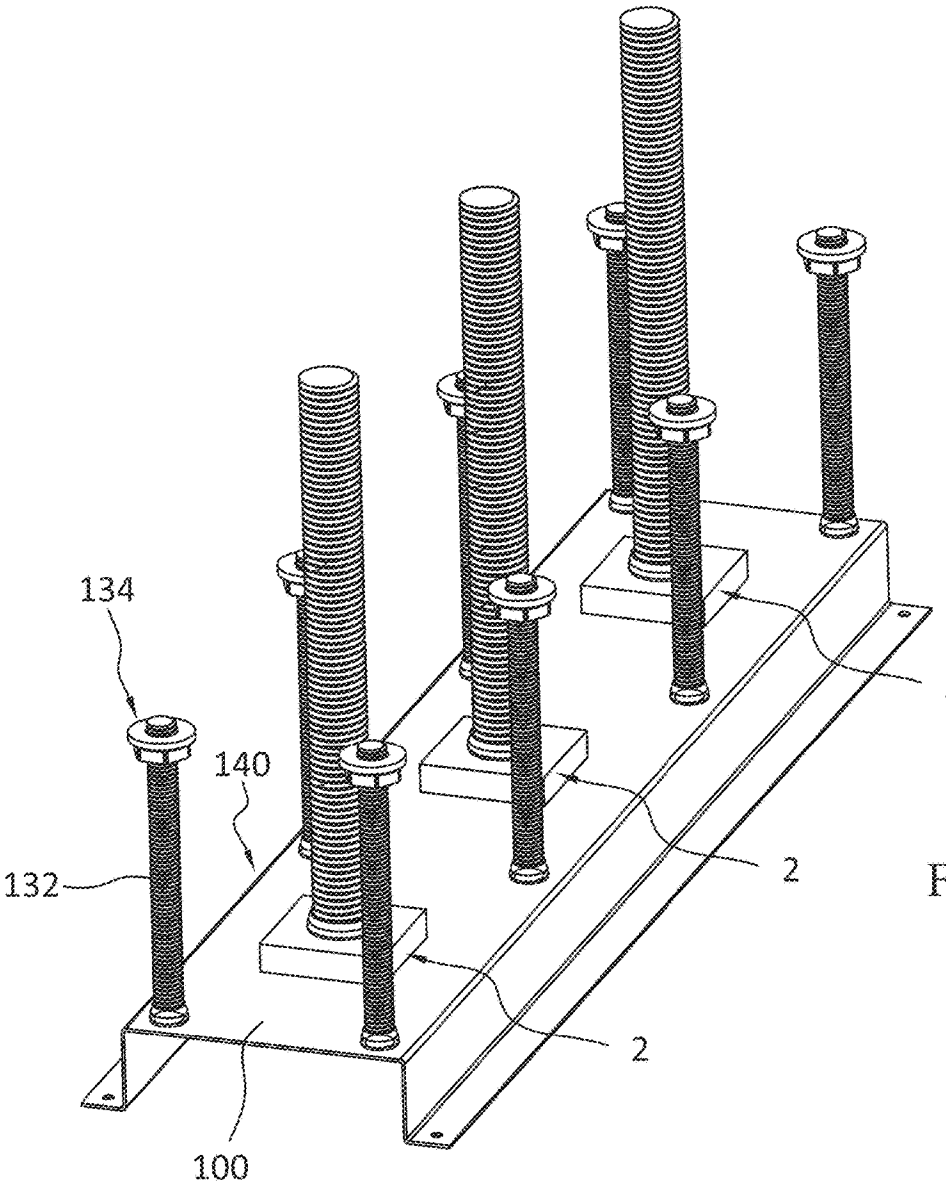

Referring to FIG. 39, the support 130 shown in FIG. 38 is modified as support 140 with the threaded boss openings 3 for the anchor bolts or rods 30 disposed at the bottom of the base 100. Anchor metal plates 2 are disposed on the top surface of the base wall 100 and threaded to the respective anchor bolts or rods 30. The anchor metal plates 2 advantageously lock the respective anchor bolts or rods 30 to the support 140 to prevent them from turning while the anchor bolts or rods 30 are being attached to the load or structure such as a wall.

Figure 40:
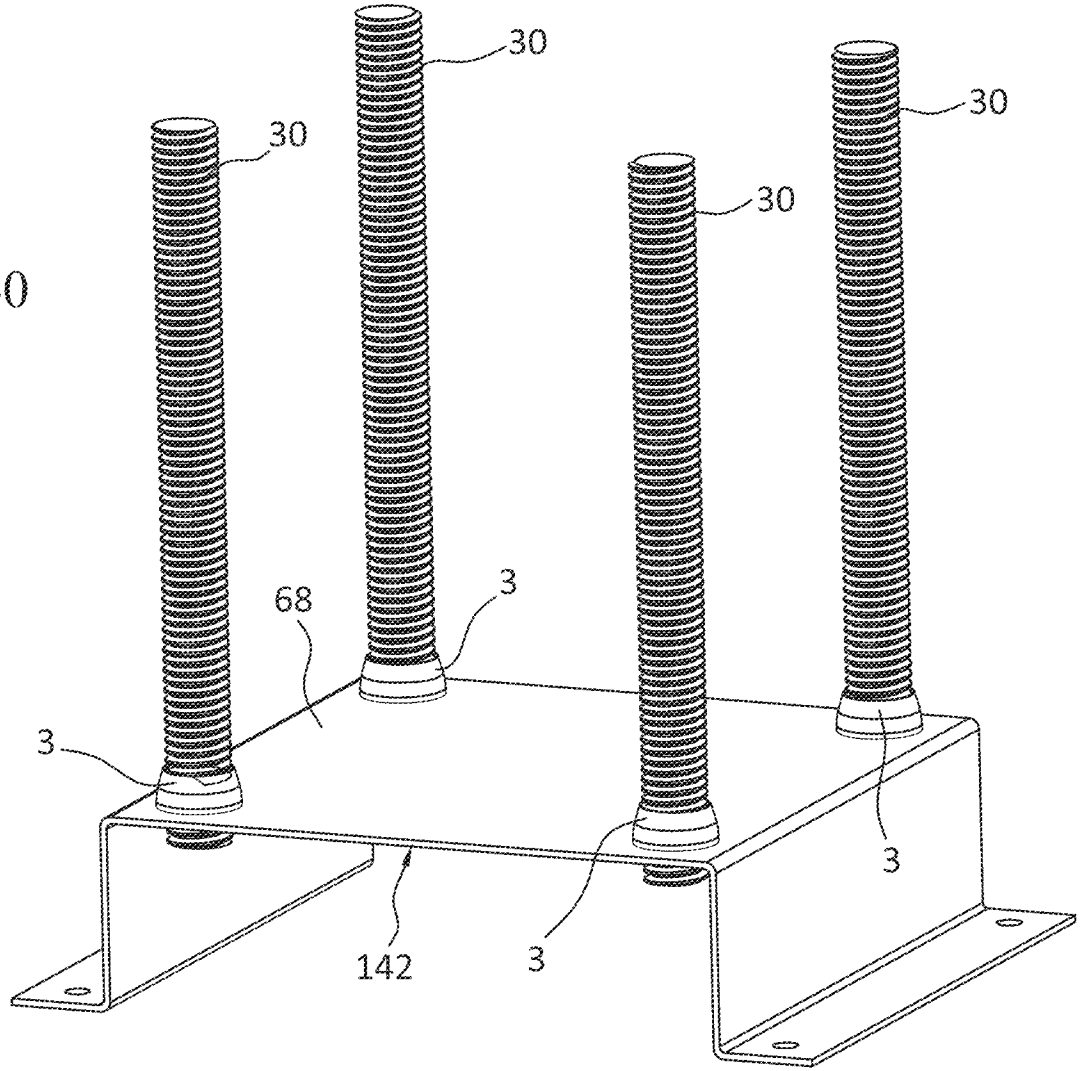

Referring to FIG. 40, the support 74 shown in FIG. 18 is modified as holder or support 142 to accommodate multiple anchor bolts or rods 30, which are arranged in a square configuration with each rod 30 defining a corner of the square. The support 142 advantageously provides the proper spacing between the rods 30 required for a specific application.

Figure 41:
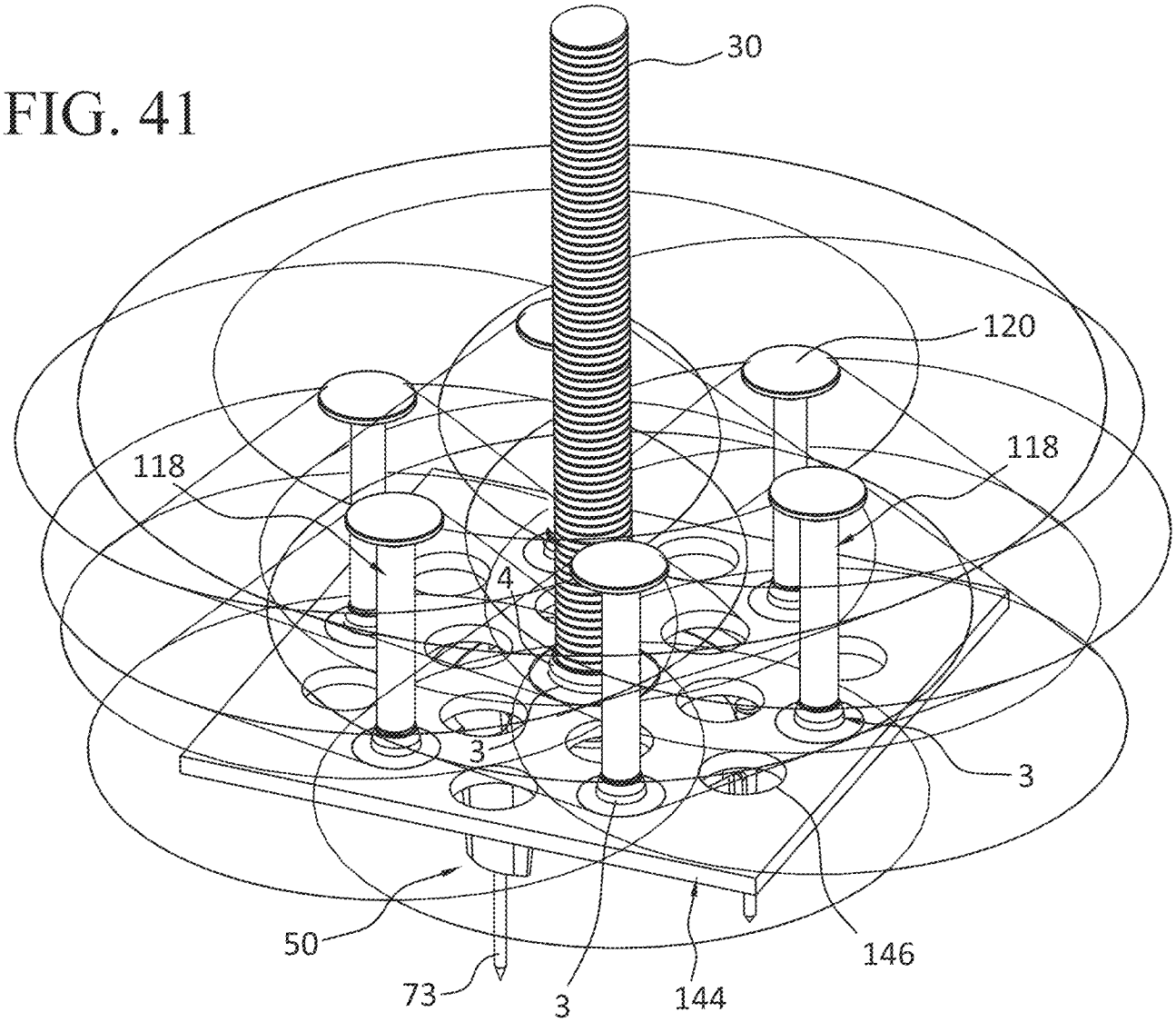
Figure 42:
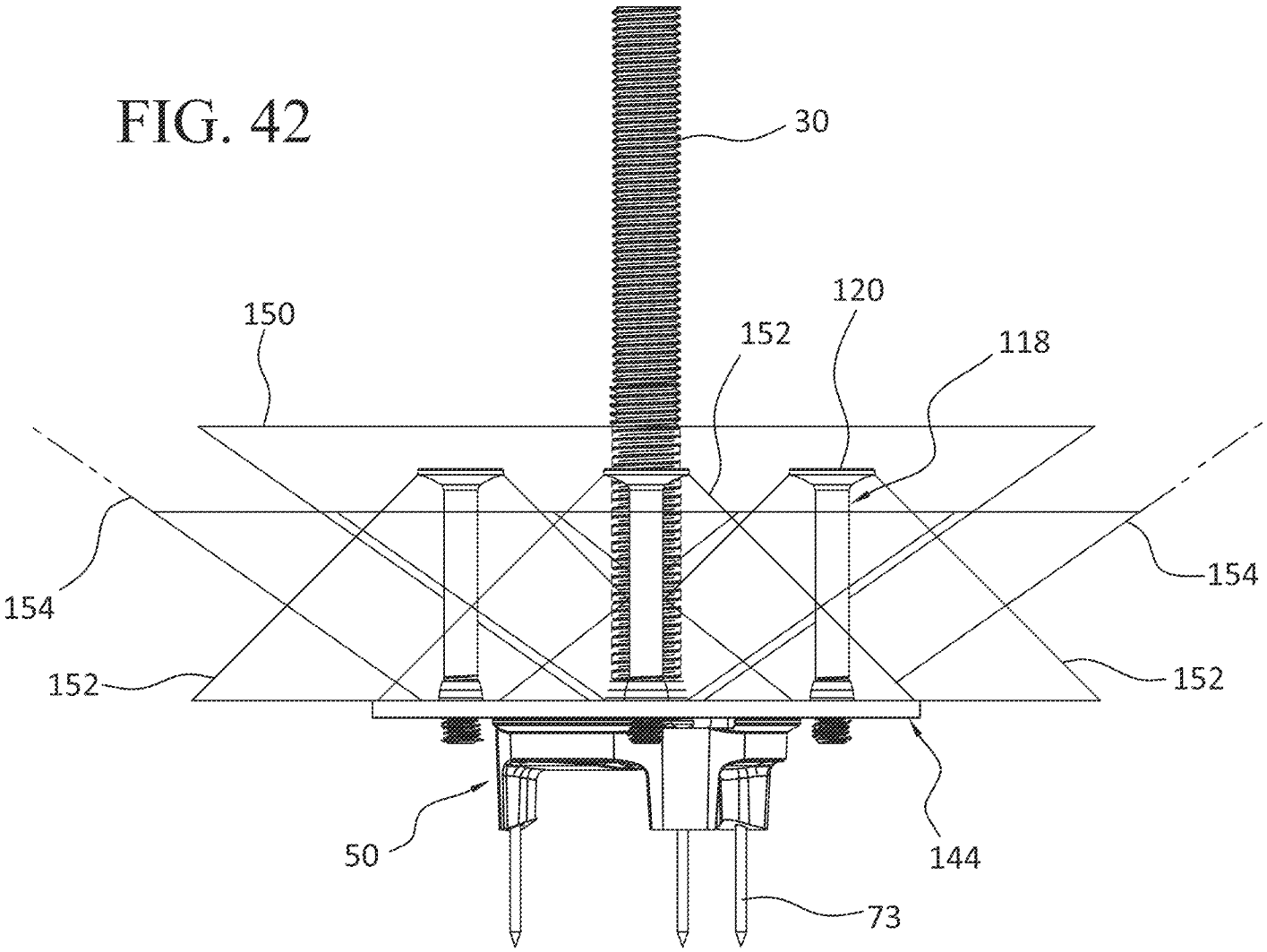

Referring to FIGS. 41 and 42, a fixture plate 144 is provided to pre-position the anchor studs 118 equidistant to each other and to the anchor bolt or rod 30. The plate 144 includes threaded boss openings 3 for receiving the threaded ends of the anchor studs 118 and anchor bolt or rod 30. The plate 144 is preferably square with openings 146 to advantageously allow the wet concrete to flow below the plate 144 and prevent air pockets. A support 50, preferably made of plastic, elevates the plate 144 above the formboard. The support 50 includes a threaded central opening for receiving one end of the anchor bolt or rod 30. Nails 73 secure the support 50 to the formboard. The support 50 can be any configuration as long as it has a central threaded opening to receive the bottom end portion of the anchor bolt or rod 30 and elevates the plate 144. For example, the support 66 shown in FIG. 16, or the support 92 shown in FIG. 28 may be used. The embodiment of the support 50 shown in FIG. 42 is disclosed in U.S. Pat. No. 8,943,777, hereby incorporated herein by reference.

A shear cone 150 is generated by the center boss section 4 attached to the anchor bolt or rod 30 when the rod 30 is subjected to a tension load. Shear cones 152 are generated by the head portions 120 of the anchor studs 118 to resist the concrete shear that is generated by the central boss section 4 associated with rod 30. Shear cones 154 are generated by the uplift forces on the anchor studs 118, creating a larger shear cone than the center anchor bolt or rod 30 alone by itself.

Figure 43:
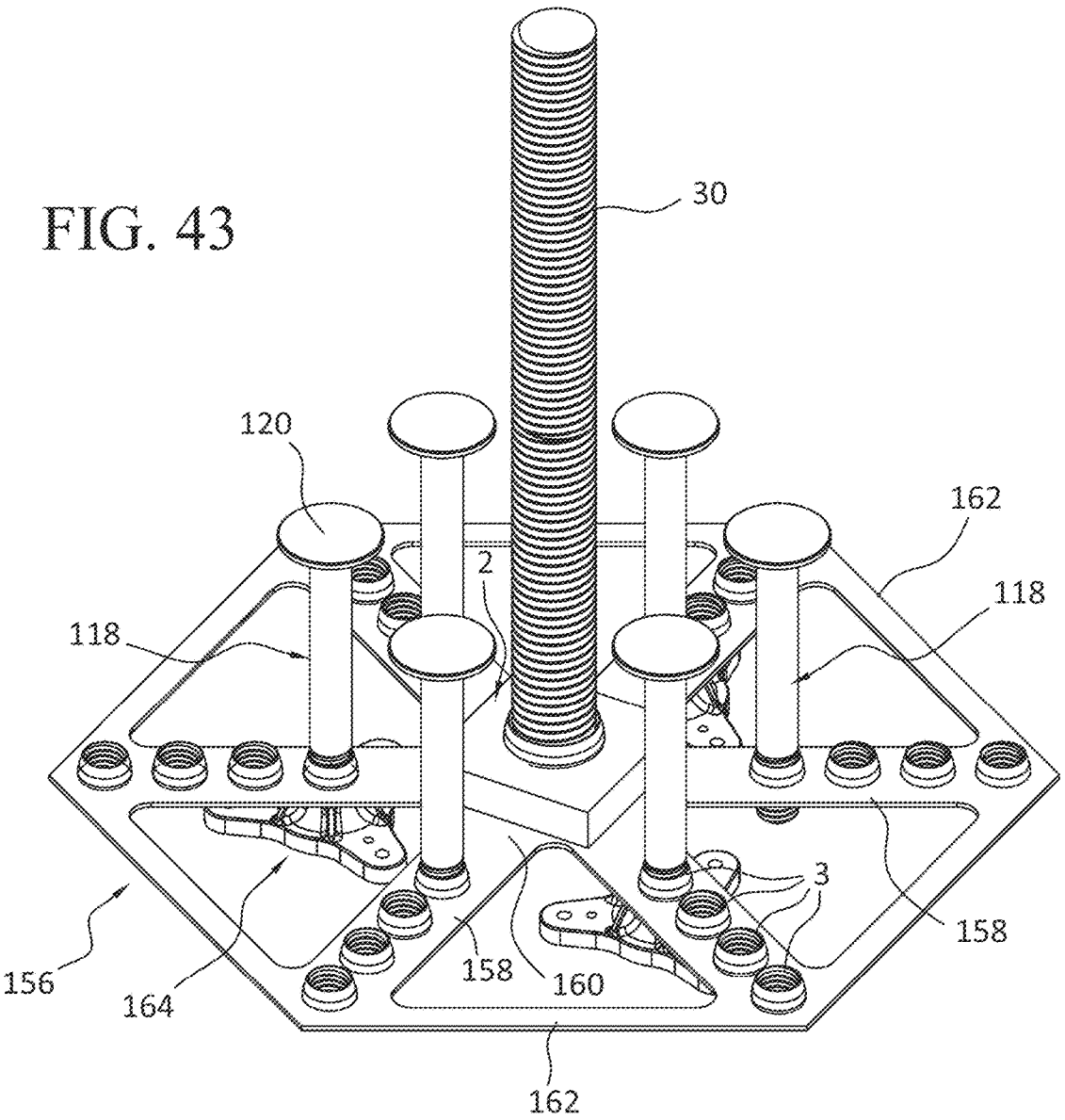

Referring to FIG. 43, a metal fixture 156 is provided to pre-position the anchor studs 118 equidistant to each other and to the anchor bolt or rod 30. The fixture 156 has arms 158 radiating from a central portion 160. Each arm 158 represent the radius of a circle, each radius being spaced from the adjacent radius at the same angle. In the embodiment shown, the angle is 60°. The outer ends of the arms 158 are joined by connecting arms 162 to form multiple triangles around the central portion 160. Each arm has a plurality of evenly spaced threaded boss openings 3 to advantageously provide for multiple anchor stud locations. While the embodiment shows one anchor stud per arm, more than one anchor stud may be provided on each arm, depending on the expected load and the strength of the concrete. While the studs 118 are shown in the openings 3 nearest to the central portion 160, it should be understood that the anchor studs 118 may be moved to the other threaded openings 3, depending on the specific load calculations.

Figure 23:
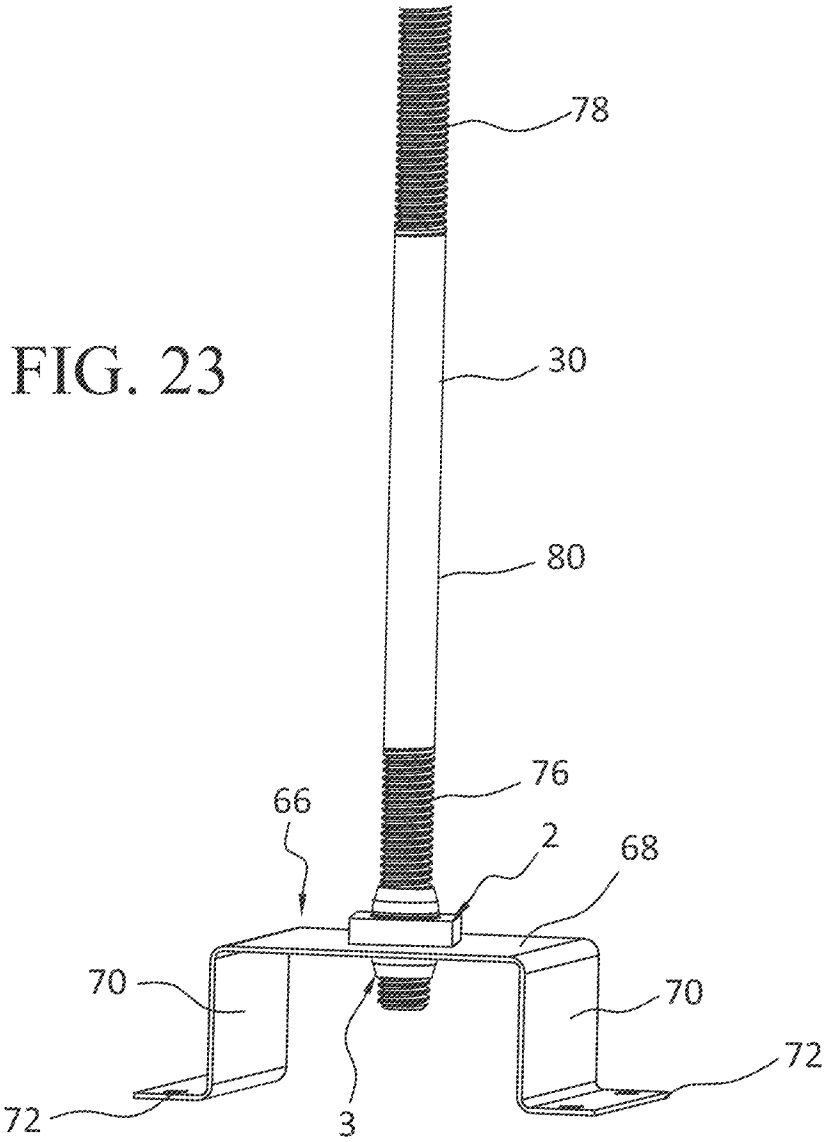

A threaded boss opening 3 is also provided on the bottom of the central portion 160, as shown in FIG. 23, for threading to the rod 30.

Supports 164, preferably made of plastic, are provided to elevate the fixture 156 above the formboard. Each of the supports 164 includes a threaded central opening for receiving one end of the respective anchor stud 118. Nails may be used to secure the support 164 to the formboard. The support 164 can be any configuration as long as it has a central threaded opening to receive the bottom end portion of the anchor stud 118 and elevates the fixture 156 above the formboard. For example, the support 66 shown in FIG. 16, or the support 92 shown in FIG. 28 may be used. The embodiment of the support 164 shown in FIG. 43 is disclosed in U.S. Pat. No. 9,222,251, hereby incorporated herein by reference.

An anchor body 2 is used to lock the anchor bolt or rod 30 to the fixture 156 to prevent the rod 30 from turning while being attached to a structure such as a wall.

Figure 44:
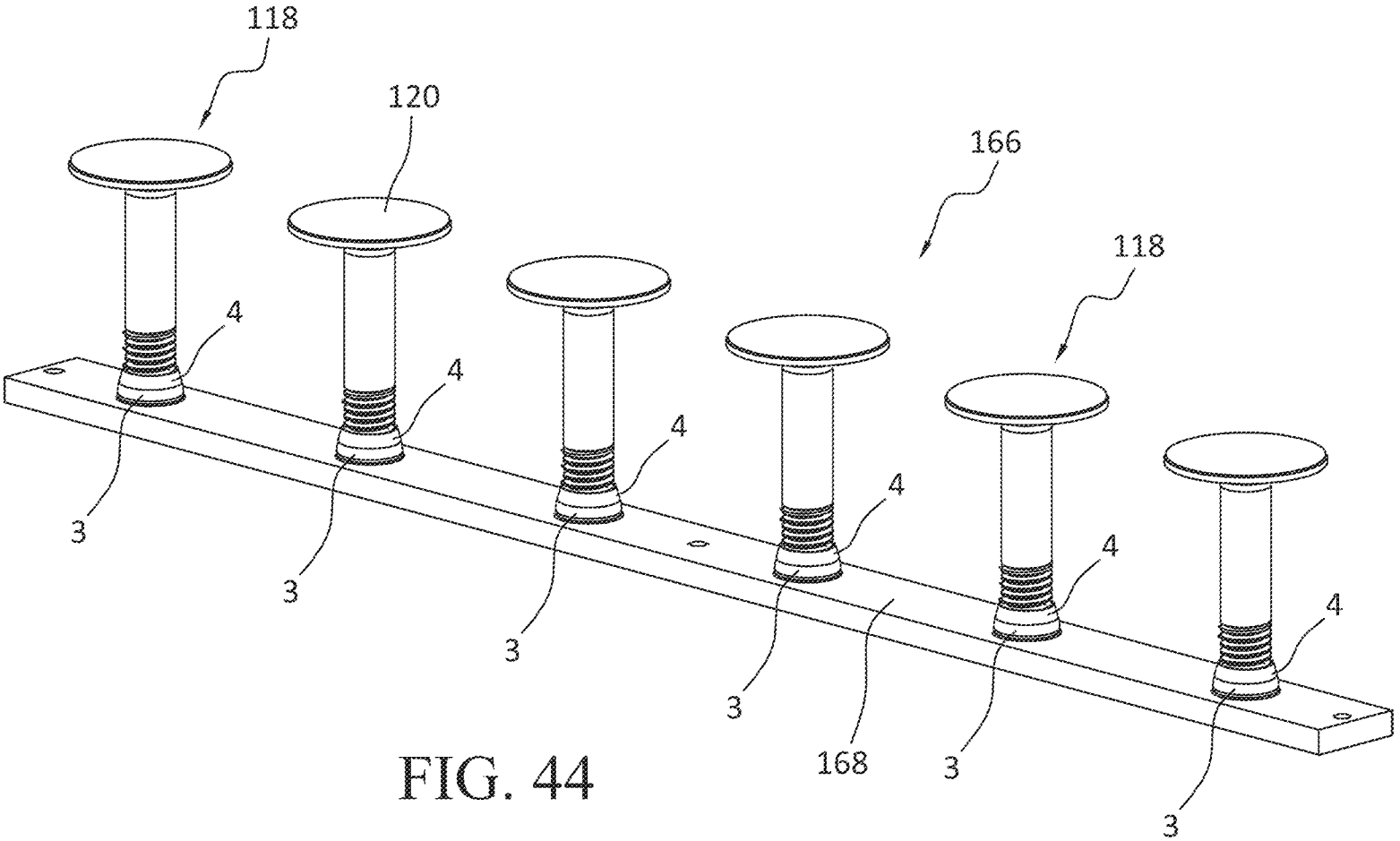
FIGS. 44-63 show several stud rail assemblies embedded in concrete.

Referring to FIG. 44, a stud rail 166 includes a longitudinal metal plate 168 provided with threaded boss openings 3 evenly spaced along the length of the plate 168 with their respective boss sections 4 extending upwardly from the top surface of the metal plate. Anchor studs 118 are threaded to the respective threaded boss openings 3. The metal plate 168 provides a base for holding the anchor studs 118. Stud rails are typically used in concrete reinforcement to resist punching shear at slab-column connections in elevated slabs and foundation mat slabs.

Figure 45:
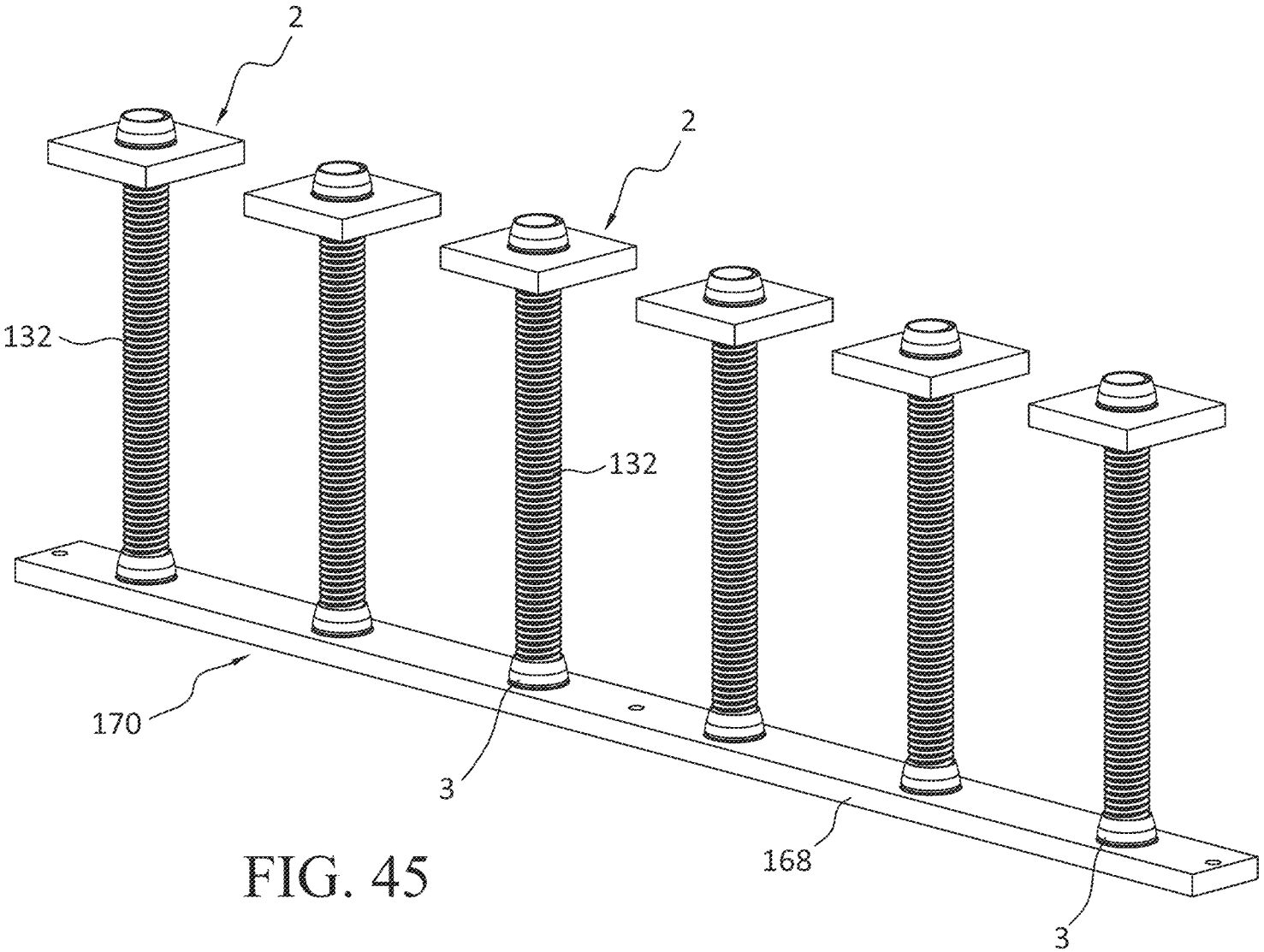
Figure 46:
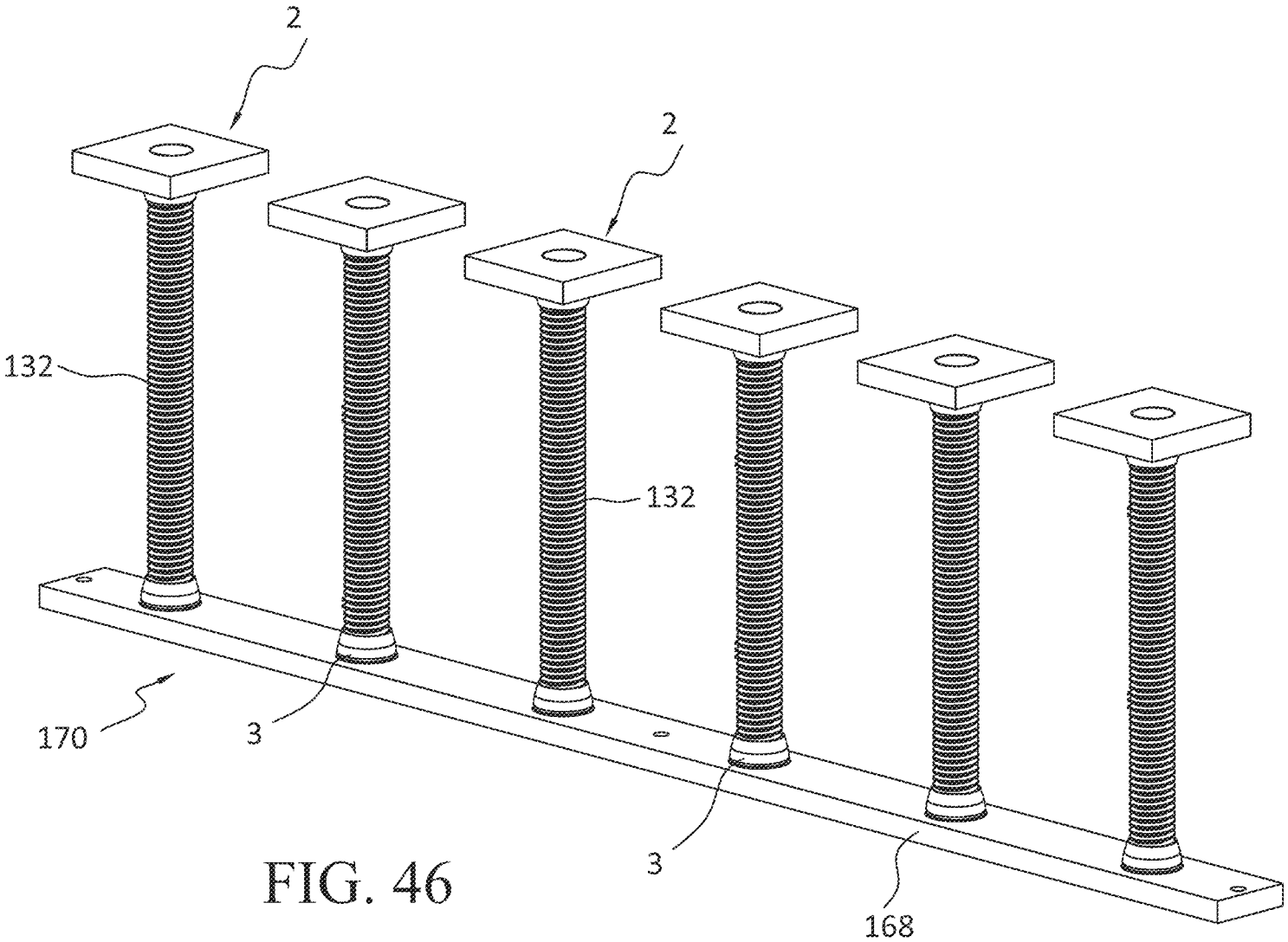

Referring to FIGS. 45 and 46, the stud rail 166 shown in FIG. 44 is modified as stud rail 170. The anchor studs 118 are replaced with stud bolts 132. Anchor metal plates 2 are threaded to one of each stud bolt 132. The other end of each stud bolt 132 is threaded to the threaded boss openings 3 in the metal plate 168. The threaded boss openings 3 of the anchor plates 2 are directed upwardly away from the metal plate 168 as shown in FIG. 45 and directed downwardly toward the metal plate 168 as shown in FIG. 46.

Figure 47:
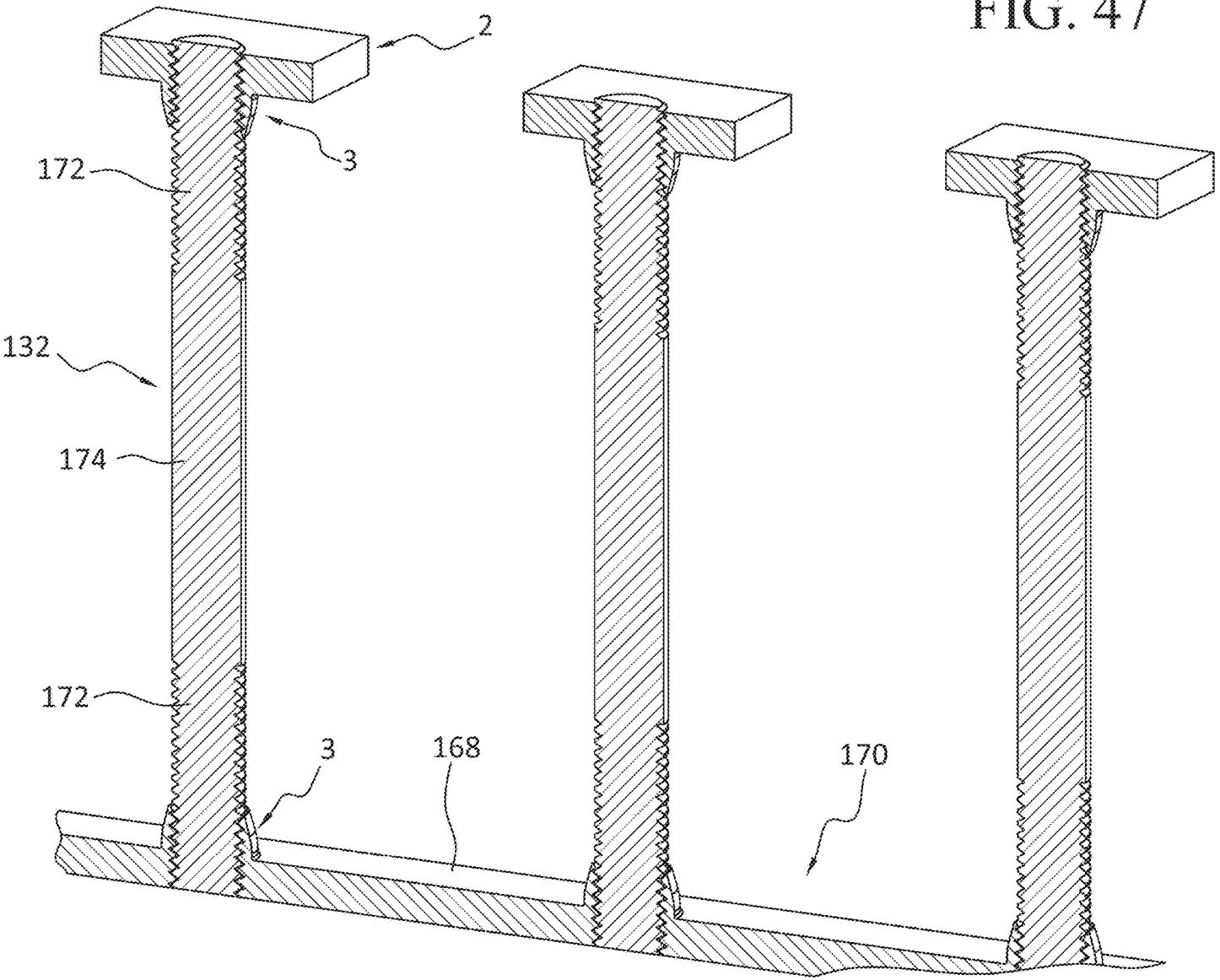

Referring to FIG. 47, the stud bolts 132 instead of being all-thread as shown in FIG. 46, the stud bolts 132 shown in FIG. 47 are threaded only at their end portions 172 with intermediate portions 174 being unthreaded.

Figure 48:
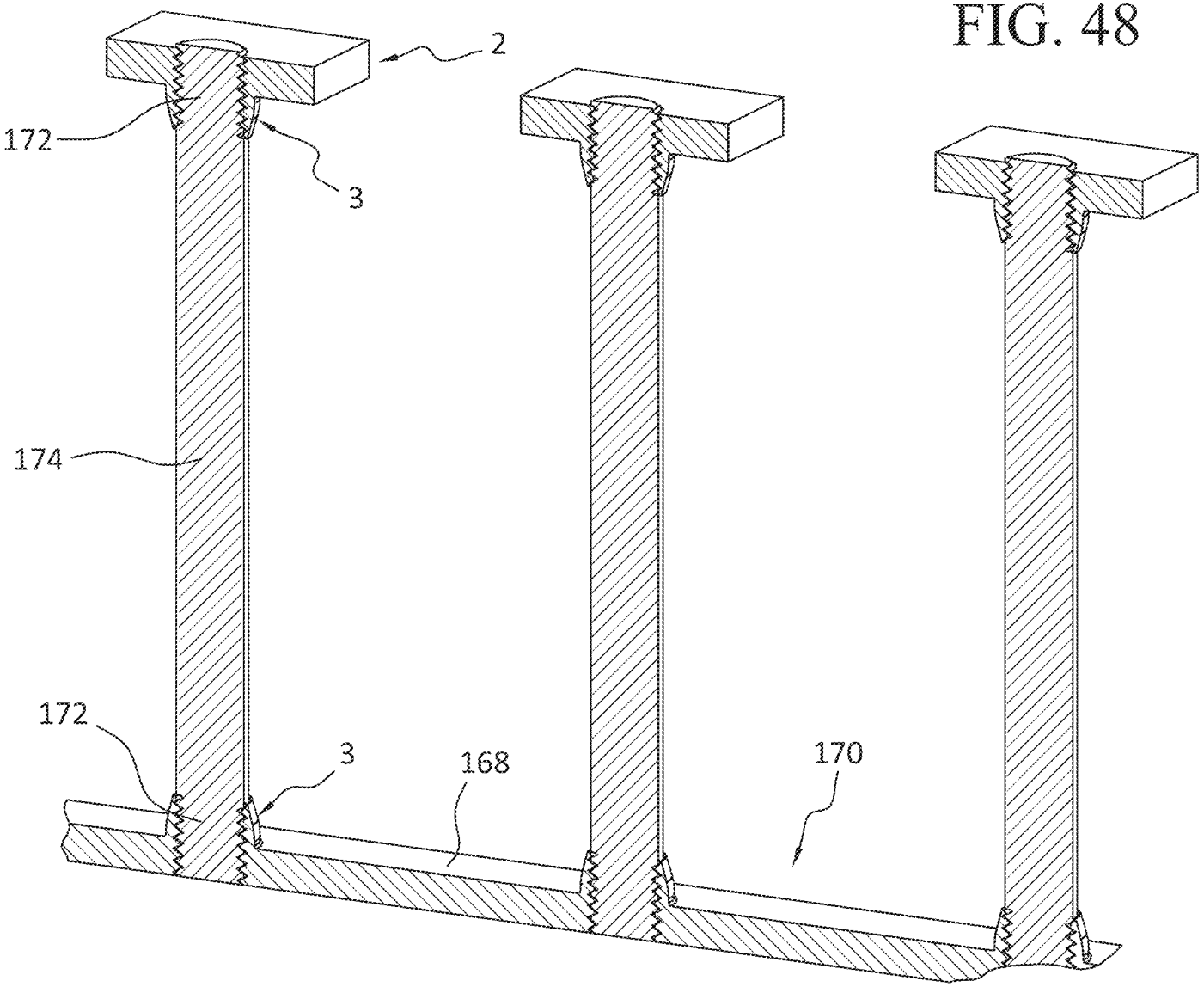

Referring to FIG. 48, the anchor plates 2 are threaded to the end portion 172 until they reach the end of the thread of the end portions 172. The end portions 172 are threaded so that all the thread of the boss openings 3 are engaged.

Figure 49:
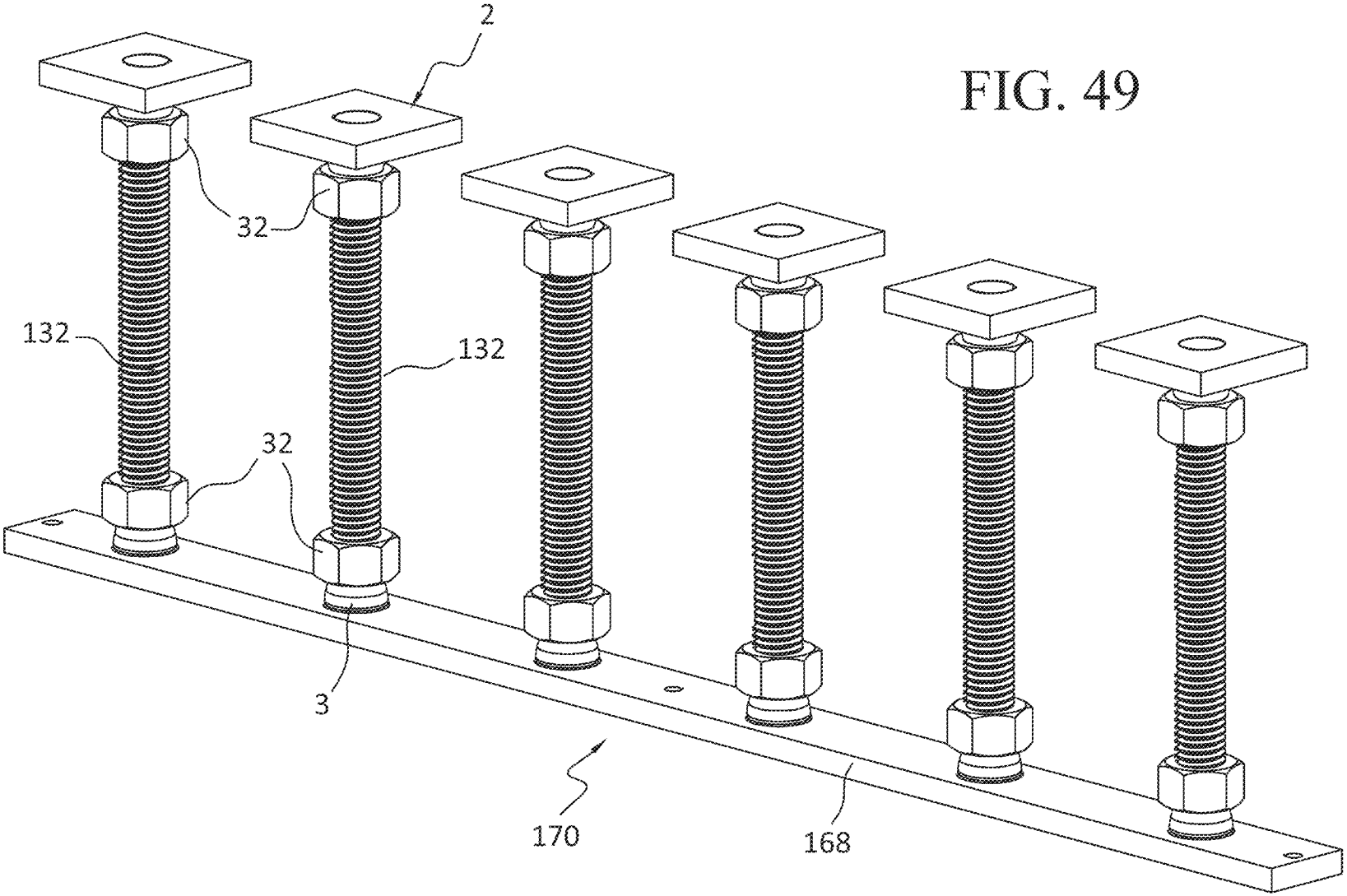

Referring to FIG. 49, hex nuts 32 are used to lock the stud bolts 132 to the plate 168 and the anchor plates 2 to the stud bolts 132.

Figure 50:
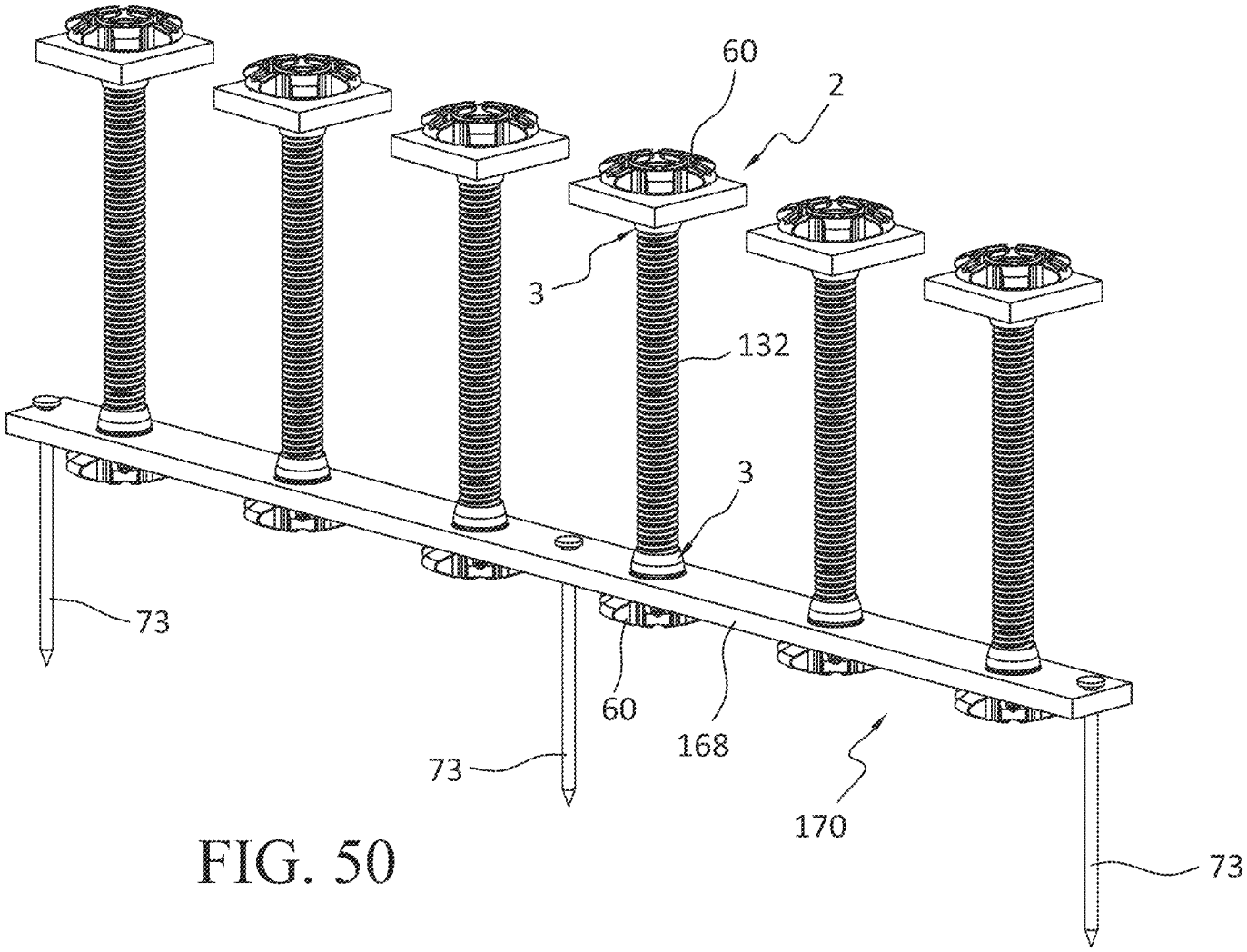

Referring to FIG. 50, the stud bolts 132 are threaded to the metal plate 168 so as to extend below the plate 168 in the same manner shown in FIG. 18. The stud bolts 132 are also threaded to the anchor plates 2 so as to extend above the anchor plates 2 in the same manner as shown in FIG. 10. The plastic nuts 60 are threaded to the extending end portions of the stud bolts 132 to advantageously lock the stud bolts 132 to the plate 168 and the anchor plate 2. The thread engagement of the plastic nuts 60 with the stud bolts 132 ensure that there is full thread engagement between the threaded boss openings 3 and the stud bolts 132. Nails 73 are used to attach the stud rail 170 to the formboard. The plastic nuts 60 below the plate 168 advantageously elevate the plastic 168 above the formboard so that the wet concrete is able to flow underneath the plate 168 and seals it from the atmosphere that can cause corrosion.

Figure 51:
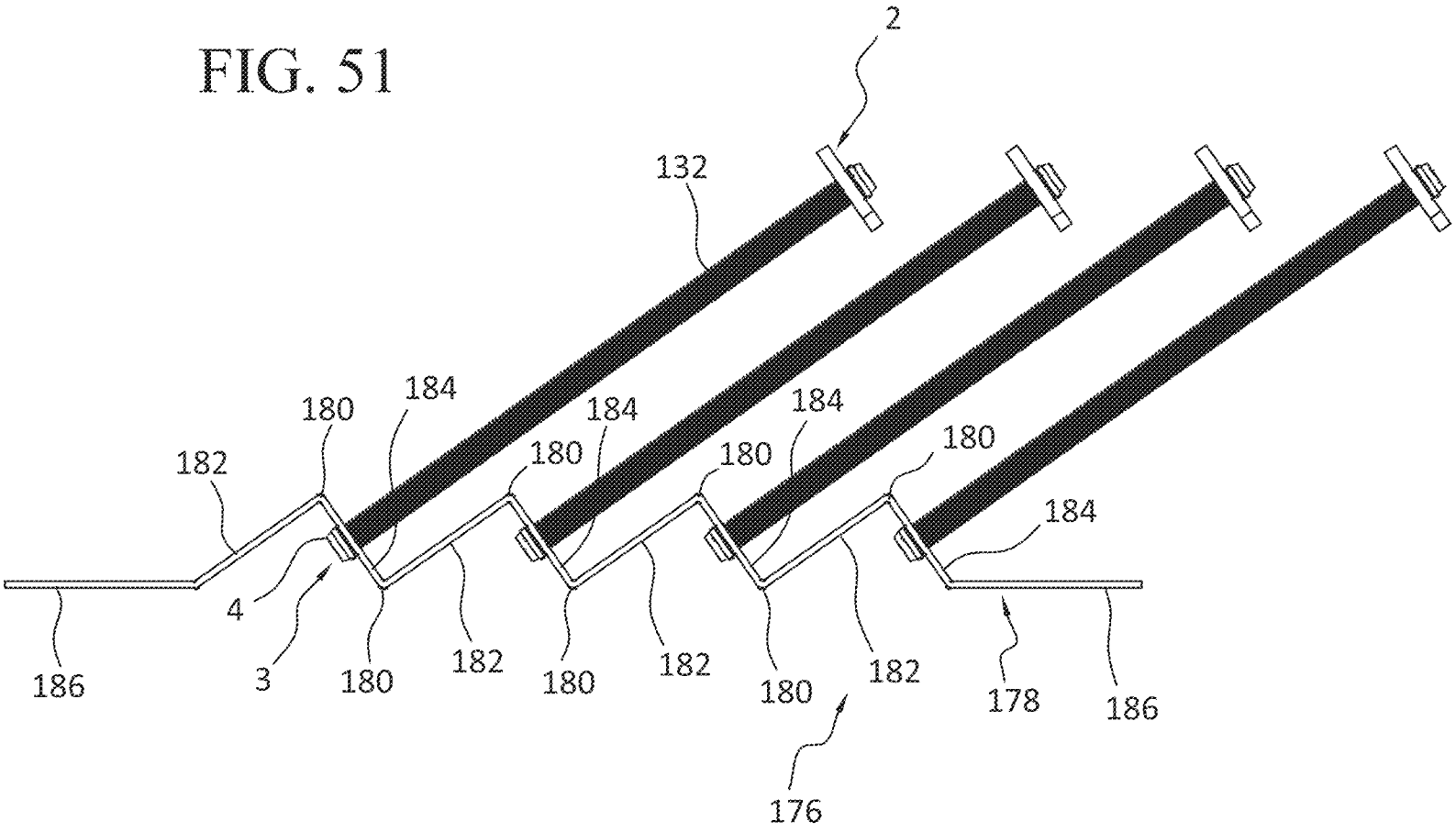

Referring to FIG. 51, the stud rail 170 shown in FIG. 45 is modified as stud rail 176 with a saw-tooth shaped metal plate 178 with alternating bends 180, for example 90°. The plate 178 has ascending portions 182 and descending portions 184. The descending portions 184 are provided with threaded boss openings 3 with the boss sections 4 disposed below. The stud bolts 132 threaded to the threaded boss openings 3 to position the stud bolts 132 at an angle with respect to the horizontal end portions 186. The orientation of the stud bolts 132 will be dependent on the specific application of concrete reinforcement. The bends 180 may be changed to more or less than 90° to change the angle of the stud bolts 132 with the horizontal end portions 186. The threaded boss openings 3 in the plate 178 may also be changed so that the boss sections 4 are on the top side of the descending portions 184. The threaded boss openings 3 in the plate 178 may also be disposed in the ascending portions 182, depending on the desired angle of the stud bolts 132 with the horizontal end portions 186.

Figure 52:
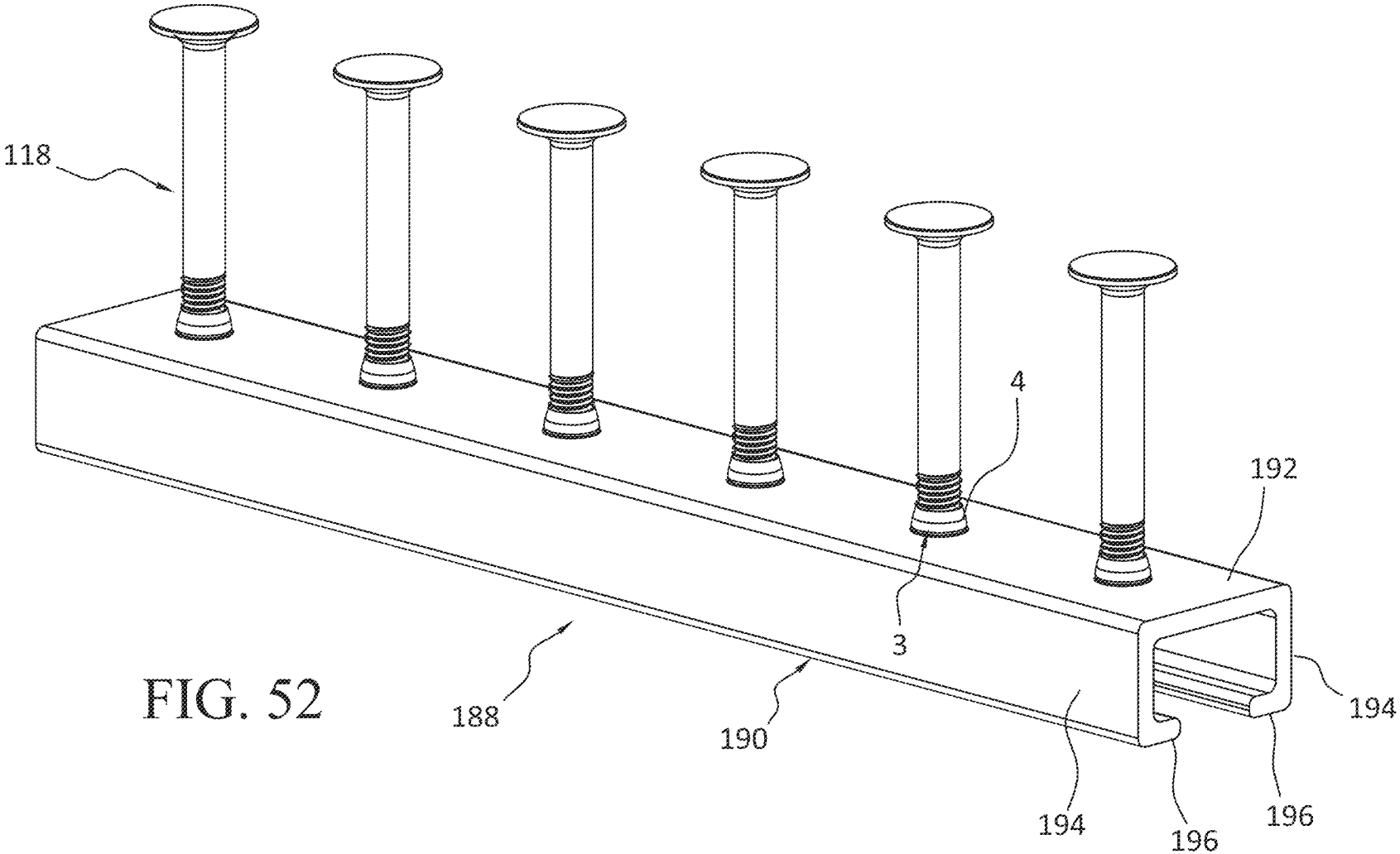

Referring to FIG. 52, the stud rail 166 shown in FIG. 44 is modified as stud rail 188 with a C-shaped channel member 190. The member 190 includes a base wall 192, side walls 194 and lip walls 196. Threaded boss openings 3 are provided in the base wall 192 with the boss sections 4 extending outwardly.

Figure 53:
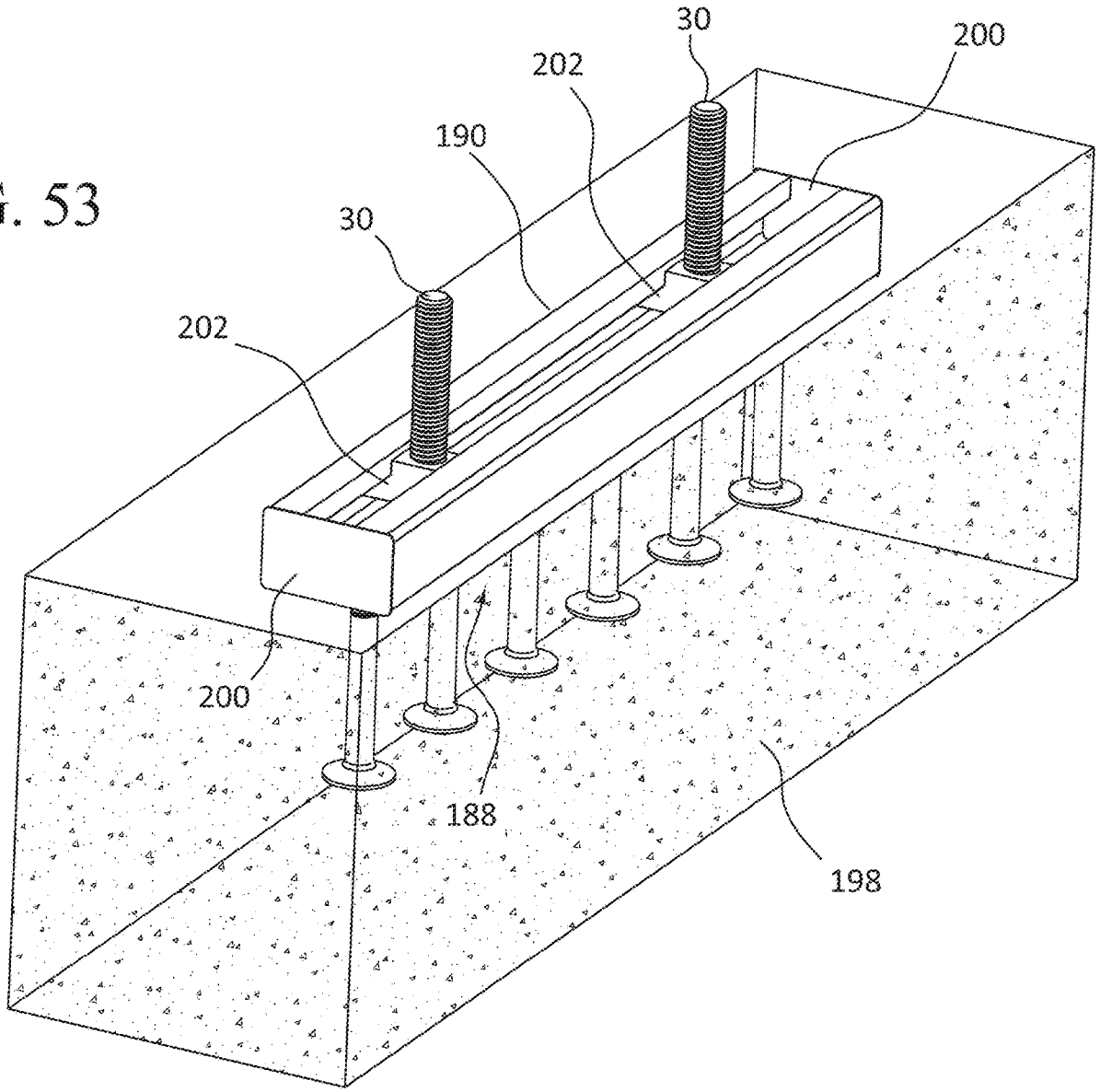

Referring to FIG. 53, the stud rail 188 is embedded in concrete 198. The ends of the channel member 190 are sealed with tapes 200 to prevent the wet concrete from flowing into the channel member 188. Square nuts 202 are captured inside the channel member 190. Anchor bolts or rods 30 are threaded to the square nuts 202. The square nuts 202 are slidable within the channel member 190 to advantageously adjust the positions of the anchor bolts or rods 30 prior to connection to a load.

Figure 54:
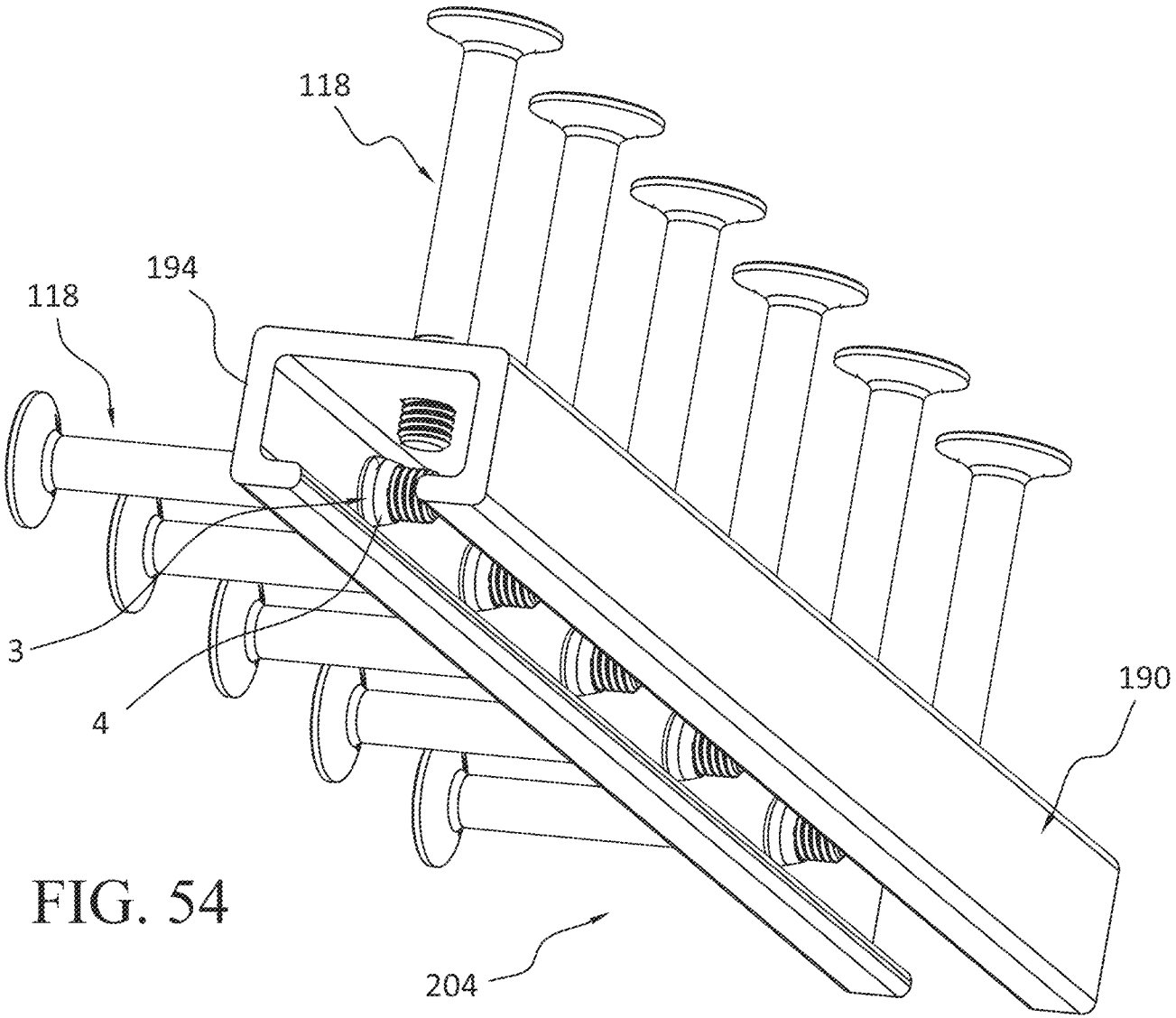

Referring to FIG. 54, the stud rail 188 shown in FIG. 52 is modified as stud rail 204. The channel member 190 is provided with another row of anchor studs 118 along the side wall 194. The two rows of anchor studs 118 are preferably 90° to each other. Threaded boss openings 3 are provided on the side wall 194 with the respective boss sections 4 disposed inside the channel member 190.

Figure 55:
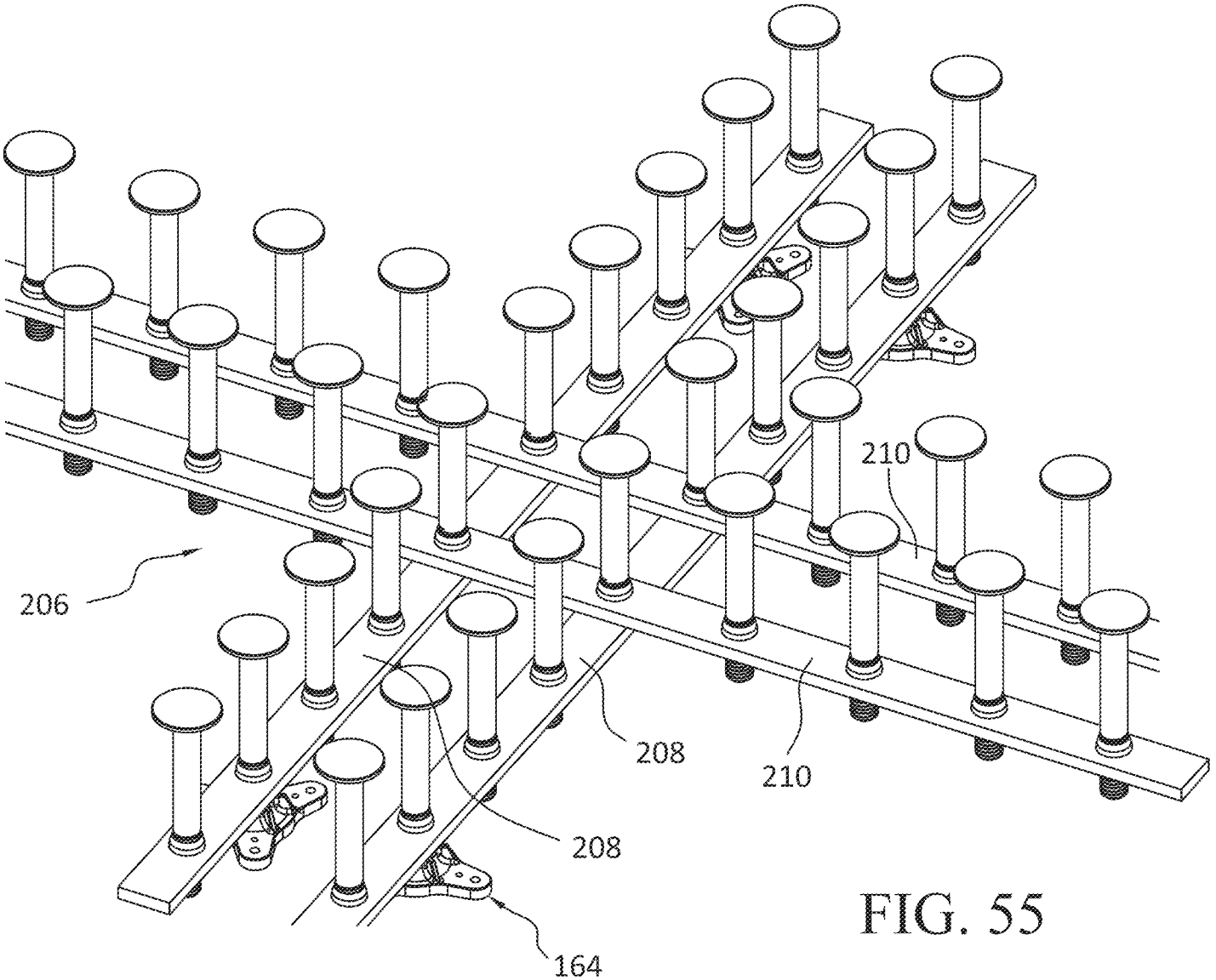

Referring to FIG. 55, the stud rail 166 shown in FIG. 44 may be configured into a stud rail system 206. It should be understood that the other embodiments of the stud rails disclosed herein may be assembled into a system as desired. Plastic supports 164 may be used to elevate the system 206 above the formboard to seal the system 206 inside the concrete structure and prevent exposure to the atmosphere that can cause corrosion. The lower longitudinal plates 208 where they cross the upper longitudinal plates 210 are provided with threaded boss openings 3 with the boss sections pointing downwardly as, for example, shown in FIG. 37 to allow the anchor stud 118 to secure the plates 208 and 210 together.

Figure 56:
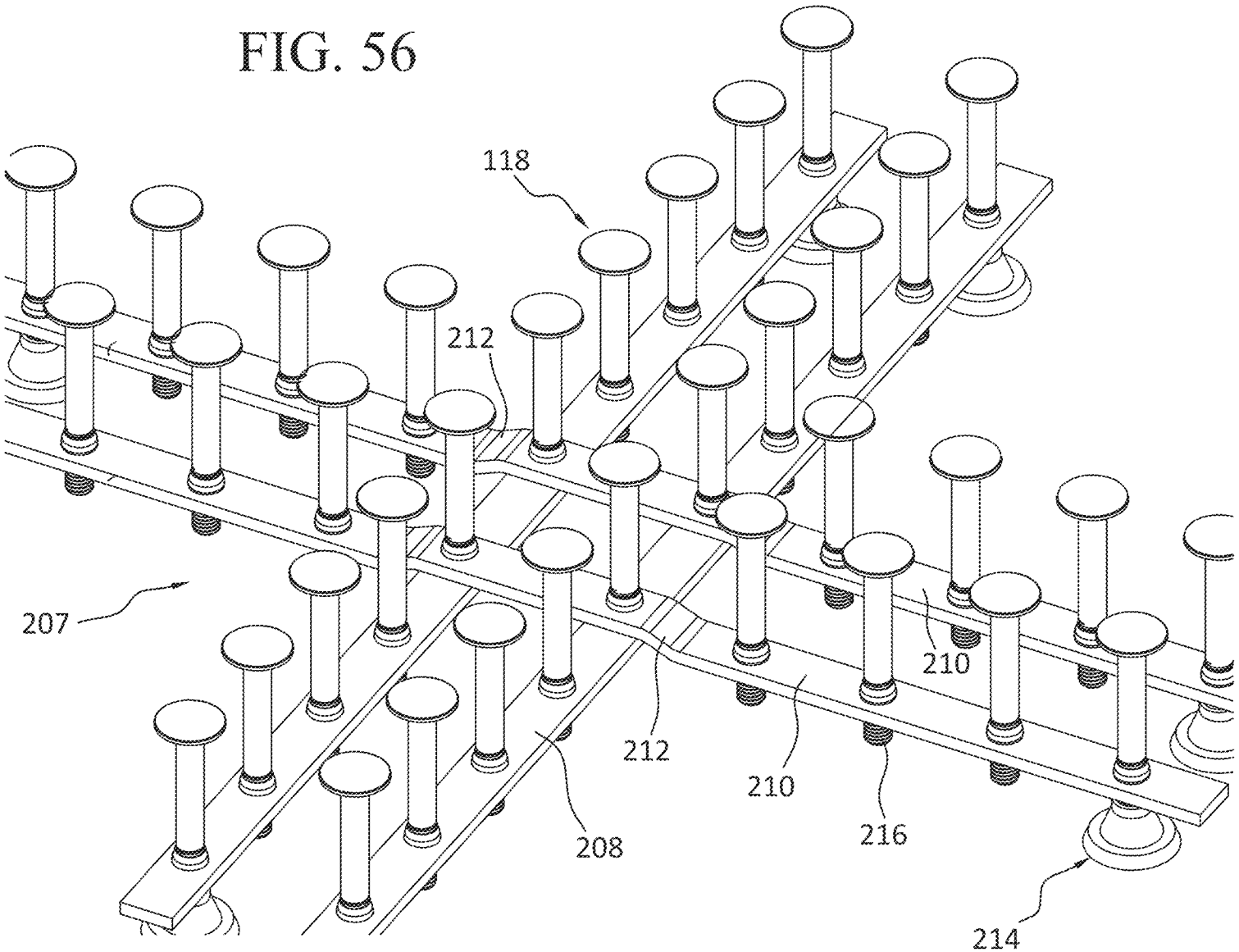
Figure 57:
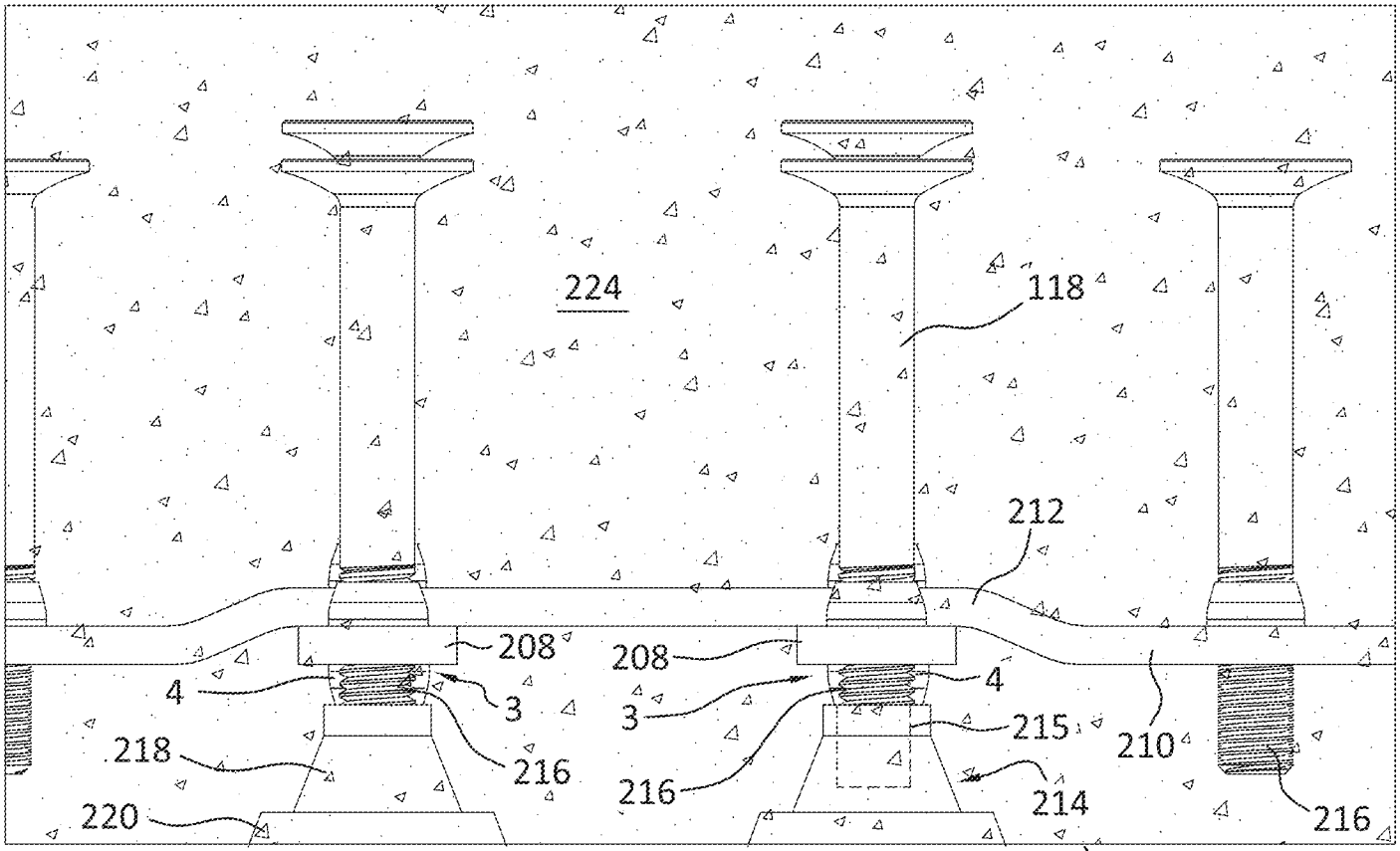

Referring to FIGS. 56 and 57, the stud rail system 206 is modified as stud rail system 207 with the upper plates 210 are bent at 212 so that the anchor studs 118 will be at the same level except for the four anchor studs at the intersections of the upper plates 210 and the lower plates 208. The anchor studs 118 extend below the plate 208 and 210 in the same manner shown in FIG. 18. Plastic supports 214 include respective central blind holes 215 into which the extending end portions 216 are threaded. The support 214 includes a conical body 218 disposed on a base 220 with conical side 222. The stud rail system 207 is shown embedded in concrete 224 with a bottom surface 226 defined by the formboard which has been removed. The supports 214 advantageously elevates the stud rail system 207 above the formboard to allow the fresh concrete to flow below the plates 210 and 212.

Figure 58:
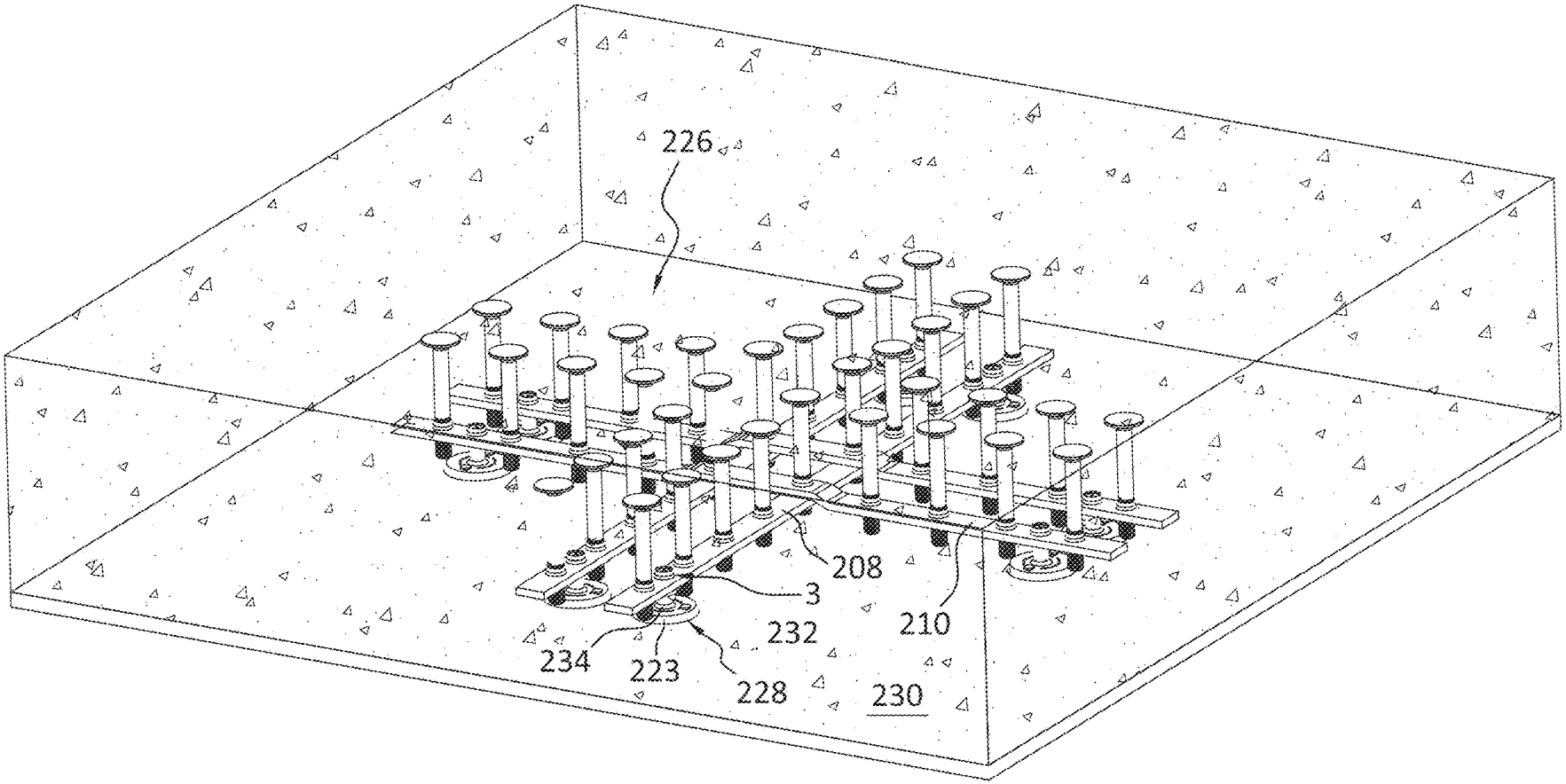
Figure 59:
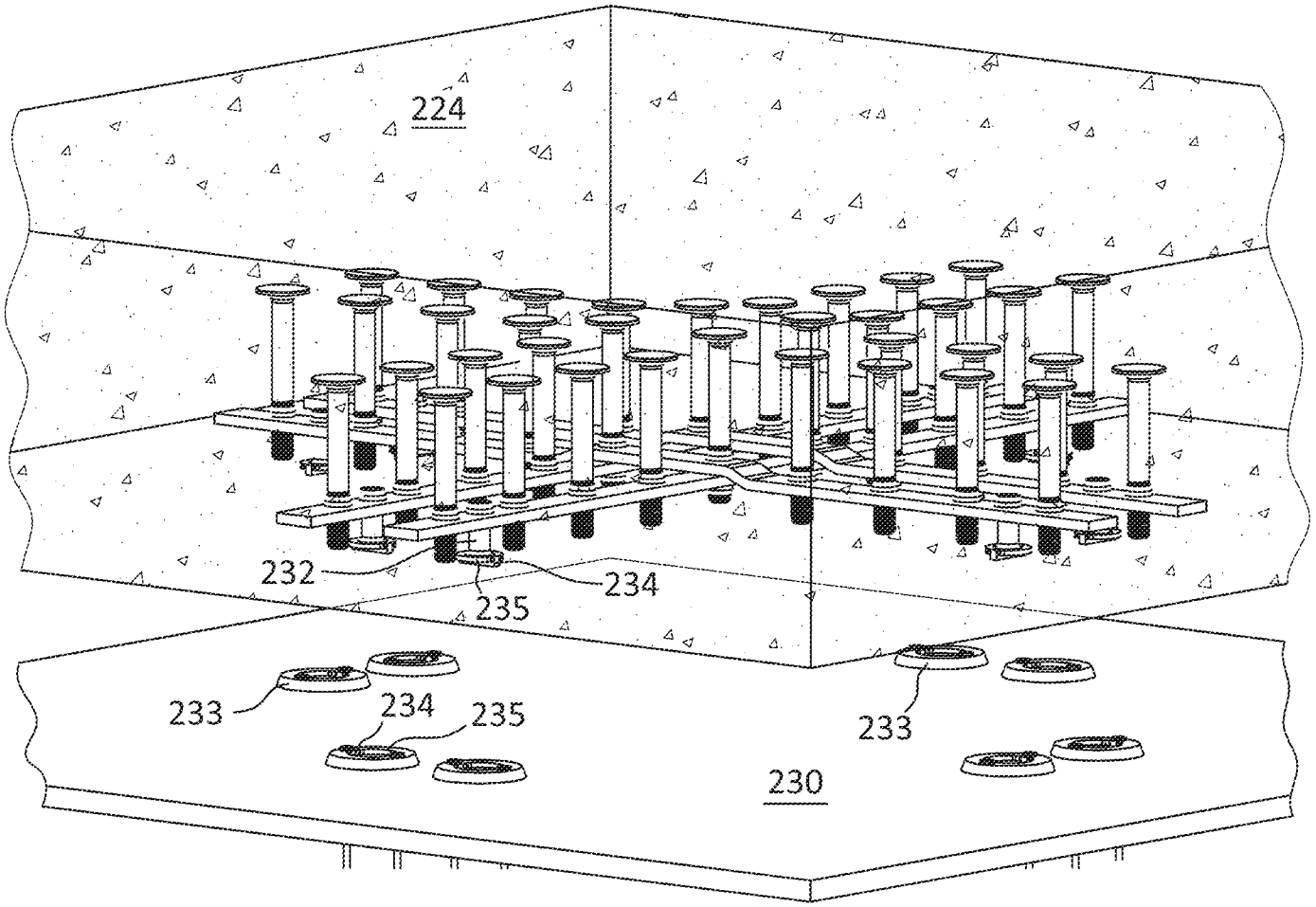

Referring to FIGS. 58 and 59, the stud rail system 207 is modified as stud rail system 227 shown with supports 228 nailed to the formboard 230. The support 228 includes a plug portion 232 for threaded connection with the threaded boss opening 3 in plates 208 and 210. The plug portion 232 is attached to a base portion 233 with thinned portions 234 at the ends of two semi-circular slits 235 that extend through the thickness of the base portion 233. The thinned portions 234 are configured to be breakable when the formboard is separated from the cured concrete 224, thereby allowing the nails to remain with the formboard. The plug portion 232 remains attached to the stud rail system 227.

Figure 60:
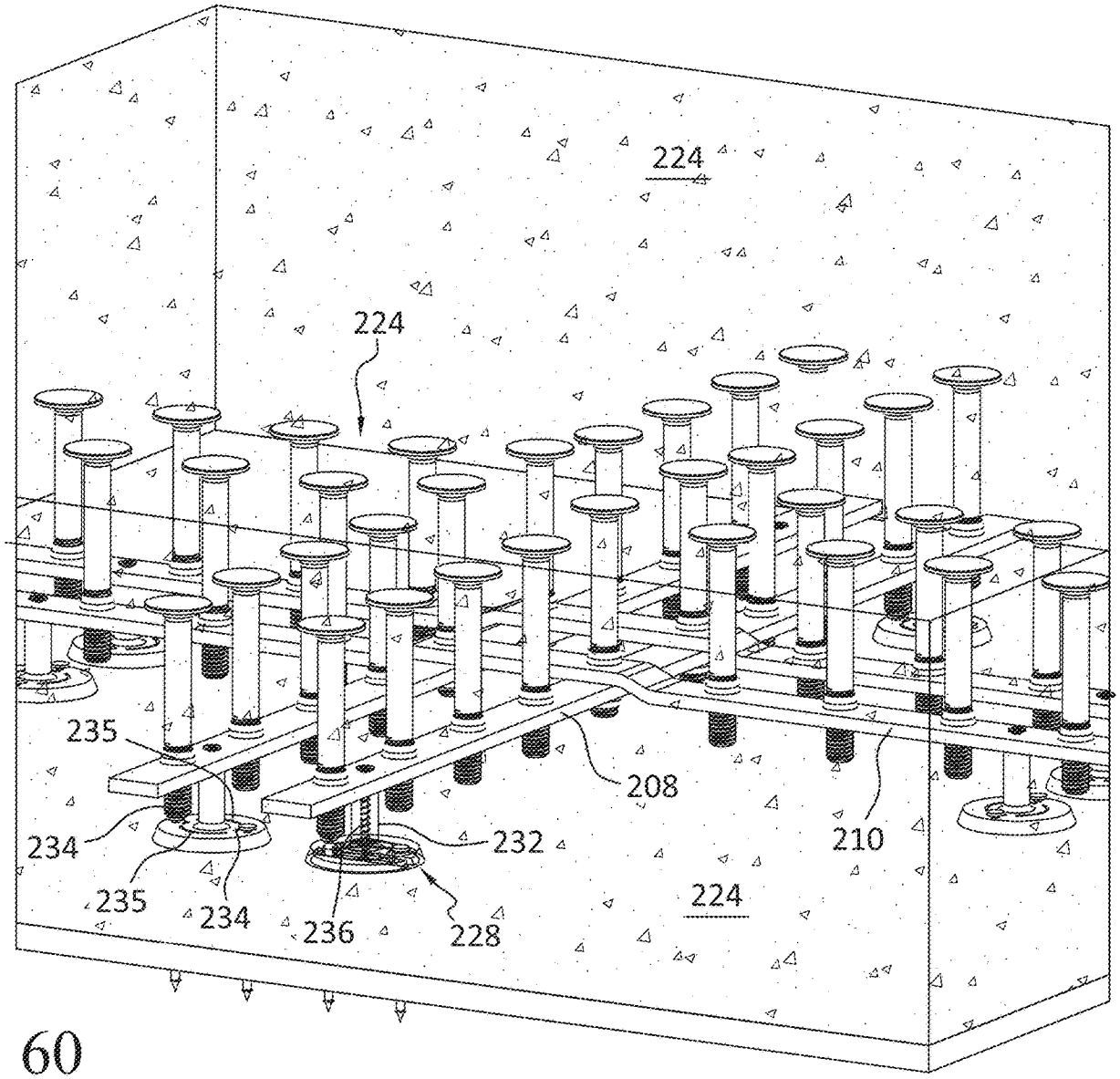
Figure 61:
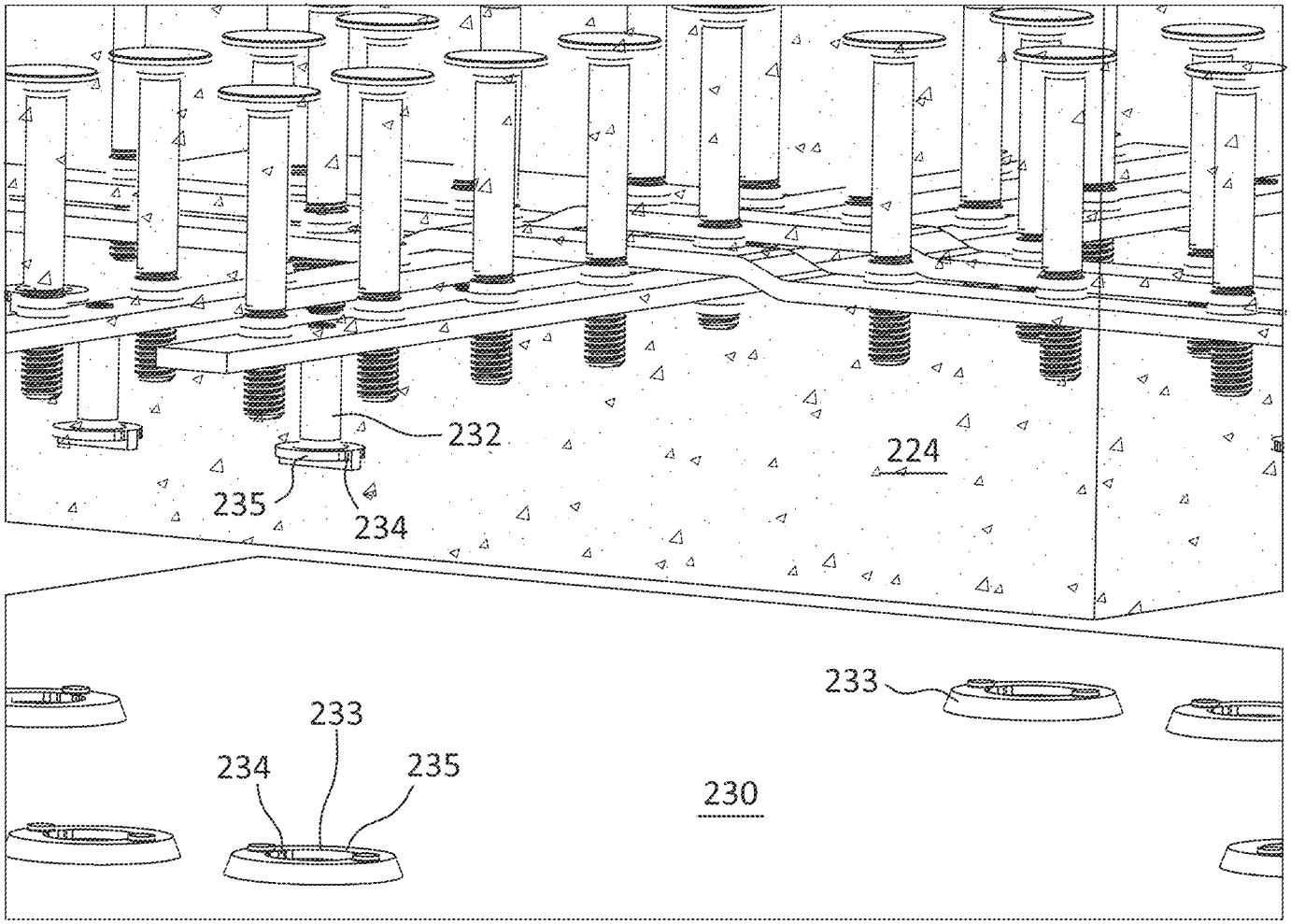

Referring to FIGS. 60 and 61, the supports 228 are screwed to the plates 208 and 210 with screws 236 that do not penetrate the base portion 233, keeping the stud rail system sealed in concrete.

Figure 62:
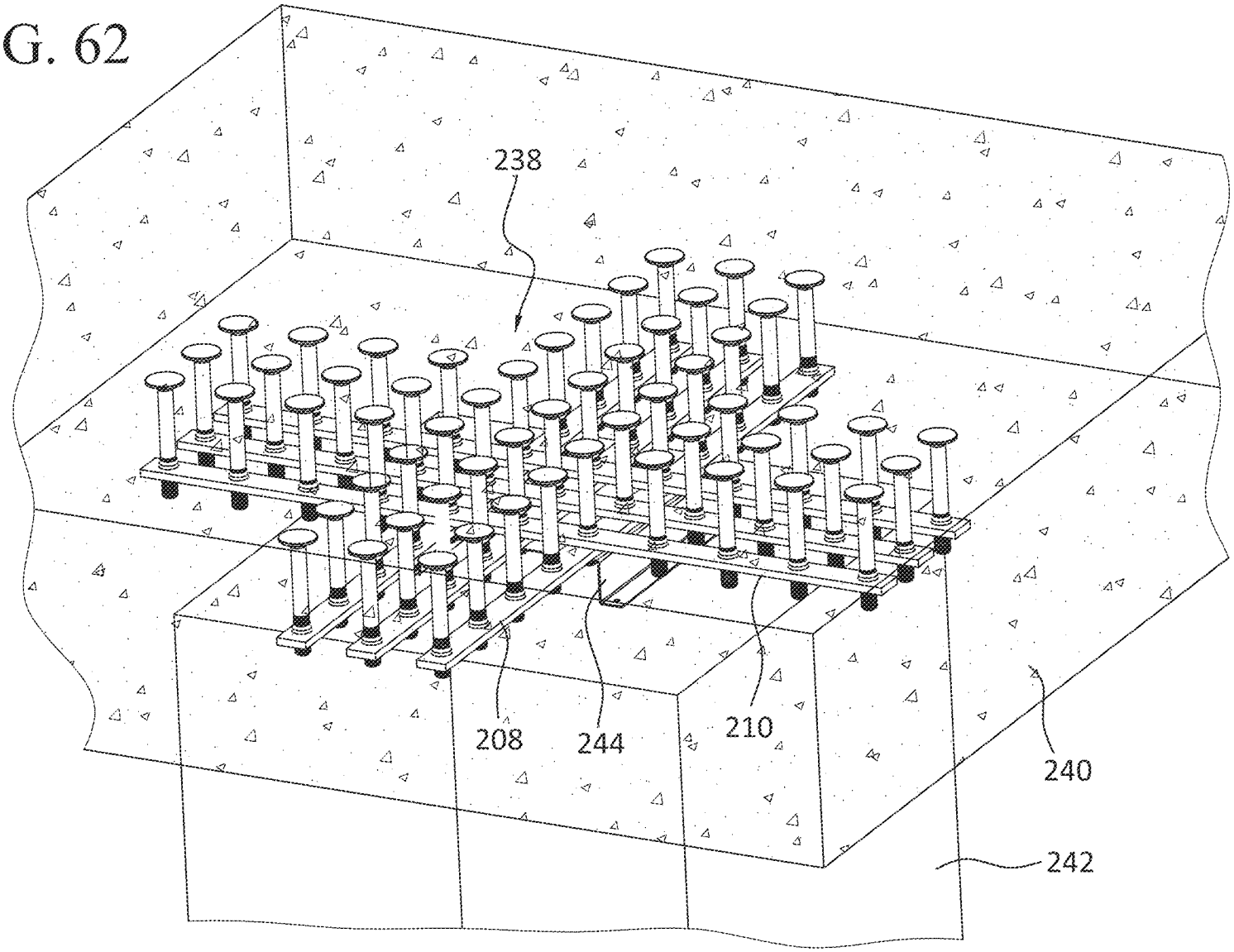

Referring to FIG. 62, a stud rail system 238 similar to the stud rail system 206 is shown embedded in a concrete slab 240 above a concrete column 242. The use of the stud rail system 238 advantageously eliminates the need for column heads or drop panels to reinforce the slab to column connection to prevent column punch-through. The stud rail system 238 is supported above the formboard by a support 244 similar in shape as the support 66 shown in FIG. 15. The support 244 includes a base portion large enough to accommodate the area covered by the intersection of the lower longitudinal plates 208 and the upper longitudinal plates 210.

Figure 63:
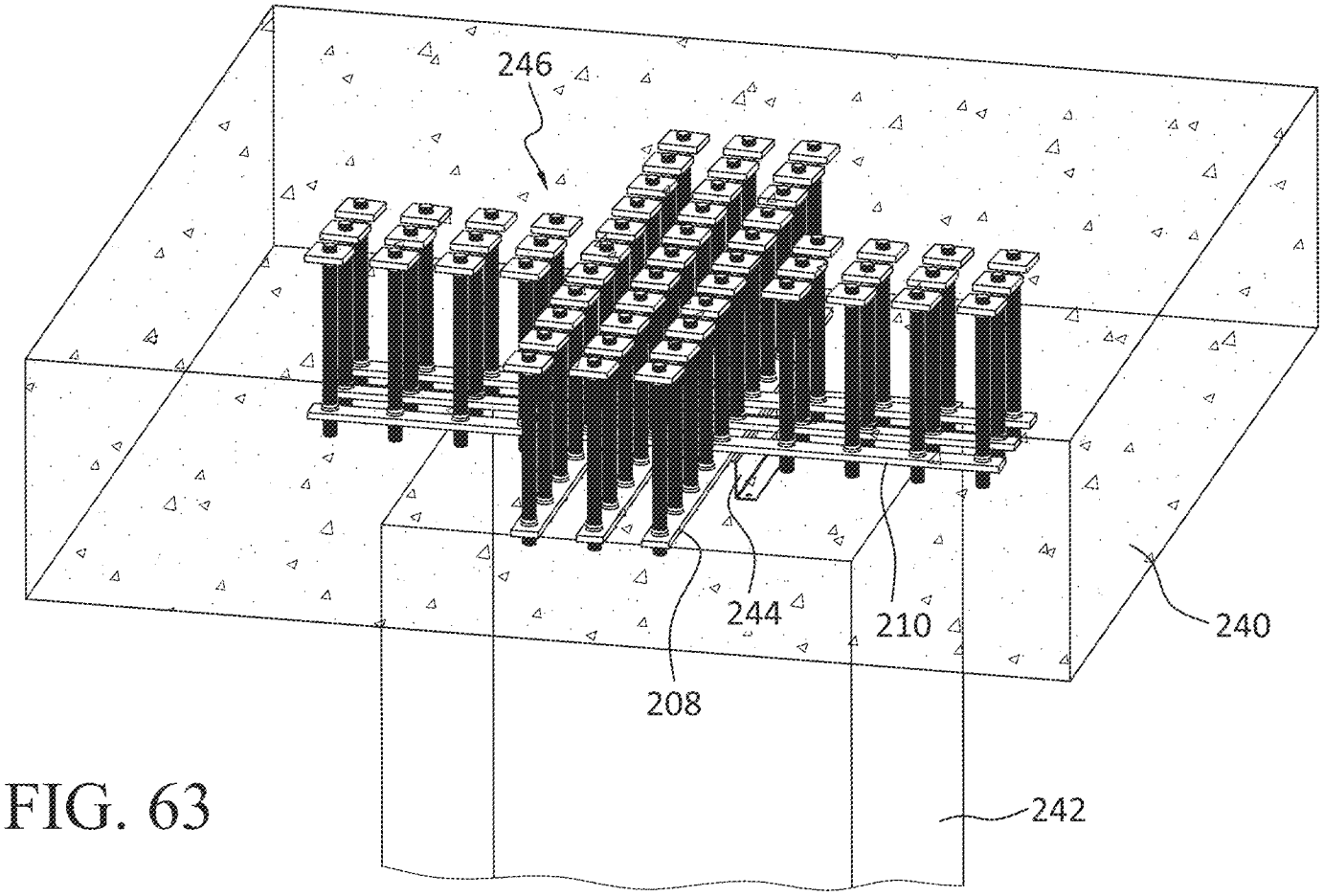

Referring to FIG. 63, a stud rail system 246 is made up of several units of the stud rail 170 shown in FIG. 46. The stud rail system 246 is shown embedded in a concrete slab 240 above a concrete column 242. The use of the stud rail system 246 advantageously eliminates the need for column heads or drop panels to reinforce the slab to column connection to prevent column punch-through. The stud rail system 238 is supported above the formboard by the support 244 shown in FIG. 62. The support 244 includes a base portion large enough to accommodate the area covered by the intersection of the lower longitudinal plates 208 and the upper longitudinal plates 210.

Figure 64:
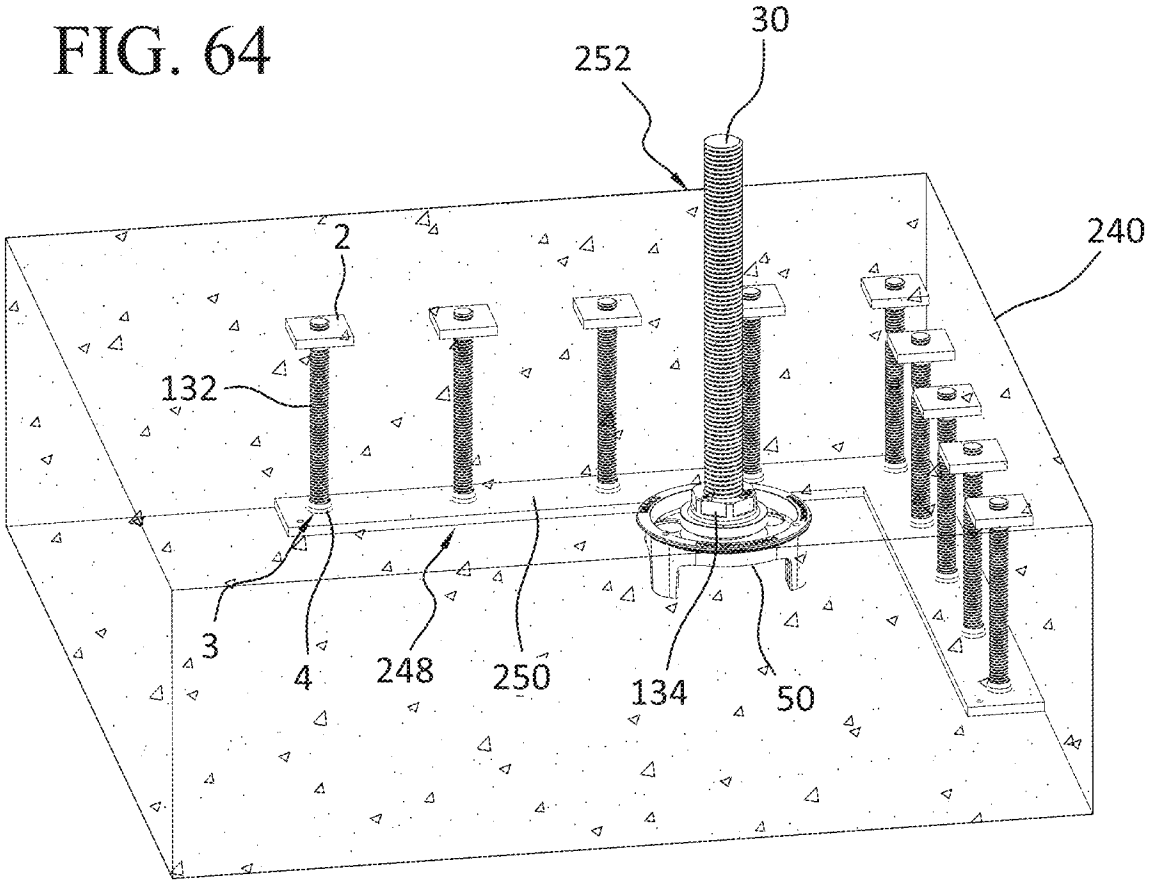
FIGS. 64-88 show several anchor assemblies for being embedded in concrete, using stud rail assemblies for reinforcement.

Referring to FIG. 64, the stud rail 170 shown in FIG. 46 is configured into a geometric-shaped stud rail, such as L-shaped stud rail 248 to reinforce an edge or corner of a slab 240. The stud rail 248 has a plurality of stud bolts 132 attached to an L-shaped plate 250 provided with threaded boss openings 3 with the boss section 4 on the top surface of the plate 250. Anchor plates 2 with downward directed threaded boss openings 3 are attached to respective stud bolts 132.

An anchor assembly 252 is disposed in the inside corner of the L-shaped stud rail 248. The anchor assembly 252 includes a plastic support 50, an anchor rod 30 threaded to a threaded central opening in the support 50 and an anchor body 134. The support 50 is also shown in FIG. 42.

Figure 65:
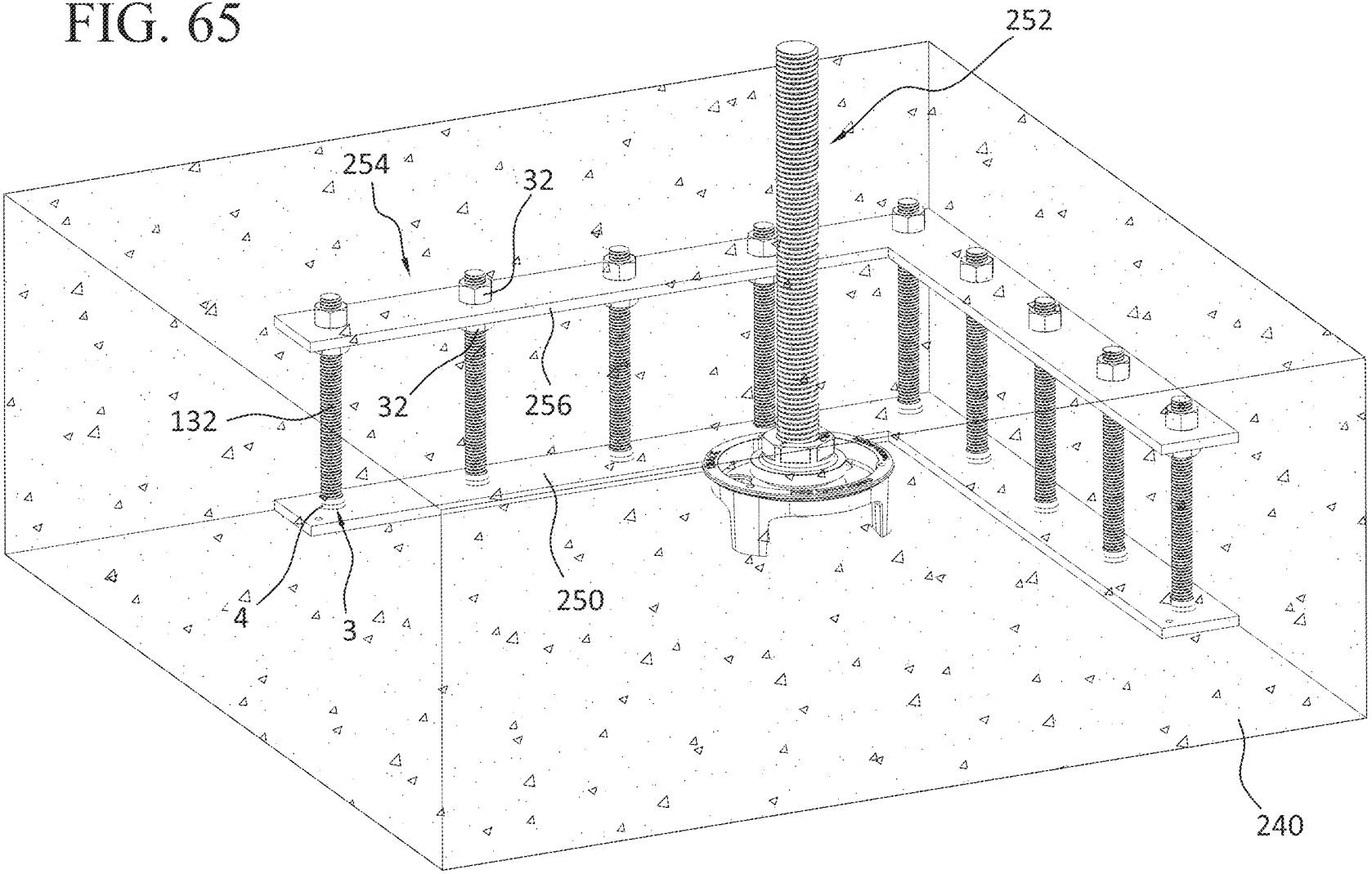

Referring to FIG. 65, the stud rail 248 shown in FIG. 64 is modified as stud rail 254 with the addition of another L-shaped plate 256 and the use of hex nuts 32 in place of the anchor metal plates 2. The hex nuts 32 secure the plate 256 to the stud bolts 132 above the plate 250.

Figure 66:
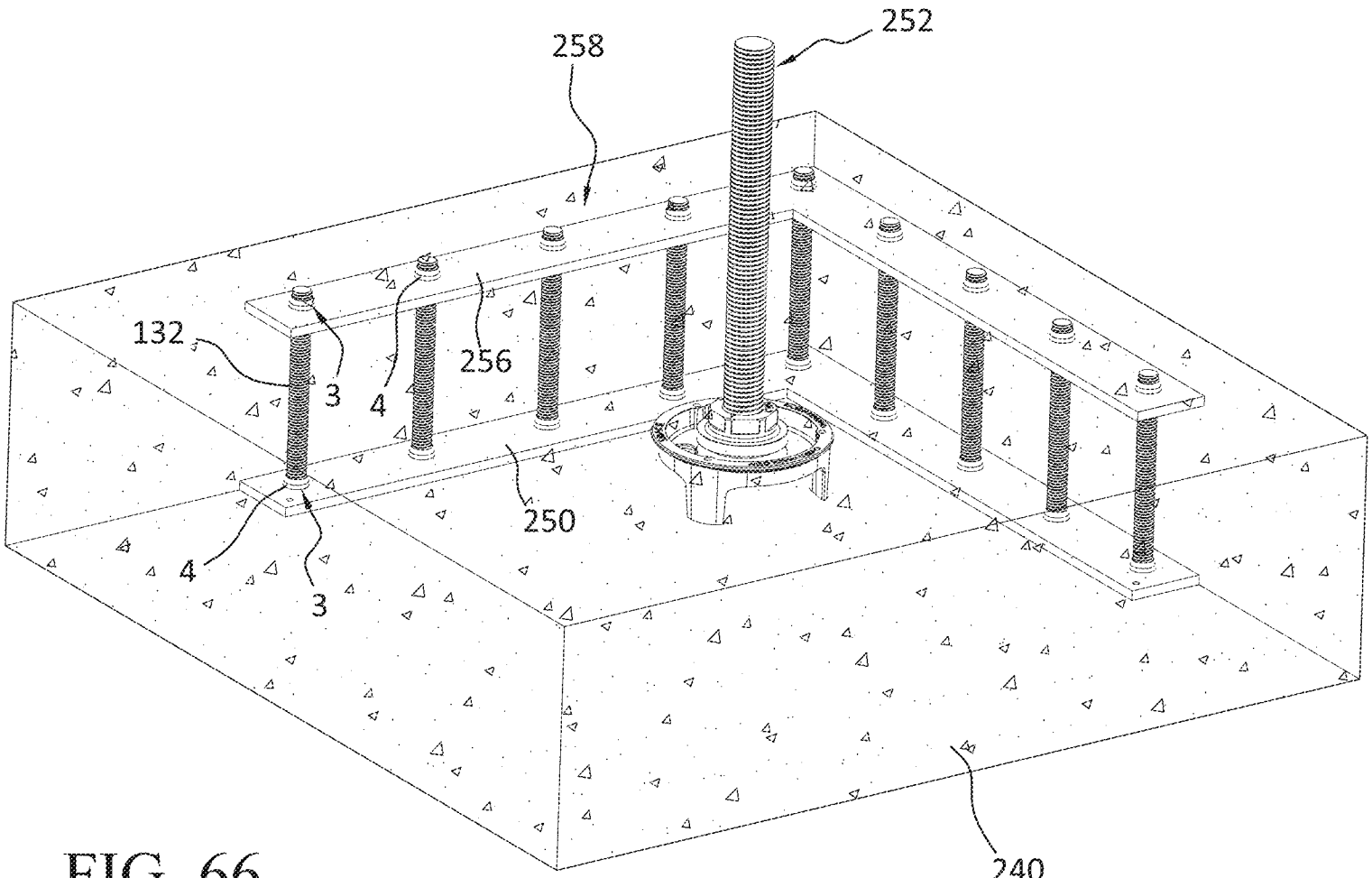

Referring to FIG. 66, the stud rail 254 shown in FIG. 65 is modified as stud rail 258 where the upper plate 256 is provided with threaded boss openings 3 in place of the hex nuts 32 for attaching to the stud bolts 132. The boss sections 4 face upwardly on the plates 250 and 256.

Figure 67:
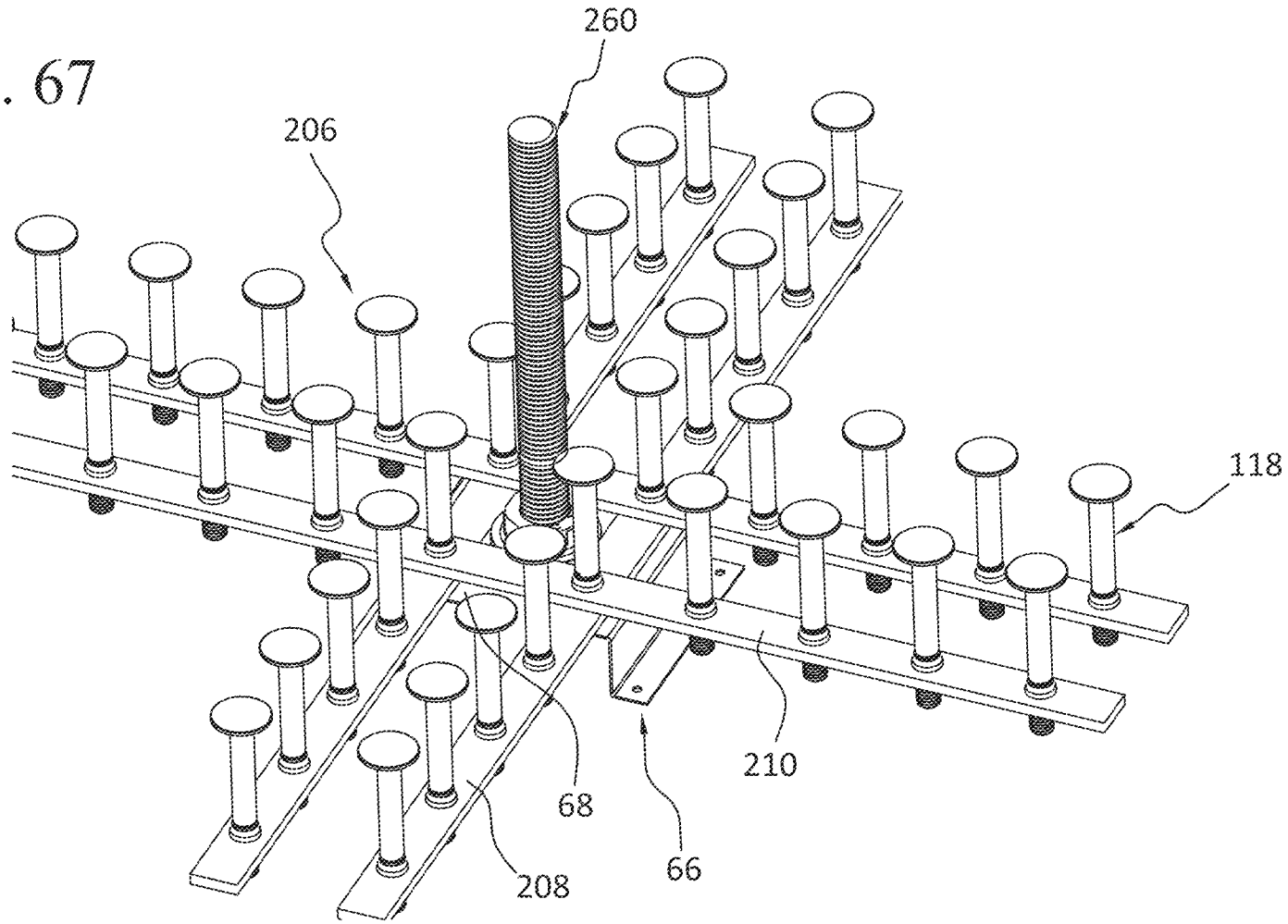

Referring to FIG. 67, an anchor assembly 260 is reinforced by the stud rail system 206 shown in FIG. 55. The anchor assembly 260 includes a support 66 (shown in FIG. 16), an anchor rod 30 threaded to the threaded boss opening 3 (shown in FIG. 16) and an anchor body 134. The anchor assembly 260 is disposed at the center of the stud rail system 206. The center portions of the lower plates 208 are supported by the base 68 of the support 66. The support 66 advantageously elevates the stud rail system 206 above the formboard so as to be completely embedded and sealed inside the concrete structure.

Figure 68:
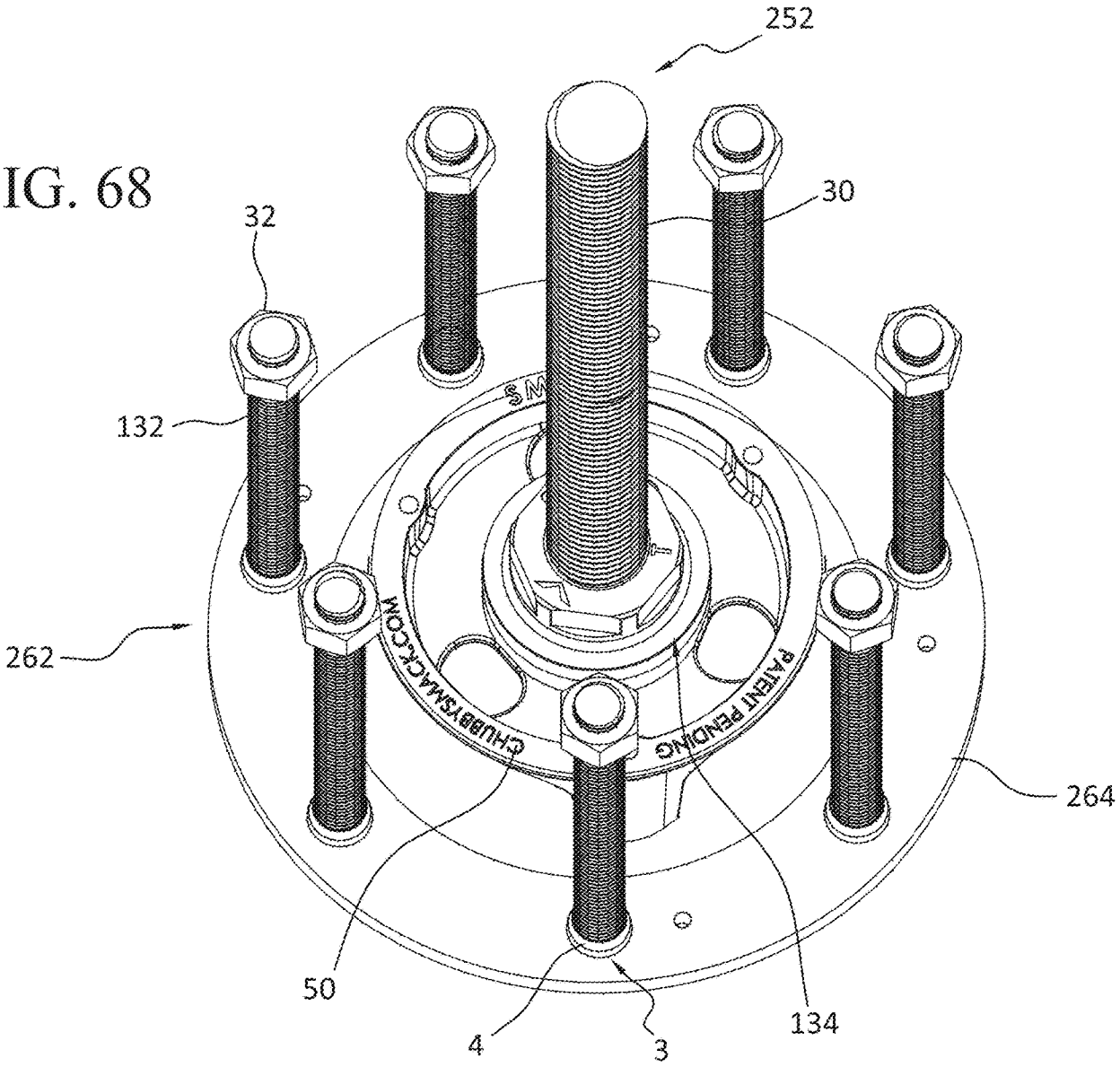

Referring to FIG. 68, the stud rail 248 shown in FIG. 64 is modified as a geometric-shaped stud rail, such as circular stud rail 262 to reinforce the anchor assembly 252. The stud rail 262 has a plurality of stud bolts 132 attached to a circular ring plate 264 provided with threaded boss openings 3 with the boss section 4 extending on the top surface of the ring plate 264. Hex nuts 32 are threaded to the upper end portions of the stud bolts 132. It should be understood that other anchor bodies disclosed herein may be used in place of the hex nuts, such as the anchor plate 2, the anchor bodies 134, etc.

Figure 69:
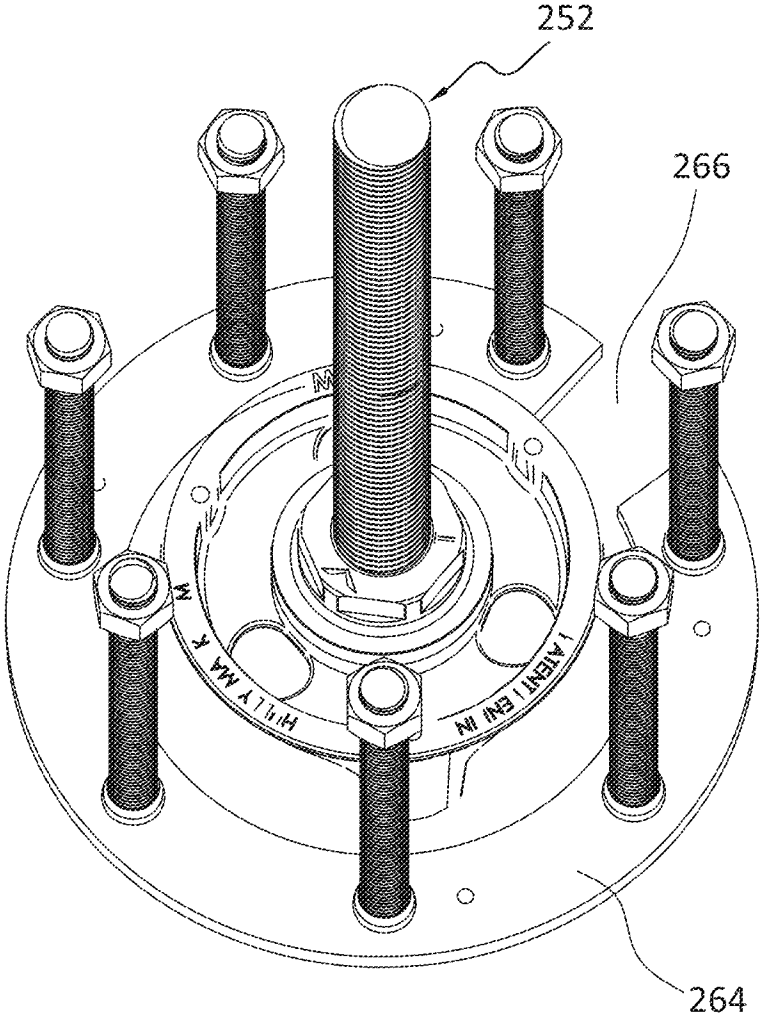

Referring to FIG. 69, the circular ring plate 264 is discontinuous with a cut-out 266.

Figure 70:
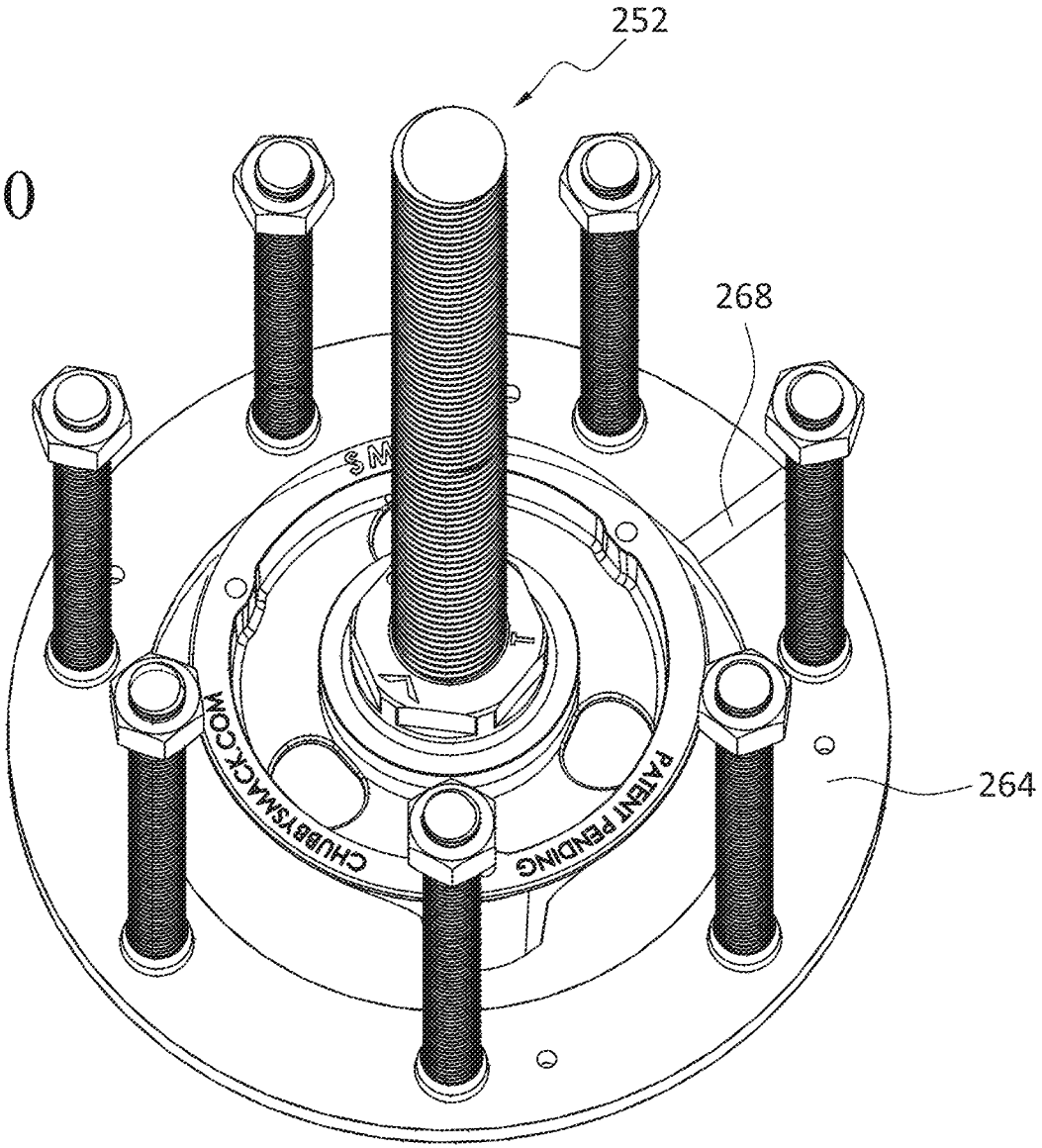

Referring to FIG. 70, the circular ring plate 264 is welded at 268 to provide a continuous circular ring plate 264.

Figure 71:
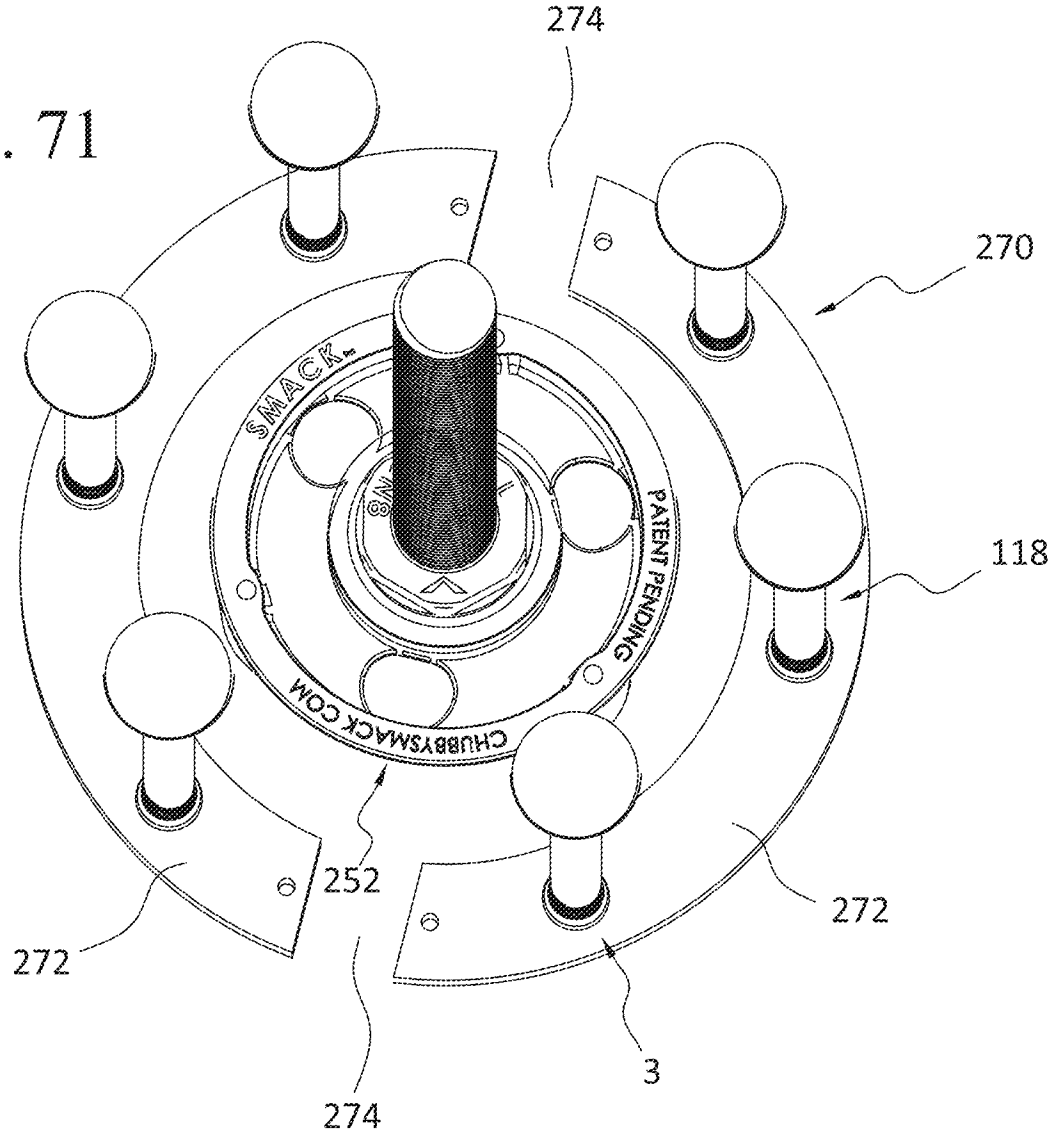

Referring to FIG. 71, the circular stud rail 262 shown in FIG. 68 is modified as stud rail 270 with semi-circular plates 272 provided with threaded boss openings 3. Anchor studs 118 are threaded to the threaded boss openings 3. The semi-circular plates 272 preferably have the same radius so that when arranged as shown with gaps 274 will have a common center. The anchor assembly 252 is disposed in the center of the plates 272.

Figure 72:
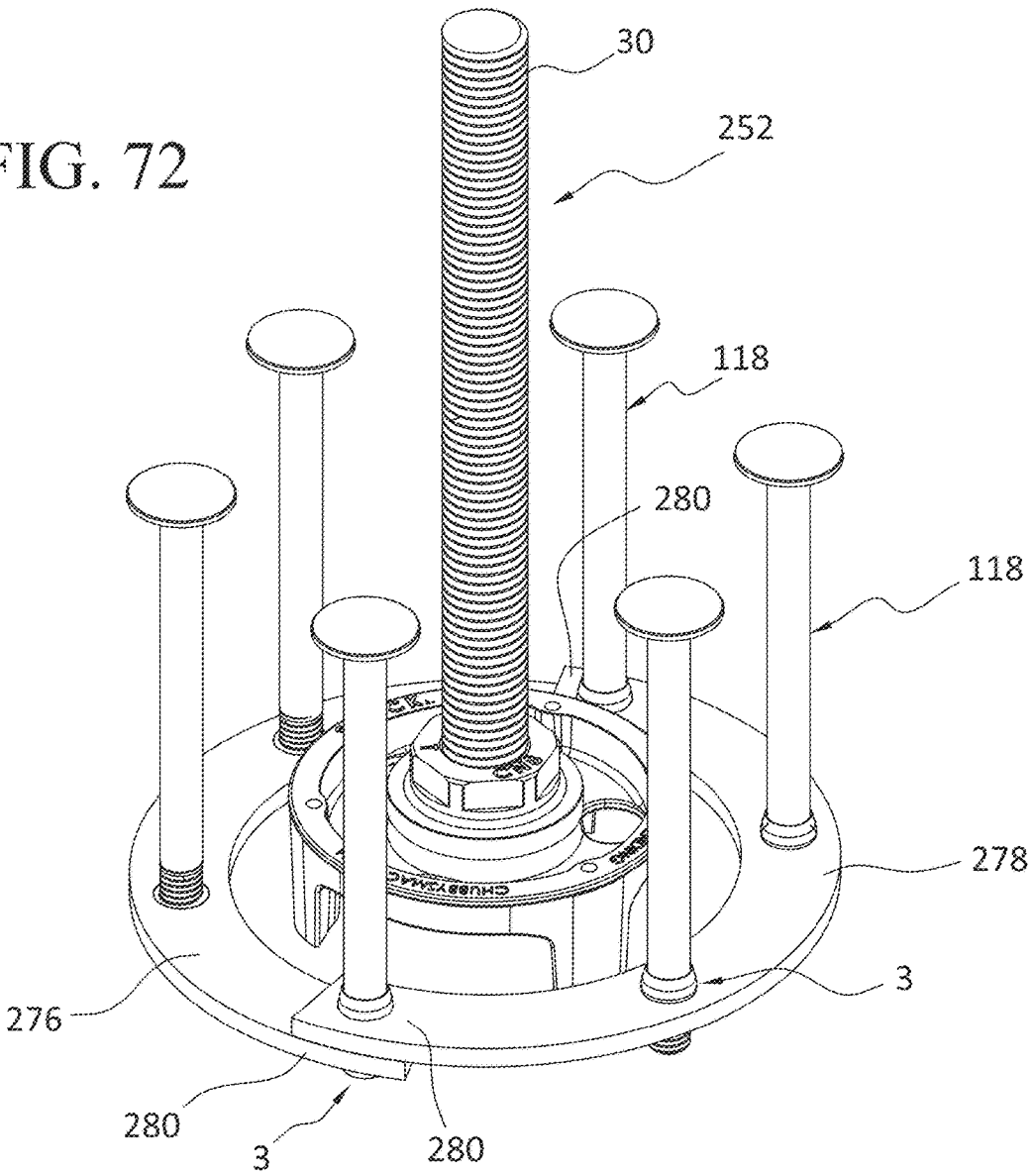

Referring to FIG. 72, semi-circular plates 276 and 278 have overlapping end portions 280 joined together by two of the anchor studs 118. The lower plate 276 includes the threaded boss openings 3 with the boss sections directed downwardly. The upper plate 276 has the threaded boss openings 3 with the boss sections 4 pointing upwardly.

Figure 73:
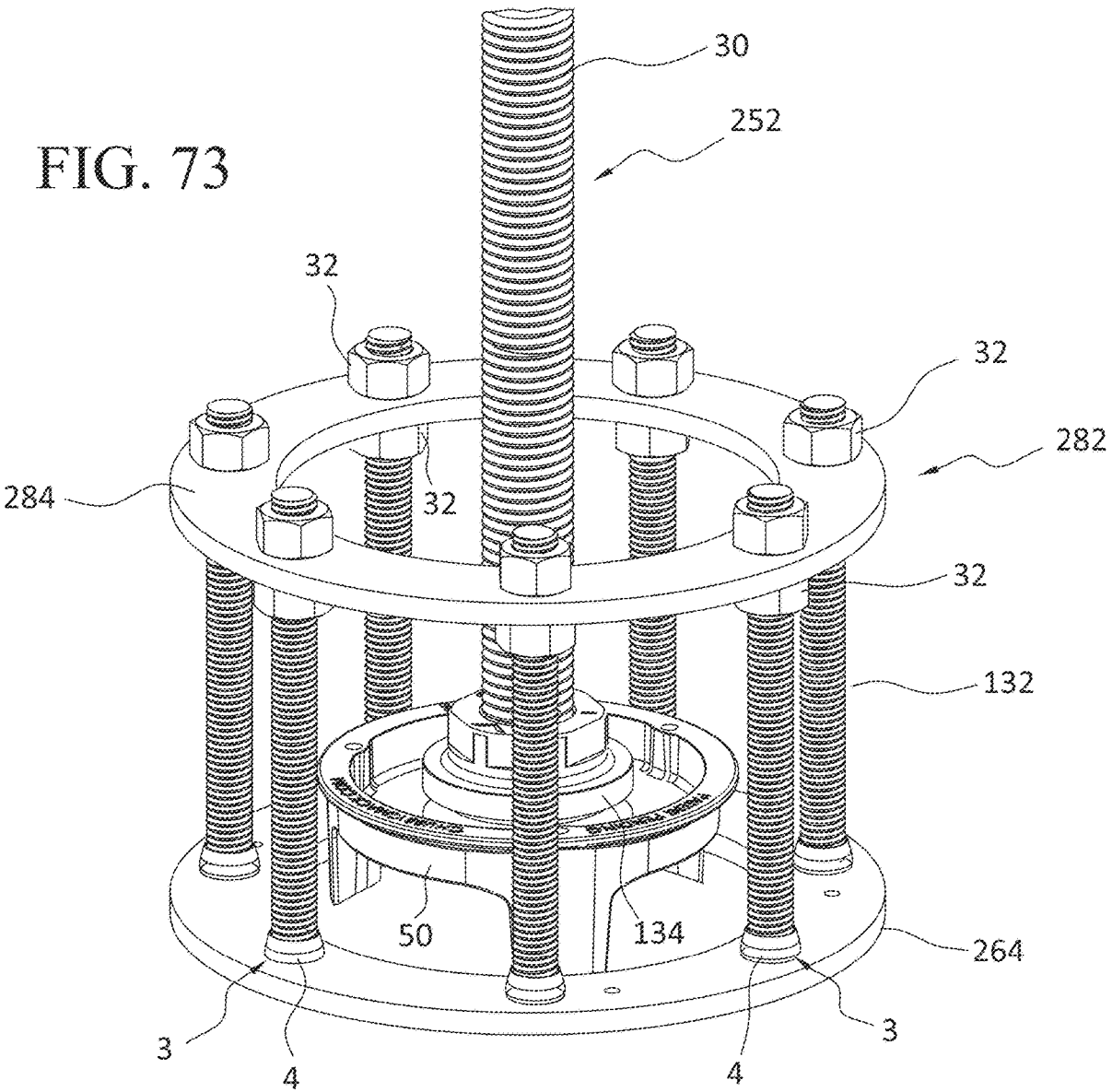

Referring to FIG. 73, the stud rail 262 shown in FIG. 68 is modified as stud rail system 282. An upper circular ring plate 284 is attached to the upper end portions of the stud bolts 132 with hex nuts 32 above and below the plate ring 284. The anchor body 134 is disposed within the volume of the stud rail system 282.

Figure 74:
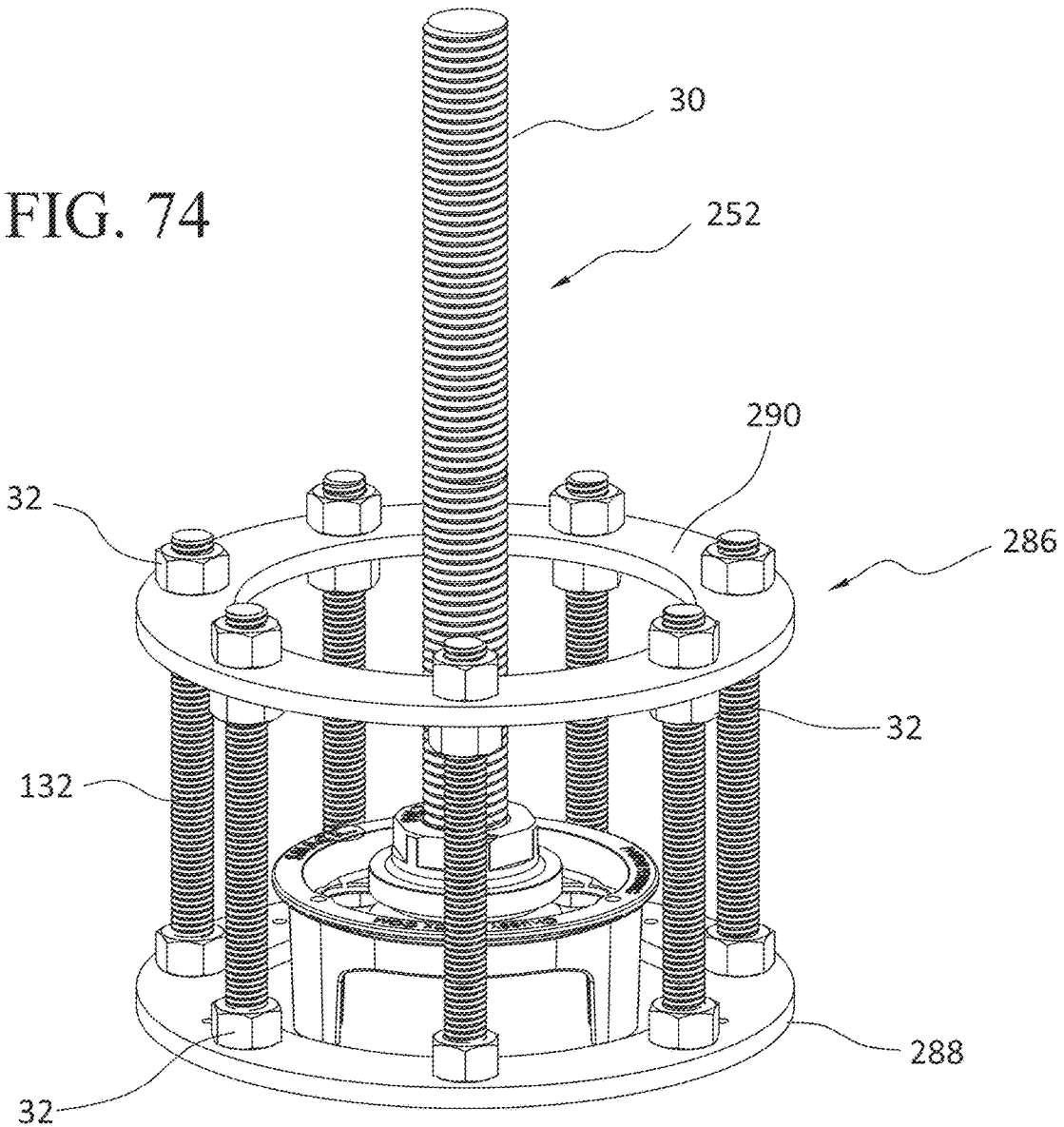

Referring to FIG. 74, the stud rail system 282 is modified as stud rail system 286 with ring plates 288 and 290 preferably plastic for fixturing or placement of the stud bolts 132. The lower ring plate 288 includes threaded holes for threading to the bottom end portions of the stud bolts 132. The nuts 32 provide anchorage in concrete.

Figure 75:
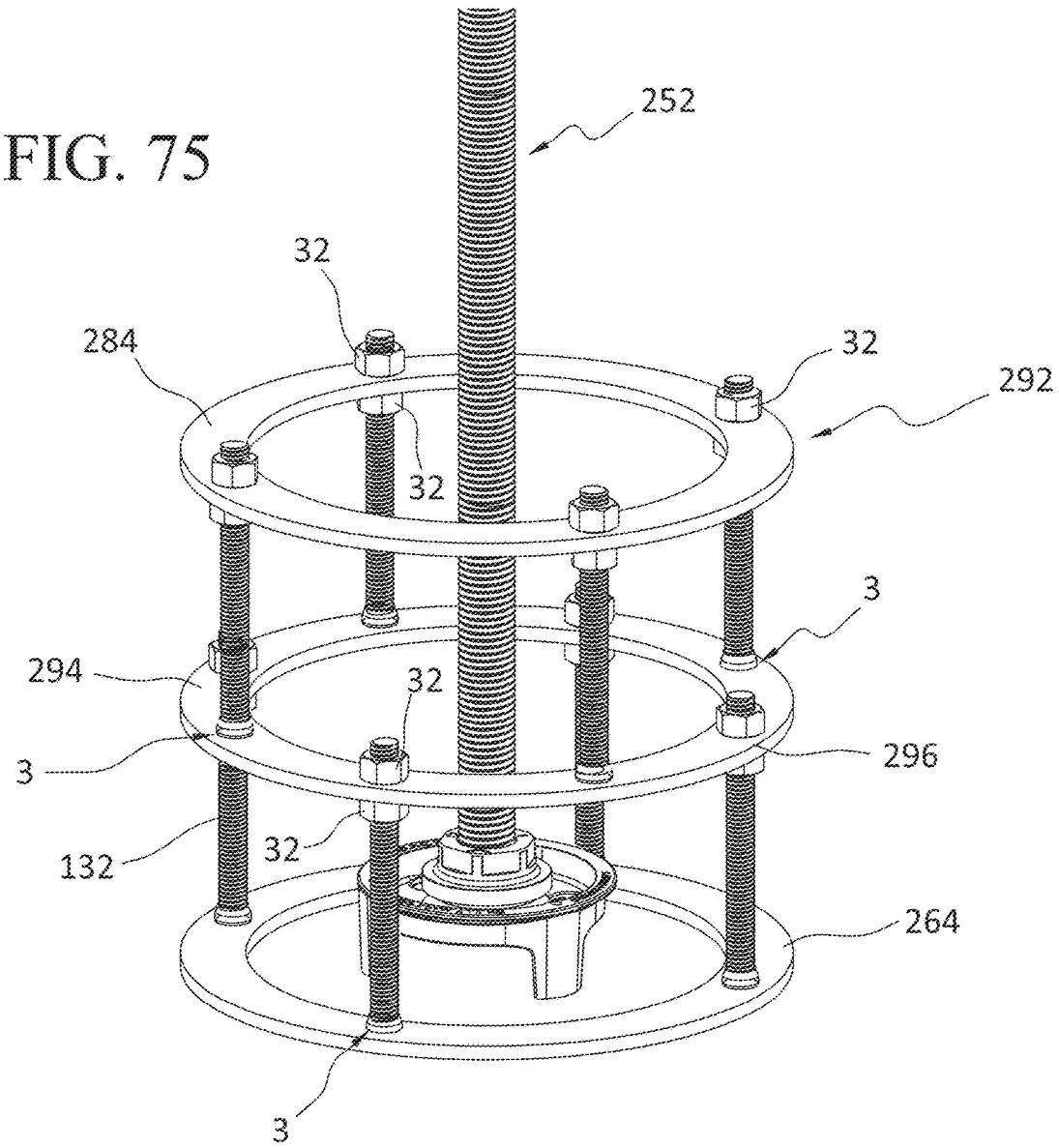

Referring to FIG. 75, the stud rail system 282 shown in FIG. 73 is modified as stud rail system 292. A center ring plate 294 is added with alternating plain openings 296 and threaded boss openings 3. Stud bolts 132 between the lower ring plate 264 and the center ring plate 294 are shifted or staggered relative to the stud bolts 132 between the center ring plate 294 and the upper ring plate 284. The center ring plate 294 is attached to the stud bolts 132 attached to the lower ring plate 264 with nuts 32. The stud bolts 132 are attached to the lower ring plate 264 using the threaded boss openings 3 in the lower ring plate 264. Stud bolts between the center ring plate 294 and the upper ring plate 284 are attached to the center ring plate 294 using the threaded boss openings 3 in the center ring plate 294. The upper ring plate 224 is attached to the stud bolts 132 attached to the center ring plate 294 with nuts 32.

Figure 76:
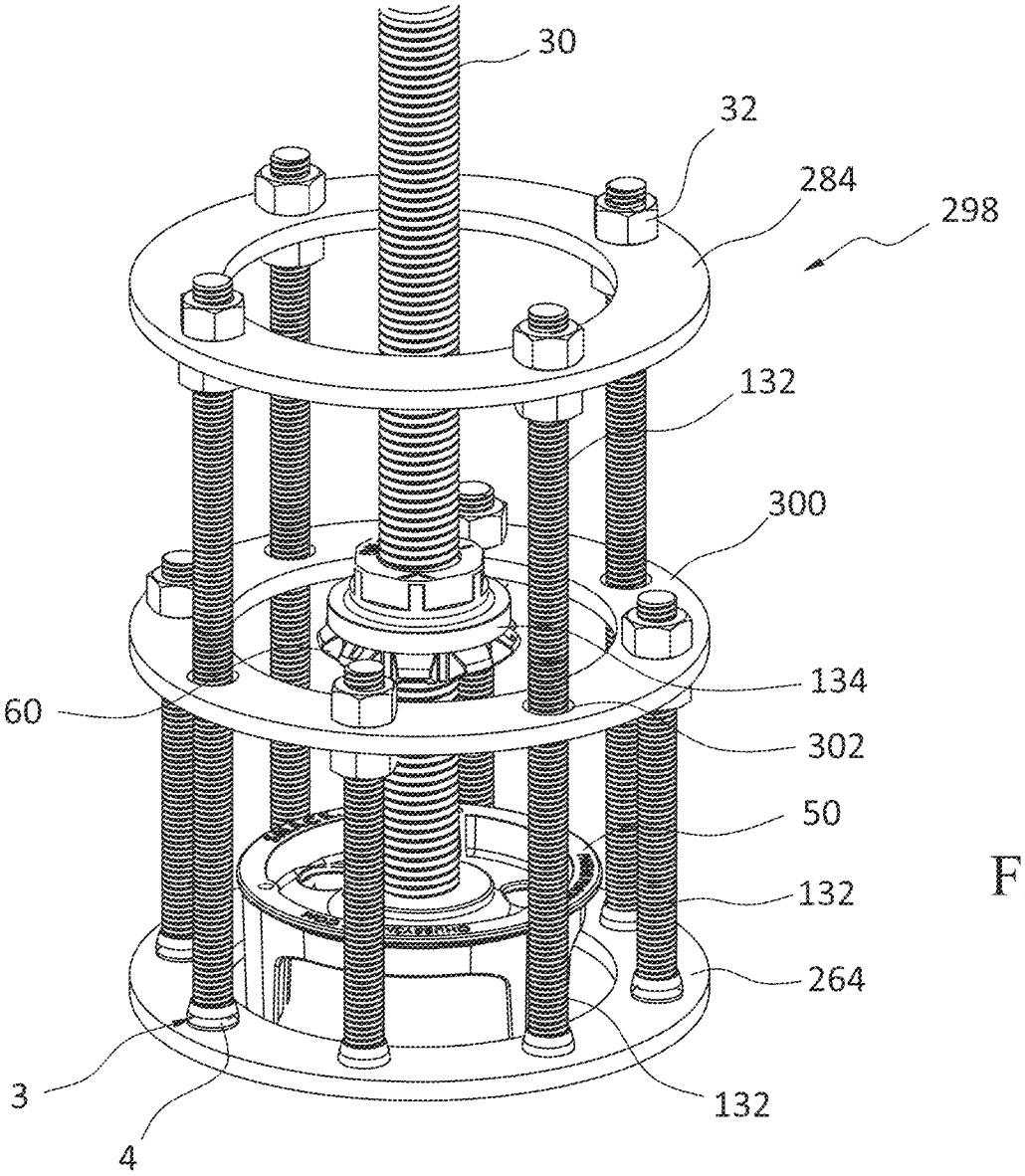

Referring to FIG. 76, the stud rail system 292 shown in FIG. 75 is modified as stud rail system 298. The center ring plate 294 is modified as center ring plate 300. The upper ring plate 284 is directly attached to the lower ring plate 264 with stud bolts 132 that pass through the center ring plate 300 through openings 302. The center ring plate 300 is attached directly to the lower ring plate 264 with the stud bolts 132 and the nuts 32. The stud bolts 132 are attached to the lower ring plate 264 using the threaded boss openings 3 in the lower ring plate 264. The anchor body 134 is disposed higher than the center ring plate 300. The anchor body 134 is advantageously raised to enable the anchor body 134 to generate a larger shear cone when subjected to a compression (downward direction) load than if the anchor body 134 were a lower position. A plastic lock nut 60 or any standard hex nut locks the anchor body 134 in place.

Figure 77:
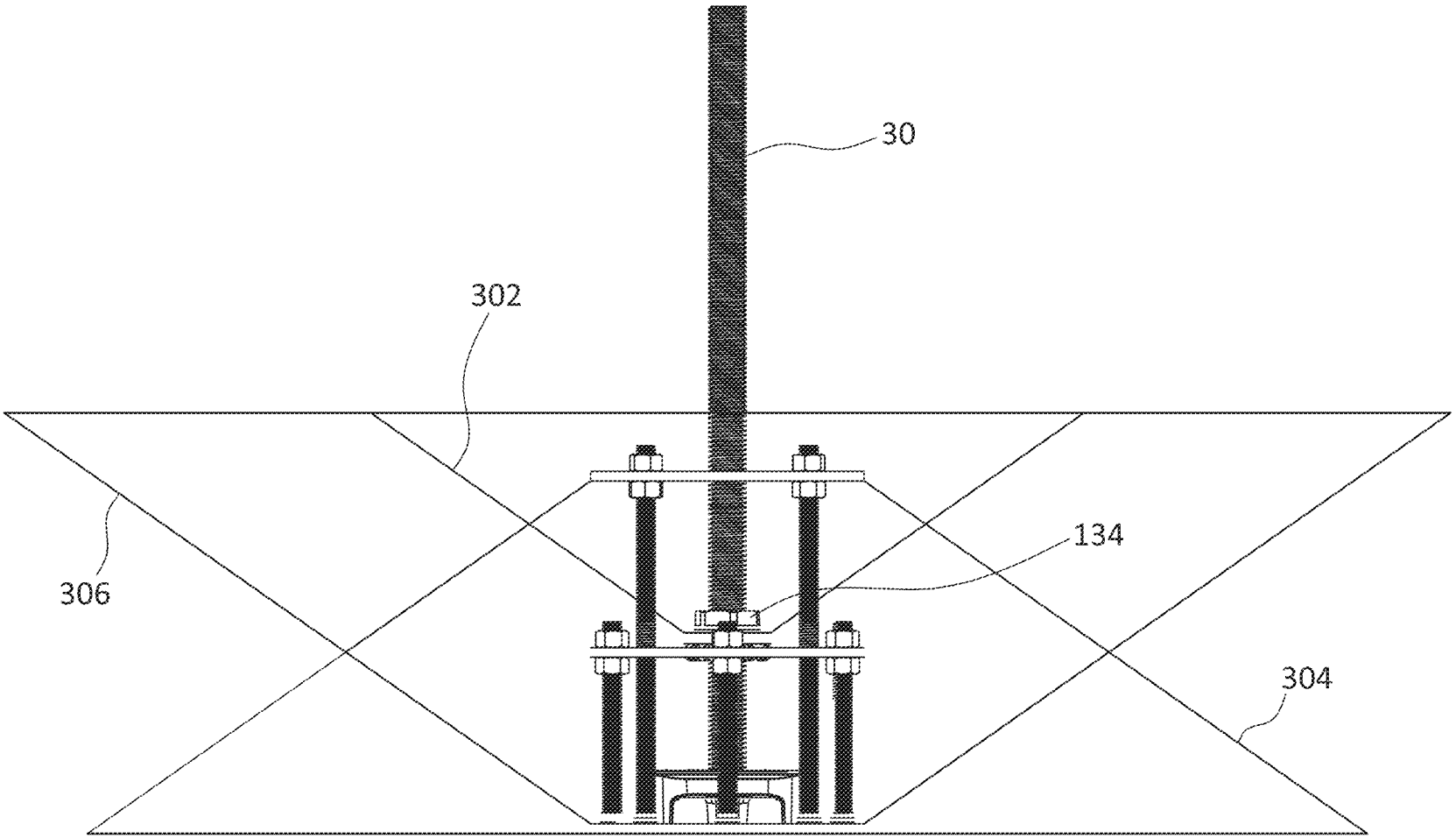

Referring to FIG. 77, the shear cones generated by the stud rail system 298 are shown. Shear cone 302 is generated in the concrete structure by the anchor body 134 when tension (upward direction) load is applied on the anchor rod 30. Shear cone 304 is generated by the upper ring plate 284 in reaction to the tension load on the anchor rod 30. Shear cone 306 is generated by the stud rail system 298 in reaction to the shear cone 304. The shear cone 304 advantageously provides reinforcement to the shear cone 302, thereby increasing the anchorage strength of the anchor body 134.

Figure 78:
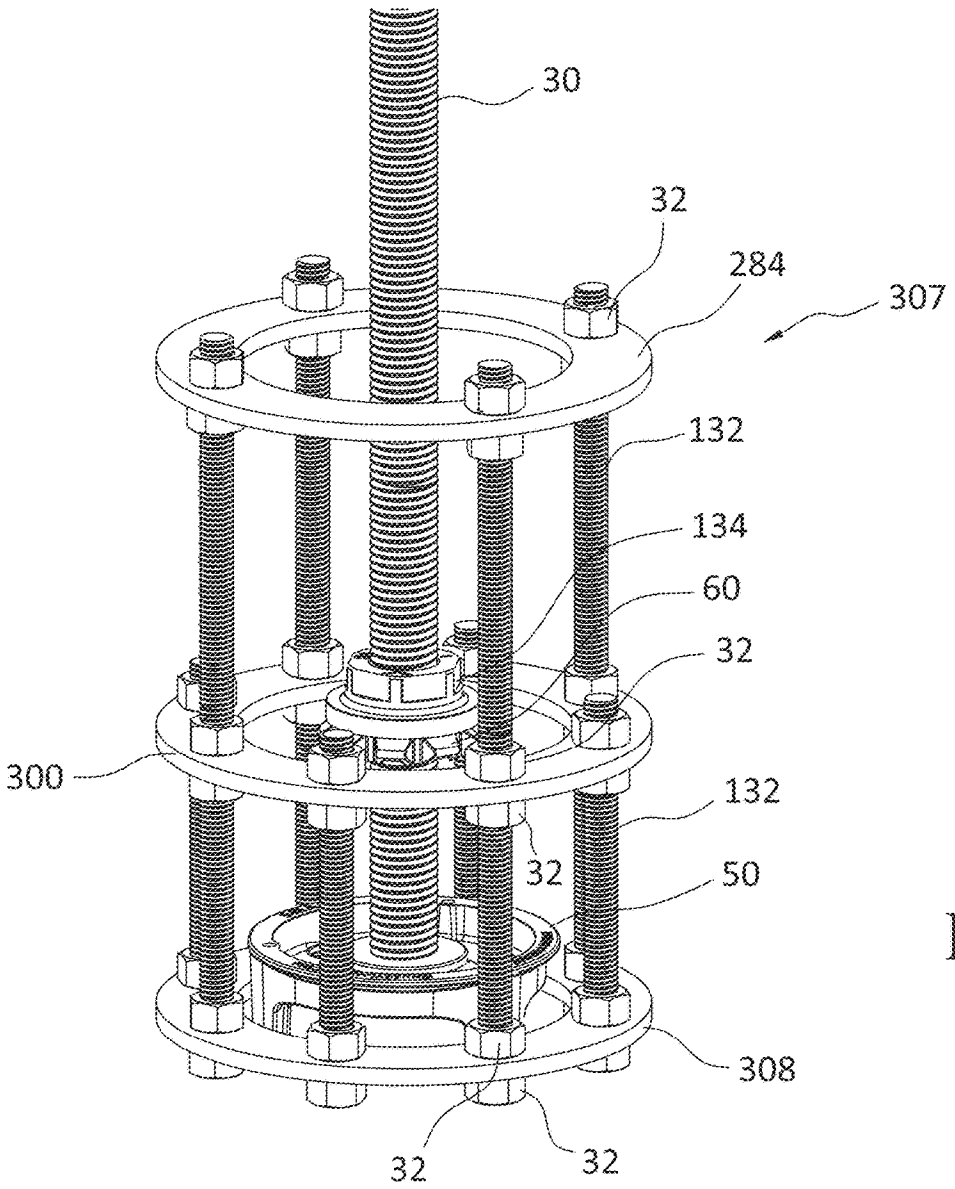

Referring to FIG. 78, the stud rail system 298 shown in FIG. 76 is modified as stud rail system 307 with a lower ring plate 308 without threaded boss openings. Instead, the lower ring plate 308 is provided with openings through which the stud bolts 132. Hex nuts 32 secure the stud bolts 32 to the lower ring plate 308. The stud bolts 132 that extend through the center ring plate 300 are attached to the center ring plate 300 with hex nuts 32. The upper ring plate 284 is attached to both the center ring plate 300 and the lower ring plate 308. The ring plates 284, 300 and 308 may be made of plastic, steel or similar materials.

Figure 79:
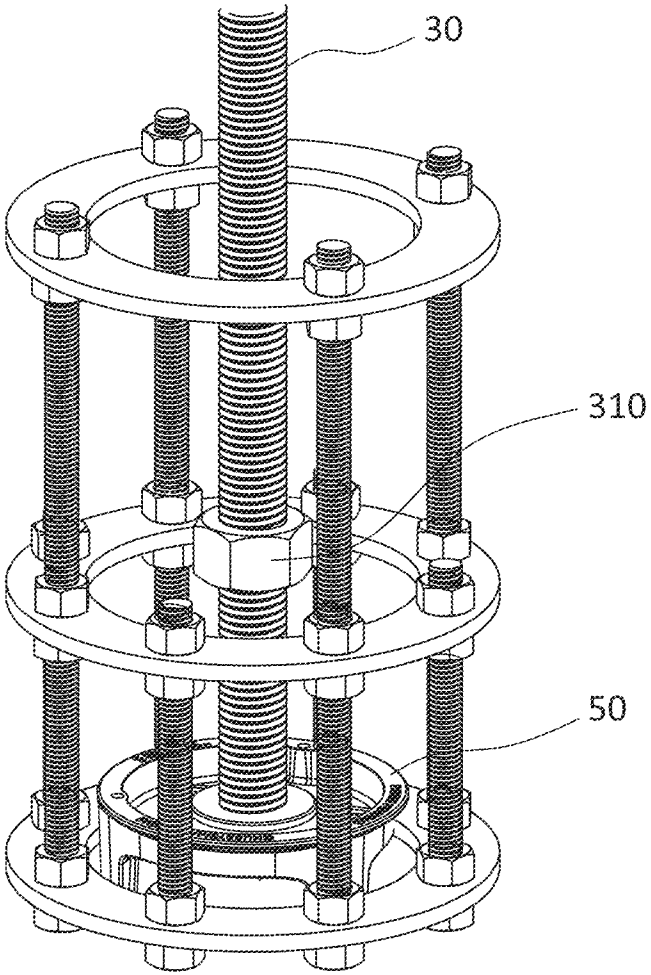

Referring to FIG. 79, the anchor body 134 shown in FIG. 78 is replaced with a hex nut 310.

Figure 80:
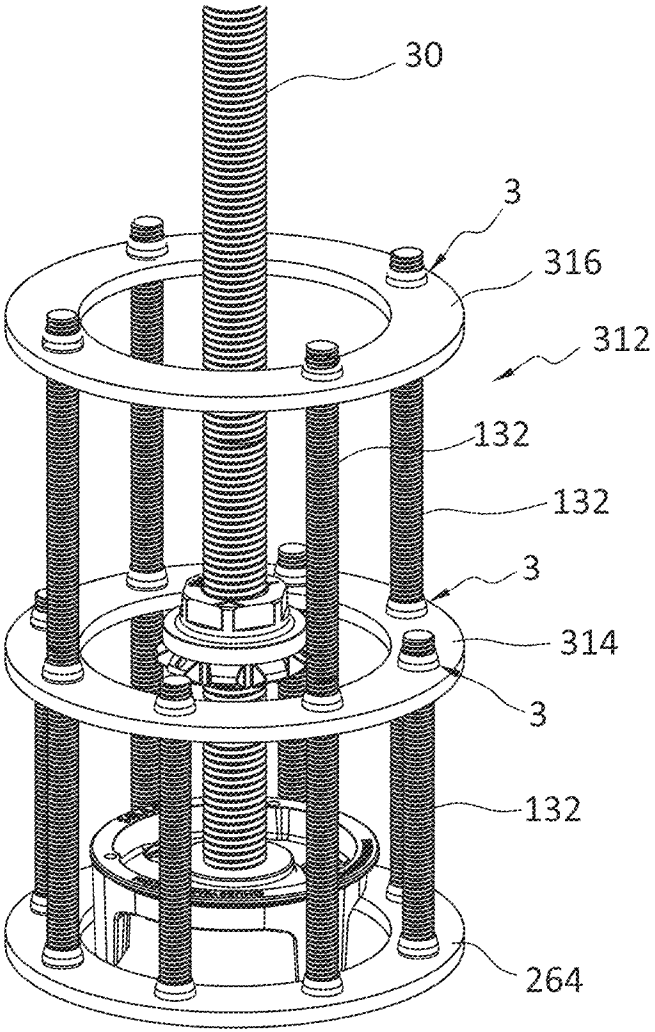

Referring to FIG. 80, the stud rail system 298 is modified as stud rail system 312 where center ring plate 314 and upper ring plate 316 are provided with threaded boss openings 3 to which the stud bolts 132 are attached.

Figure 81:
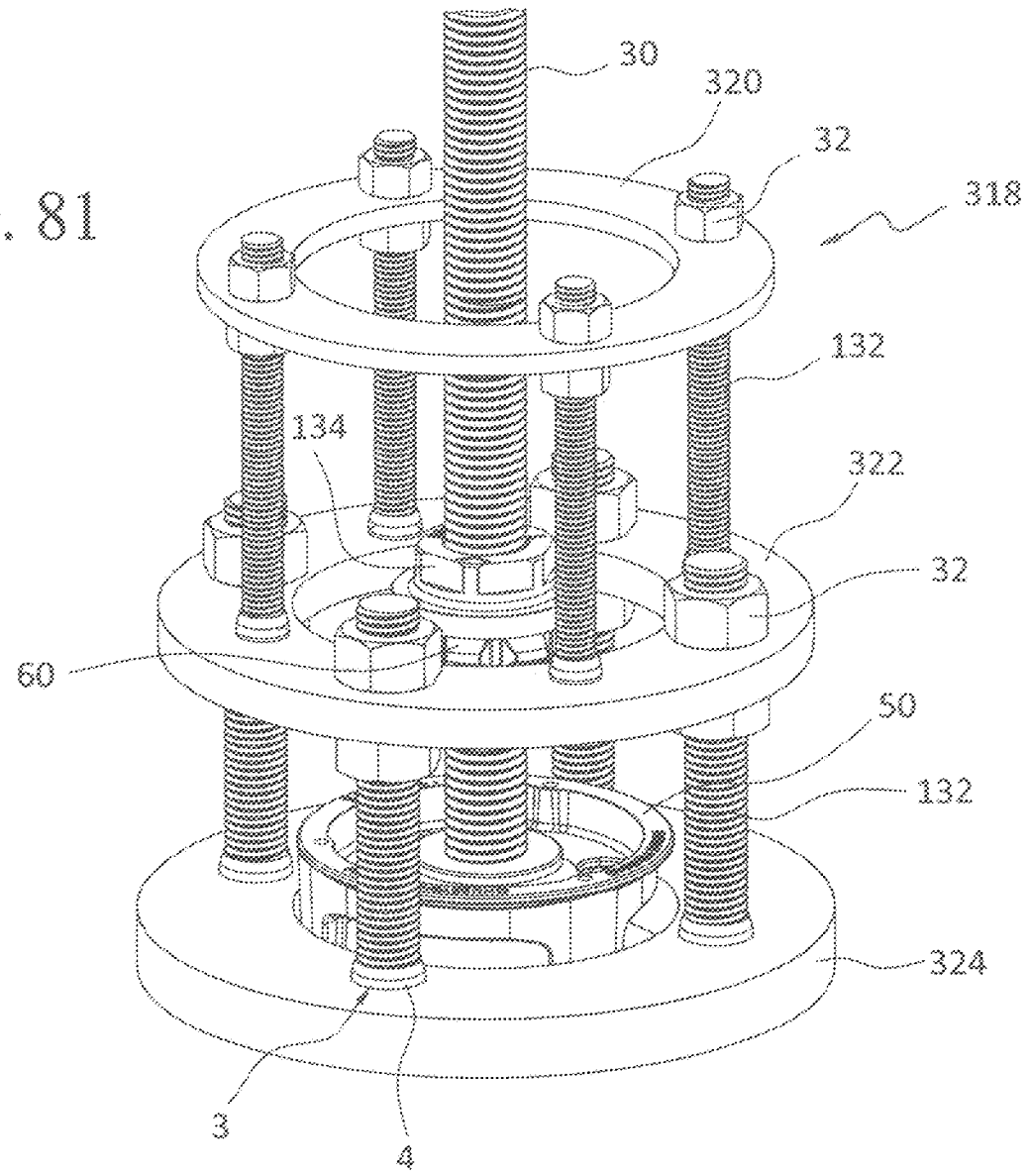

Referring to FIG. 81, the stud rail system 292 shown in FIG. 75 is modified as stud rail system 318. The upper ring plate 320 is smaller in diameter and thinner in thickness than the center ring plate 322. The center ring plate 322 is smaller in diameter and thinner in thickness than the lower ring plate 324. The stud bolts 132 connecting the lower ring plate 324 to the center ring plate 322 are larger in diameter than the stud bolts 132 connecting the center ring plate 322 to the upper ring plate 320. The lower ring plate 324 creates a larger breakout (shear) cone than if all the ring plates are of the same diameter. A larger breakout cone means a stronger anchorage in the concrete structure.

Figure 82:
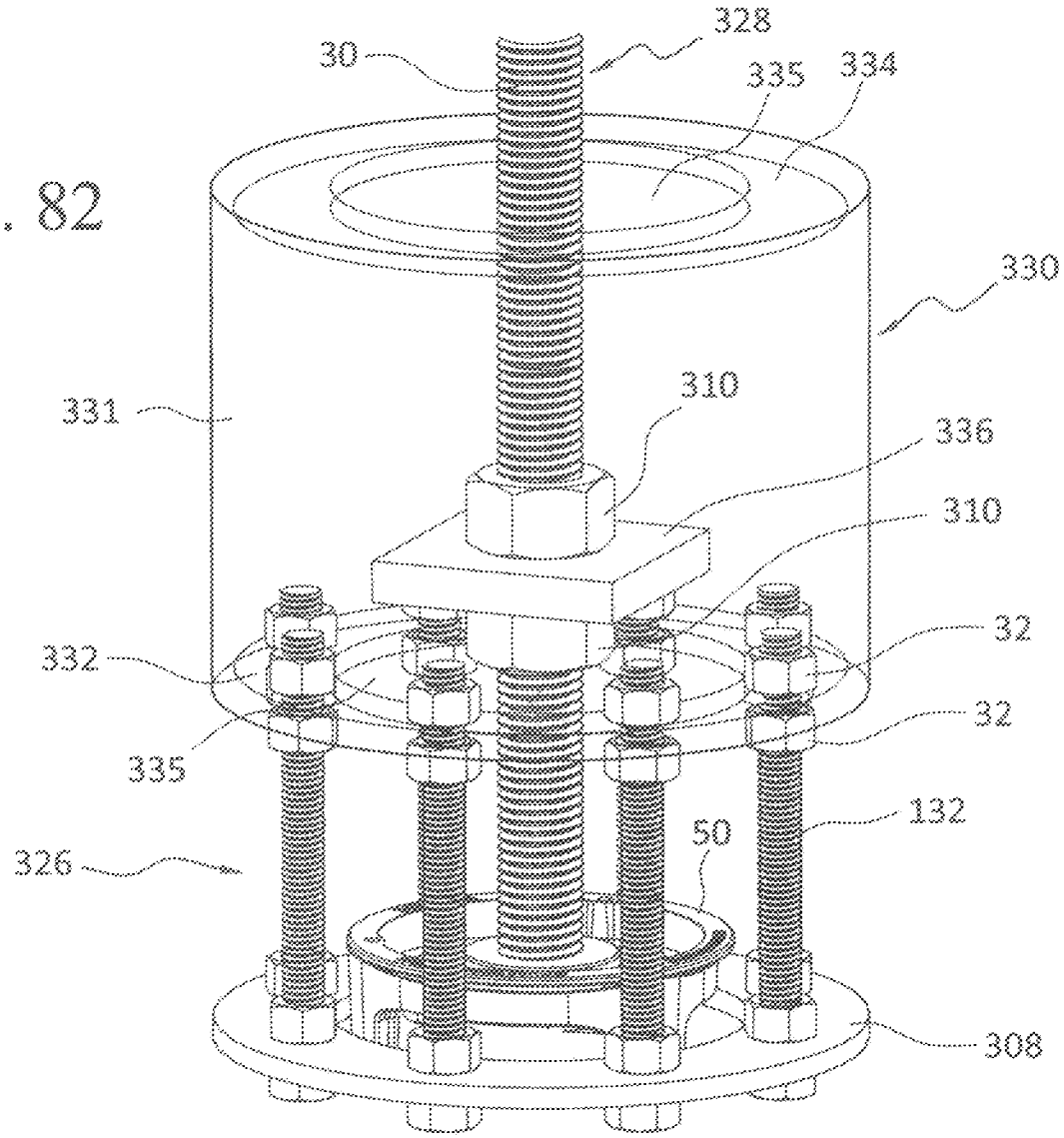

Referring to FIG. 82, the stud rail 2 shown in FIG. 79 is modified as stud rail system 326 for reinforcing an anchor assembly 328. A hollow cylindrical member 330 includes a side wall 331, a bottom wall 332 and a top wall 334. The bottom wall 332 and the top wall 334 include an opening 335. The cylindrical member 330 is attached to ring plate 308 via the upper end portions of the stud bolts 132. Nuts 32 bear on the bottom wall 332. An anchor plate 336 secured by hex nuts 310 are disposed inside the cylindrical member 330.

Figure 83:
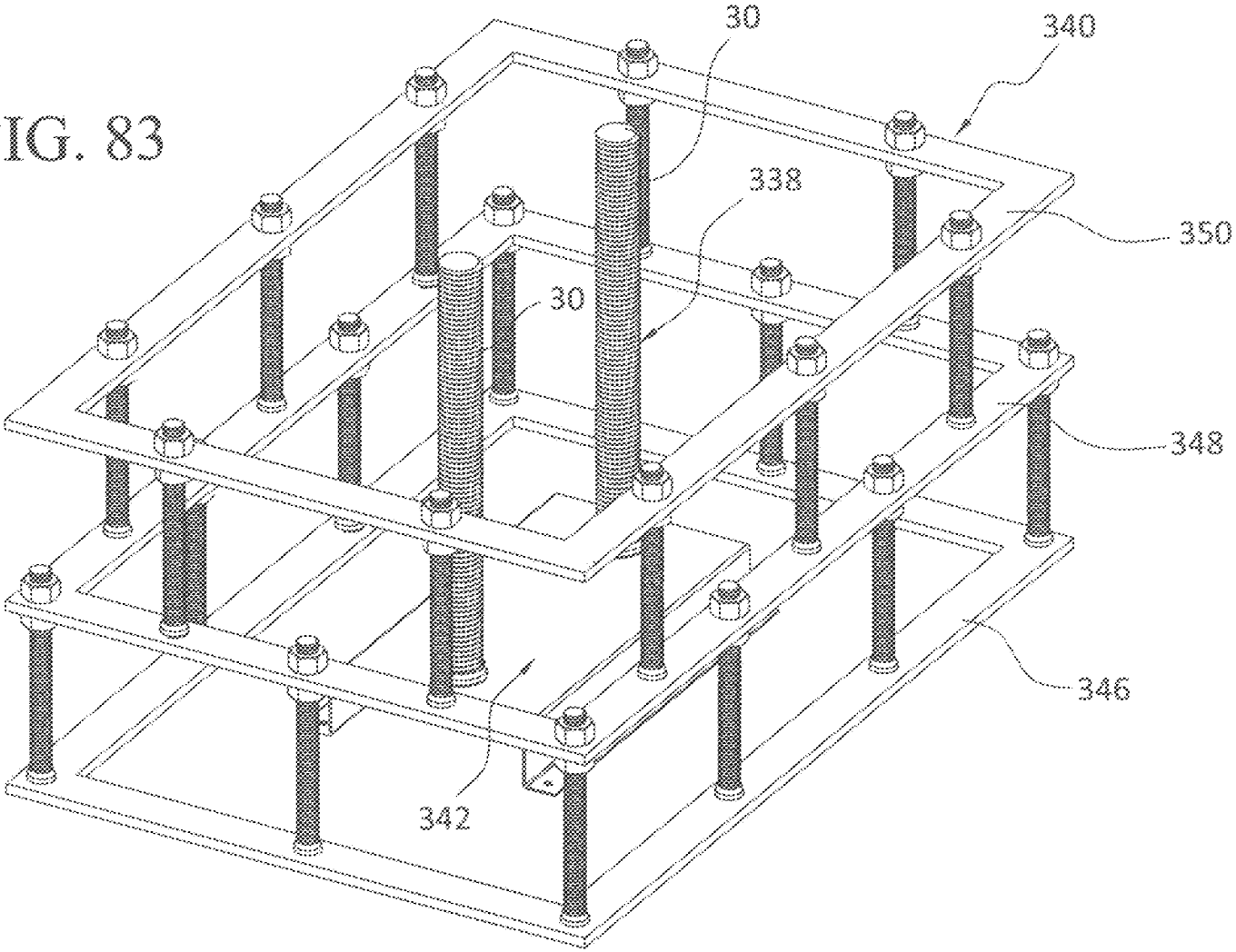

Referring to FIG. 83, an anchor assembly 338 is reinforced by a geometric-shaped stud rail system 340. The anchor assembly 338 includes anchor rods 30 supported by support 342, which is similar to the support 98 shown in FIG. 33. The stud rail system 340 is similar to the stud rail system 292 shown in FIG. 75, except that the ring plates 264, 294 and 284 are modified as rectangular ring plates 346, 348 and 350.

Figure 84:
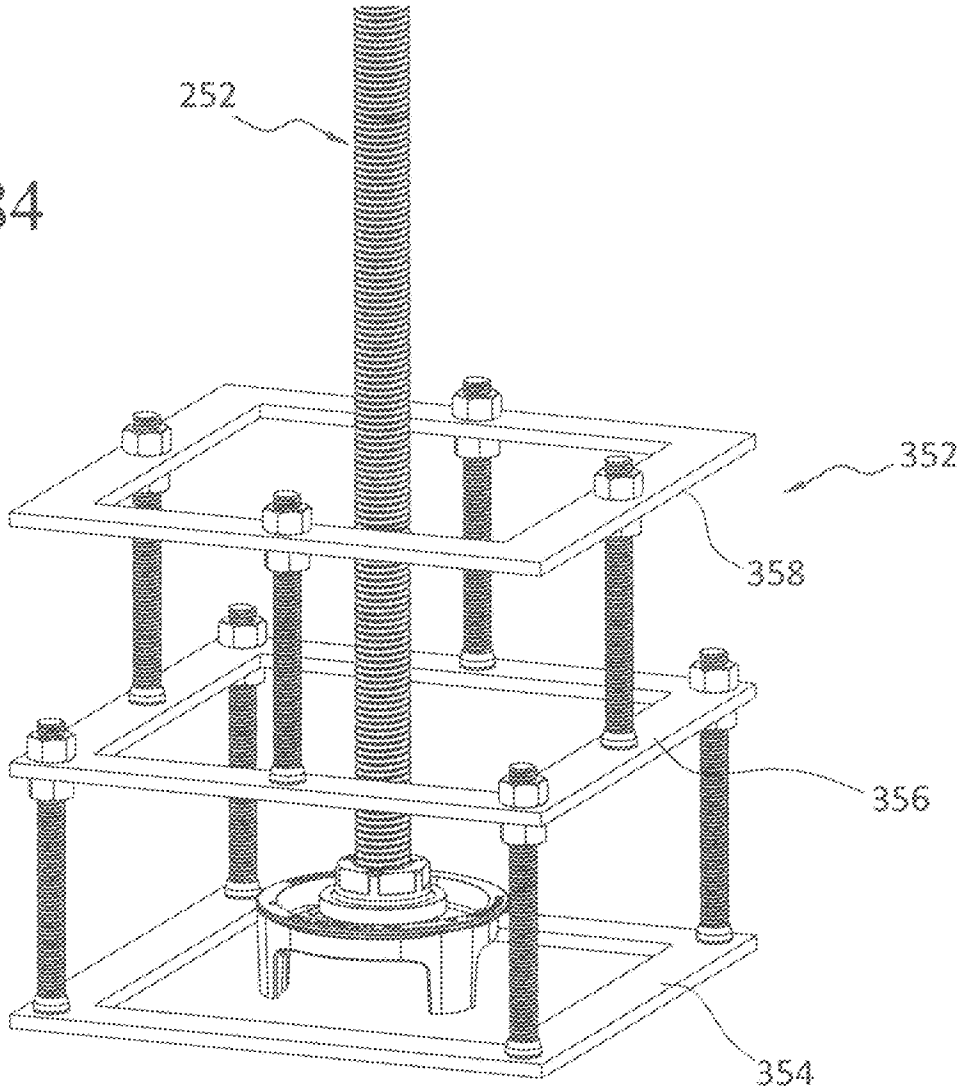

Referring to FIG. 84, the stud rail system 292 shown in FIG. 75 is modified as stud rail system 352 with square ring plates 354, 356 and 358.

Figure 85:
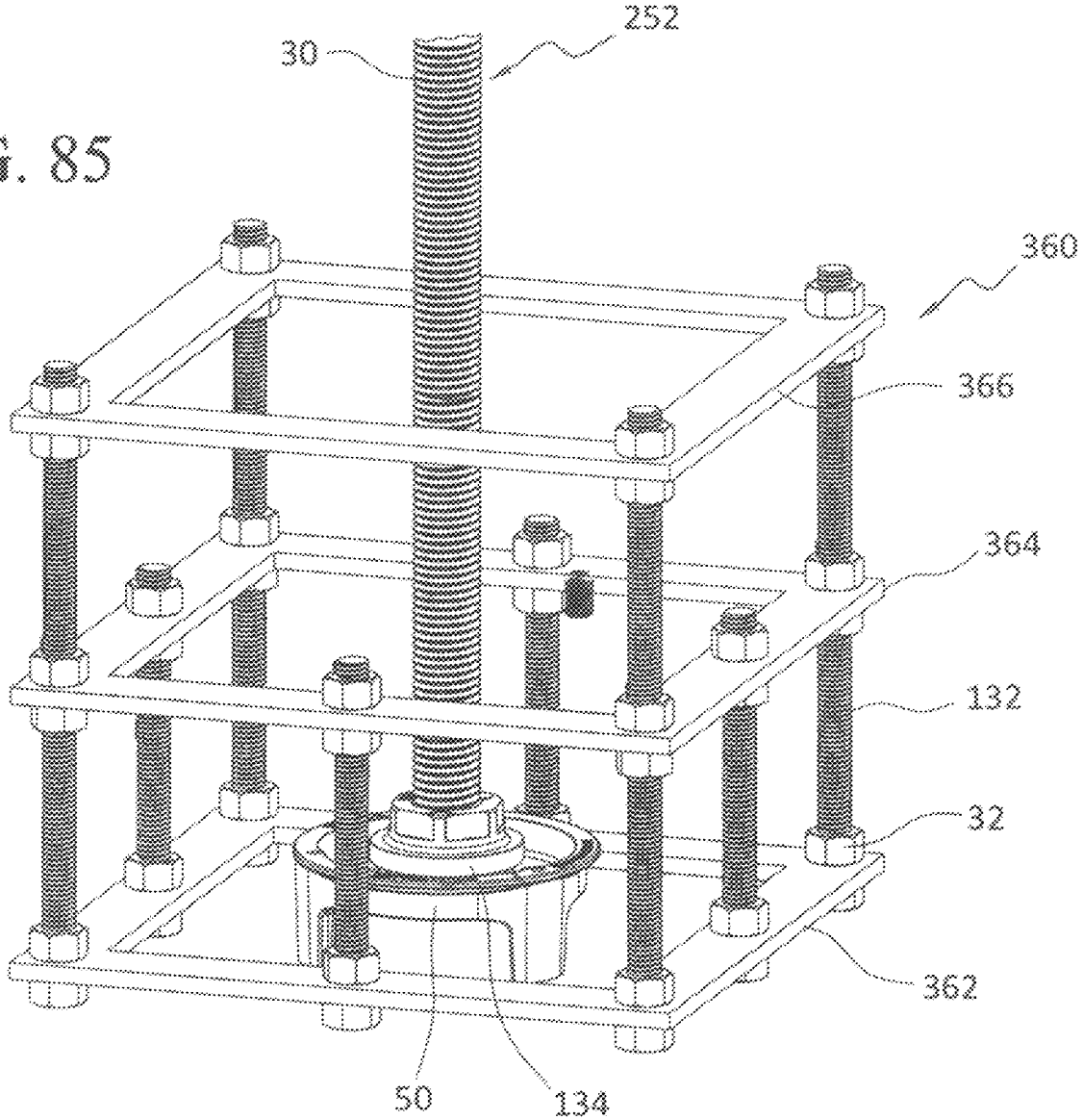

Referring to FIG. 85, the stud rail system 307 shown in FIG. 78 is modified as stud rail system 360 with square ring plates 362, 364 and 366. The upper square ring plate 366 is attached to both the center square plate 364 and the lower square ring plate 362.

Figure 86:
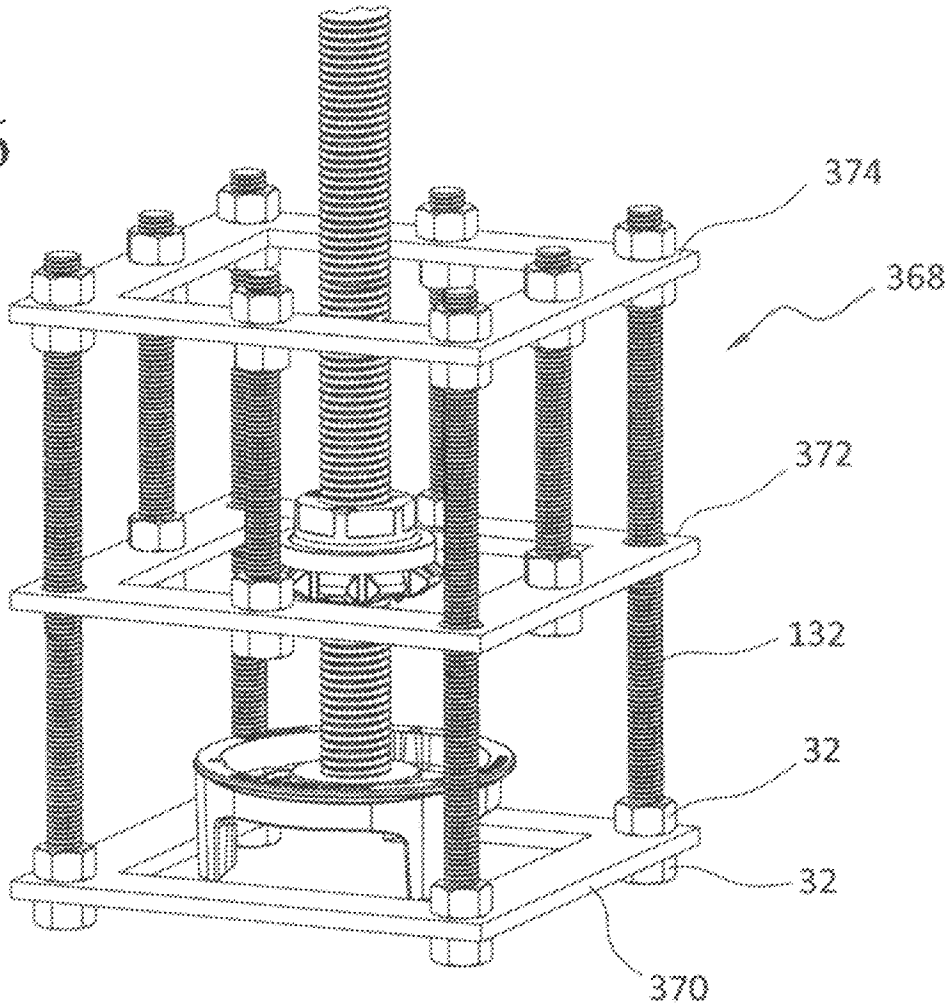

Referring to FIG. 86, the stud rail system 298 shown in FIG. 76 is modified as stud rail system 368 with square ring plates 370, 372 and 374, which can be plastic, steel or similar materials. The upper square ring plate 374 is attached directly to the center square ring plate 372 and the lower square ring plate 370. The lower square ring plate 370 is attached directly to the upper square ring plate 374. Hex nuts 32 are used to attach the stud bolts 132 to the lower square ring plate 370.

Figure 87:
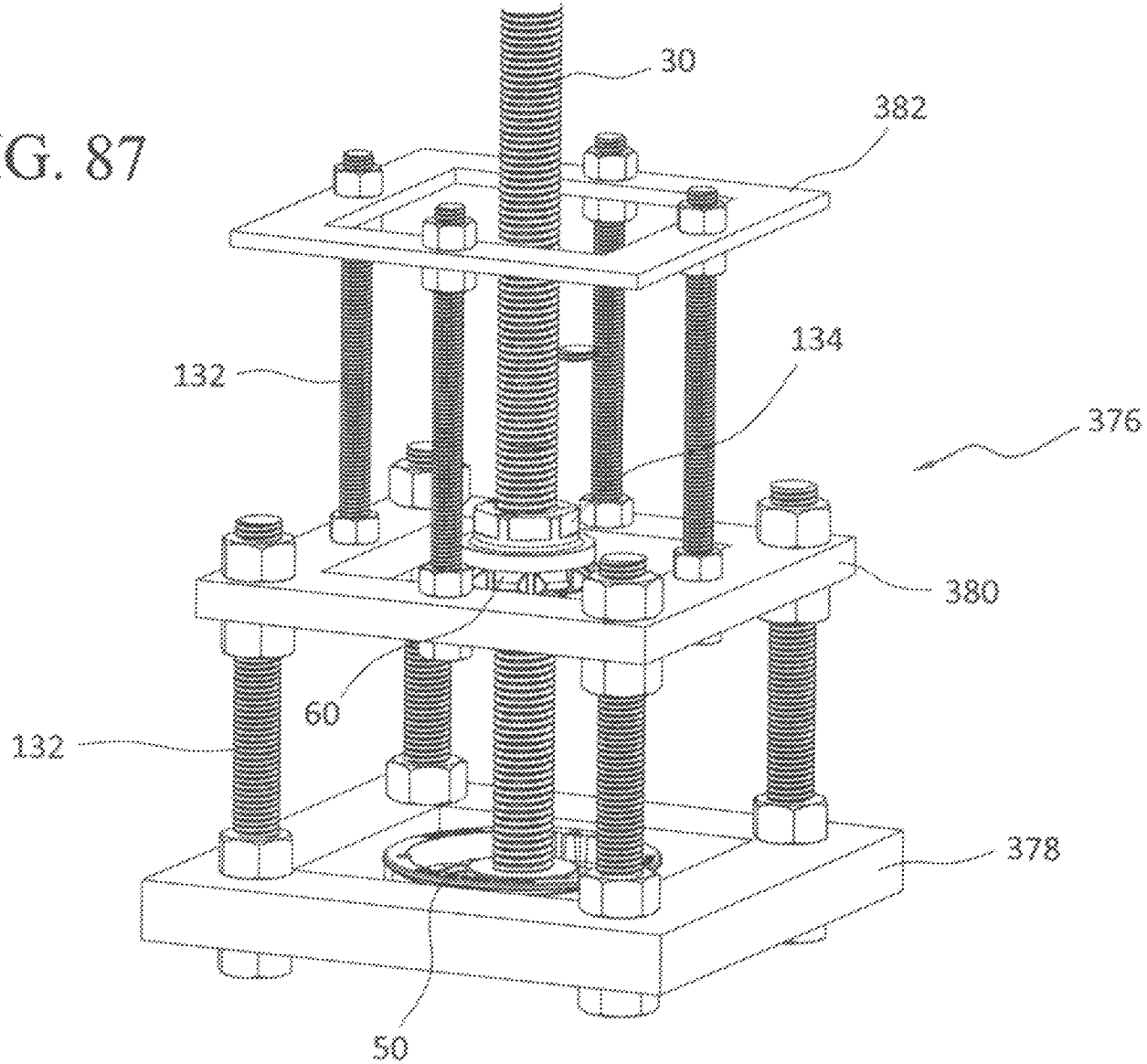

Referring to FIG. 87, the stud rail system 318 shown in FIG. 81 is modified as stud rail system 376 with square ring plates 378, 380 and 382. The upper square ring plate 382 is smaller in periphery and thinner in thickness than the center square ring plate 380. The center square ring plate 380 is smaller in periphery and thinner in thickness than the lower square ring plate 378. The stud bolts 132 connecting the lower square ring plate 378 to the center square ring plate 380 are larger in diameter than the stud bolts 132 connecting the center square ring plate 380 to the upper square ring plate 382.

Figure 88:
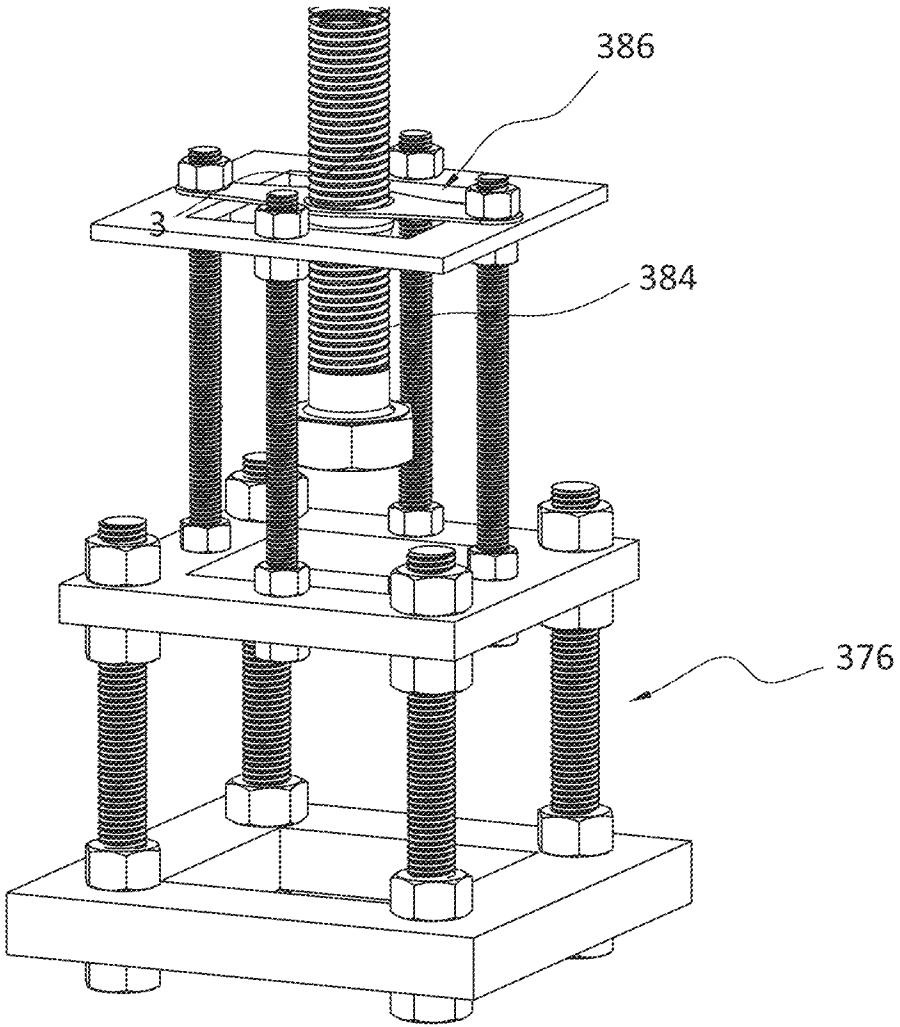

Referring to FIG. 88, a hex bolt 384 is used in place of the anchor rod 30, the anchor body 134, the lock nut 60 and the support 50. A bracket 386 with a threaded boss opening 3 is threaded to the hex bolt 384 to support the hex bolt 384 inside the stud rail system 376.

Figure 89:
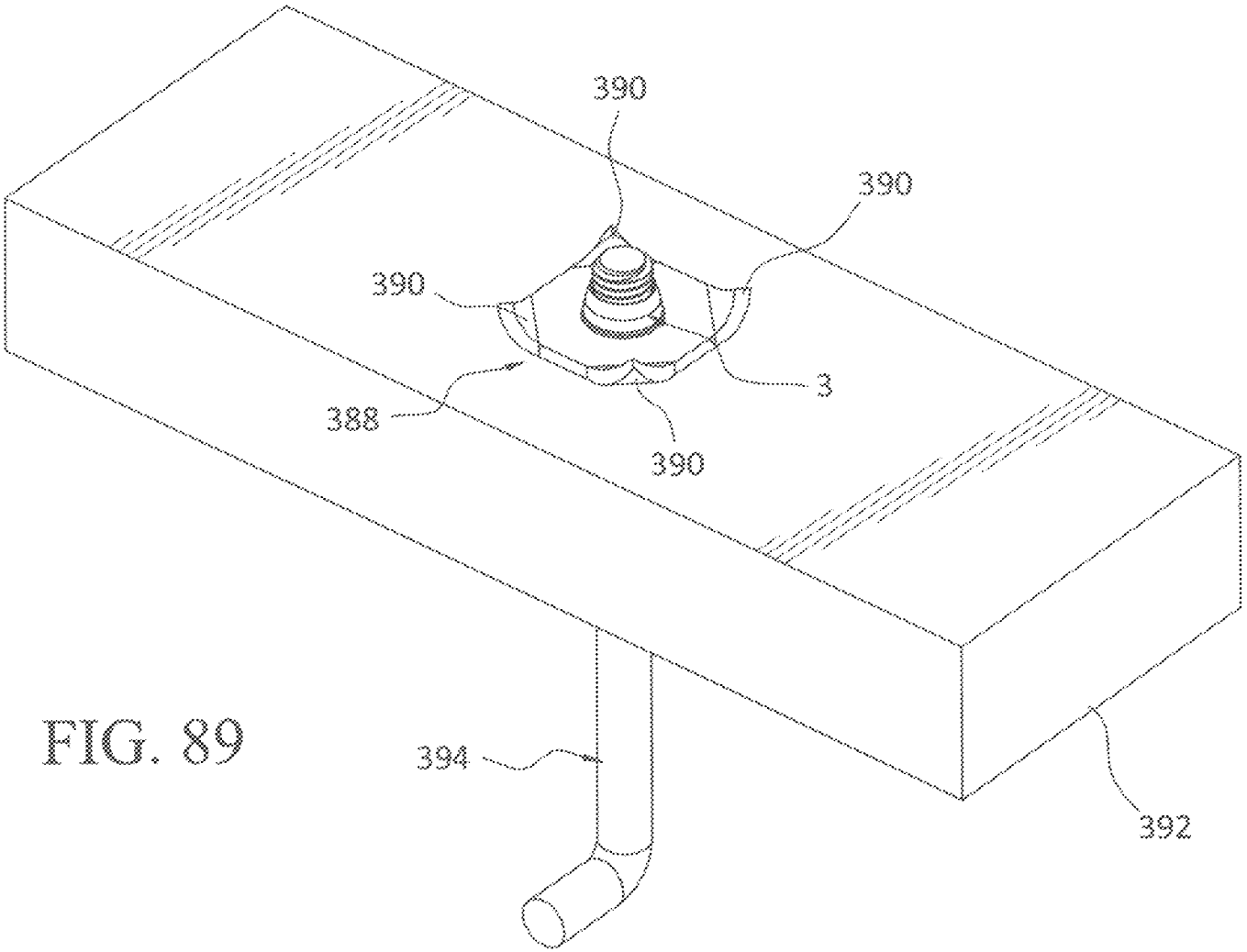
FIGS. 89-106 show several systems for anchoring a sill or bottom plate to a concrete structure, such as a concrete foundation or concrete slab.

Referring to FIG. 89, a bearing plate 388 is provided with a threaded boss opening 3. The bearing plate 388 may be rectangular or square. The bearing plate 388 includes upturned corner portions 390 to advantageously provide the user a way to grab the bearing plate for tightening by hand. The bearing plate 388 may be used to secure a sill or bottom plate 392 to an L-shaped anchor bolt 394 embedded in concrete. Other anchor bolts may be used, such as those anchor assemblies disclosed herein. The sill plate or base plate 392 is part of a standard stud wall.

Figure 90:
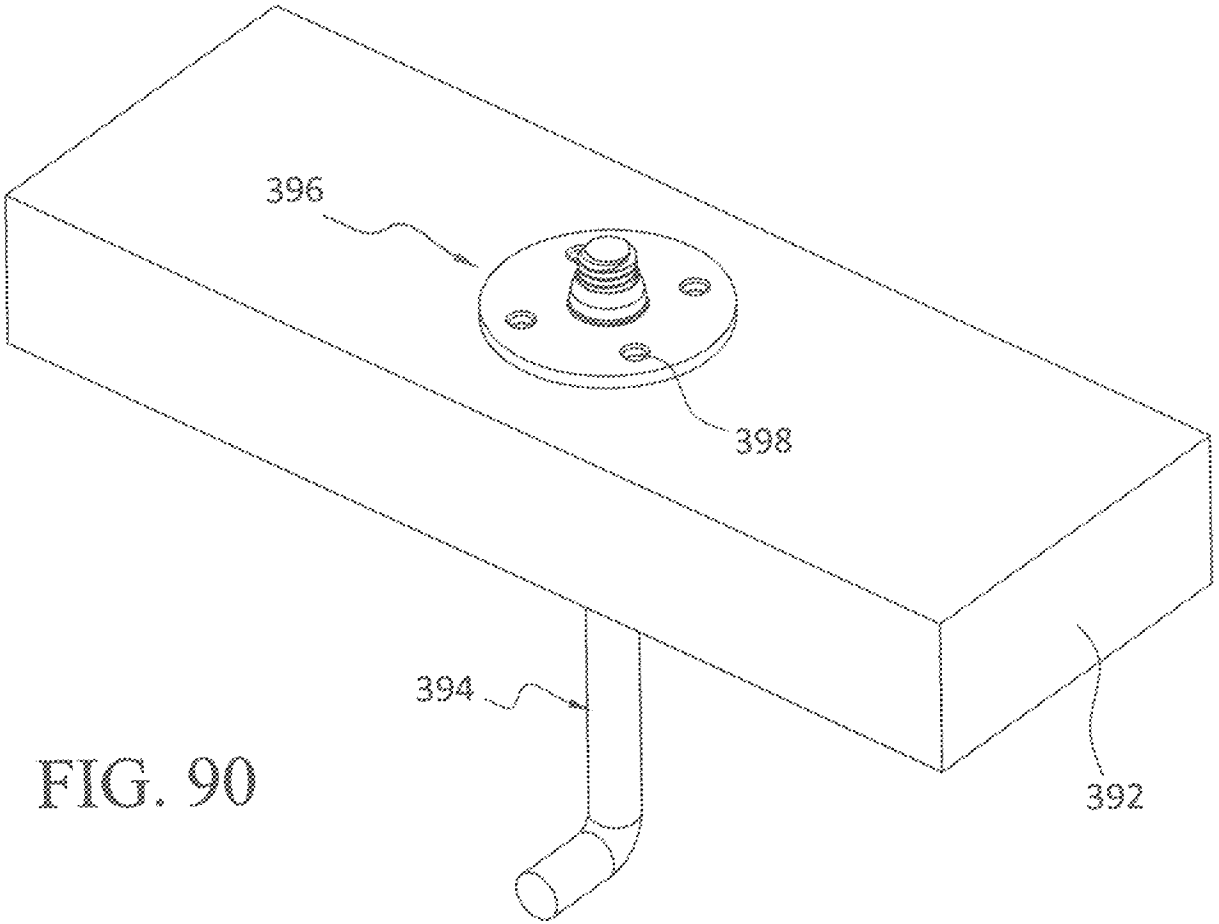

Referring to FIG. 90, the bearing plate 388 is modified as a circular bearing plate 396 with holes 398 for use with a tool, such as a spanner wrench, for tightening the bearing plate 396 to the sill plate 392.

Figure 91:
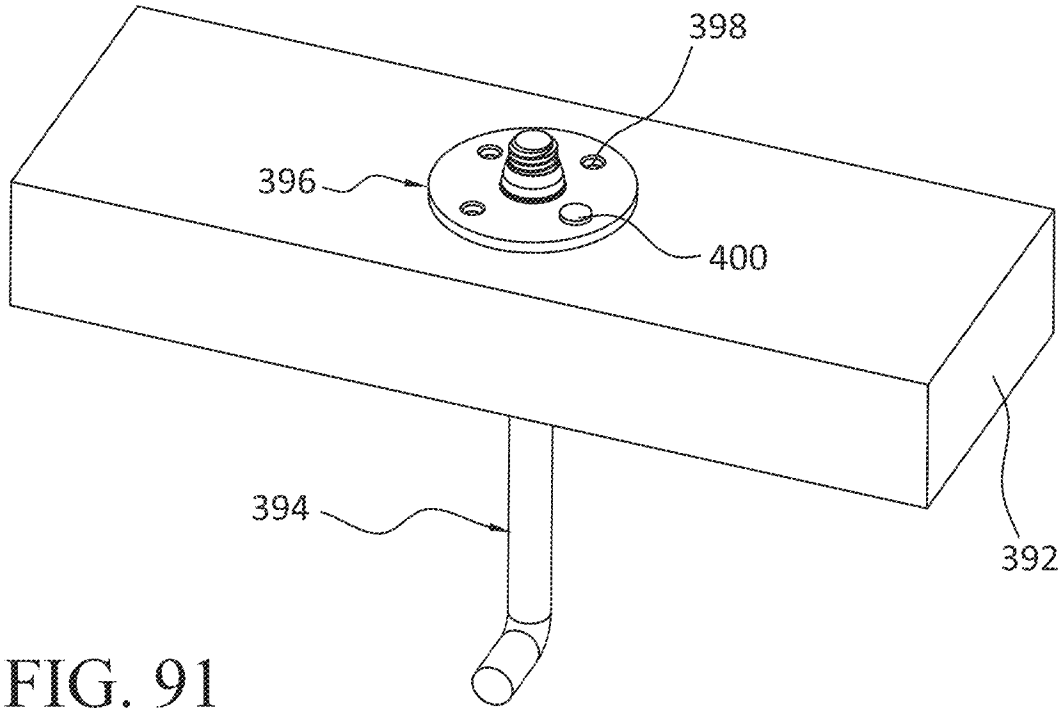

Referring to FIG. 91, a nail 400 may be driven through one of the holes 398 for keeping the bearing plate 396 from rotating once installed.

Figure 92:
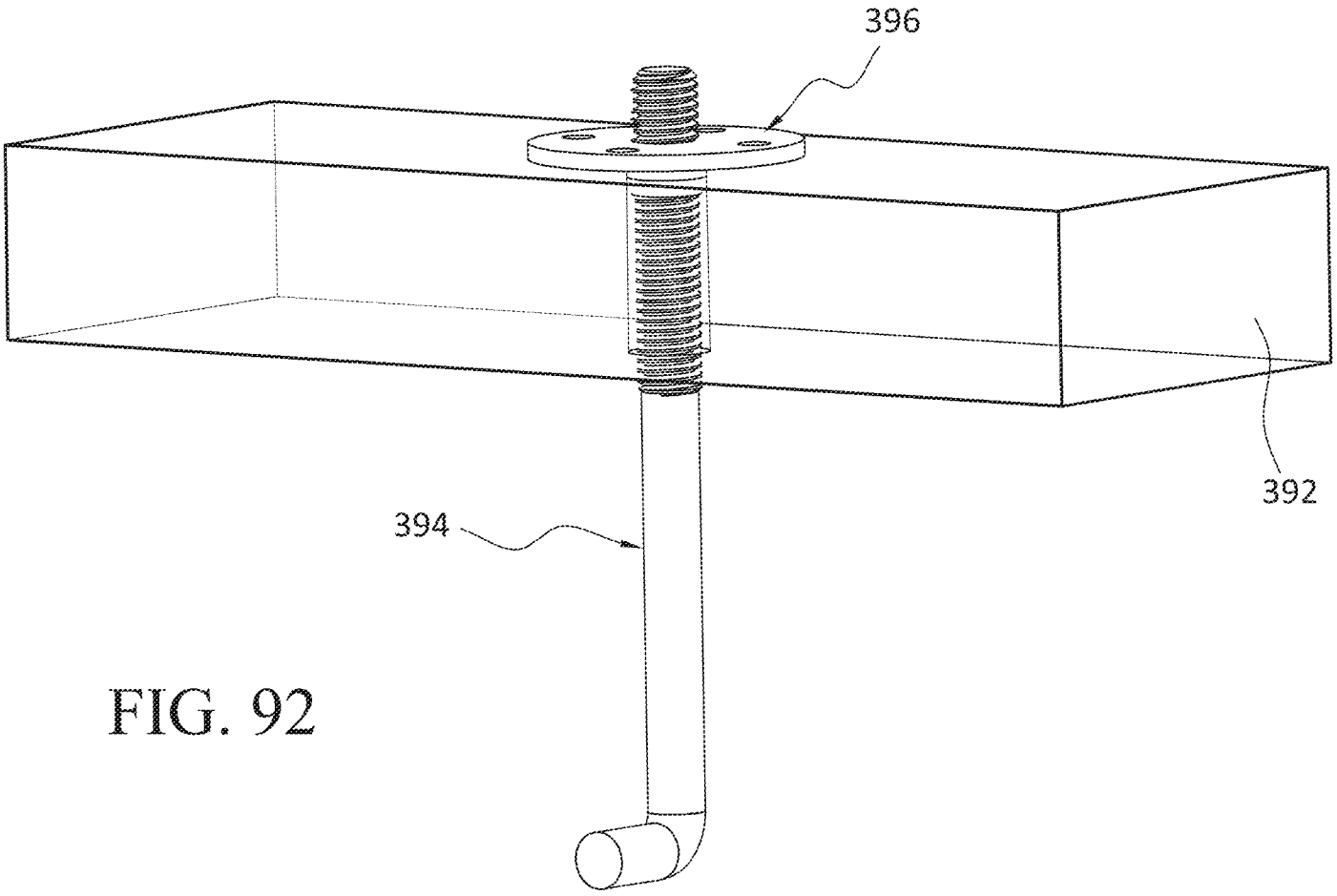
Figure 93:
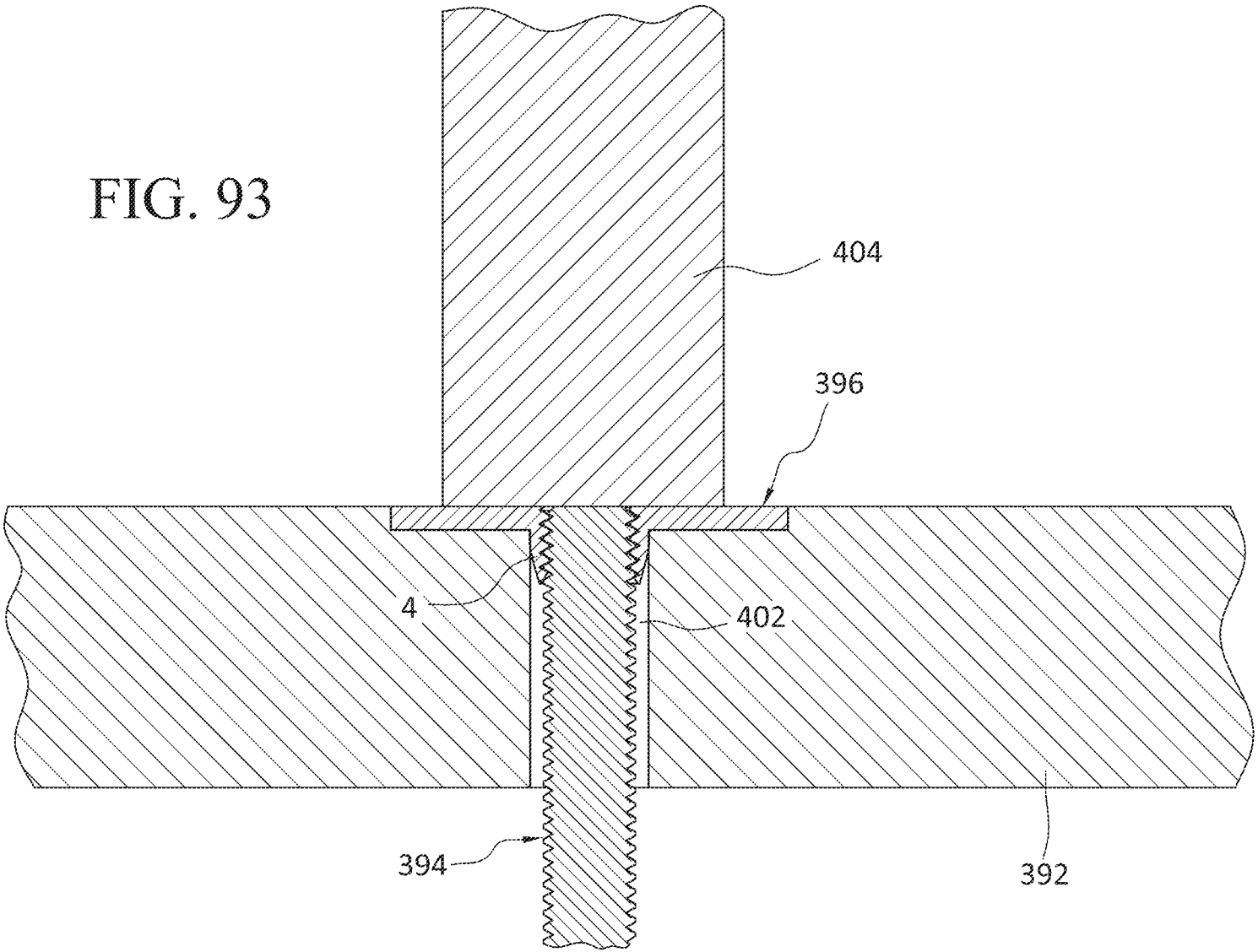

Referring to FIGS. 92 and 93, the bearing plate 396 may be installed with the boss section 4 inside the sill plate 392. An opening 402 in the sill plate 392 tightly fits around the boss section 4 to advantageously transfer the shear forces from the anchor 394 to the wall of the opening 402. The bearing plate 396 may be recessed into the sill plate 392 to allow a wall stud 404 to be placed directly over the bearing plate.

Figure 94:
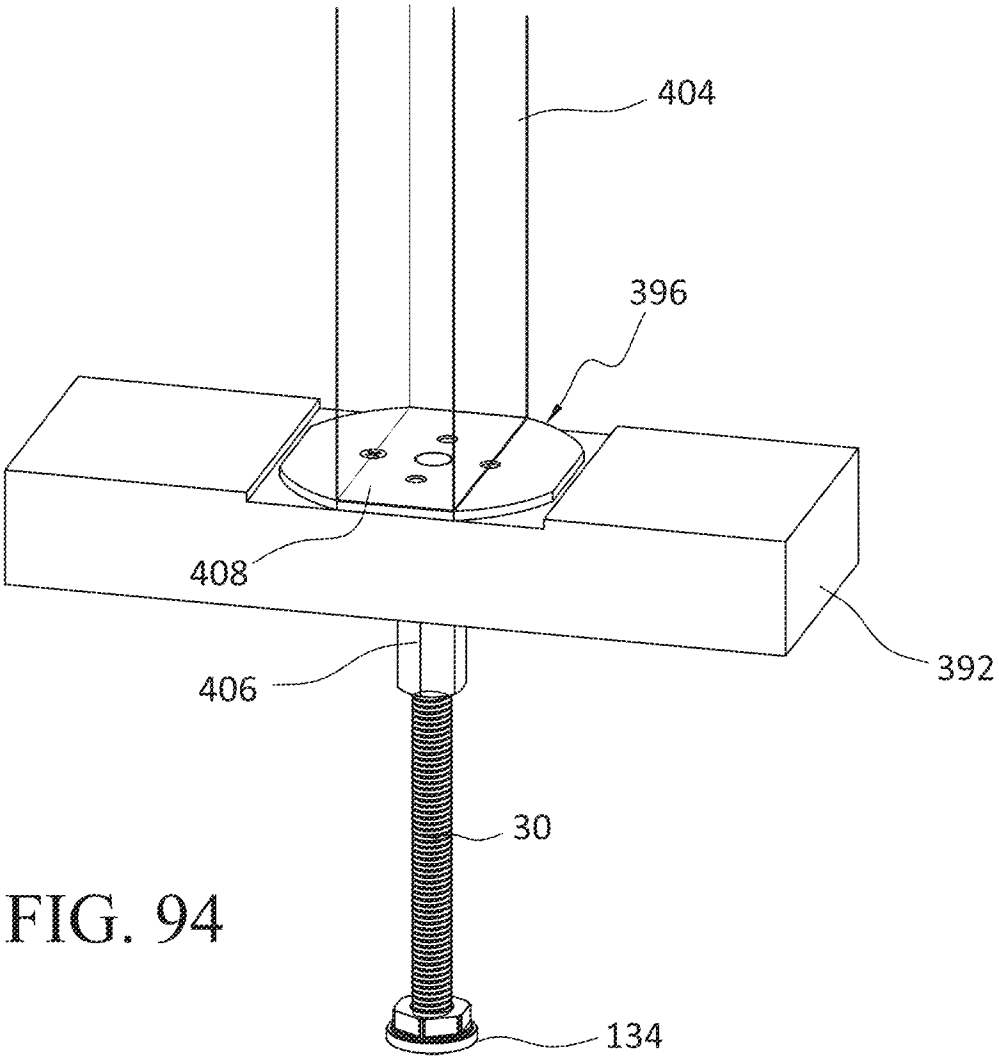
Figure 95:
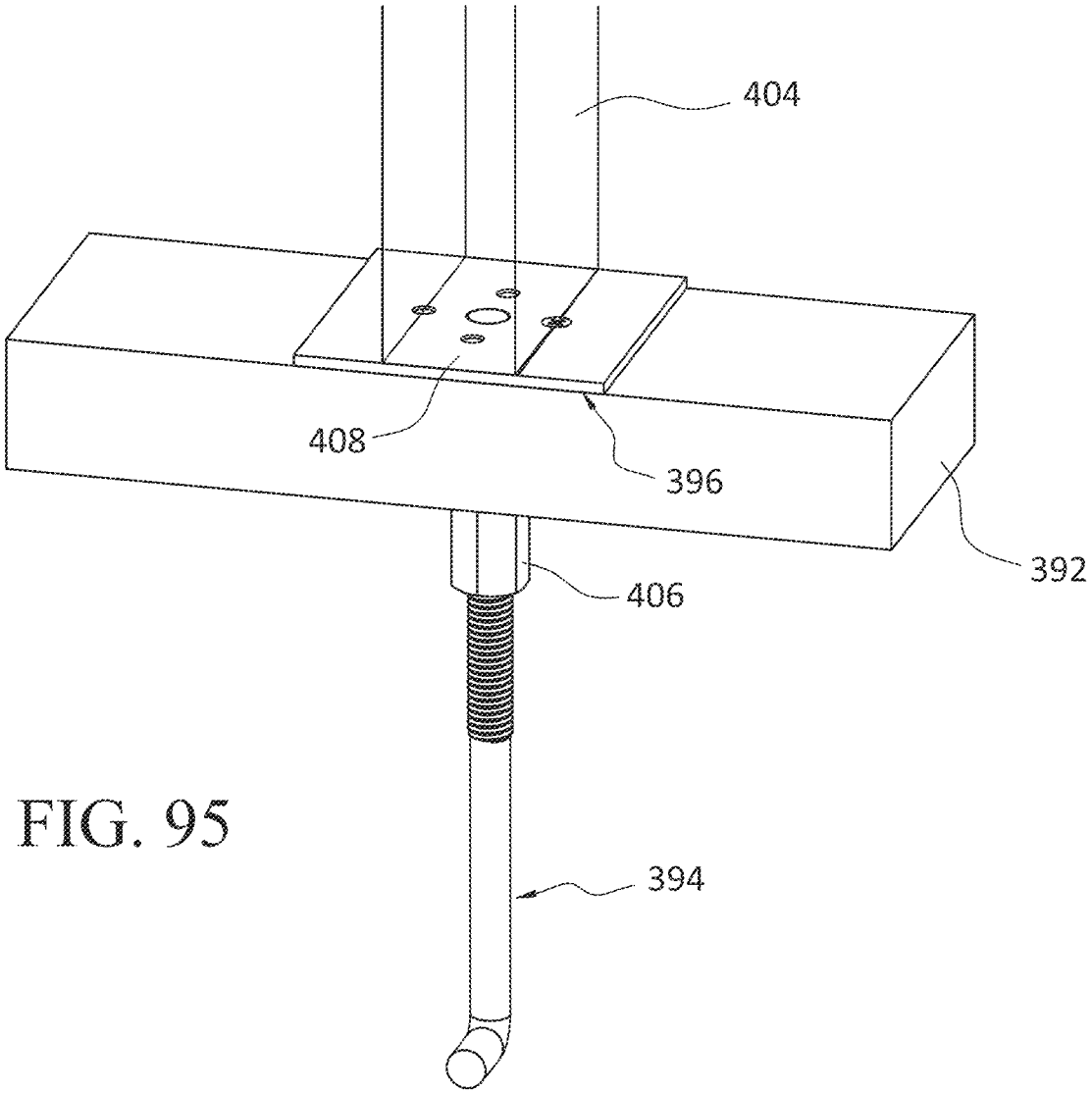

Referring to FIGS. 94 and 95, the bearing plate 396 is enlarged to encompass the entire bottom end surface 408 of the wall stud 404. A coupler 406 is attached to the anchor rod 30 which is attached to the anchor body 134. The bearing plate 396 may be recessed into the sill plate 392 or simply lay on the top surface of the sill plate 392.

Figure 96:
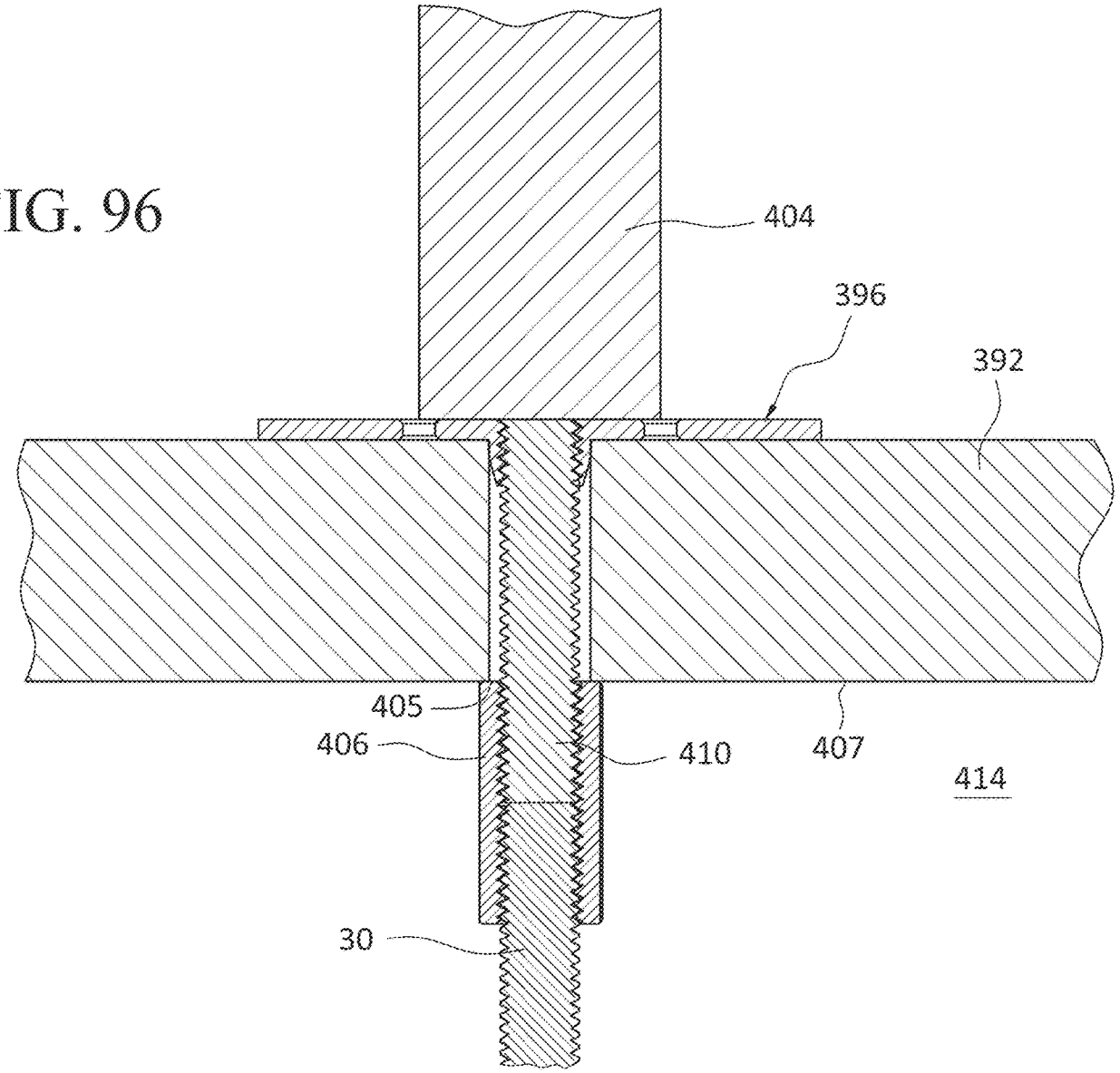
Figure 97:
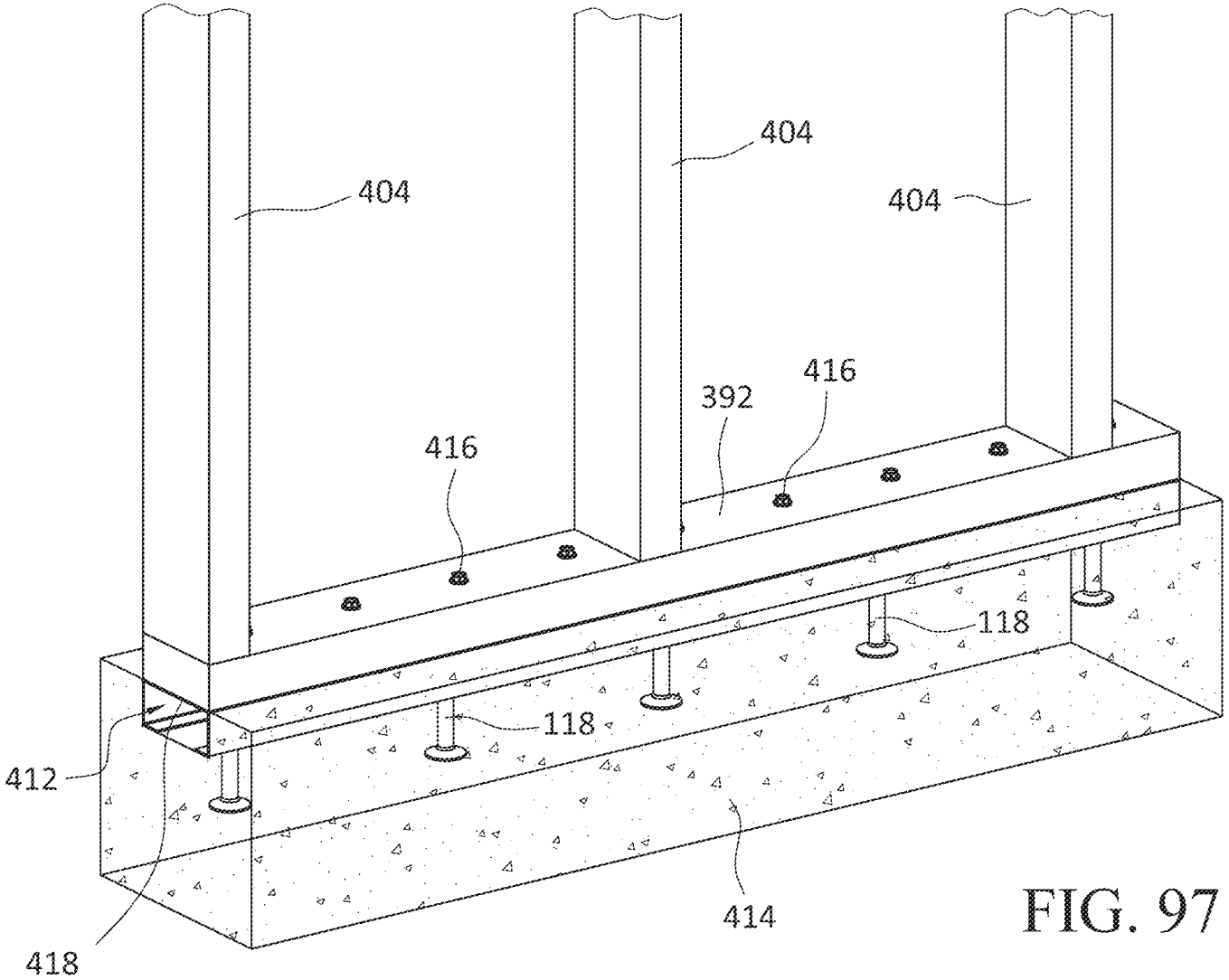
Figure 98:
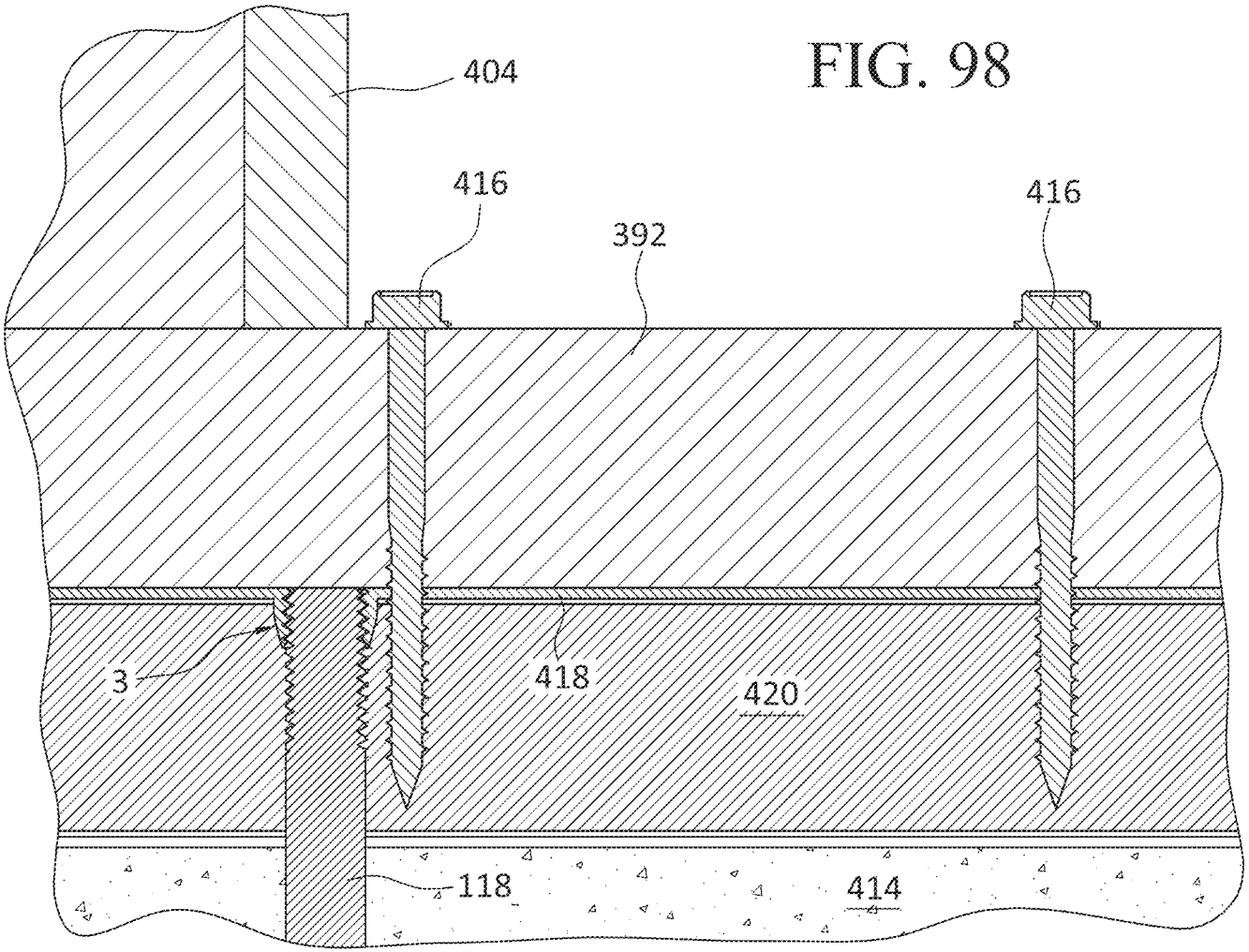
Figure 99:
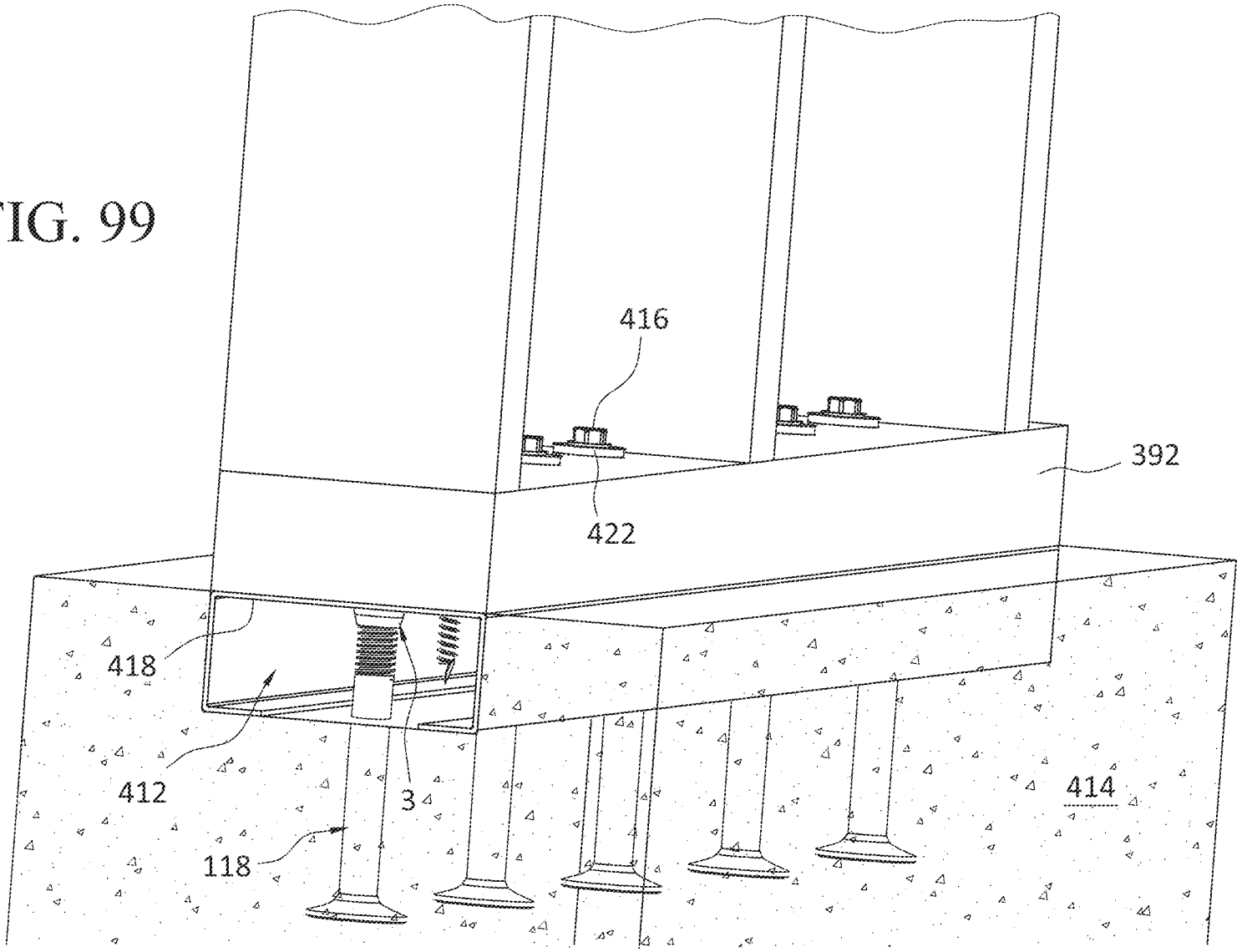
Figure 100:
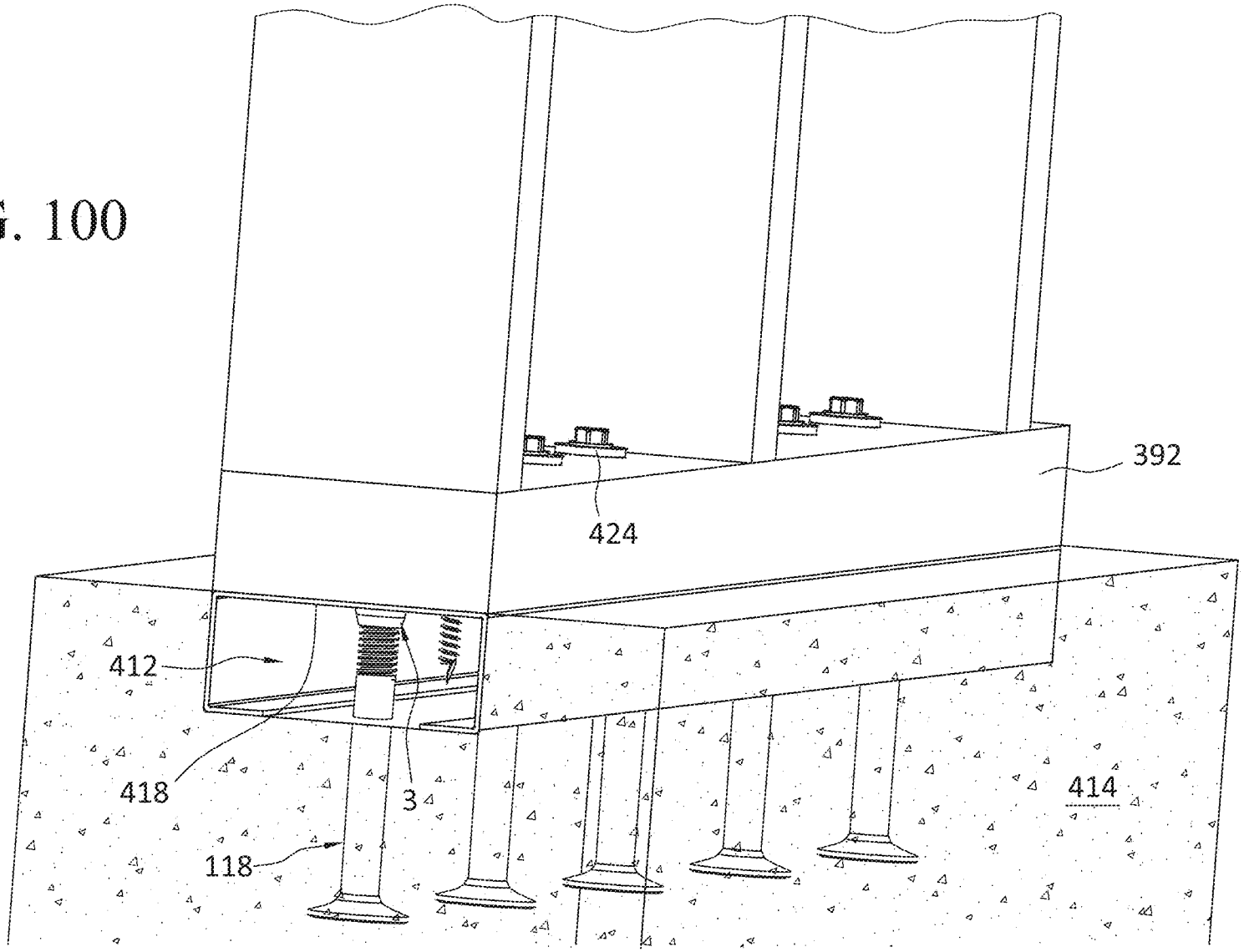

Referring to FIG. 96, the top edge 405 of the coupler 406 is flush with the top surface 407 of the concrete structure 414. A threaded rod 410 connects the coupler 406 to the bearing plate 396.

Referring to FIGS. 97, 98, 99 and 100, a C-shaped metal channel 412 is recessed into a concrete structure 414, such as a concrete foundation or concrete slab. The channel 412 is attached to anchor studs 118, which are embedded in the concrete structure. Screws 416 are used to attach the sill plate 392 to the metal channel 412. The base wall 418 of the channel 412 is provided with threaded boss openings 3 to which the anchor studs 118 are attached. The metal channel 412 may be filled with foam 420 to advantageously keep the wet concrete out. Washers 422 may be used with the screws 416 to increase the bearing area of the screw heads. Screws with extra-large screw heads 424 may also be used to increase the bearing area.

Figure 101:
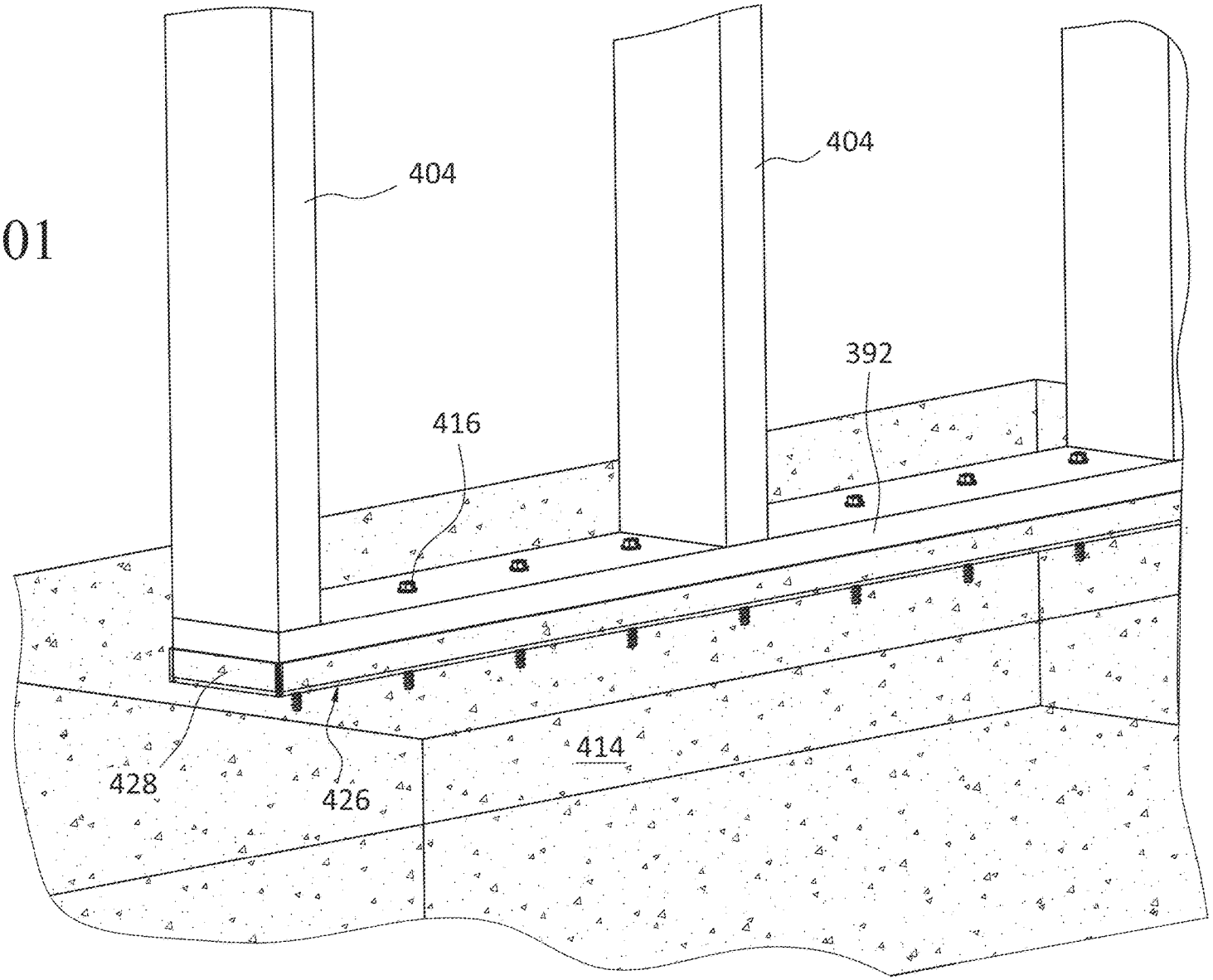

Referring to FIG. 101, a metal channel 426 is recessed into the concrete structure 414 with its top edge flush with the top of the concrete structure. The ends 428 of the metal channel 426 are bent to keep wet concrete out of the channel during pouring of the concrete. The sill plate 392 is partially recessed into the concrete structure. Screws 416 penetrate the sill plate 392, the metal channel 426 and the concrete structure 414. Shear forces on the stud wall are transferred from the sill plate 392 through the metal channel 426 to the concrete structure instead of solely through the anchor bolts to the concrete structure 414.

Figure 102:
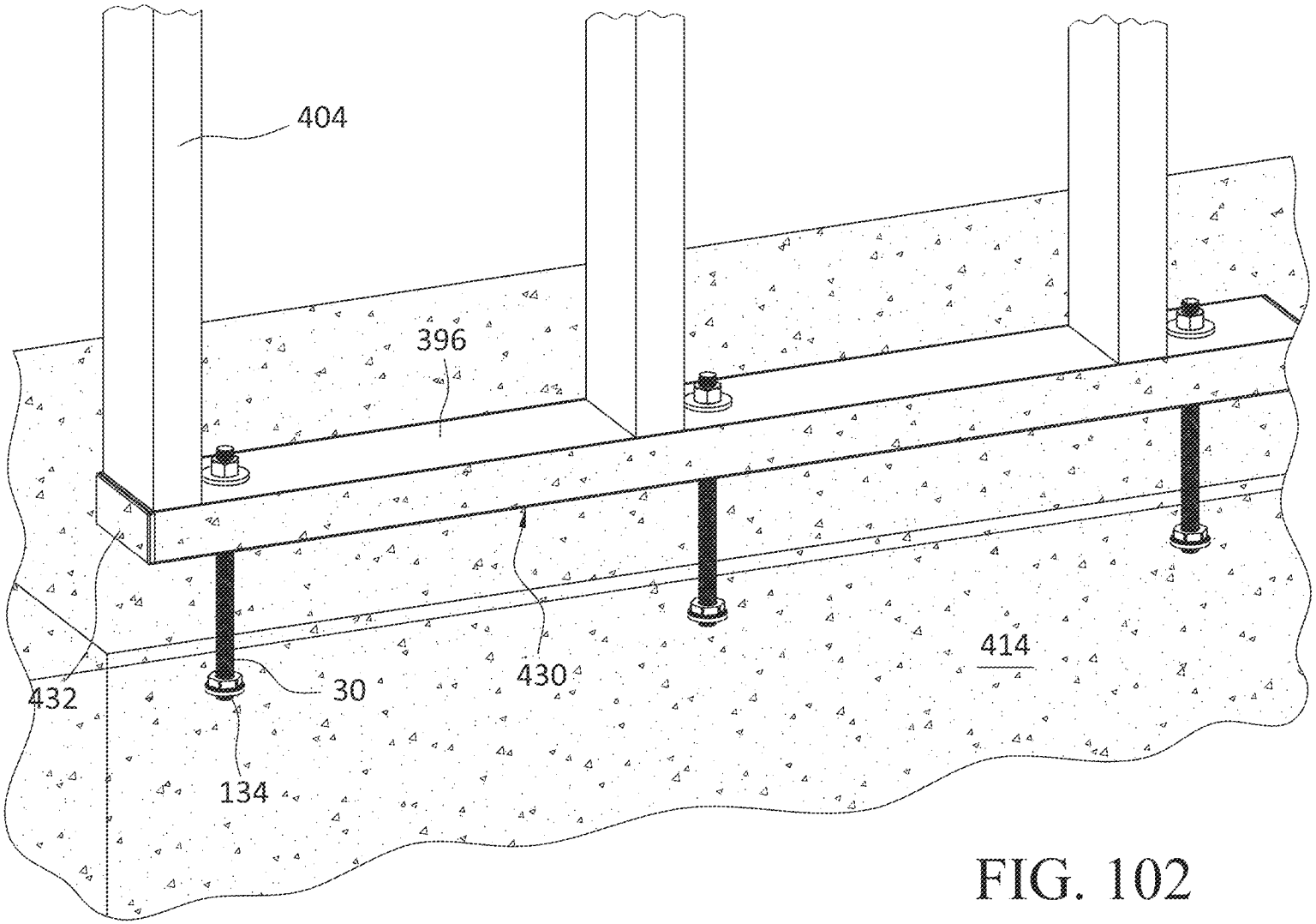
Figure 103:
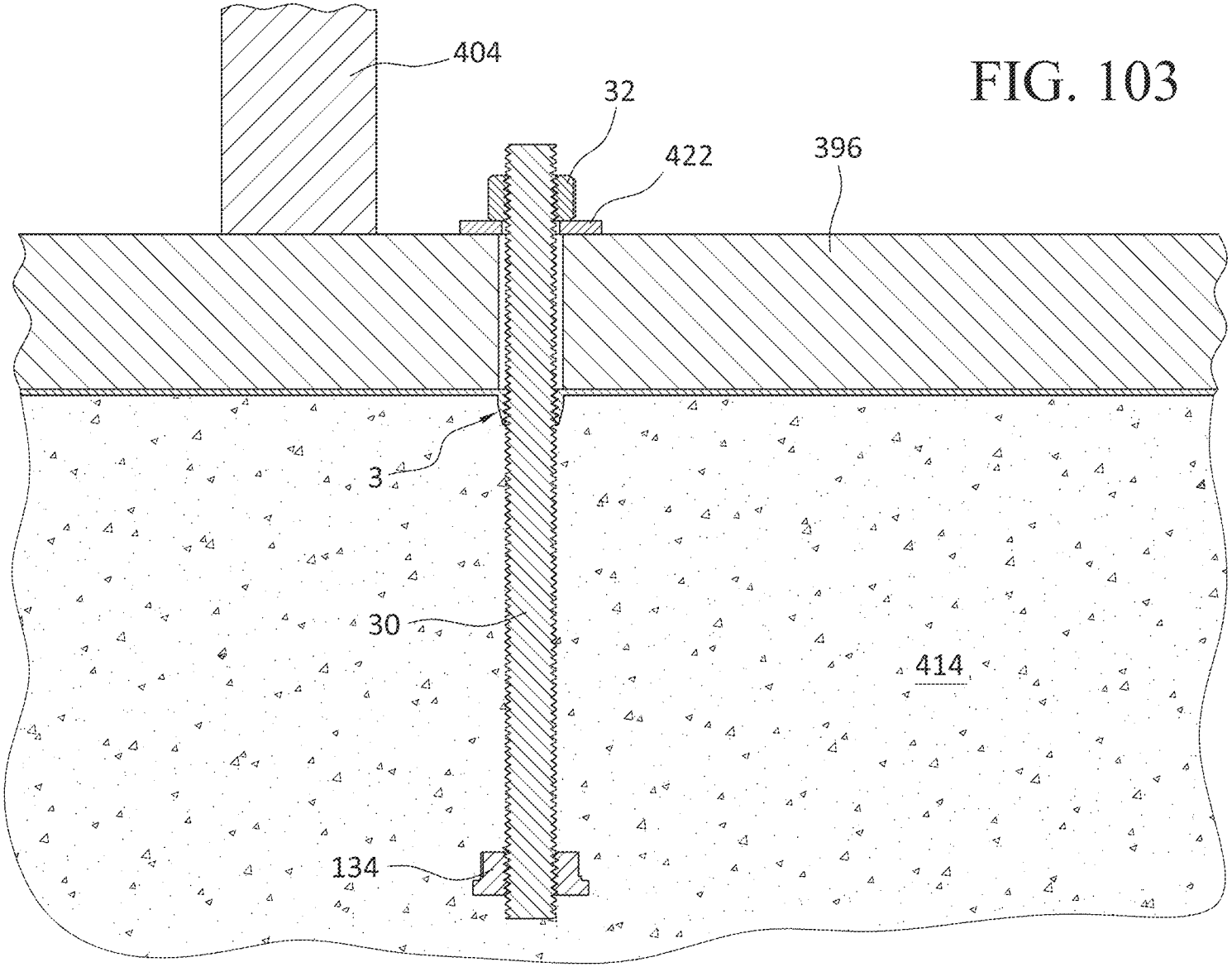

Referring to FIGS. 102 and 103, a metal channel 430 is recessed into the concrete structure with its top edge flush with the top surface of the concrete structure. Caps 432, preferably made of plastic, seal the ends of the metal channel 430 to keep concrete out during concrete pour. Bottom wall 434 of the channel 430 is provided with threaded boss openings 3. Anchor rods 30 are threaded to the threaded boss openings 3 and extend through the bottom plate 396, which is disposed inside the metal channel 430. The top of the bottom plate 396 is flush with the top of the concrete structure 414. Nuts 32 and washers 422 are used to attach the anchor rod to the sill plate 396.

Figure 104:
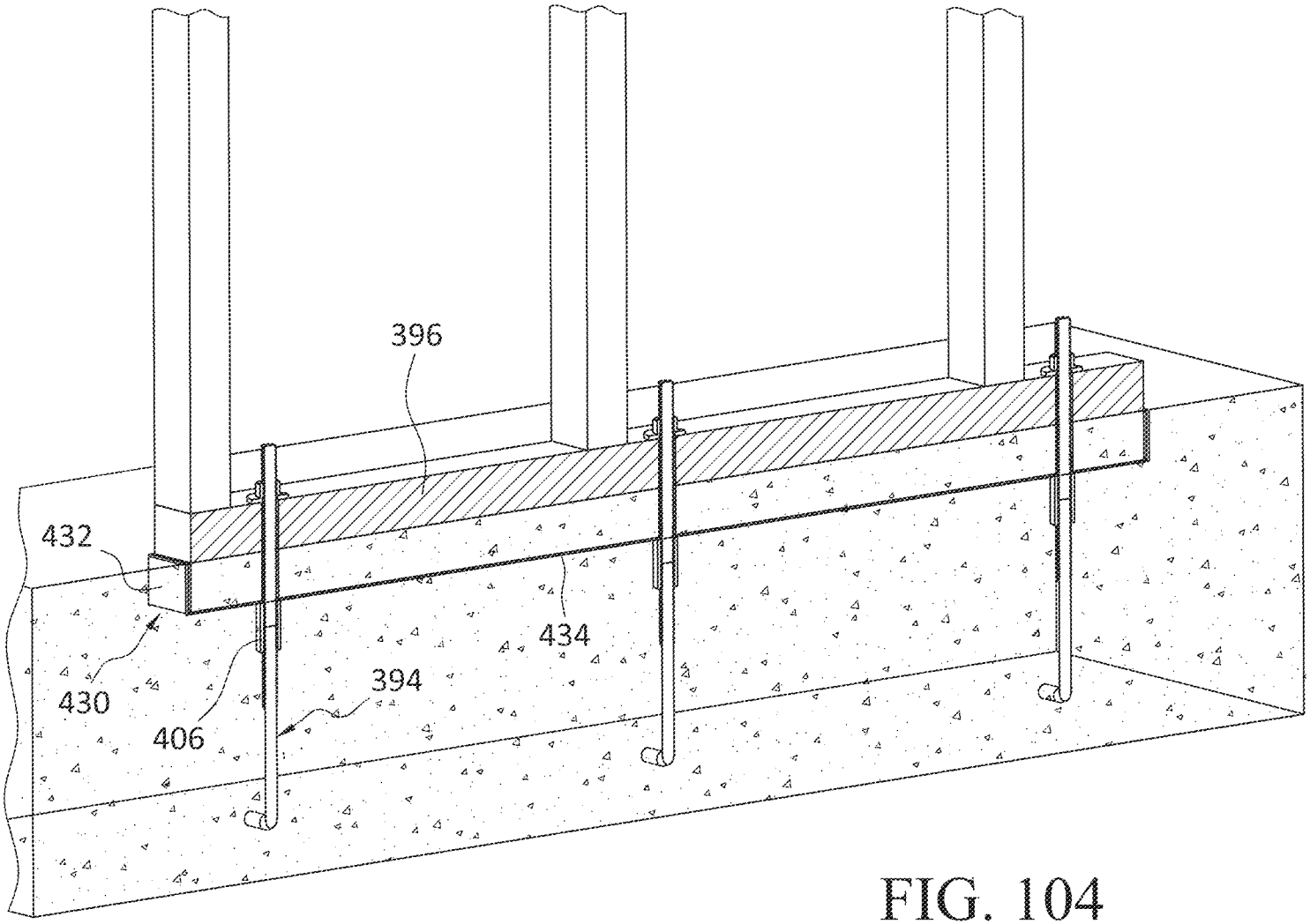
Figure 105:
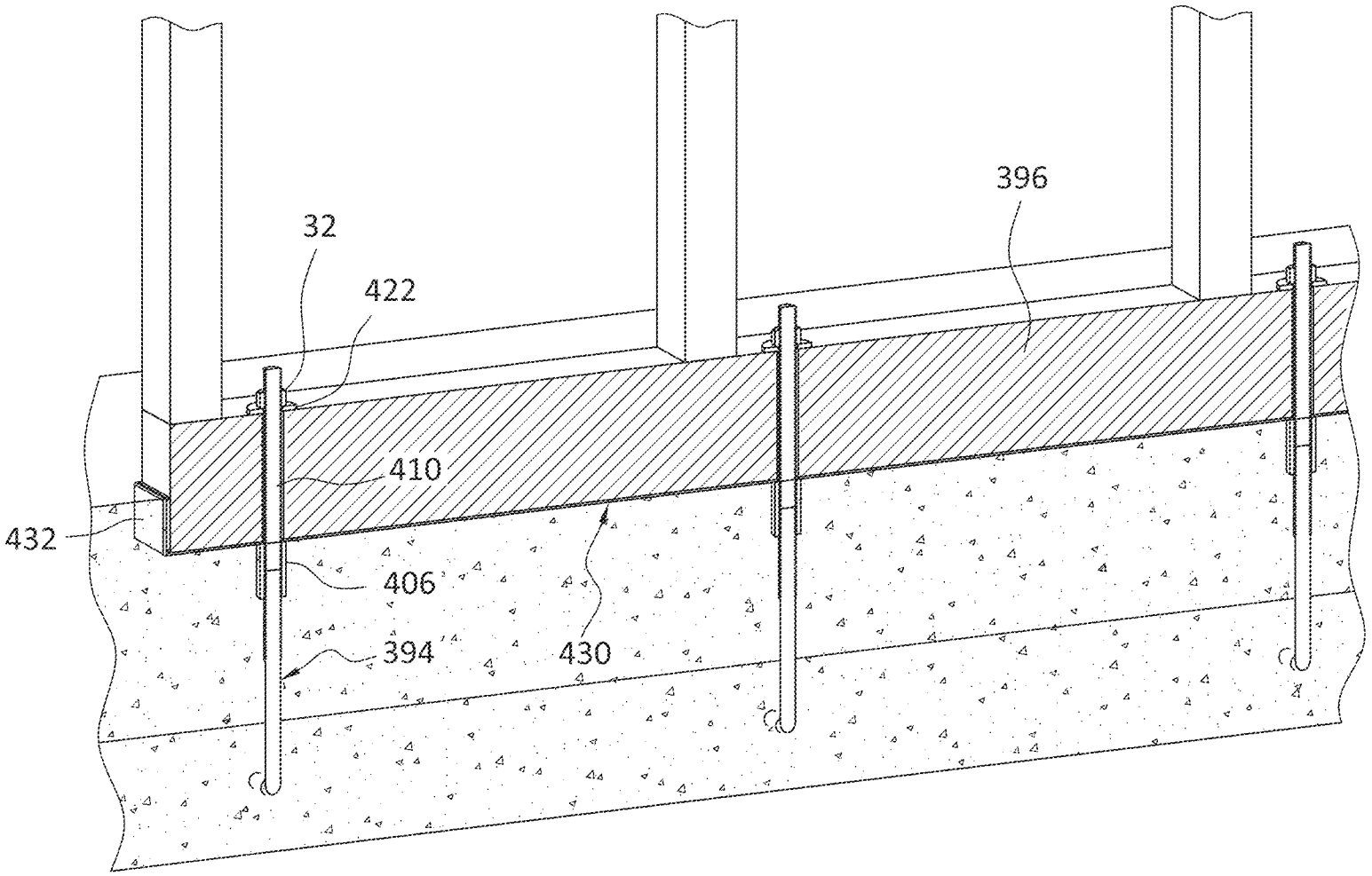
Figure 106:
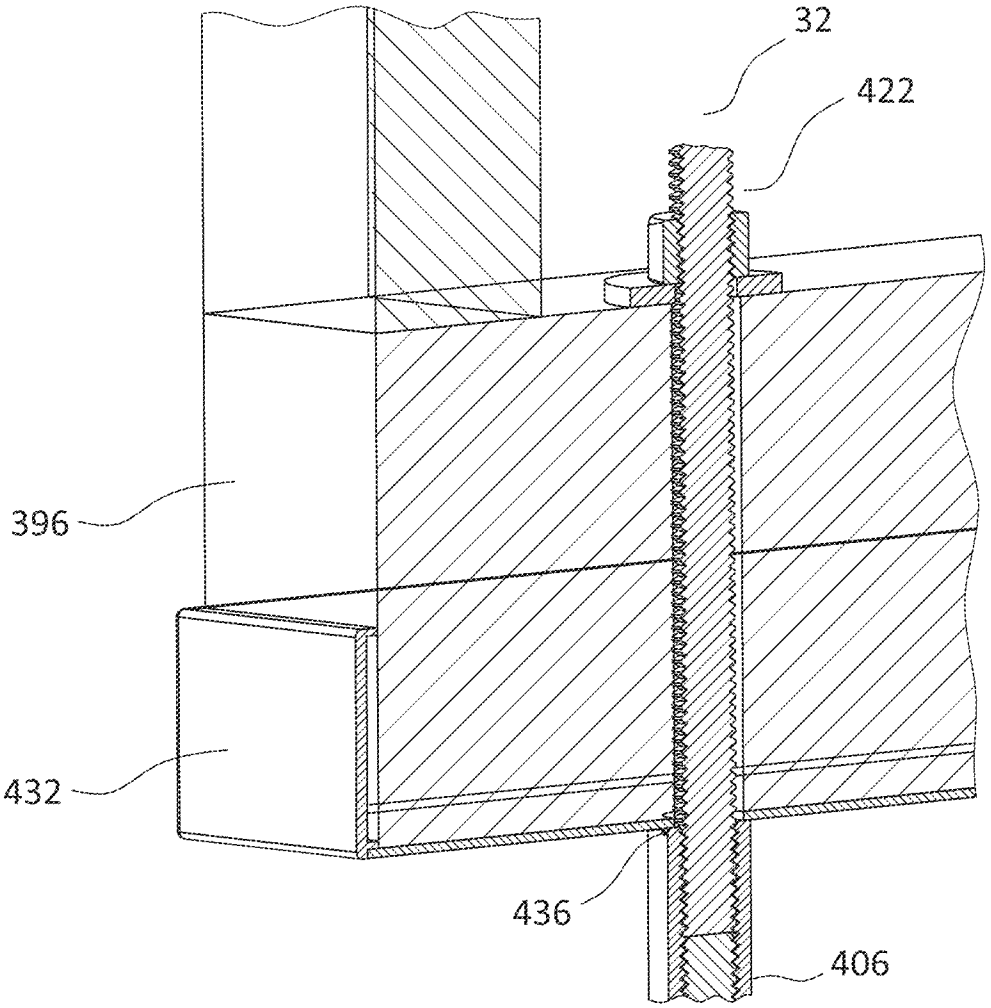

Referring to FIGS. 104, 105 and 106, bottom wall 434 of the metal channel 430 is provided with couplers 406 instead of the threaded boss openings 3. The couplers 406 are attached to the bottom wall 434 of the metal channel 430 by welding 436. The metal channel 430 is flush with the top of the concrete structure 414. The sill or bottom plate 396 may be two 2× or a single 4× so that part of the bottom plate 396 is above the concrete structure. Threaded rods 410 are attached to the couplers 406 and extend through the sill plate 396. Nuts 32 with washers 422 attach the rods 410 the sill plate 396.

Figure 107:
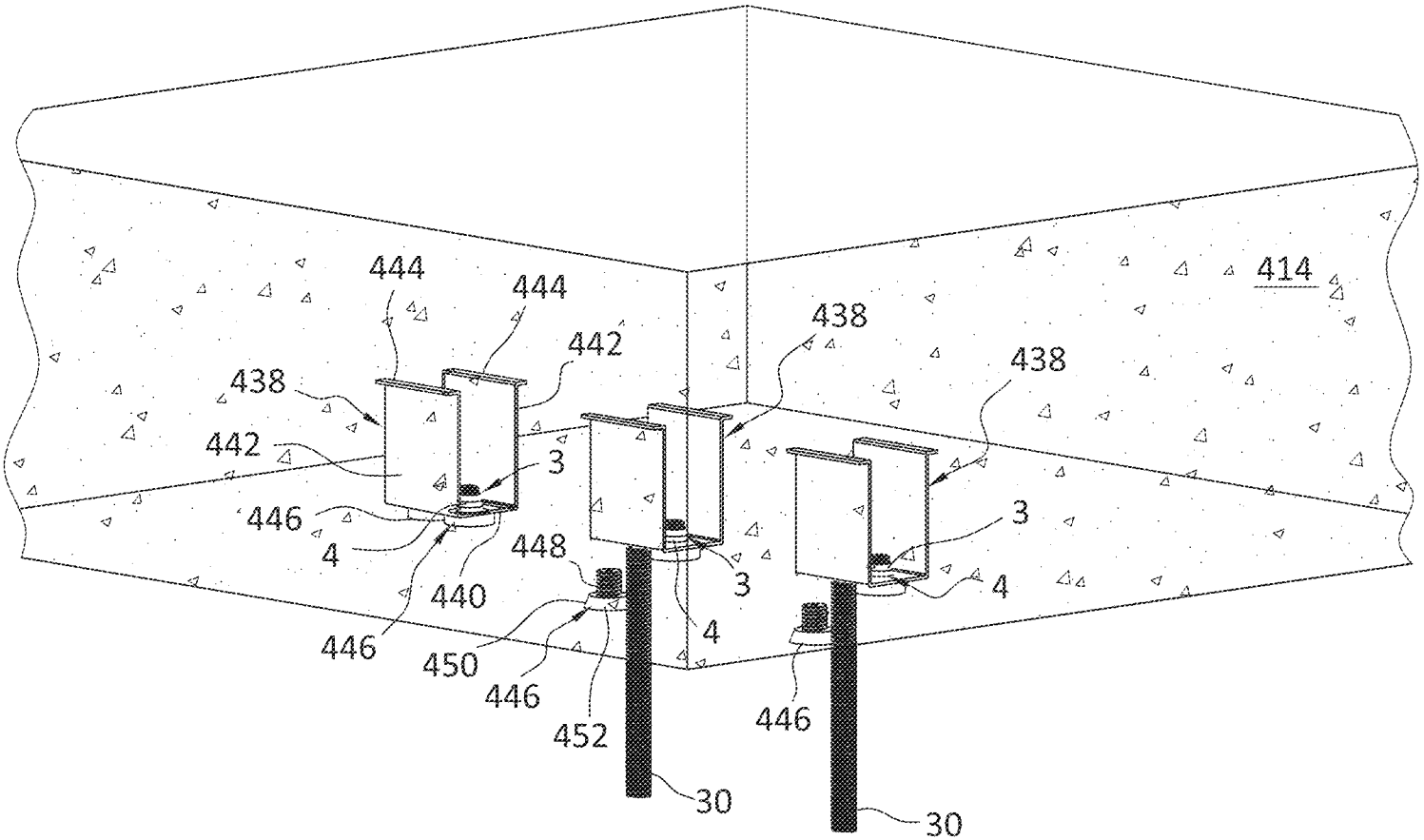
FIGS. 107-122 show several anchor assemblies embedded in concrete, using metal channels with threaded boss openings that are accessible from outside the concrete structure for attachment of threaded rods.

Referring to FIG. 107, concrete anchors 438 are shown embedded in concrete 414. The concrete anchors are hollow metal members. The anchor 438 is a U-shaped, bent meal channel with a base portion 440, side walls 442 and outer edge portions 444. The base portion 440 is provided with two threaded boss openings 3 with the respective boss sections 4 extending upwardly from the base portion 440 inside the U-shaped channel. The threaded boss openings 3 are provided with plastic plugs 446 to keep the wet concrete out. The threaded boss openings 3 may be of different diameter sizes to advantageously accommodate different size anchor rods 30. The outer edge portions 444 are turned 90° outwardly relative to the respective side walls 442. The edge portions 444 advantageously provide for concrete bearing surfaces relatively deep inside the concrete structure when the anchor rod 30 is subjected to tension loads. Two of the plastic plugs 446 are shown removed from the respective anchors 438 after the concrete has dried. The plug 446 includes a threaded stem portion 448 and a base portion 450. The stem portion 446 is threaded into the threaded boss opening 3. The base portion 448 has a circular shape with conical side surface 452 to advantageously facilitate removal of the plugs 446 after the concrete has dried and the formboard removed. With the plugs 446 removed, access to the threaded boss openings is then provided for attachment of the anchor rods 30 or any other hardware, such as bolts.

Figure 108:
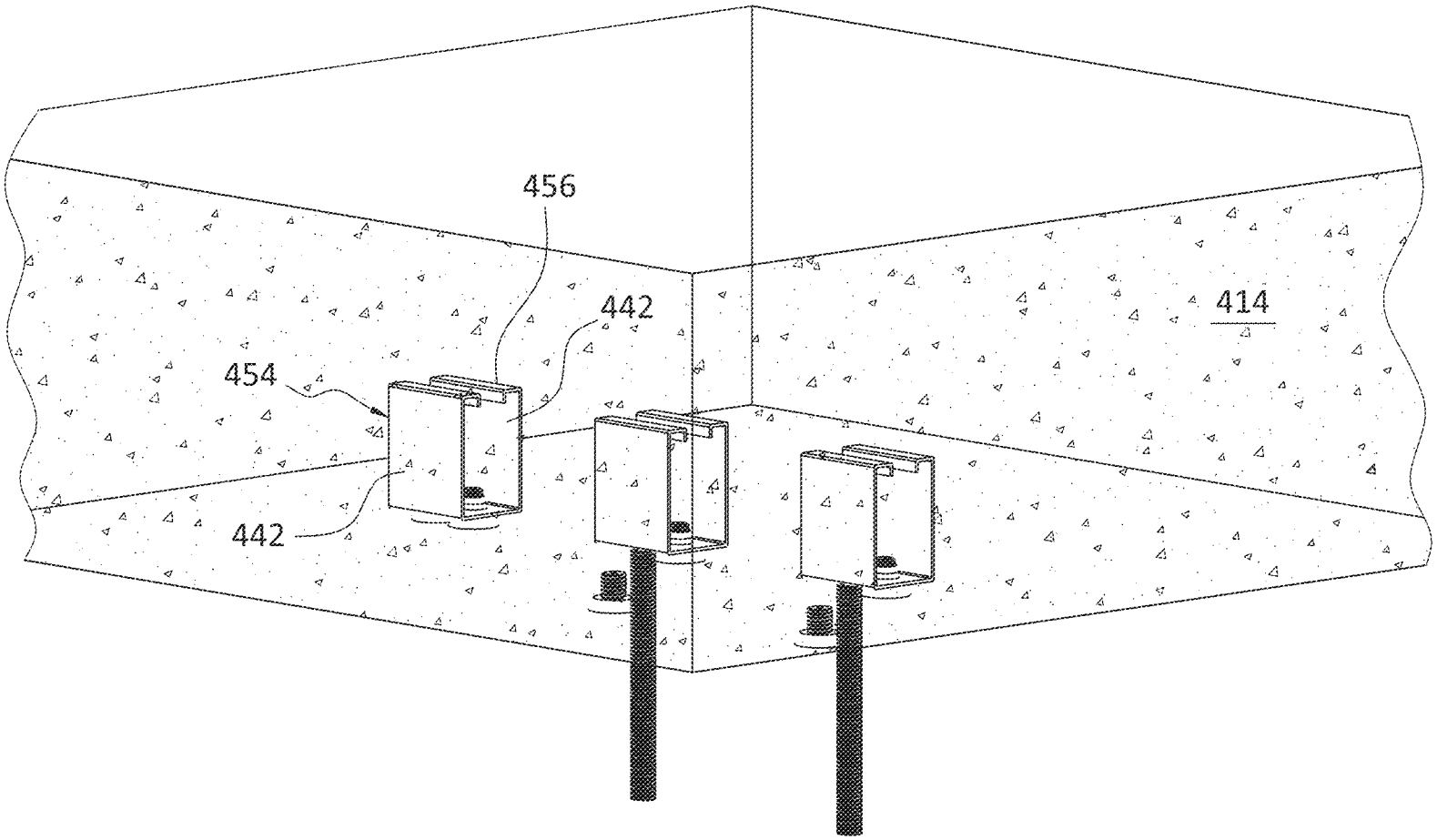

Referring to FIG. 108, the anchor 438 is modified as anchor 454 with edge portions 456 turned 90° inwardly twice relative to the respective side walls 442.

Figure 109:
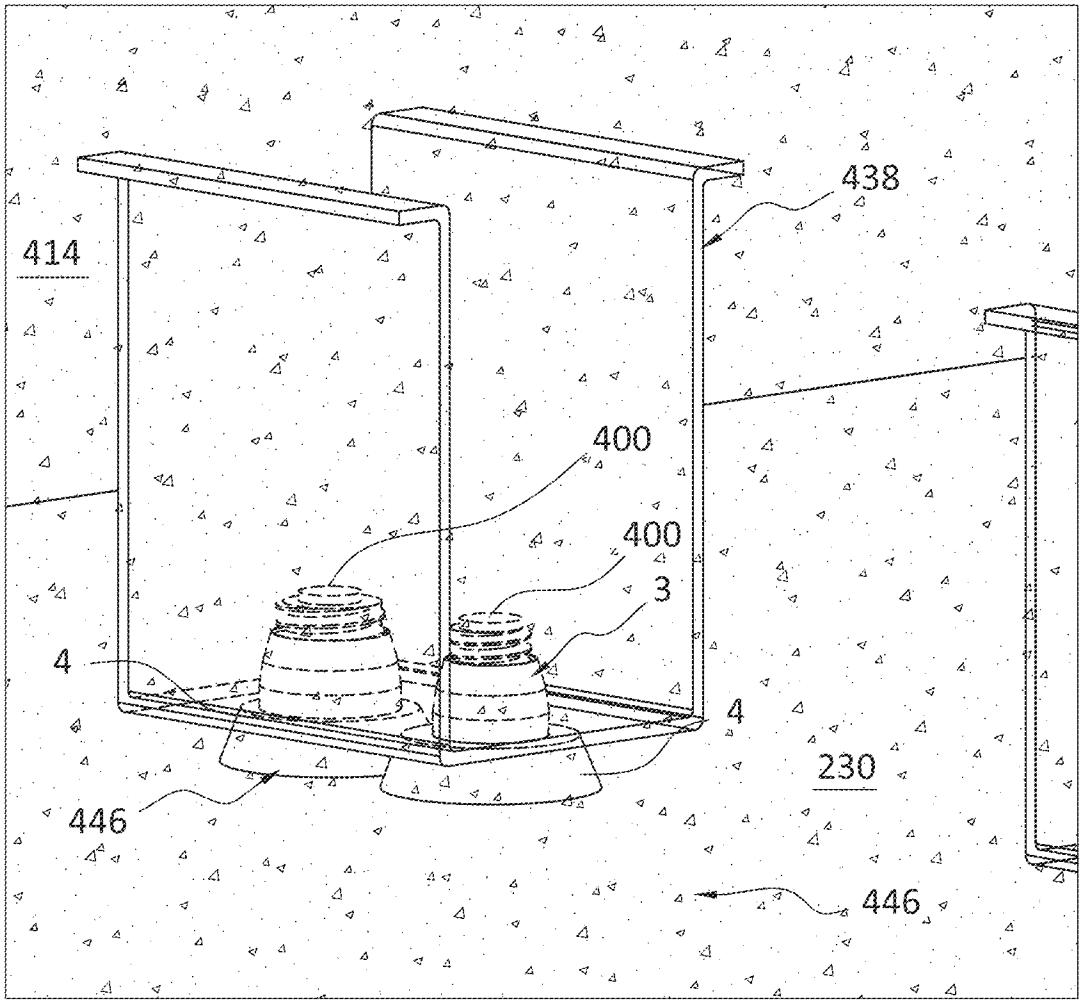

Referring to FIG. 109, the anchor 438 is attached to the formboard 230 with nails 400 through respective central openings in the plastic plugs 446.

Figure 110:
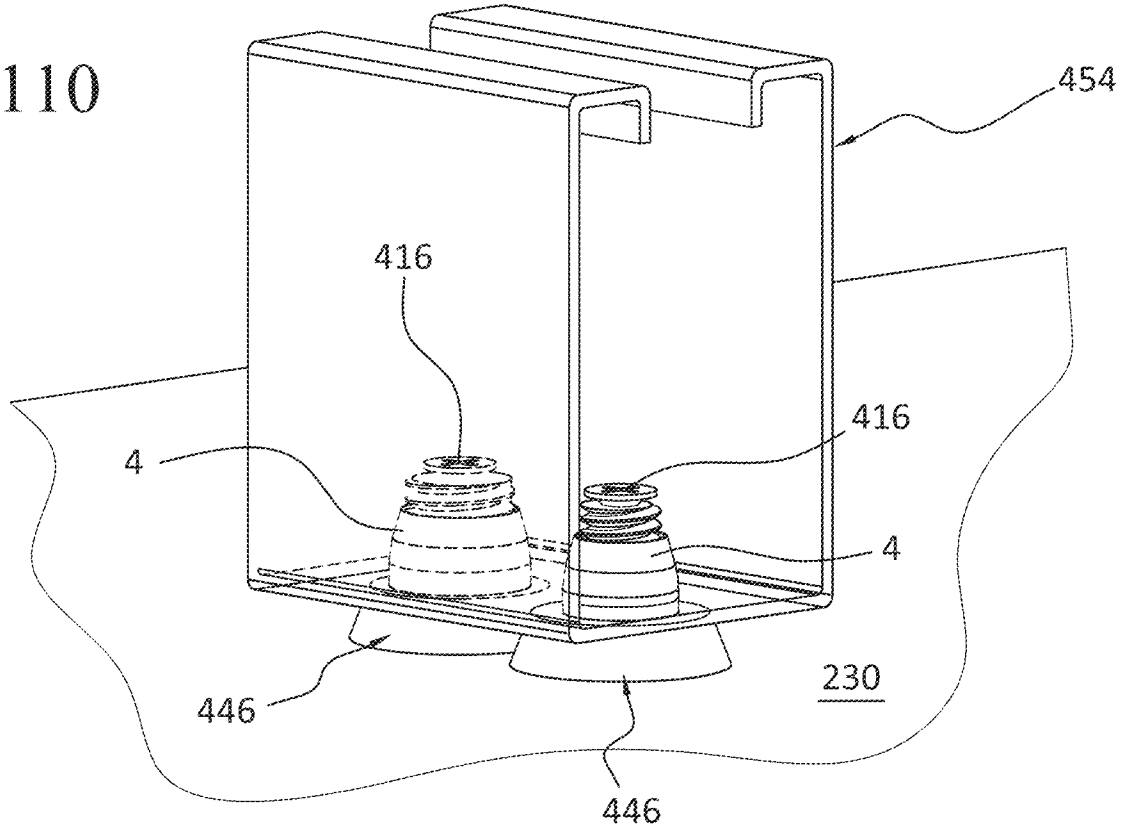

Referring to FIG. 110, screws 416 instead of the nails 400 may be used to attach the anchor 438 or 454 to the formboard 230.

Figure 111:
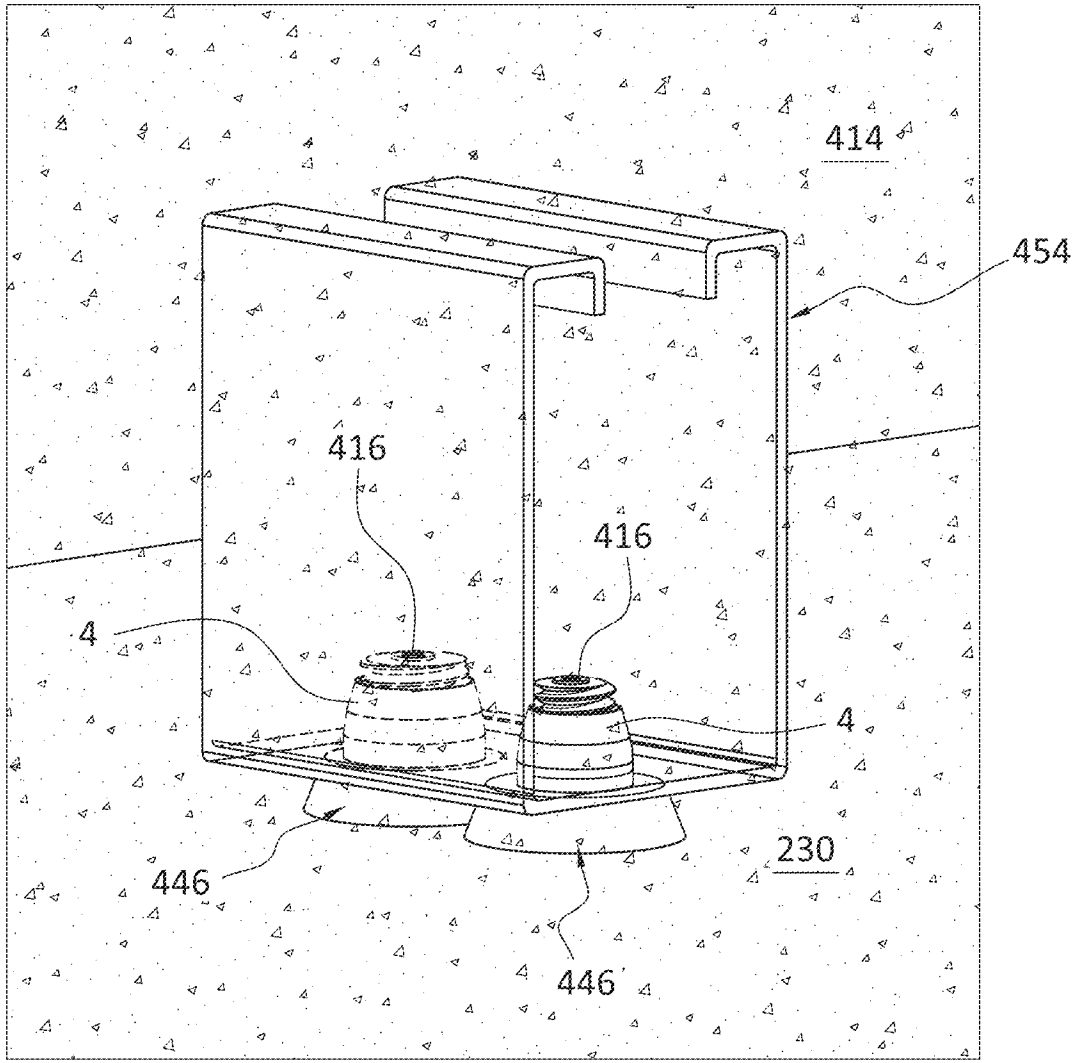

Referring to FIG. 111, the screws 416 may be flush with the top of the plugs 446 so concrete cannot get under the screw heads.

Figure 112:
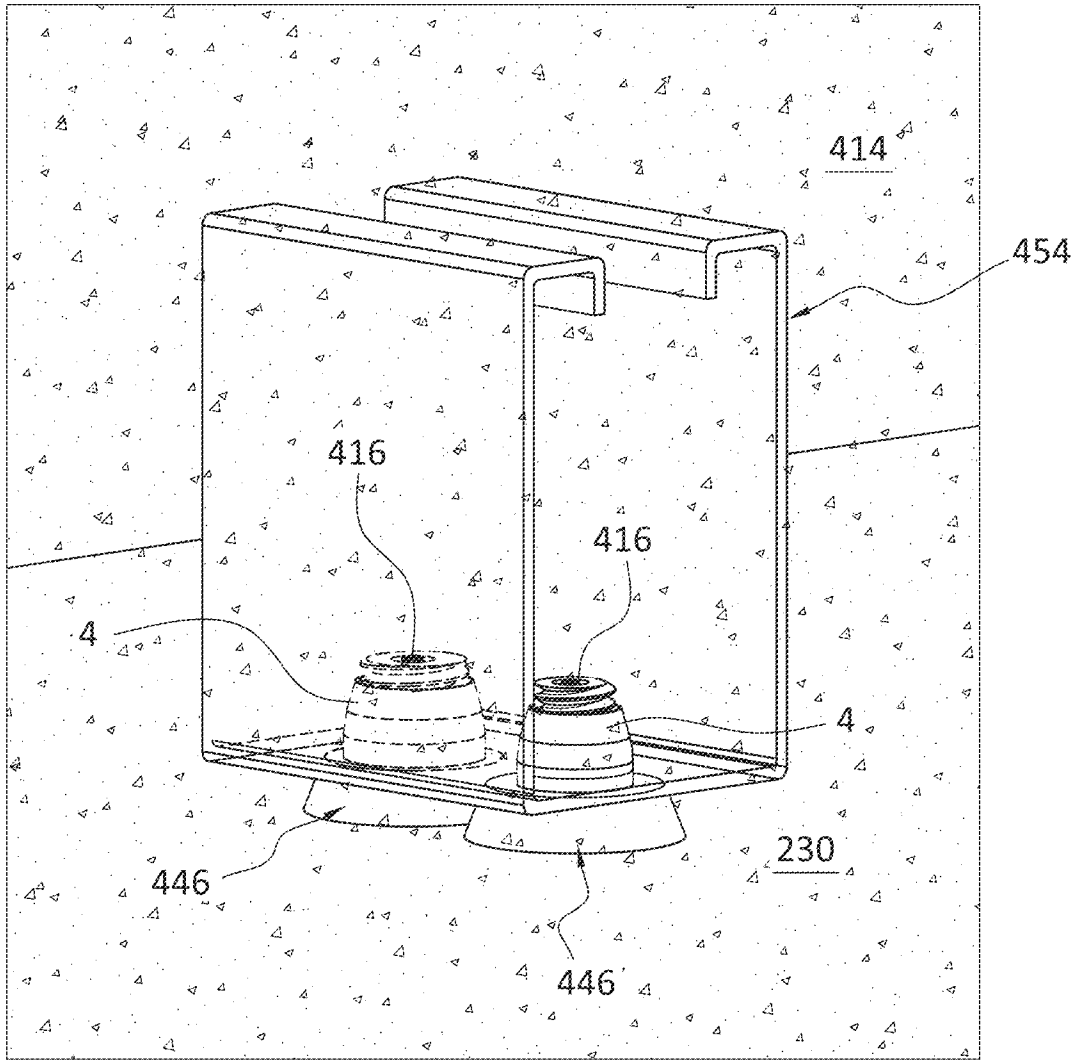

Referring to FIG. 112, the screw heads of the screws 416 may be recessed into the plugs 446.

Figure 113:
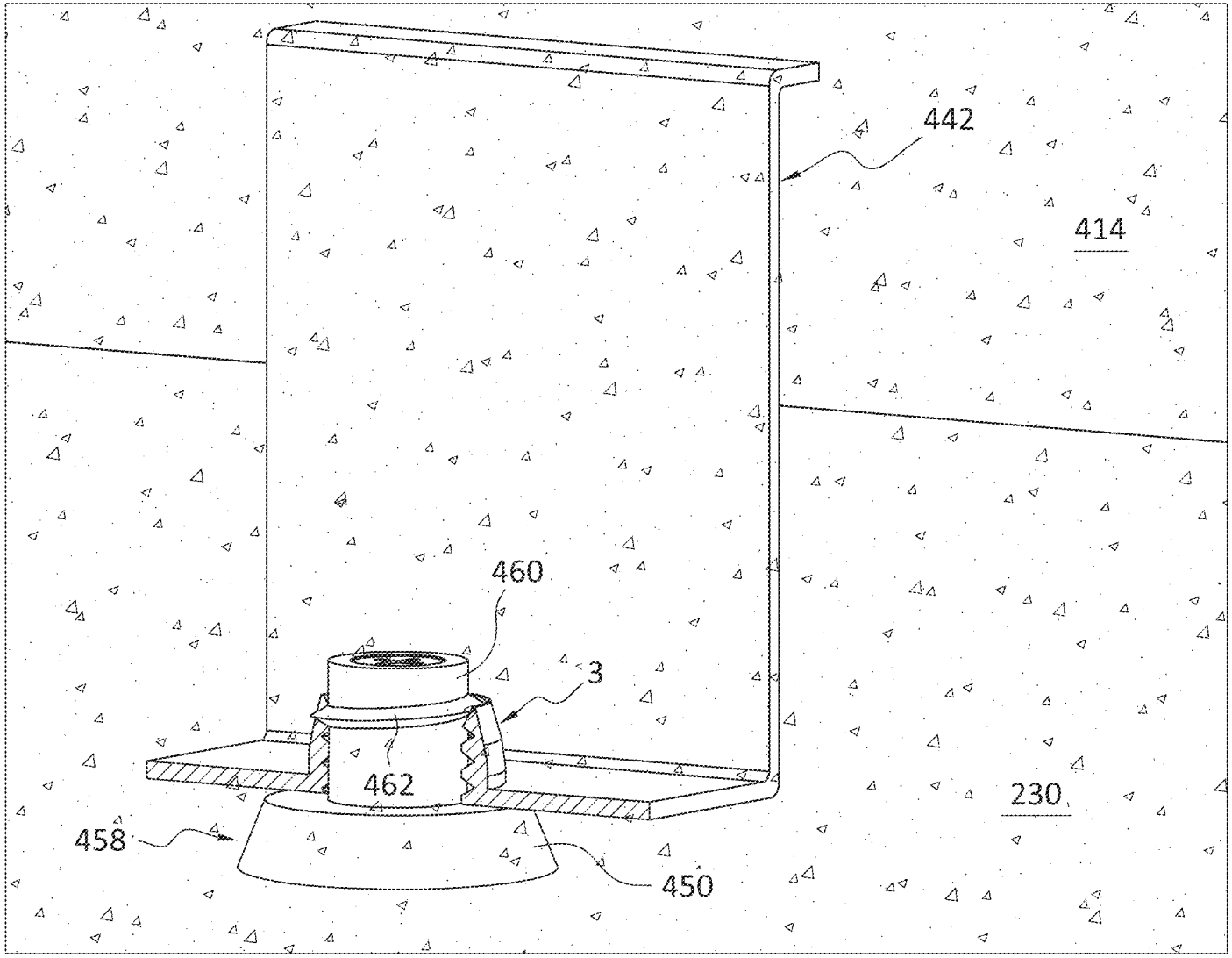

Referring to FIG. 113, the plastic plug 446 is modified as plastic plug 458 with a stem portion 460 and a base portion 452. The stem portion 460 is provided with only one revolution thread 462. The single revolution thread 462 is sufficient to seal the threaded boss opening 3 from the wet concrete and weak enough to break when the formboard 230 is removed so that the plug 458 remains attached to the formboard 230 when the formboard is removed.

Figure 114:
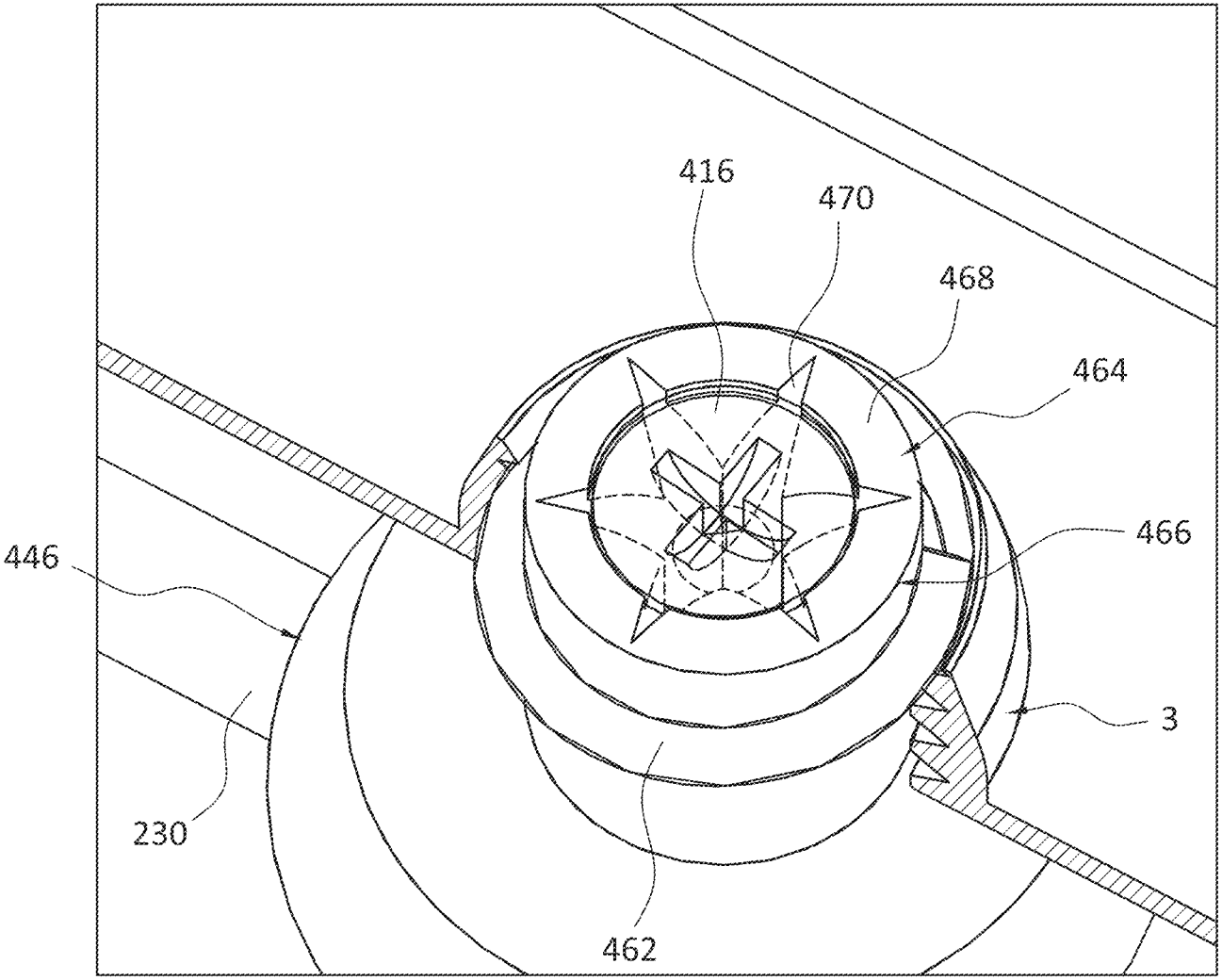

Referring to FIG. 114, the plastic plug 458 is modified as plastic plug 464 with a stem portion 466. The stem portion 466 includes a wall portion 468 with a plurality of V-shaped or triangular slots 470 that extend downwardly through the base portion 446 so that the wall portion 468 can collapse into the triangular slots 470 and allow the stem portion 466 to be disengaged from the threaded boss opening 3 when the formboard 230 is removed. The wall portion 468 will collapse around the screw 416 so that the screw will remain with the plug and the formboard during removal of the formboard 230.

Figure 116:
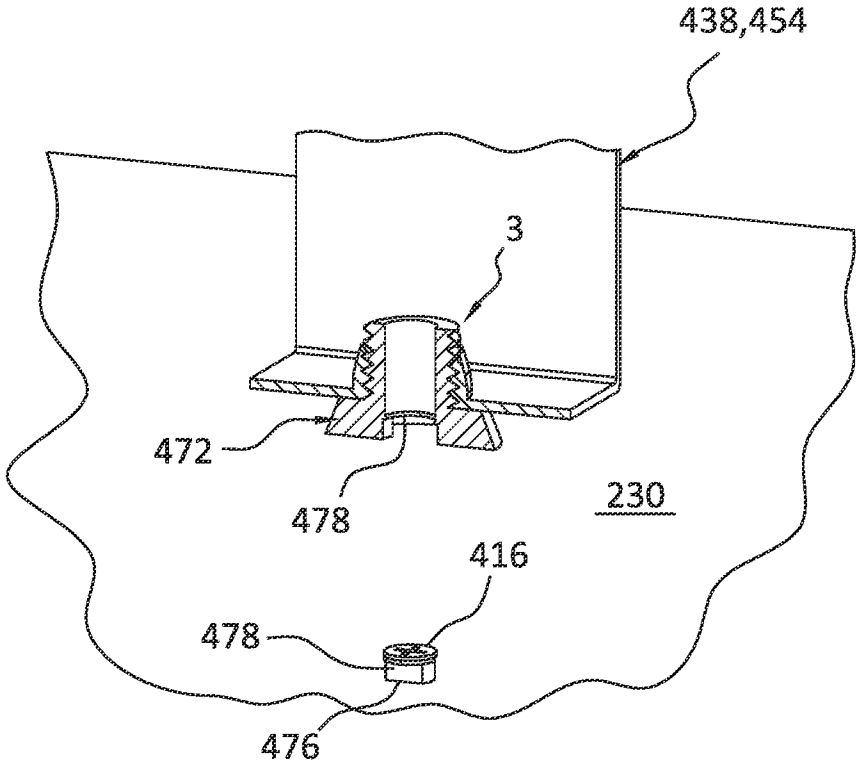
Figure 115:
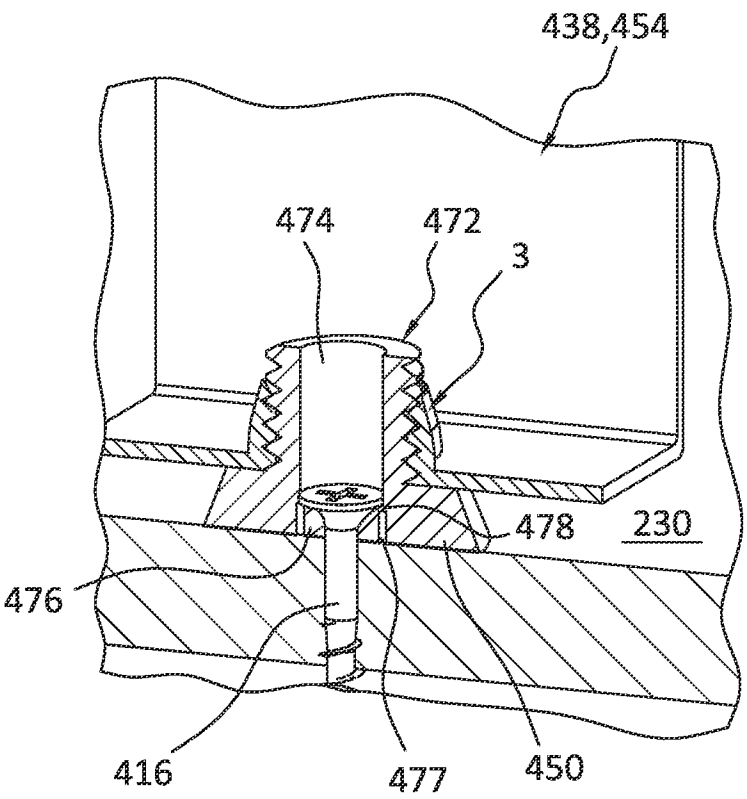

Referring to FIGS. 115 and 116, the plastic plug 446 is modified as plastic plug 472 with a central opening 474 extending down to the base portion 450. A flange portion 476 underneath the head of the screw 416 is weakened with a circumferential undercut 477 so that when the formboard 230 is removed, the screw 416 and the portion 476 remain attached to the formboard 230. The rest of the plastic plug 472 remains attached to the threaded boss opening 3 and the anchor 438 or 454. The bottom of the opening 474 has a thin circumferential portion 478 connecting the portion 476 to the opening 474 so that when the formboard 230 is removed from the concrete structure, the portion 478 breaks to allow the portion 476 and the screw 416 to remain attached to the formboard 230. Accordingly, removal of the formboard 230 and the screw 416 is advantageously facilitated.

Figure 118:
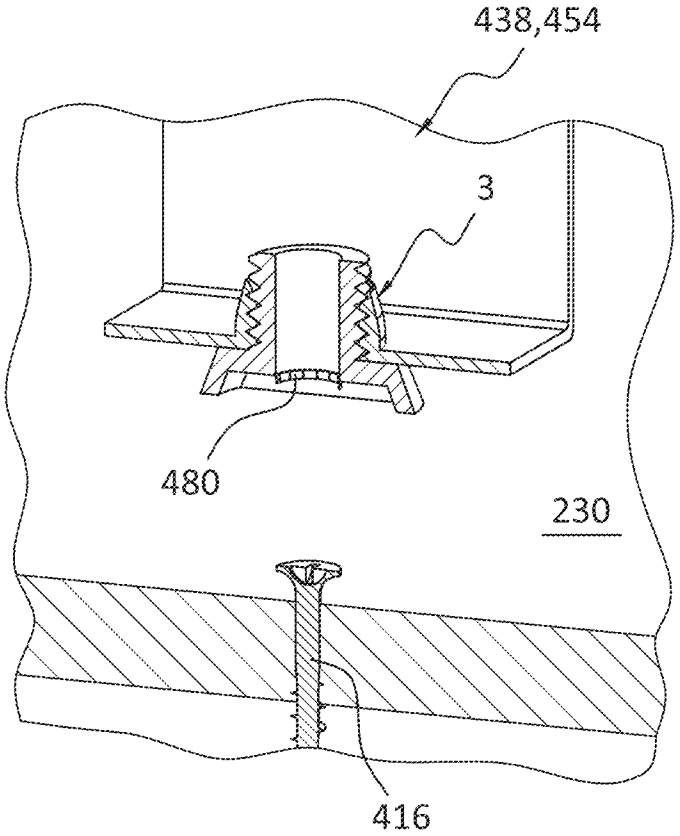
Figure 117:
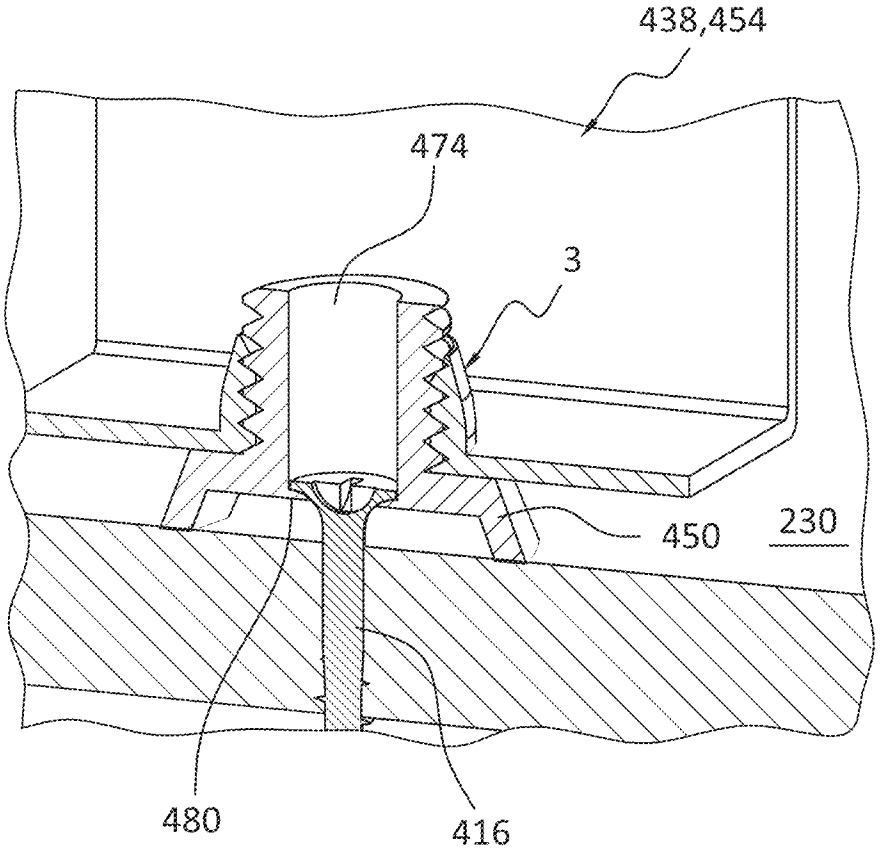

Referring to FIGS. 117 and 118, the bottom of the base portion 450 is hollow. A breakable circumferential flange portion 480 supports the head of the screw 416 in the opening 474. The flange portion 480 is sufficiently thin with a thickness so as to be breakable by the screw head when the formboard 230 to which the screw is attached is removed. The thickness of the flange portion 480 is such that the force required to break the flange portion 480 with the screw head is less than the force required to rip the screw from the formboard. The force differential allows the head of the screw 416 to break through the flange portion 480 when the formboard is removed, leaving the screw 416 to remain attached to the formboard 230. The plug remains attached to the opening 3 but is removed prior to attaching the threaded rod 30.

Figure 119:
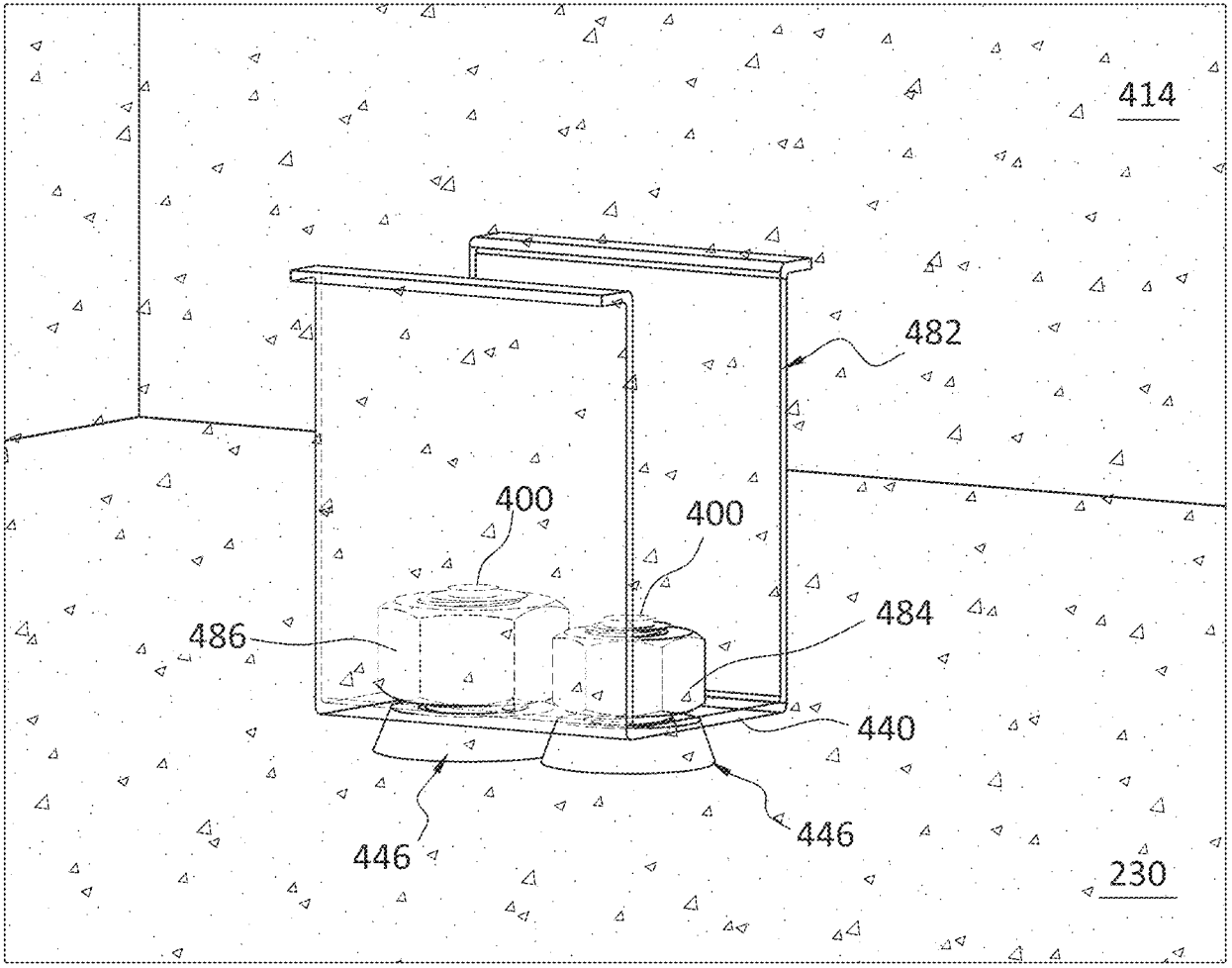

Referring to FIG. 119, the anchor 438 shown in FIG. 107 is modified as anchor 482 without the threaded boss openings 3. The plastic plugs 446 secure hex nuts 484 and 486 to the base portion of the anchor 438 and keep the concrete out from the threads of the hex nuts. The hex nut 440 has a smaller threaded opening than the hex nut 486 to advantageously allow use of different diameter anchor rods. Nails 400 or screws may be used to secure the anchor 482 to the formboard 230.

Figure 120:
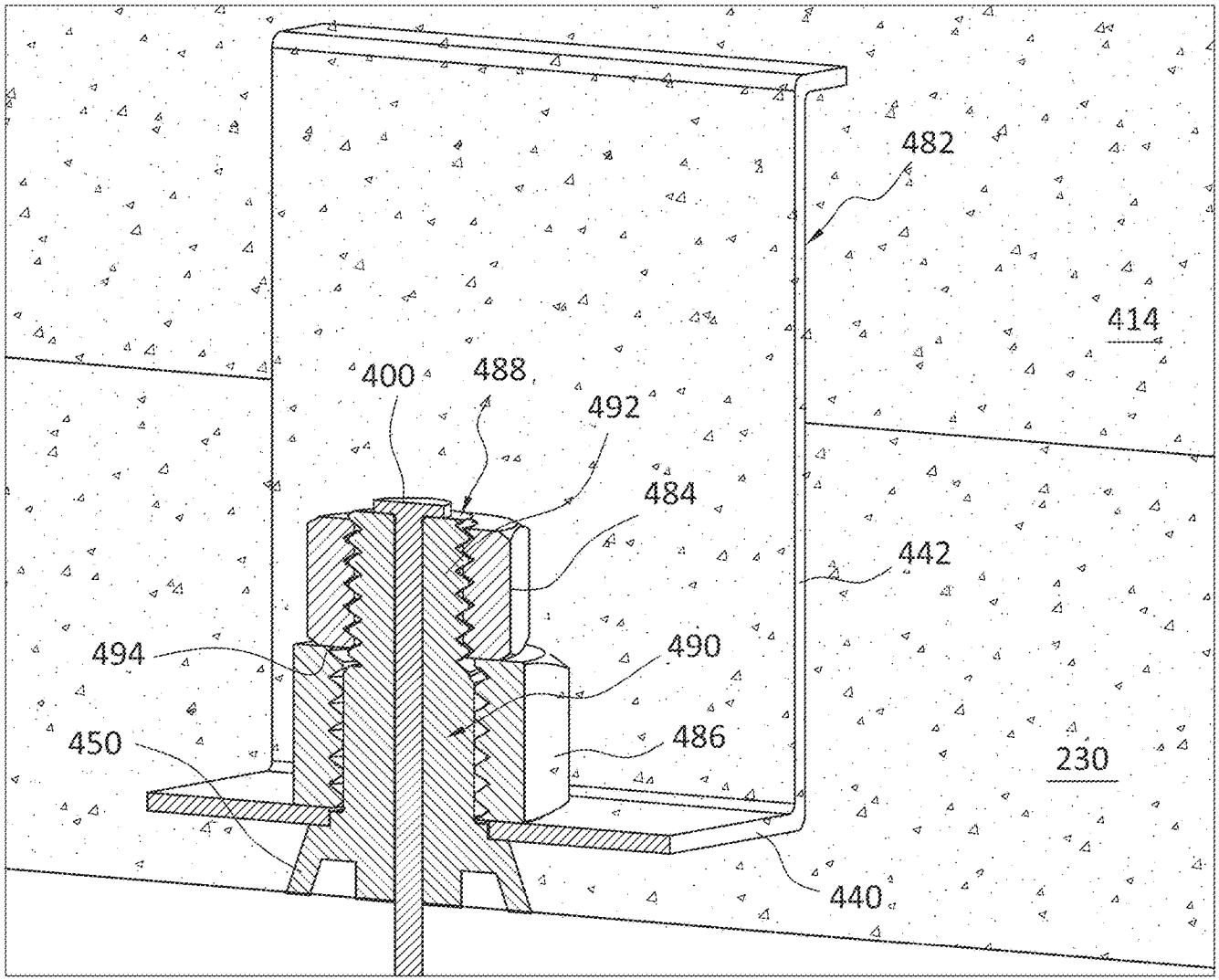

Referring to FIG. 120, the plastic plug 486 is modified as plastic plug 488 with a stem portion 488 having a larger diameter cylindrical portion 490 and a smaller diameter threaded portion 492. Hex nut 486 486 is attached to the cylindrical portion 490. Hex nut 484 is threaded to the threaded portion 492. Contact surfaces 494 between the hex nuts 484 and 486 advantageously seal the inside of the hex nut 486 from the concrete. Nail 400 or a screw attaches the anchor 482 to the formboard. After the formboard and the plug 488 are removed after the concrete has dried, an anchor rod of one size appropriate for the hex nut 486 or a different anchor rod of smaller size appropriate for the hex nut 484 may be used.

Figure 121:
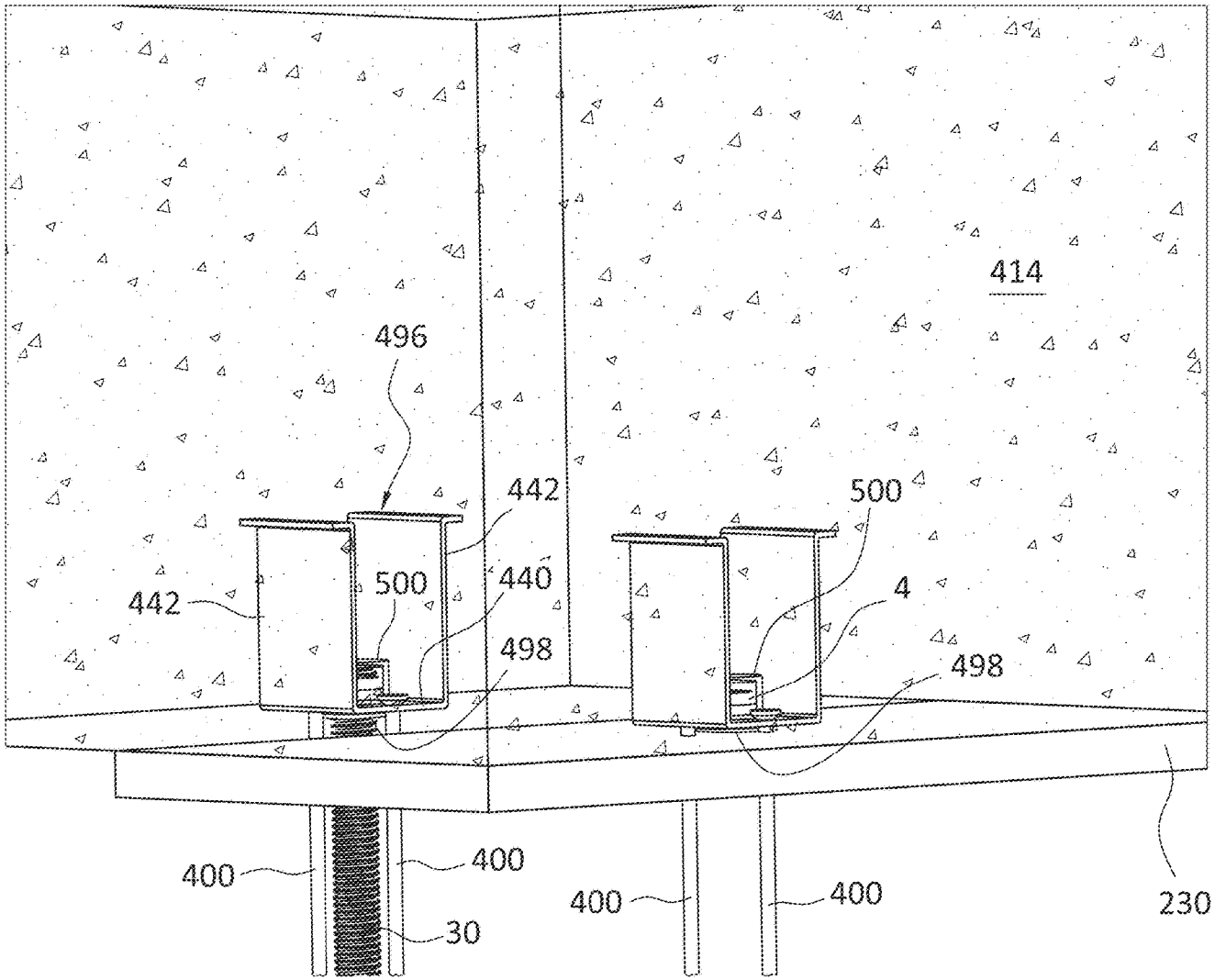

Referring to FIG. 121, the anchor 438 shown in FIG. 107 is modified as anchor 496. Threaded boss openings 3 are formed in the base portion 440. A collar 498 is formed around the openings 3 on underside of the base portion 440. The collar 498 advantageously seals the opening 3 when pressed against the formboard 230 during attachment of the anchor 496 to the formboard with nails 400. A cap 500 closes the top of the opening 3 inside the anchor 496 to keep the concrete from entering the opening. The cap 500 may be a tape disposed on top of the opening and adhered to the side of the boss section 4.

Figure 122:
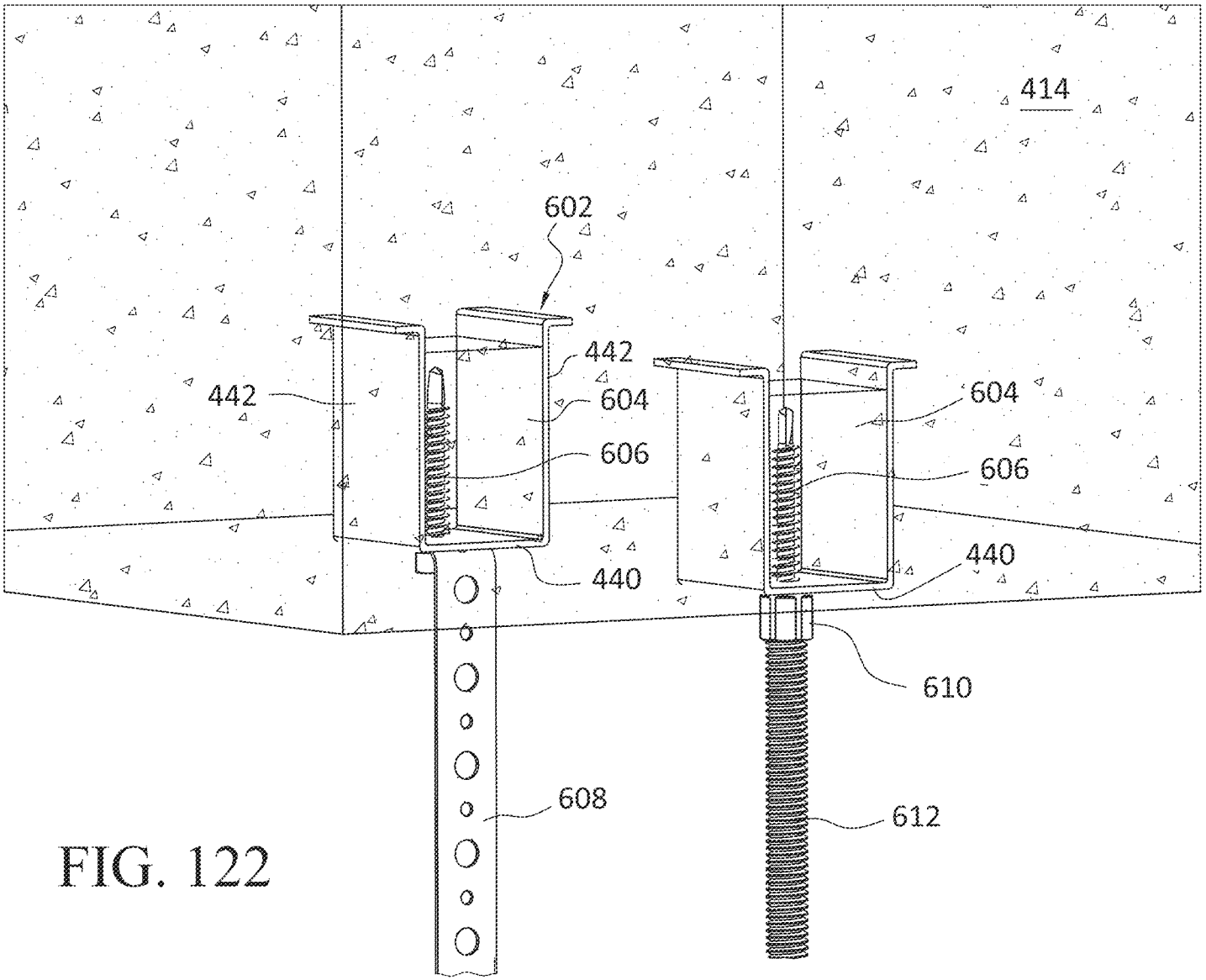

Referring to FIG. 122, the anchor 438 shown in FIG. 107 is modified as anchor 602. The base portion 440 does not have any opening. The anchor 602 is attached to the formboard with nails or screws through the base portion 440, such as shown in FIG. 121. The interior space between the side walls 442 is filled with foam 604 to keep the concrete out. When the formboard is removed, the base portion 440 becomes visible to the user. To use the anchor 602, a sheet metal screw 606, preferably self-tapping, is used to attach a metal strap 608 to the base portion 440. The screw 606 creates its own thread in the base portion 440 and protrudes into the foam 604. A threaded cup 610 may be attached to the base portion 440 using the sheet metal screw 606. A hanger rod 612 is then threaded to the cup 610.

Figure 123:
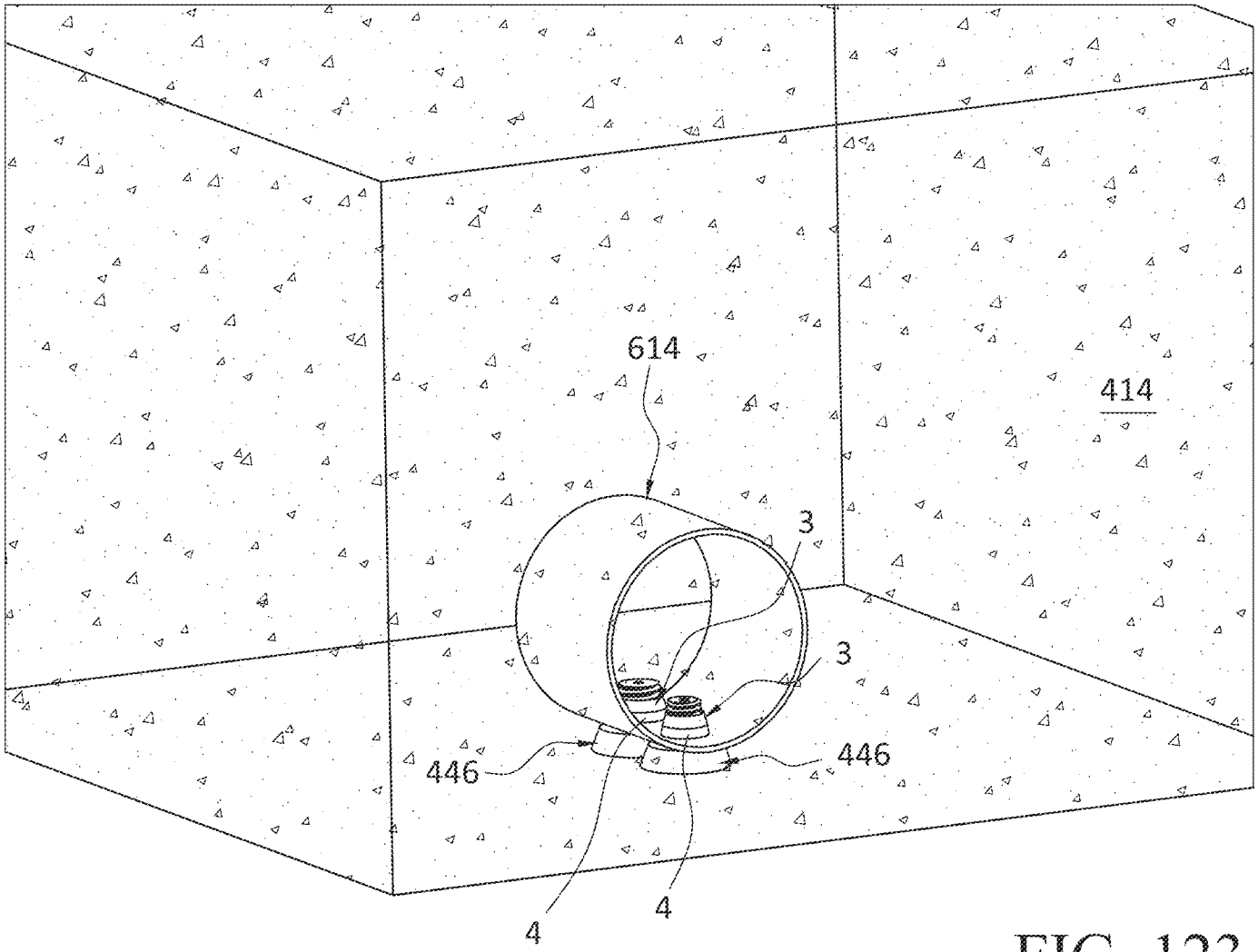
FIGS. 123-126 show several anchor assemblies embedded in concrete, using tubular channels with threaded boss openings that are accessible from outside the concrete structure for attachment of threaded rods.

Referring to FIG. 123, a tubular anchor 614 is shown embedded in a concrete structure 414. The tubular anchor 614 is a hollow metal member. Threaded boss openings 3 are provided in the wall of the anchor 614. Boss sections 4 extend into the interior of the anchor 614. Plastic plugs 446 plug the respective openings 3 to keep concrete out. The threaded boss openings 3 may be of different sizes to accommodate different size rods. The plugs 446 are later removed after the concrete has dried to provide access to the openings 3 for attachment of anchor rods (see FIG. 107).

Figure 124:
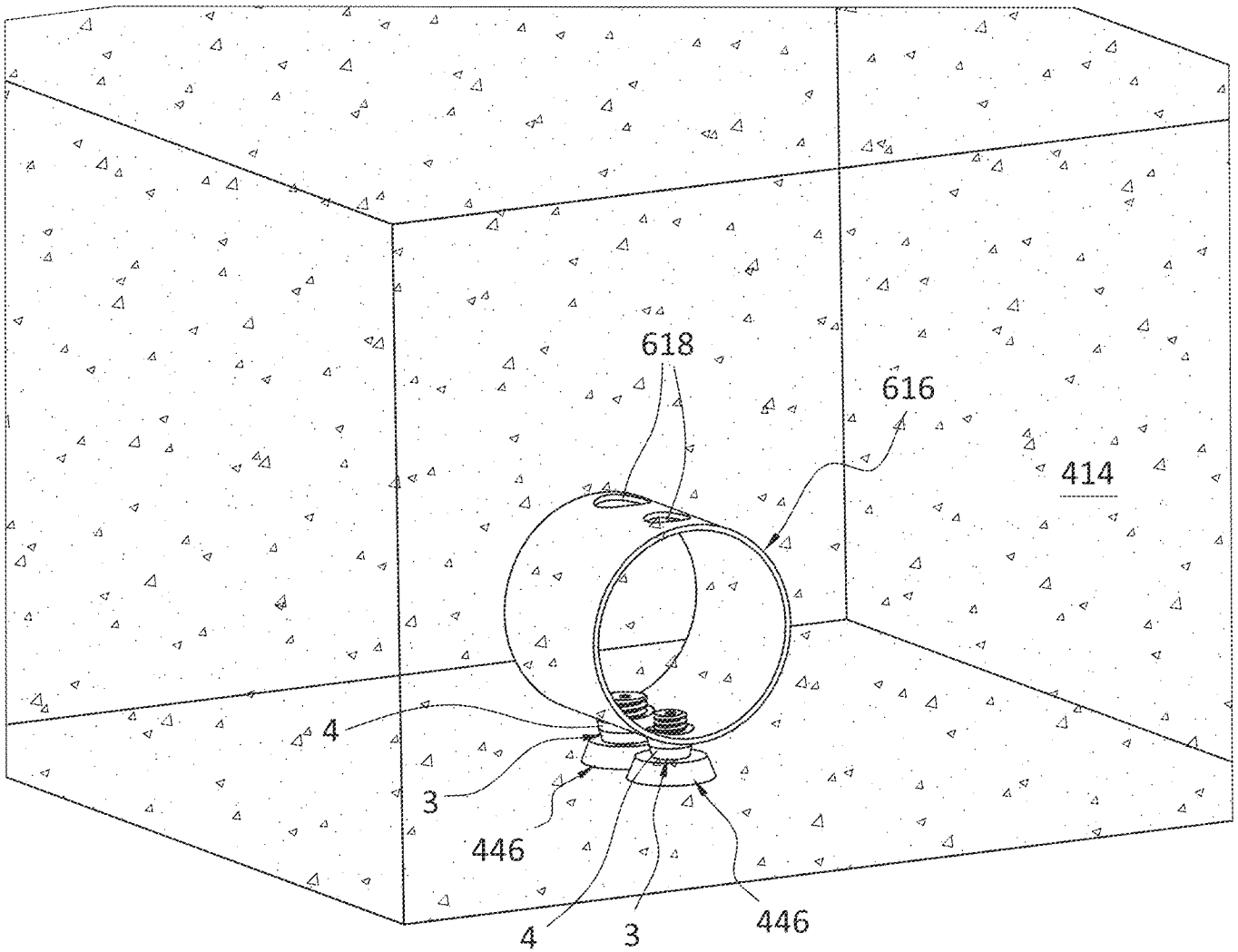

Referring to FIG. 124, the anchor 614 is modified as anchor 616. The boss sections 4 of the threaded boss openings 3 extend outside the anchor 616. The threaded boss openings 3 may be of different sizes to accommodate different size rods. Holes 618 disposed diametrically opposite the threaded boss openings 3 advantageously provide tooling clearance to facilitate in making the openings 3.

Figure 125:
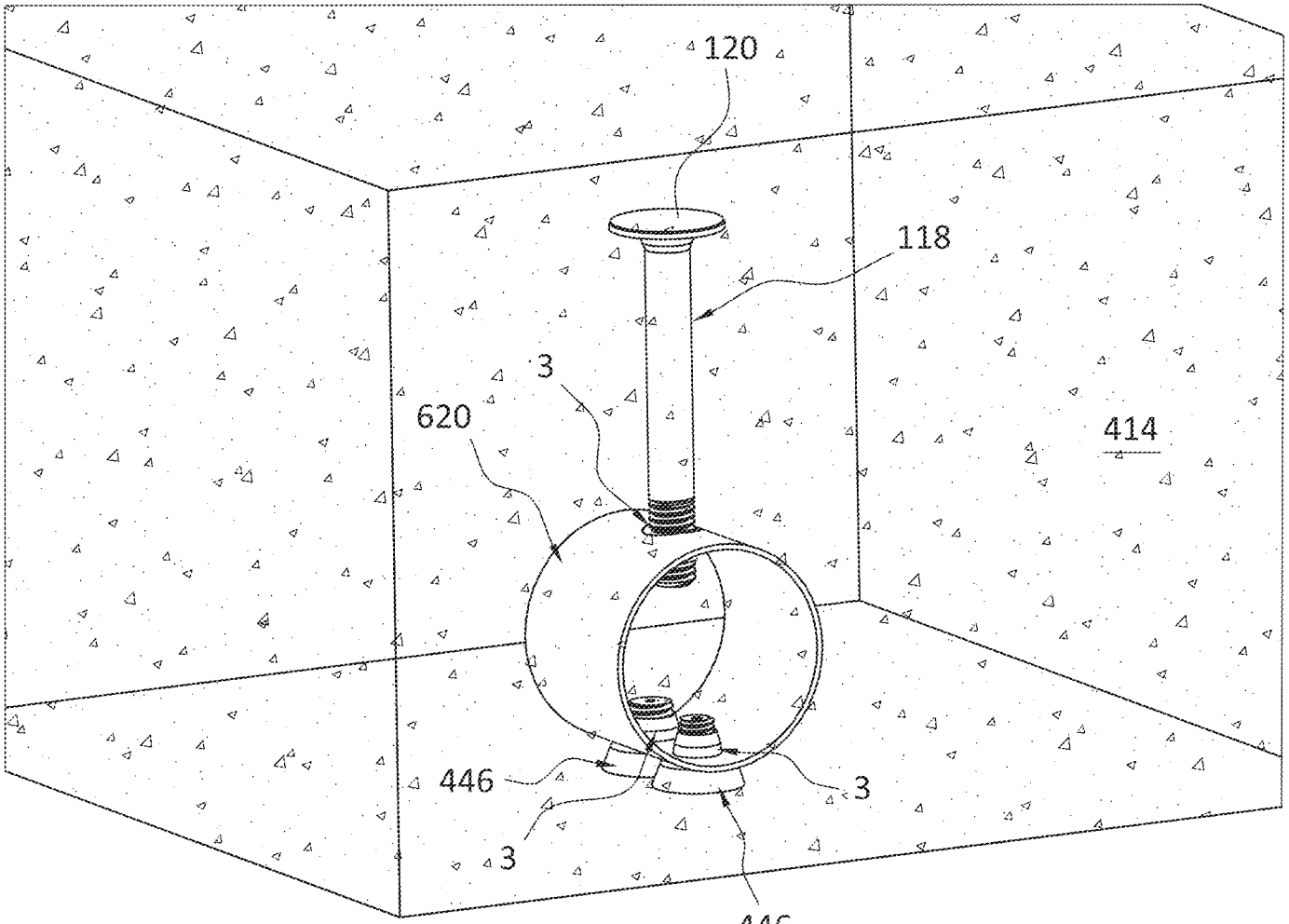

Referring to FIG. 125, the anchor 614 shown in FIG. 123 is modified as anchor 620. A third threaded boss opening 3 is provided above the two threaded boss openings 3. The boss section of the third threaded boss opening 3 preferably extends inside the anchor 620. An anchor stud 118 is threaded to the third threaded boss opening 3. The anchor stud 118 advantageously provides additional anchorage to the anchor 620 since the head portion 120 will generate a larger shear cone when a load is attached to the lower two threaded boss openings 3.

Figure 126:
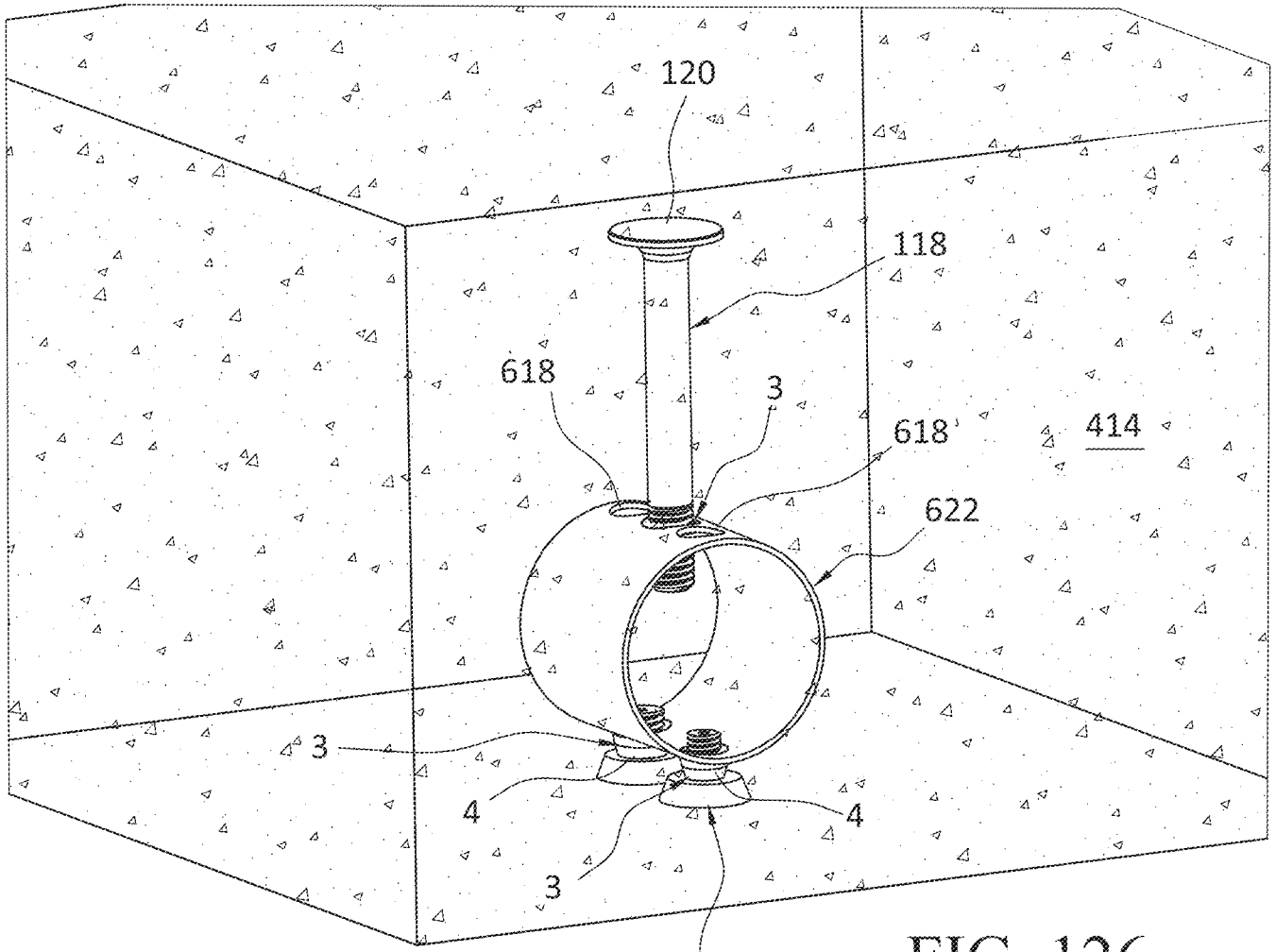

Referring to FIG. 126, the anchor 616 is modified as anchor 622. A third threaded boss opening 3 is provided above the two threaded boss openings 3. The boss section of the third threaded boss opening 3 extends inside the anchor 622. An anchor stud 118 is threaded to the third threaded boss opening 3. The anchor stud 118 advantageously provides additional anchorage to the anchor 622 since the head portion 120 will generate a larger shear cone when a load is attached to the lower two threaded boss openings 3.

Figure 127:
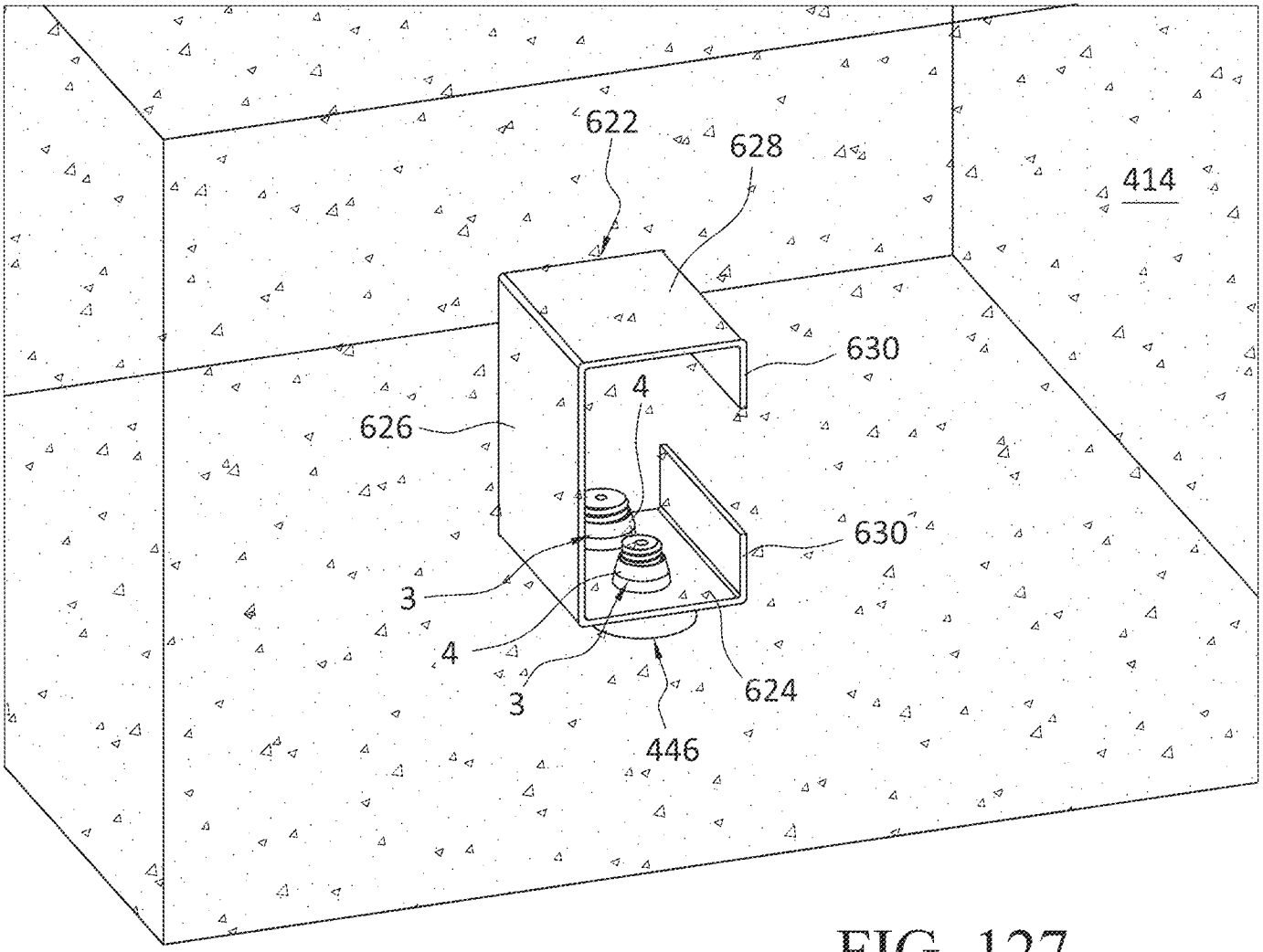
FIGS. 127-133 show anchor assemblies embedded in concrete embedded, using C-channel, I beam and double-I beam structures with threaded boss openings that are accessible for attachment of threaded rods.

Referring to FIG. 127, a C-shaped anchor 622 is shown embedded in a concrete structure 414. The anchor 622 is a hollow metal member. The anchor 622 has a base wall 624, a vertical wall 626, a top wall 628 and vertical edge walls 630. The base wall 624 is provided with threaded boss openings 3 which may be of different diameter sizes to advantageously accommodate different size anchor rods 30 or bolts. The threaded boss openings 3 are disposed inside the anchor 622, with the respective boss sections 4 extending upwardly from the base wall 624 inside the anchor 622.

Figure 128:
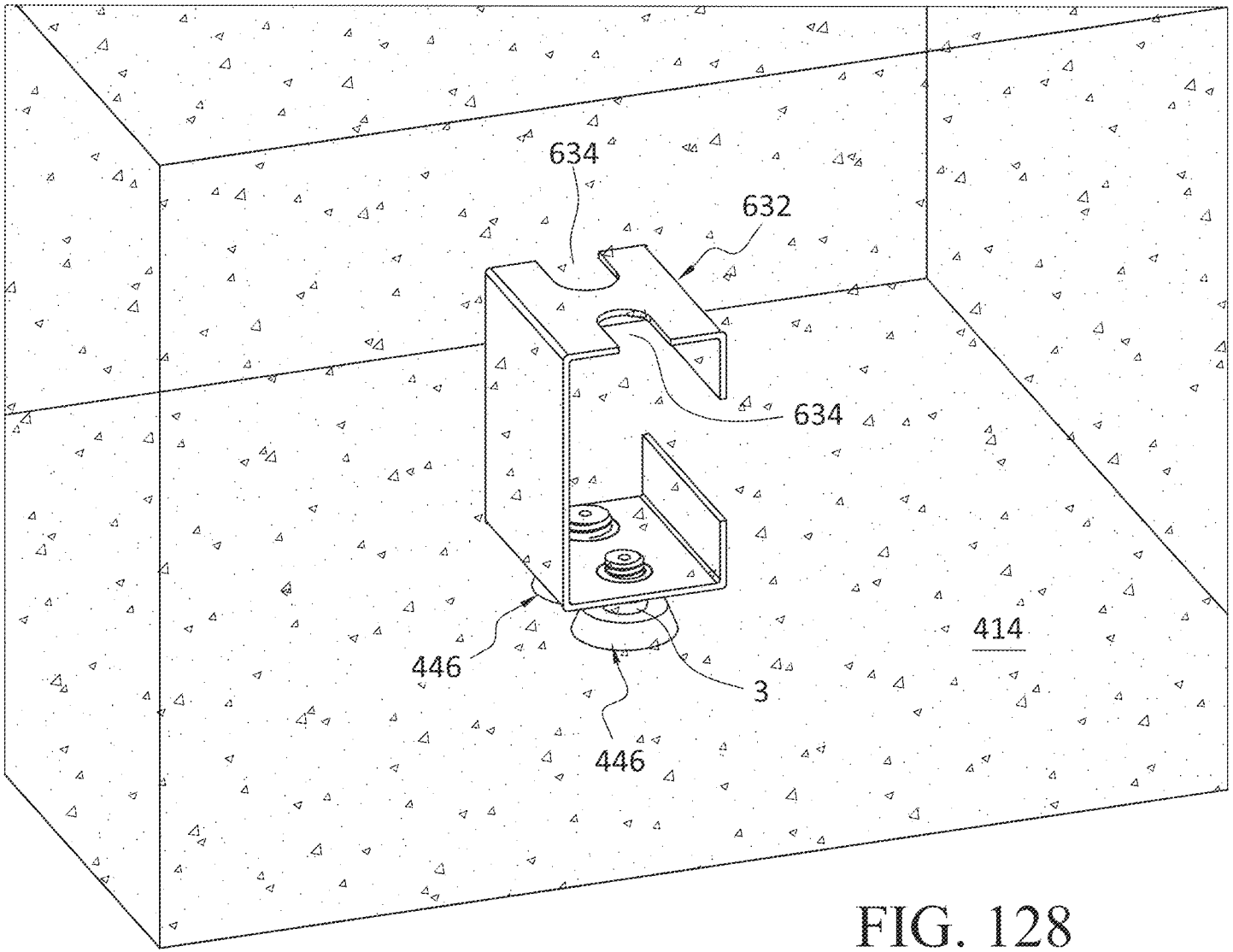

Referring to FIG. 128, the anchor 622 is modified as anchor 632 with the boss sections 4 of the threaded boss openings 3 extending outside the anchor 632. Slots 634 disposed opposite the threaded boss openings 3 advantageously provide tooling clearance to facilitate in making the openings 3.

Figure 129:
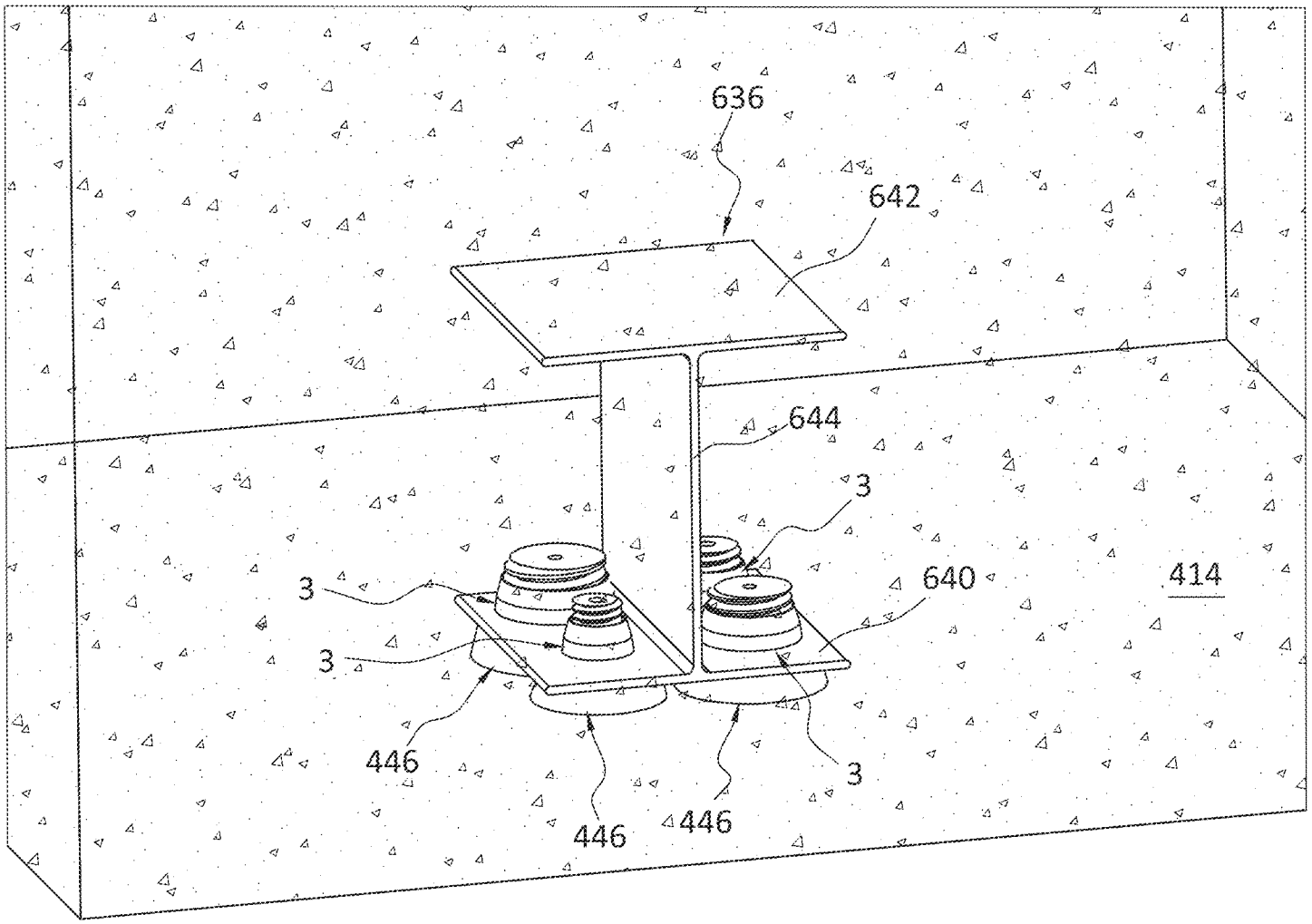

Referring to FIG. 129, an anchor 636 is disclosed embedded in a concrete structure 414. The anchor 636 is a hollow metal member. The anchor 636 is I-beam shaped with a lower flange 640, and upper flange 642 and a web 644. Four threaded boss openings 3 are provided in the lower flange 640 with four different sizes so that four different size anchor rods may be used. Each of the openings 3 is plugged by a respective plastic plug 446 to keep the concrete from entering the openings. The boss section 4 of each opening extend upwardly from the lower flange 640. After the concrete has dried and the formboard removed, the plugs 446 are to provide access to the openings 3 for attachment of anchor rods (see FIG. 107). With four different sizes of the openings 3, the user has the option of choosing from four different size anchor rods to handle the expected load.

Figure 130:
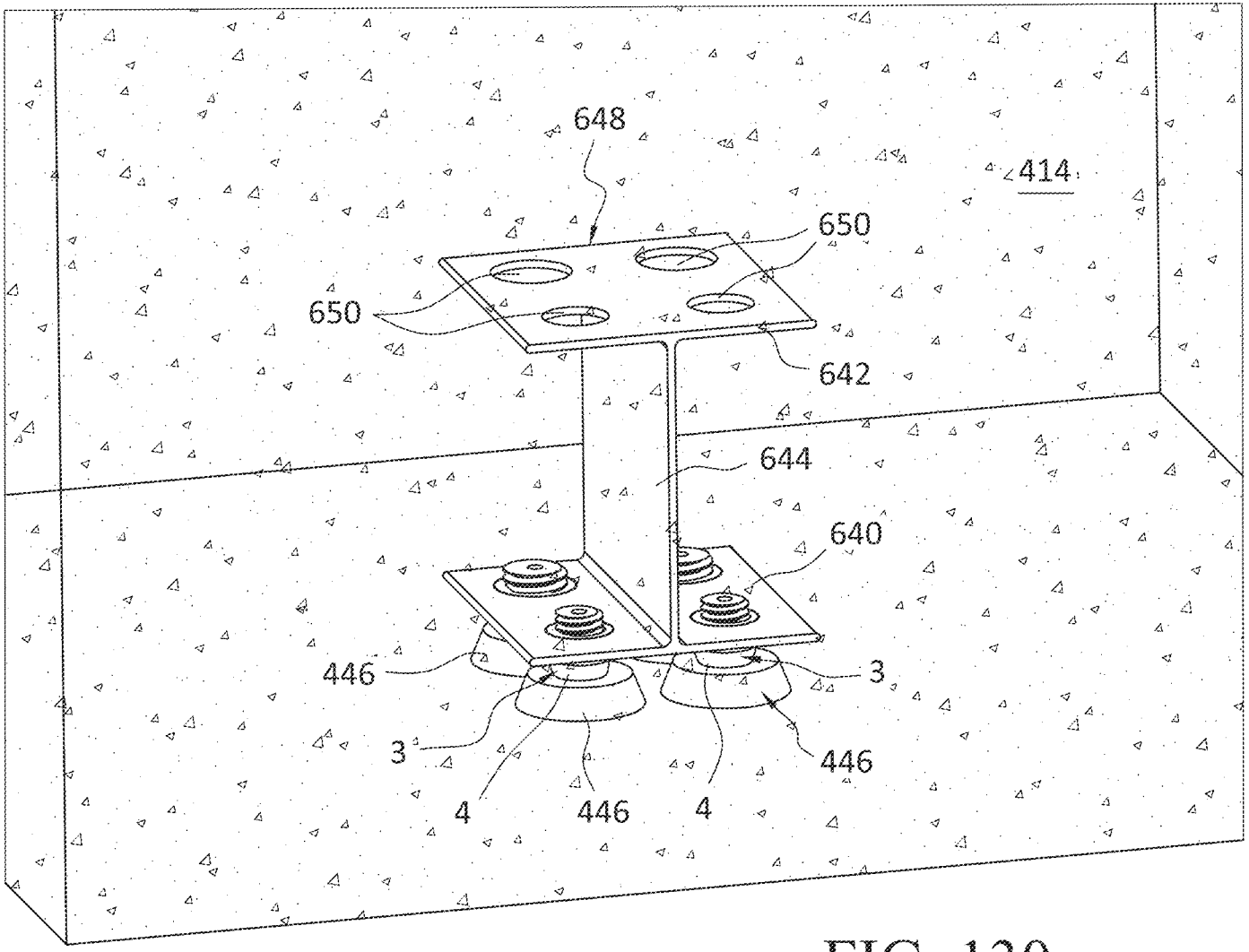

Referring to FIG. 130, the anchor 636 is modified as anchor 648 with the boss sections 4 of the threaded boss openings 3 extending downwardly from the lower flange 640. Holes 650 disposed opposite the respective threaded boss openings 3 advantageously provide tooling clearance to facilitate in making the openings 3.

Figure 131:
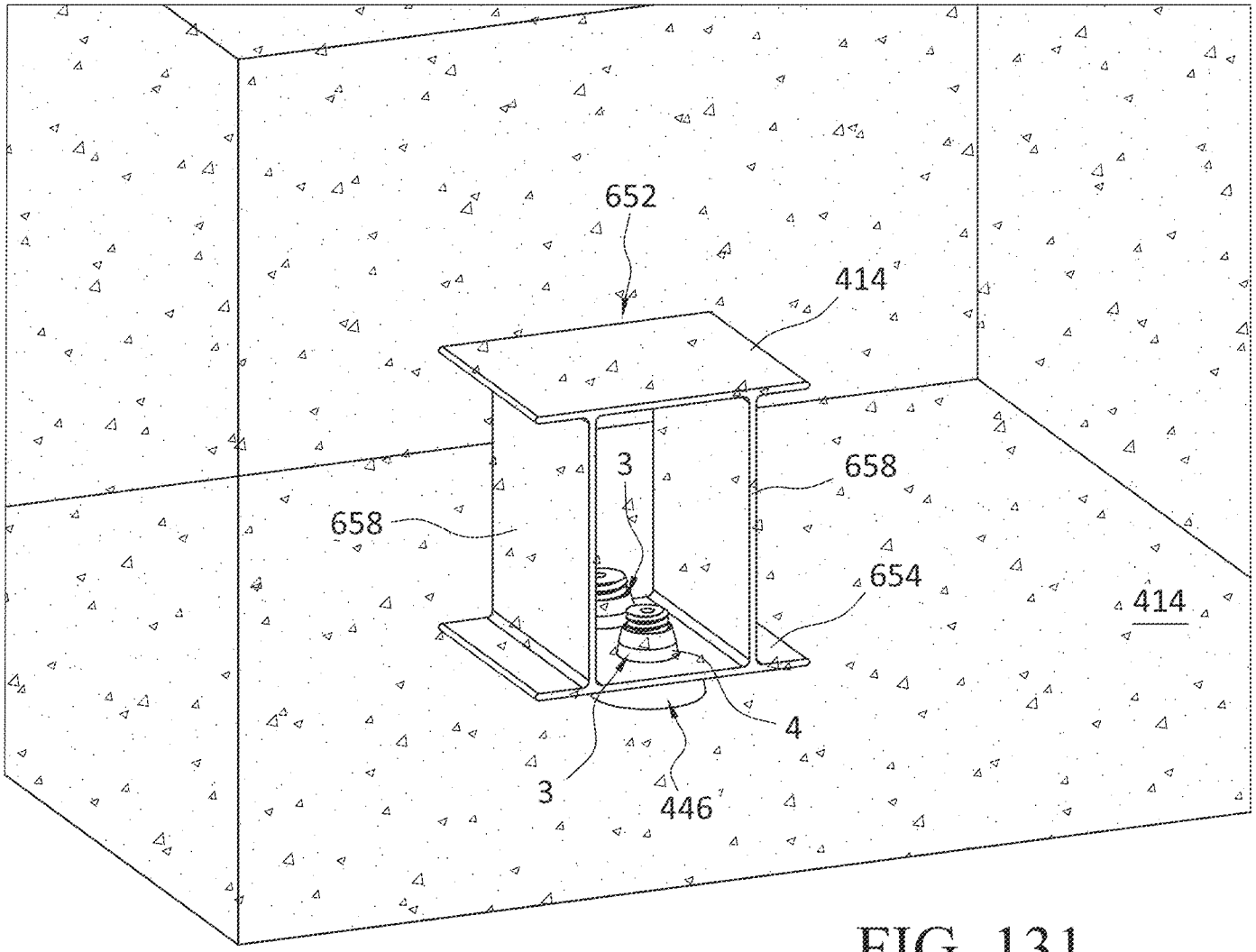

Referring to FIG. 131, an anchor 652 is disclosed embedded in a concrete structure 414. The anchor 652 is a hollow metal member. The anchor 652 is a double I-beam shaped with a lower flange 654, an upper flange 656 and spaced apart webs 658. The lower flange 654 is provided with threaded boss openings 3 with the respective boss sections 4 extending upwardly from the flange 654 inside the anchor 652 between the webs 658. Plastic plugs 446 seal the openings 3 from the concrete. The openings 3 are of different sizes to accommodate different sizes of anchor rods, smaller diameter rods for smaller loads and larger diameter rods for larger loads.

Figure 132:
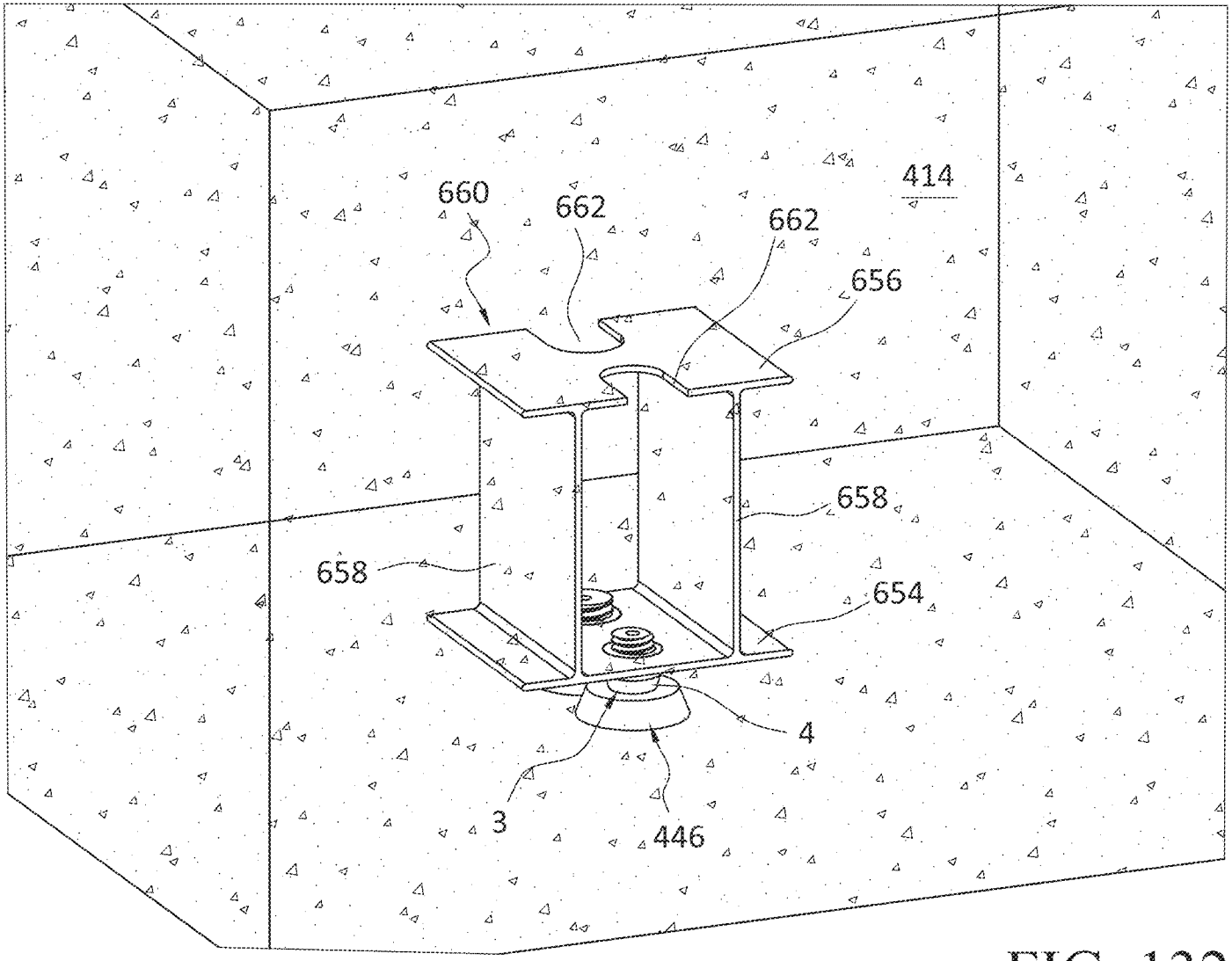

Referring to FIG. 132, the anchor 652 is modified as anchor 660 with the boss sections 4 of the threaded boss openings 3 extending downwardly from the lower flange 654 outside the anchor 656. Slots 662 disposed opposite the threaded boss openings 3 advantageously provide tooling clearance to facilitate in making the openings 3.

Figure 133:
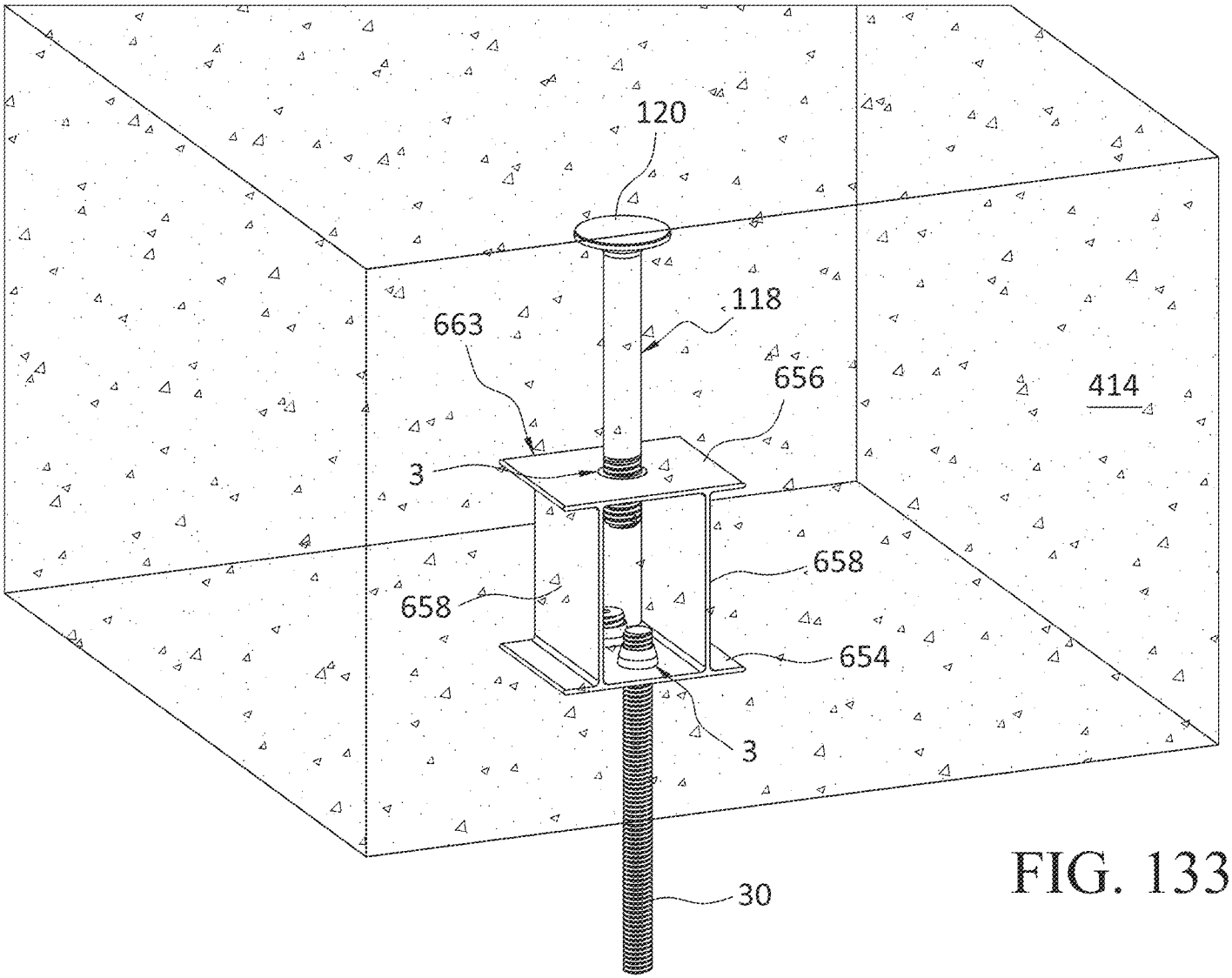

Referring to FIG. 133, the anchor 652 is modified as anchor 663. The upper flange is provided with a third threaded boss opening 3 with the boss section 4 preferably disposed inside the anchor 652 between the webs 658. An anchor stud 118 is attached to the upper flange opening 3 to advantageously provide additional anchorage to the anchor 663 since the head portion 120 will generate a larger shear cone when a load is attached to the anchor rod 30.

Figure 134:
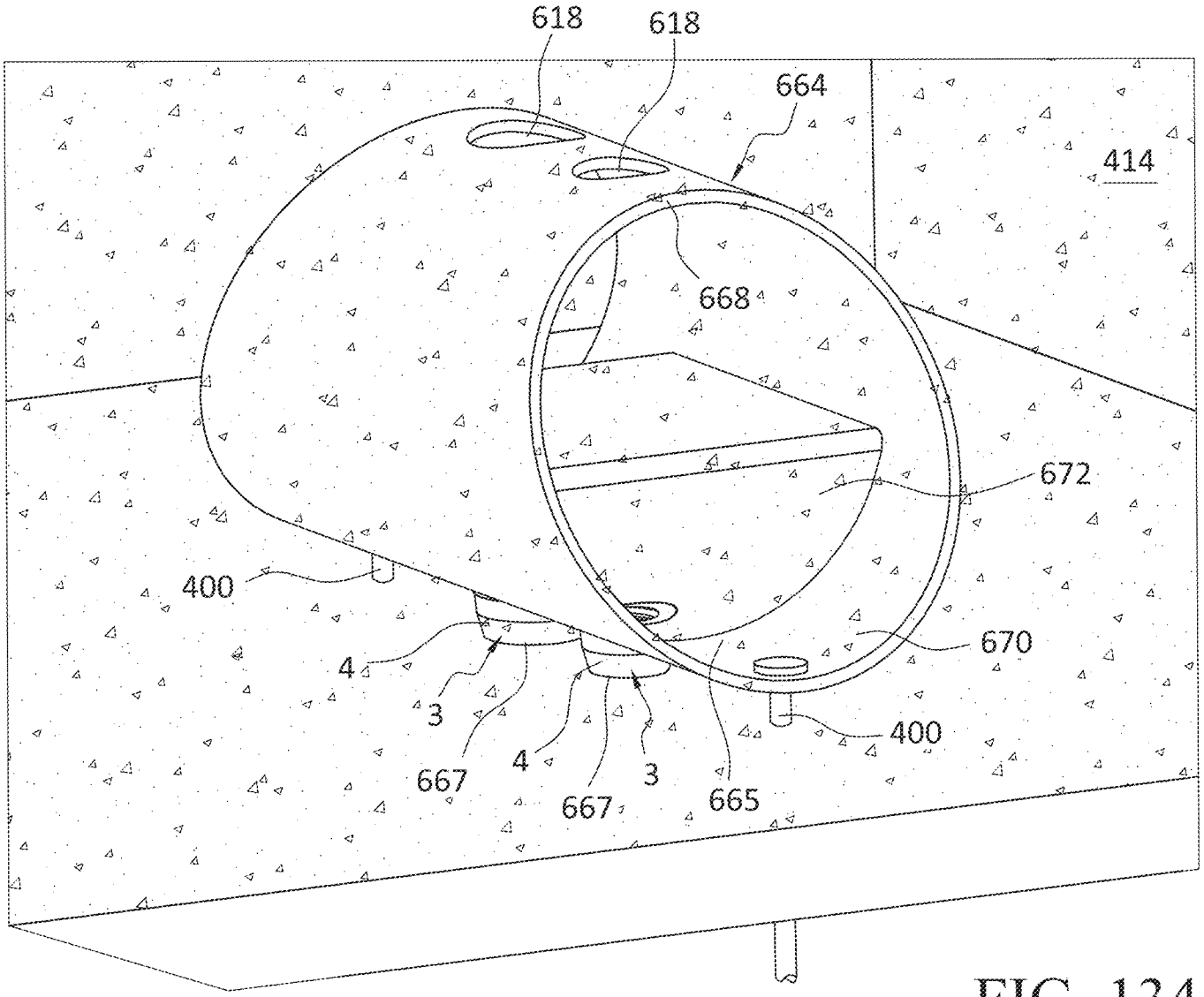
FIGS. 134-139 show anchor assemblies embedded in concrete using tubular channels with threaded boss openings that are sealed from concrete incursion when embedded in concrete.

Referring to FIG. 134, the anchor 616 shown in FIG. 124 is modified as anchor 664. The anchor 664 is a hollow metal member. The anchor 664 has a base portion 665 attached to the formboard 230 and embedded in concrete structure 414. The ends of the anchor 664 are cut at an angle to expose the lower edge portion 670 from above to advantageously provide clearance when attaching the anchor to the formboard with nails 400. The upper outer edge portion 668 of the anchor is thus offset from the lower outer edge portion 670 to provide the necessary clearance. Holes 618 disposed diametrically opposite the threaded boss openings 3 advantageously provide tooling clearance to facilitate in making the openings 3. The anchor 664 is partially filled with foam 672 to cover the openings 3 and prevent the concrete from entering the openings 3. The foam 668 is crushable so that a threaded rods or other fasteners, such as bolts, can extend past the threaded boss openings 3 inside the anchor 664 to insure complete thread engagement with the threaded boss openings 3. The boss sections 4 extend outside the anchor 664 and their outer 667 r edges press tight against the formboard 230 to seal the openings 3 from the wet concrete during installation advantageously without the use of the plastic plugs 446.

Figure 135:
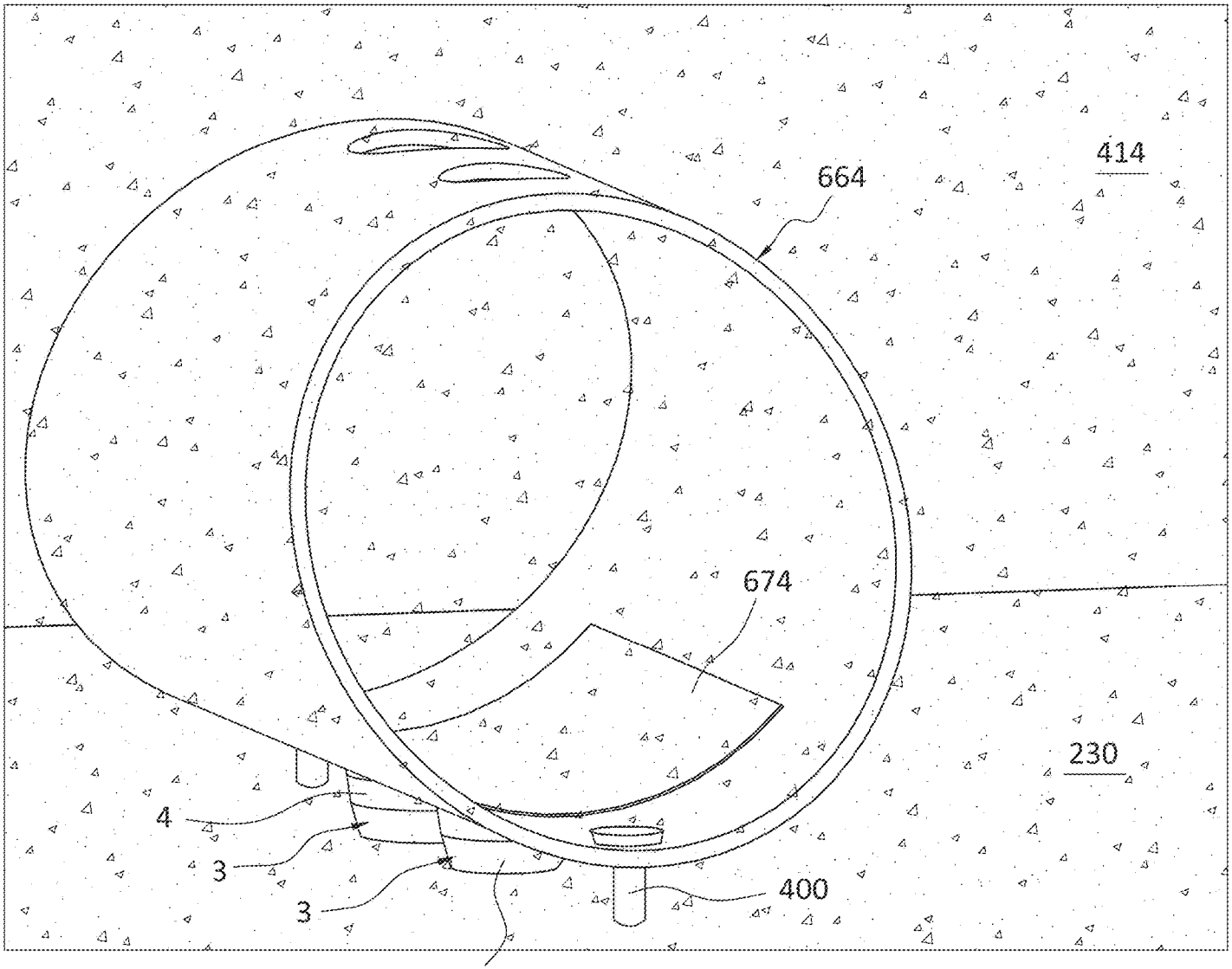

Referring to FIG. 135, a tape 674 may be used instead of the foam 672 to seal the openings 3 inside the anchor 664.

Figure 136:
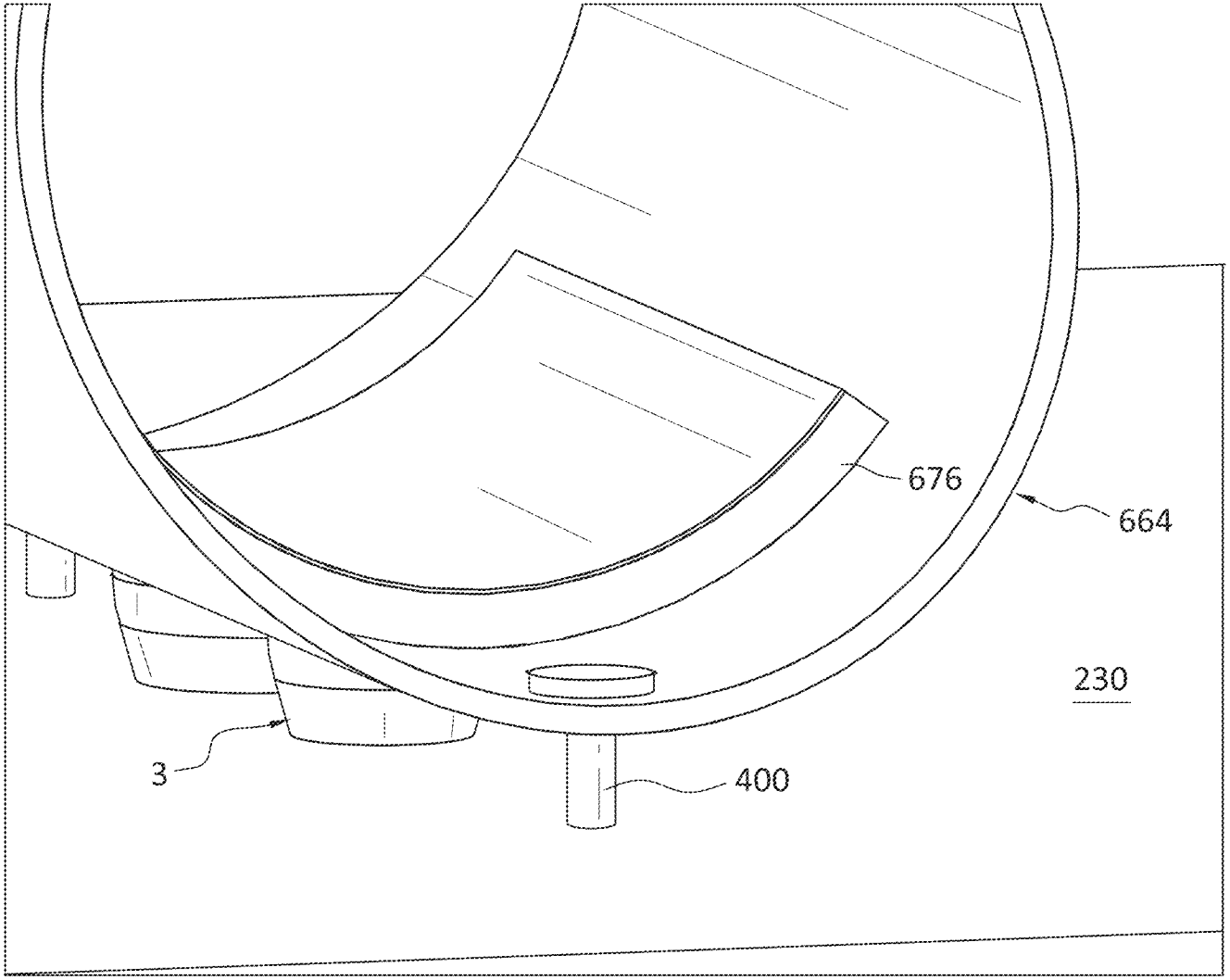
Figure 137:
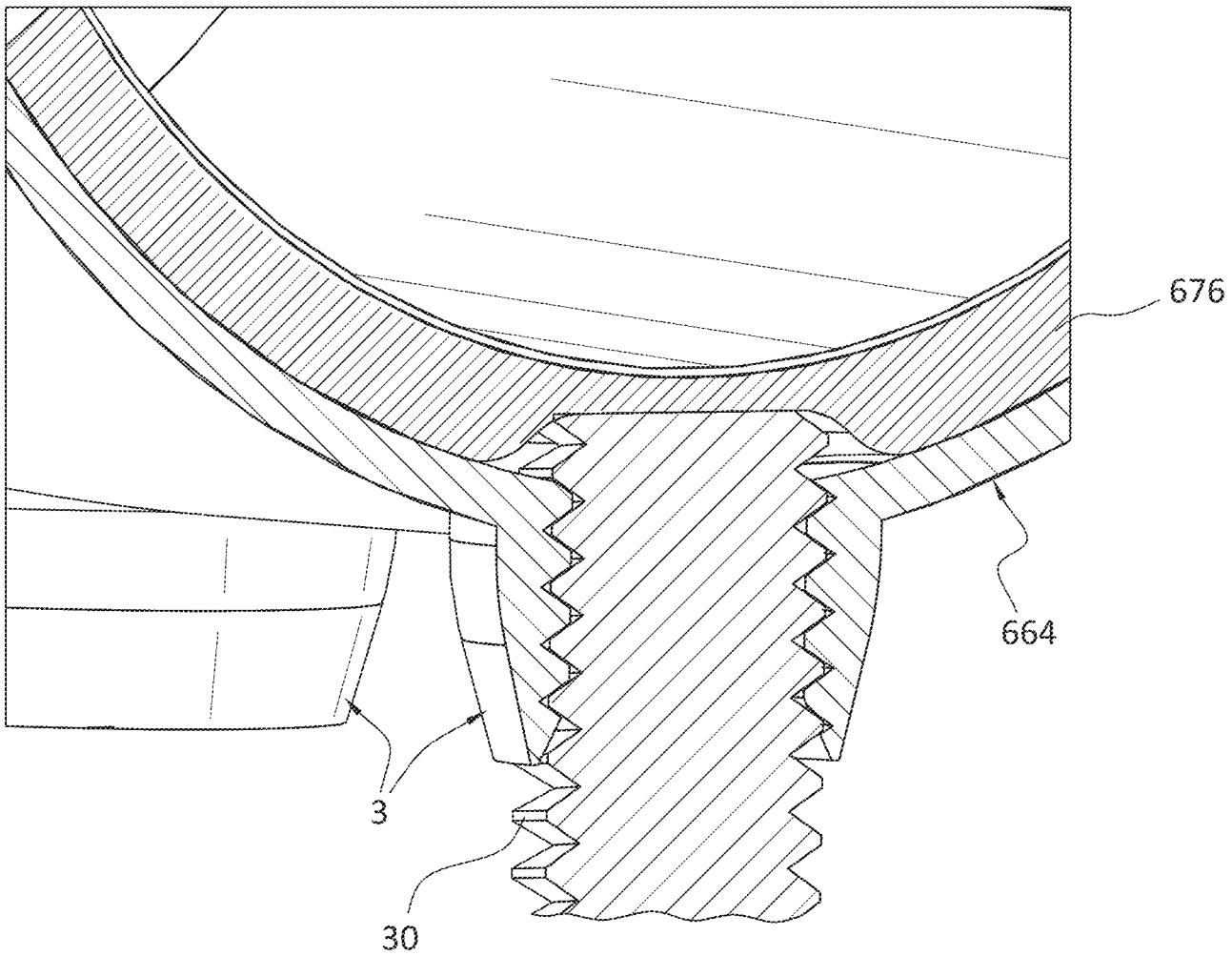

Referring to FIGS. 136 and 137, a foam tape 676 may be used to provide a crushable thickness above the openings 3 so that threaded rods 30 or other fasteners, such as bolts, can extend past the threaded boss openings 3 into the thickness of the foam tape inside the anchor 664 to insure complete thread engagement of the fasteners with the threaded boss openings 3.

Figure 138:
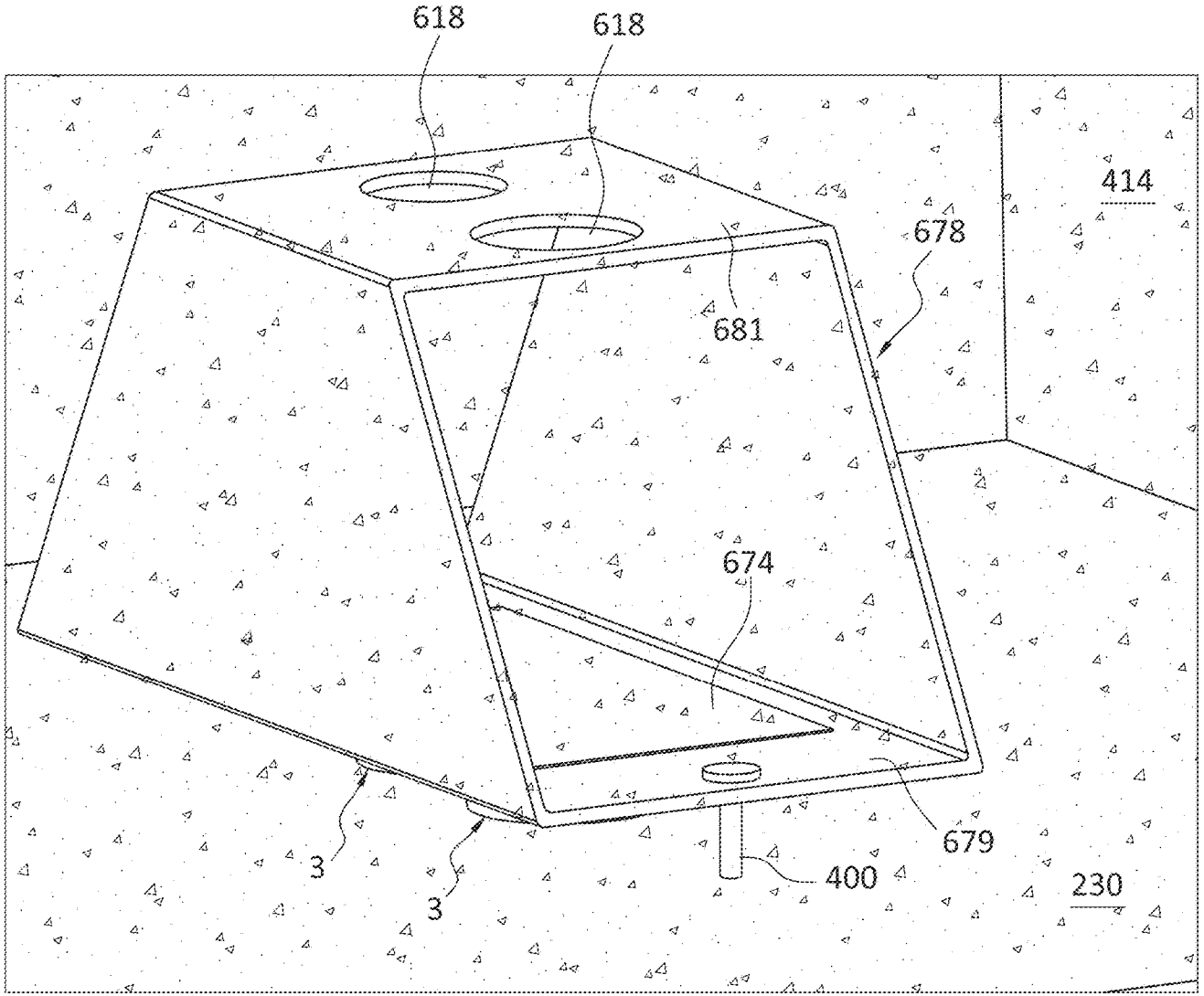

Referring to FIG. 138, an anchor 678 is shown attached to a formboard 230 with nails 400 and embedded in concrete structure 414. The anchor 678 is a hollow metal member. The anchor 678 is similar to the anchor 664 shown in FIG. 135, except that the anchor 678 is a rectangular or square tube. Tape 674 is used to seal the openings 3 inside the anchor 678. The boss sections 4 extend outside the anchor 678 and press tight against the formboard 230 to seal the openings 3 from the wet concrete during installation advantageously without the use of the plastic plugs 446. The ends of the anchor 678 are cut at an angle to expose the lower edge portion 679 from above to advantageously provide clearance when attaching the anchor to the formboard with nails 400. The upper outer edge portion 681 of the anchor is thus offset from the lower outer edge portion 679 to provide the necessary clearance.

Figure 139:
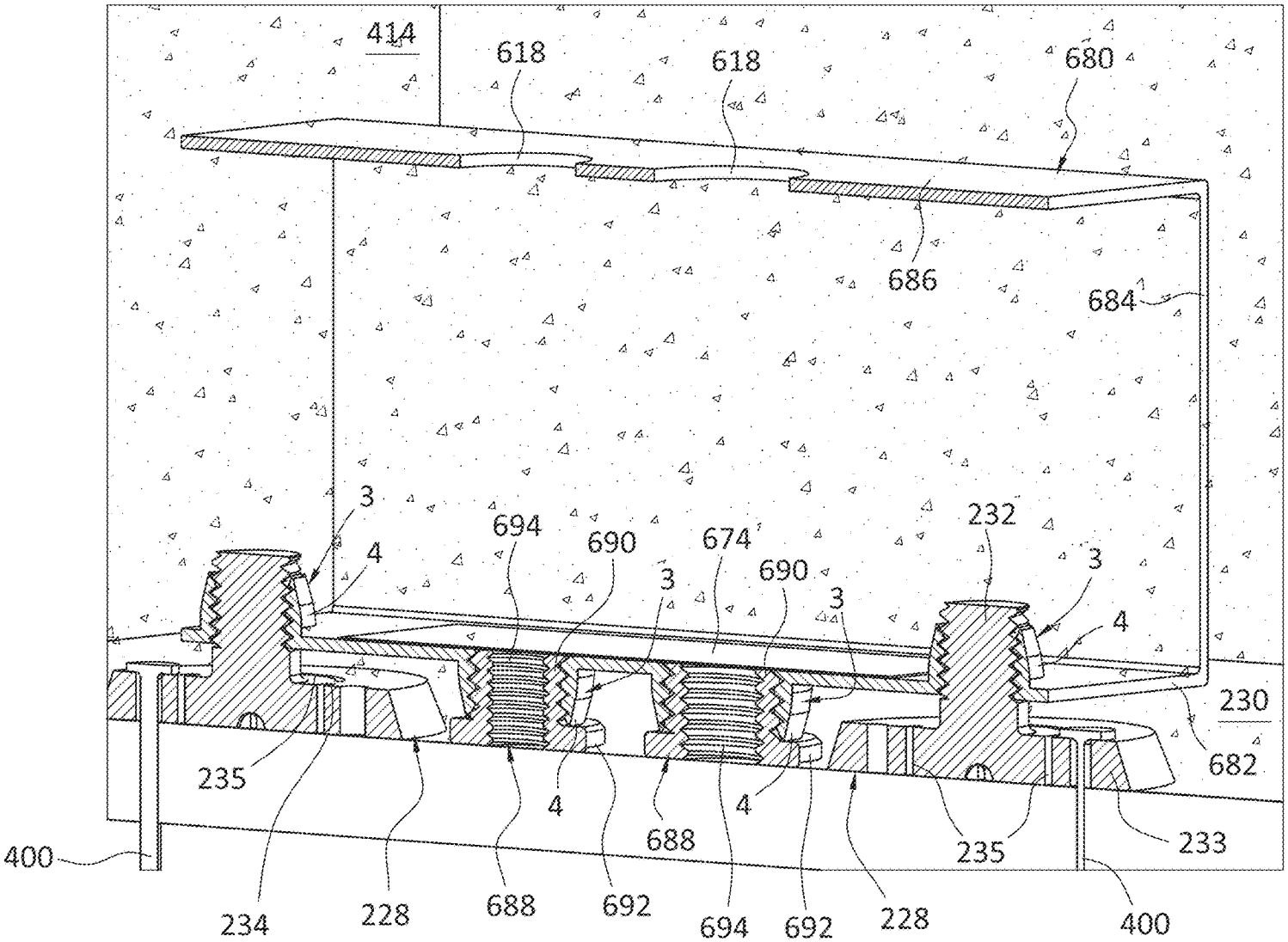

Referring to FIG. 139, an anchor 680 is shown in cross-section. The anchor 680 is hollow metal member. The anchor 680 is shown attached to the formboard 230 and embedded in concrete structure 414. The anchor 680 is a rectangular tube with a base wall 682, side walls 684 and a top wall 686. The base wall 682 is provided with two threaded boss openings 3, one on each end of the anchor, with their boss sections extending upwardly inside the anchor. Two other threaded boss openings 3 are provided with their boss sections 4 extending downwardly outside the anchor.

The upward extending openings 3 include plastic plugs 228 (see FIGS. 58-61) with plug portions 232 plug threaded to the threaded boss openings 3. The plug portions 232 are joined to the respective base portions 233 by thinned portions 234 at the ends of two semi-circular slits 235. The thinned portions 234 are breakable when the formboard is separated from the cured concrete, thereby allowing the nails to remain with the formboard. The plug portion 232 remains attached to the anchor 680. The thinned portions 234 are breakable so that the outside of the plug and the nails will stay attached to the form board when it is removed so moisture/corrosion cannot transfer from the nails to the metal anchor.

The downwardly extending threaded boss openings 3 include plastic inserts 688 to advantageously provide space for concrete cover under the base wall 682 of the anchor. The plastic insert 688 includes a stem portion 690 and a base portion 692. The stem portion 690 is threaded to the respective opening 3 and includes a threaded opening 694. The base portion 692 advantageously engages the formboard 230 to prevent wet concrete from entering the opening 694. The tape 674 covers the openings 3 inside the anchor 680 and prevent the wet concrete from entering the openings 3. The anchor 680 is advantageously isolated from moisture/corrosion that could be introduced when the threaded fastener (threaded rod, bolt, etc.) is attached to the threaded boss openings 3 or from the atmosphere when the formboard is removed. The internal threads in the openings 694 may be made small so that the installed fastener is forced through the threads, creating a tight fit between the insert 688 and the fastener. The inserts 688 may be color coded for thread size.

Figure 140:
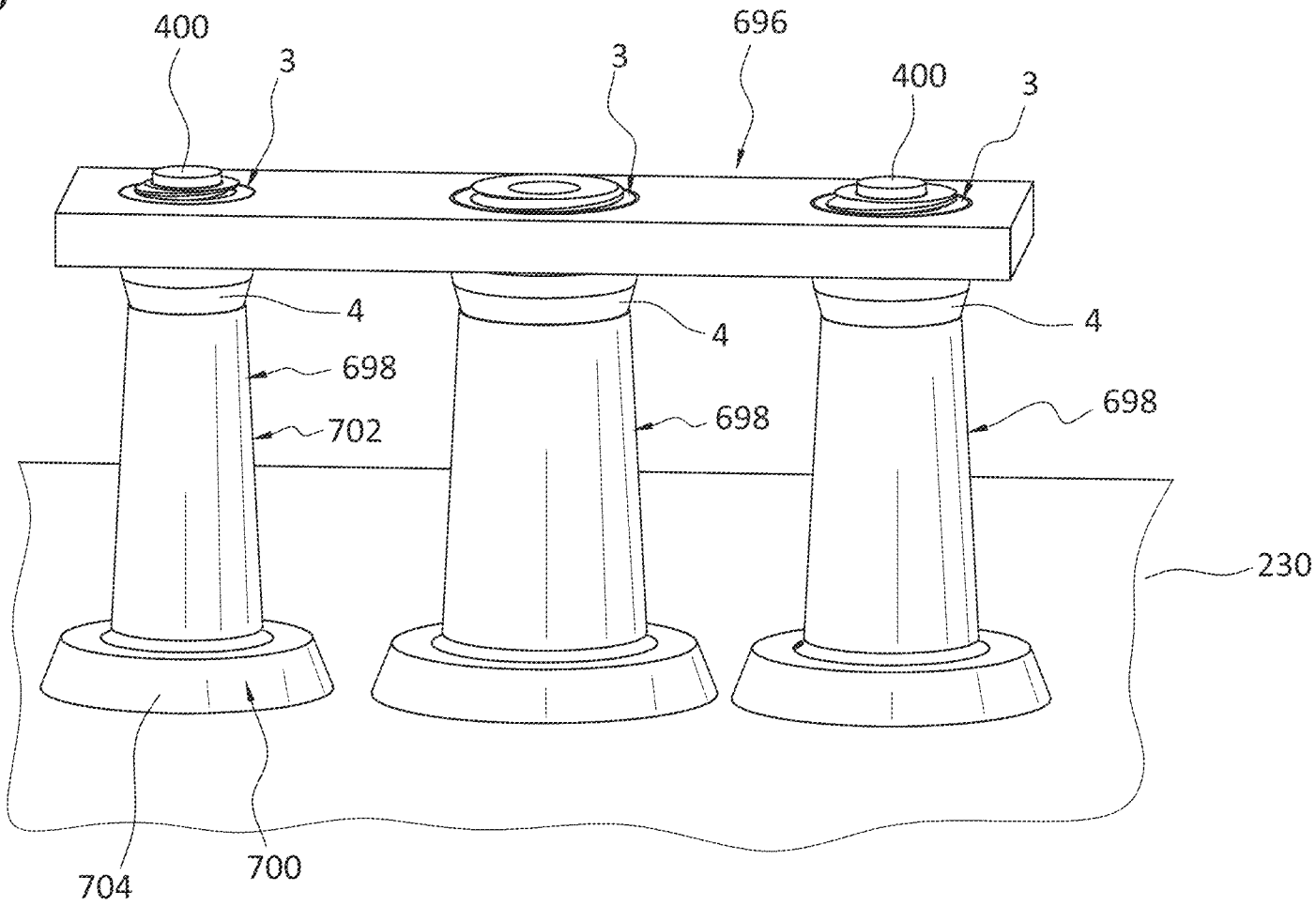
FIGS. 140-145 show anchor assemblies embedded in concrete.

Referring to FIG. 140, an anchor 696 is shown supported above a formboard 230 with supports 698, preferably made of plastic. Nails 400 or screws are used to secure the anchor 696 to the formboard. The anchor 696 is a longitudinal metal plate provided with threaded boss openings 3 with the boss sections 4 extending downwardly. The openings 3 are of different diameter sizes to advantageously accommodate different size anchor rods, bolts, etc. The supports have threaded end portions that are threaded to the respective threaded holes 3 so keep the wet concrete from entering the openings 3. The anchor 696 is advantageously elevated above the formboard to advantageously seal the anchor with the concrete and prevent or reduce possible corrosion. The elevation of the anchor 696 also creates a larger shear cone for greater anchorage. The formboard 230 is removed after the concrete has dried. The supports 698 are removed to provide void in the concrete for access to the threaded boss openings 3 for attachment of hanger rods, bolts, fasteners, etc. for attaching a load to the anchor 696. Each of the supports include a base portion 700 and a post portion 702. The side surface 704 of the base portion 700 and the exterior shape of the post portion 702 are preferably conical to facilitate removal of the supports from the concrete structure to provide access to the openings 3.

Figure 141:
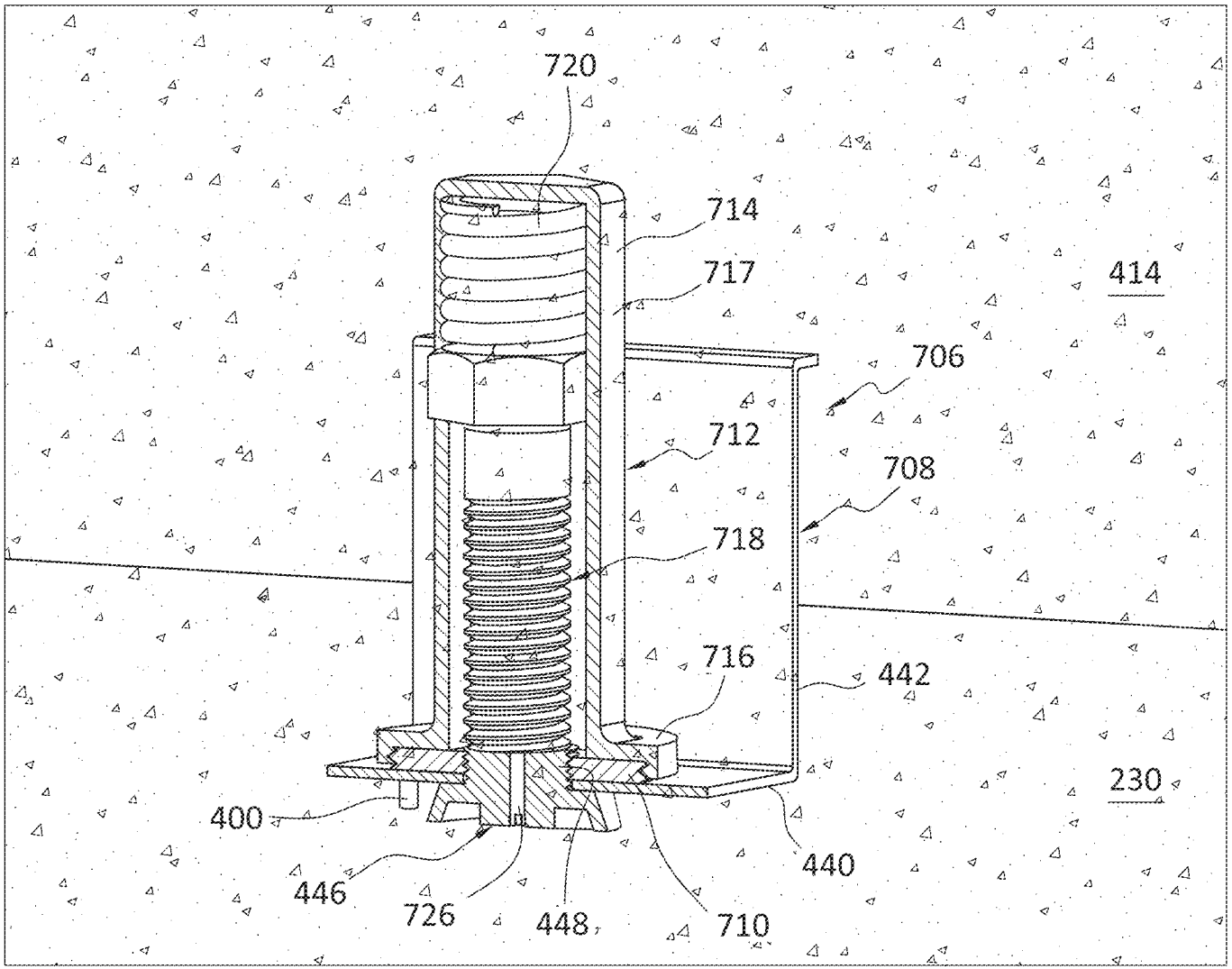

Referring to FIG. 141, an anchor assembly 706 is shown attached to a formboard 230 and embedded in concrete structure 414. The anchor assembly 706 includes an anchor 708, shown in cross-section and is similar to the anchor 438 shown in FIG. 107 but without the threaded boss openings 3. The anchor 708 is preferably metal, U-shaped with base portion 440 and side walls 442. The anchor 708 is attached to the formboard 230 with nail 440. A metal washer 710 with internal and outside threads is attached to the base portion 440 via the plastic plug 446, which is threaded to the washer 710. A housing 712 is threaded to the washer 710. The housing 712 includes a tubular portion 714 and a base or flange portion 716. The washer 710 is threaded to the bottom of the flange 716. The washer 710 is threaded to the stem portion 448 of the plug 446. The plug 446, the washer 710 and the flange portion 716 effectively seal the inside of the housing 712 from the wet concrete. The tubular portion 714 includes a hexagonal side wall 717. A bolt 718 is disposed inside the housing 712 and centrally over the opening 722. The bolt 718 has a hexagonal head portion 724 that fits inside the hexagonal side wall 717 so that the head portion 724 is prevented from rotating inside the housing 712 but allows the head portion 724 to slide vertically along the hexagonal side wall. A spring 720 is disposed inside the housing 712 above the bolt 718. The spring 720 is under compression to urge the bolt 718 against the threaded stem portion 448 of the plastic plug 446.

Figure 142:
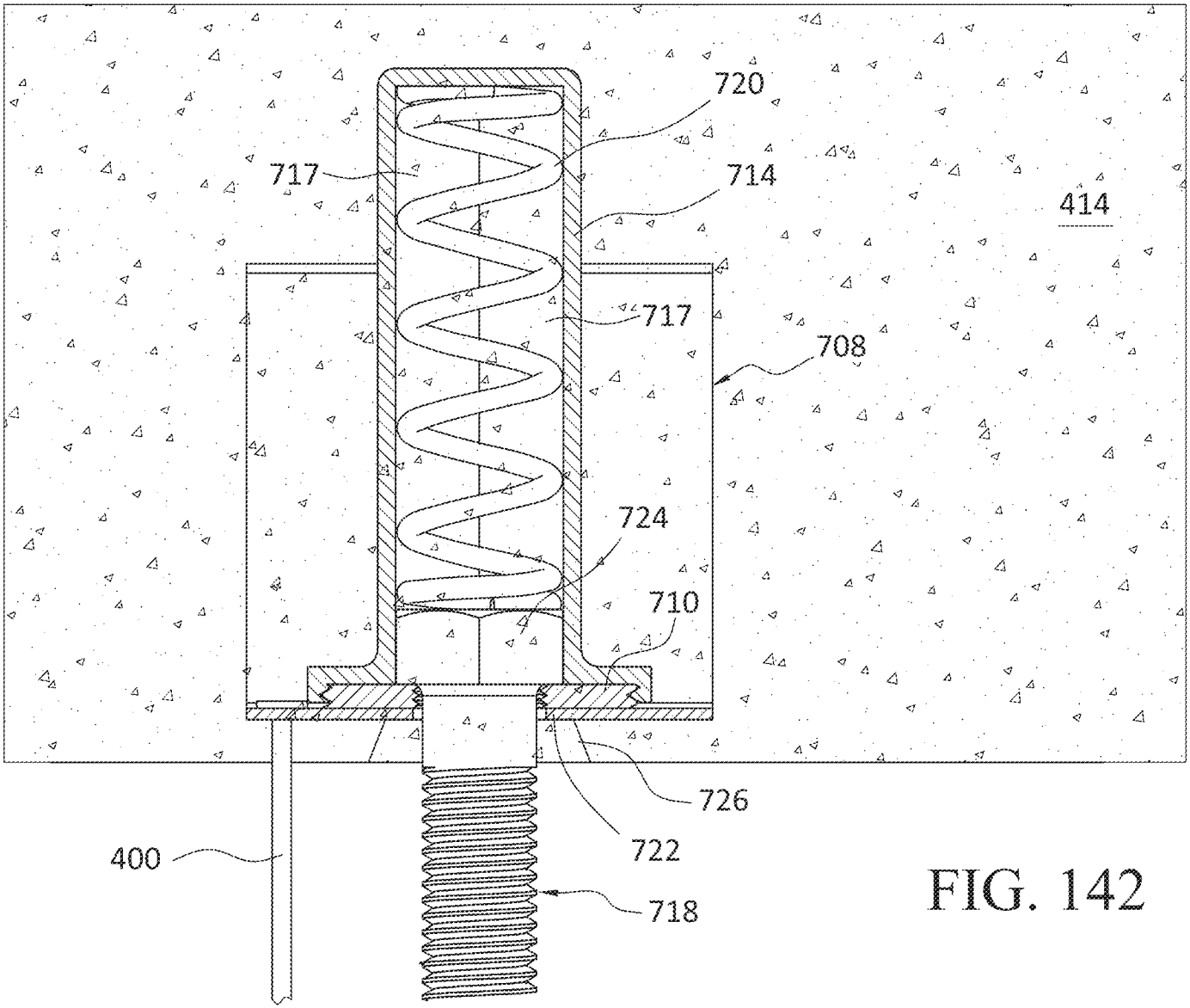

Referring to FIG. 142, when the formboard 230 is removed after the concrete has dried, the plastic plug 446 is removed, causing the bolt 718 under the action of the spring 720 to move through the opening 722 in the base portion 440 of the anchor 708. The head portion 724 of the bolt 718 is retained by the washer 710. The plastic plug 446 leaves a void 726 in the concrete after its removal. The bolt 718 is used to connect a load.

Figure 143:
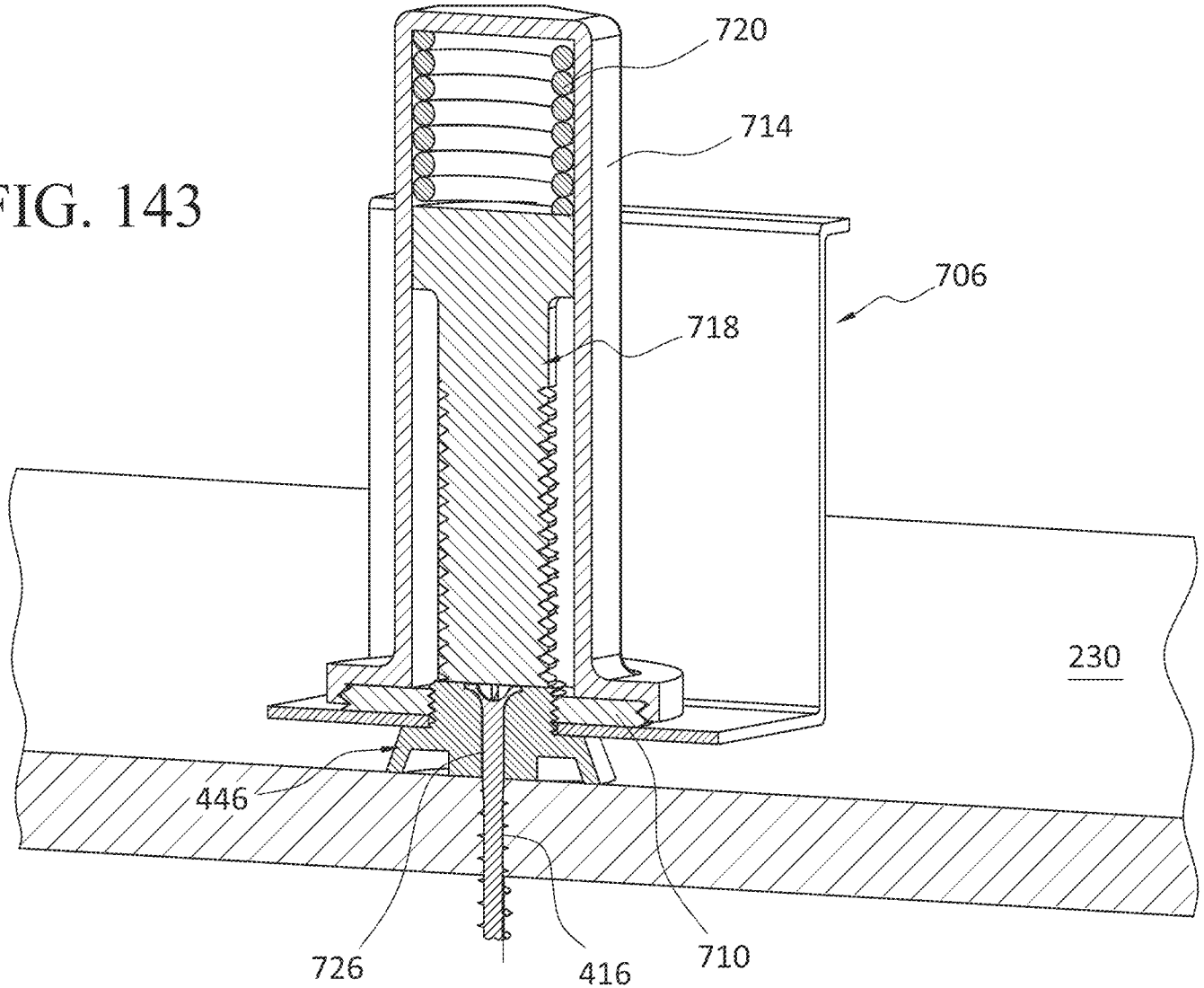

Referring to FIG. 143, a screw 416 through a central opening 726 in the plastic support 446 may be used to attach the anchor assembly 706 to the formboard 230. The screw 416 is installed before the housing is attached to the washer 710.

Figure 144:
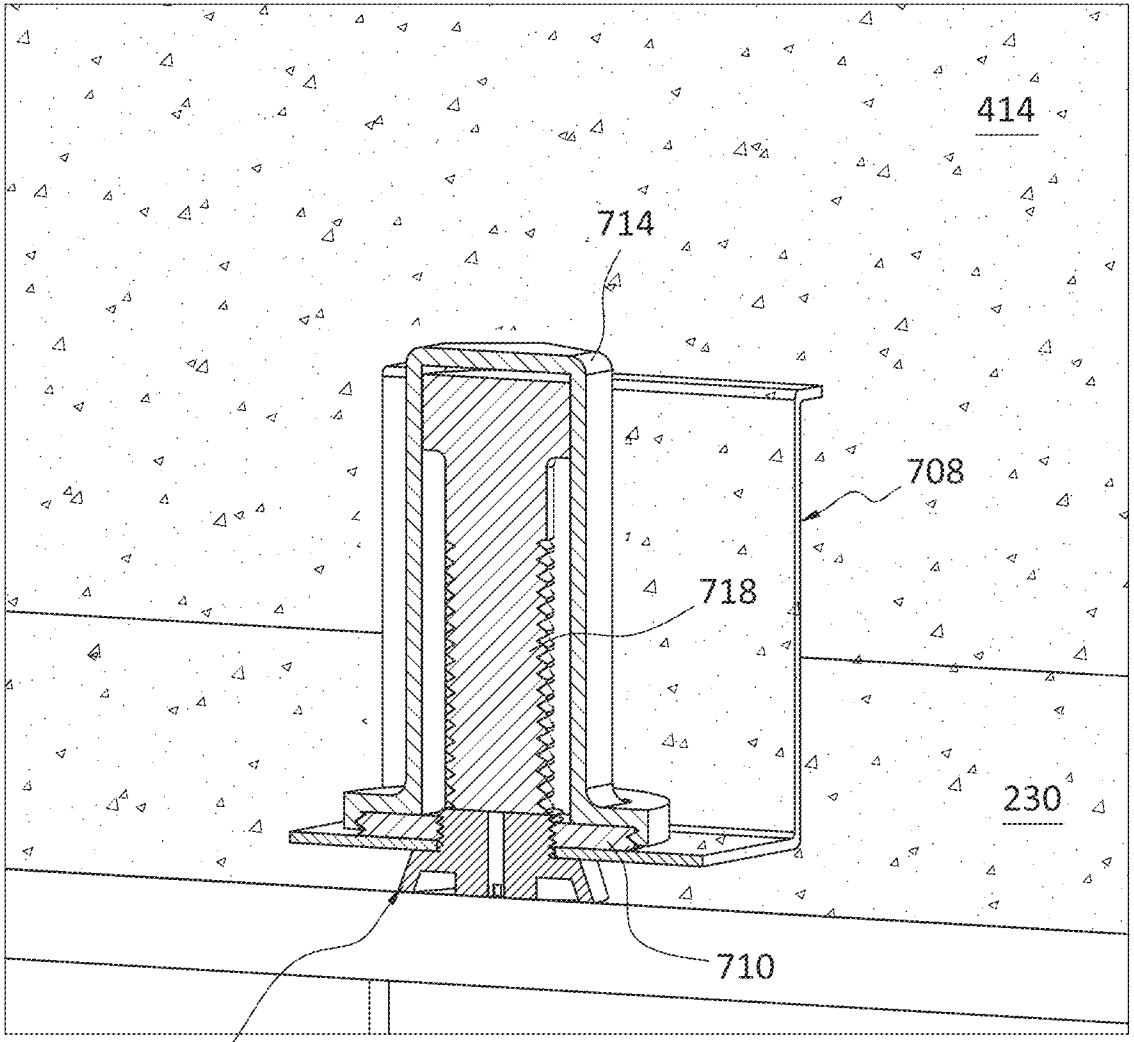
Figure 145:
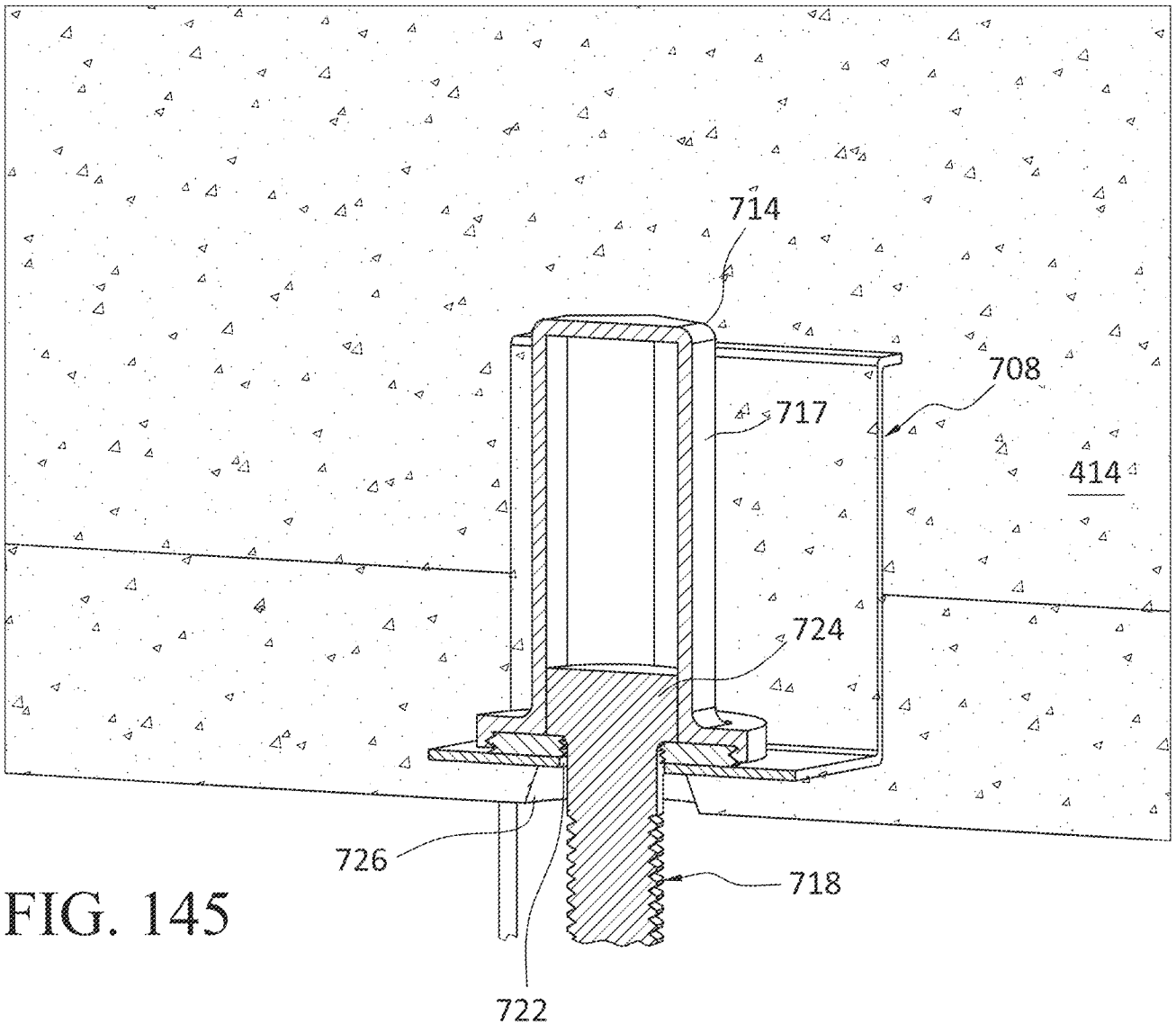

Referring to FIGS. 144 and 145, the anchor assembly 706 is modified to remove the spring 720 and shorten the housing 714. Upon removal of the plastic support 446, the bolt 718 moves through the opening 722 and the void 726 by gravity.

Figure 146B:
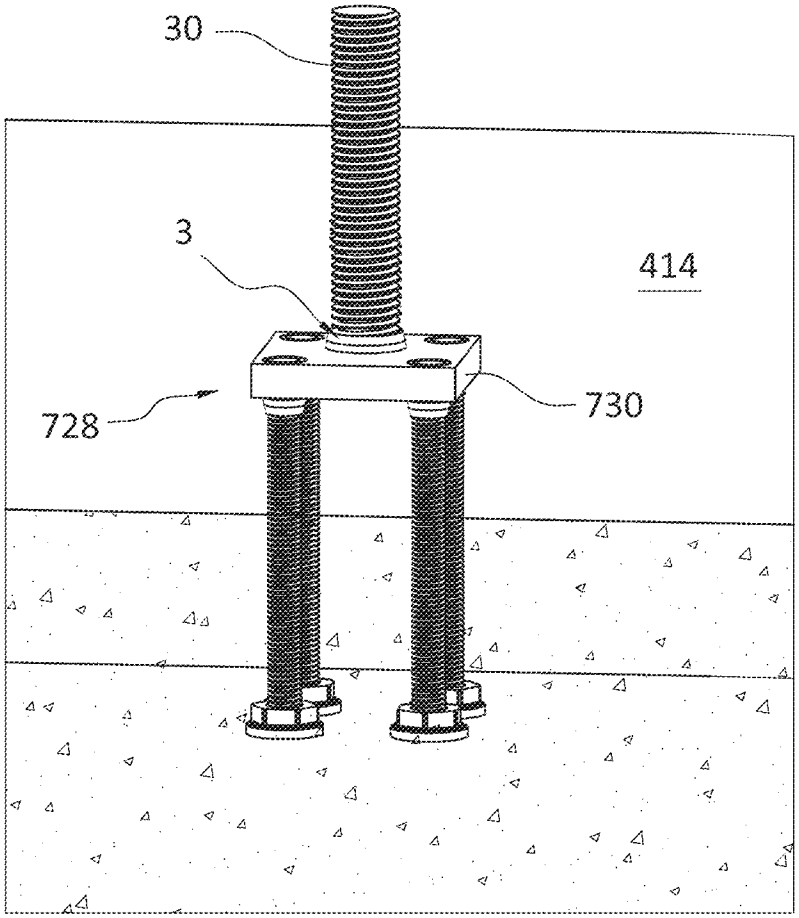
FIGS. 146A-148B show several anchor assemblies embedded in concrete using a metal plate with multiple threaded rods with one or more threaded boss openings that are accessible from outside the concrete structure for attachment of threaded rods.
Figure 146A:
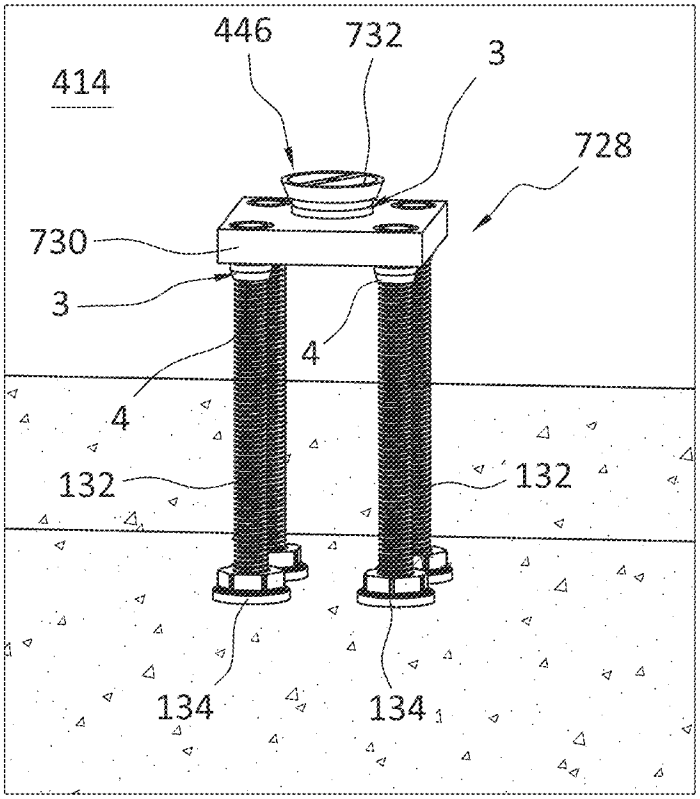

Referring to FIG. 146A, an anchor assembly 728 is shown embedded in concrete structure 414. The anchor assembly 728 includes a metal plate 730, preferably square, provided with four threaded boss openings 3 at the four corners of the plate 730, with their boss sections 4 extending downwardly. Another threaded boss opening 3 is disposed in the center of the plate 730 with the boss section 4 extending upwardly. Stud bolts 132 are attached to the four downwardly extending openings 3. Anchor bodies 134 are threaded to the bottom end portions of the respective stud bolts 132. Plastic plug 446 seals the central opening 3 to keep wet concrete from entering. The top 732 of the plastic plug 446 is preferably flush with the top of the concrete structure 414 so as for the plastic plugs 446 to be accessible for removal after the concrete has dried.

Referring to FIG. 146B, the plastic plug 446 has been removed and an anchor rod 30 has been attached to the central opening 3.

Figure 147B:
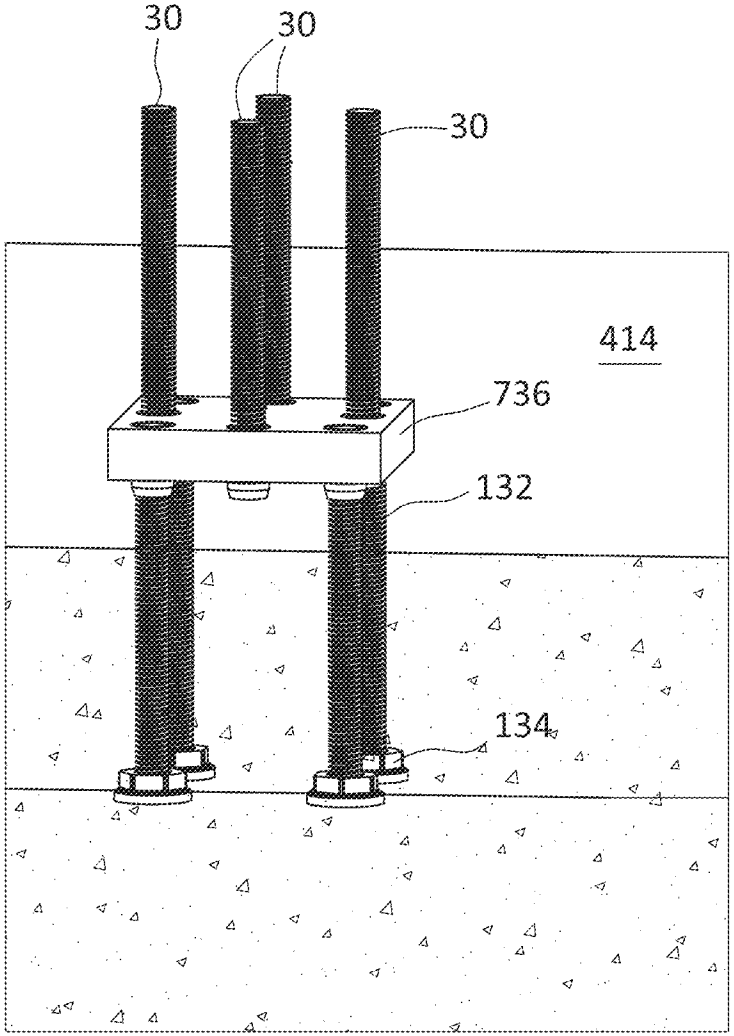
Figure 147A:
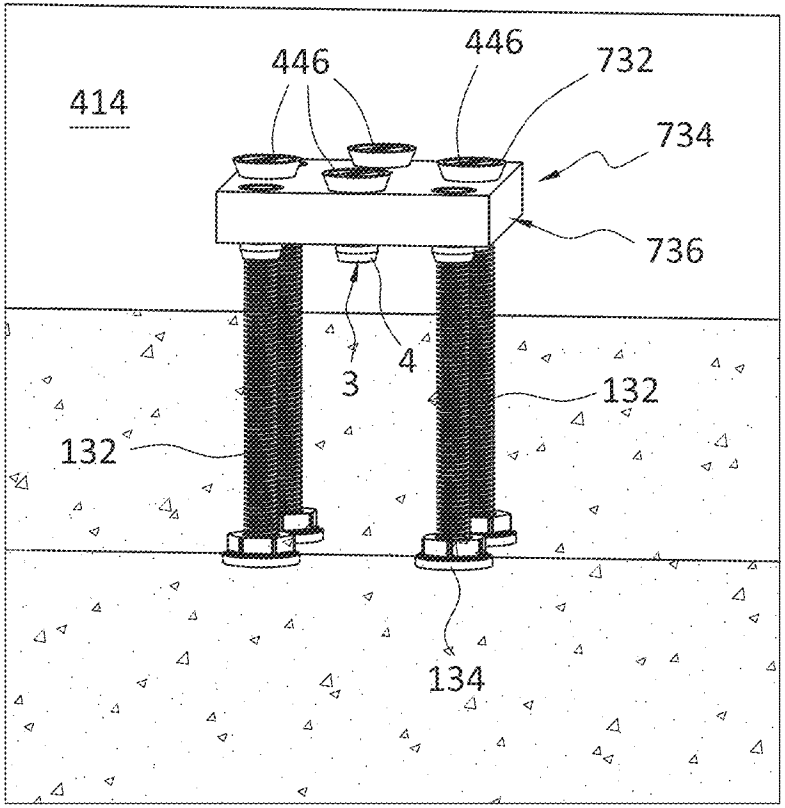

Referring to FIG. 147A, the anchor assembly 728 is modified as anchor assembly 734. The metal plate 730 is modified as metal plate 736 with four additional threaded boss openings 3 with their boss sections 4 extending downwardly. Plastic plugs 446 seal the four additional openings 3 to keep the wet concrete from entering. The top 732 of each of the plastic plugs 446 is preferably flush with the top of the concrete structure 414 so as for the plastic plugs 446 to be to be accessible for removal after the concrete has dried.

Referring to FIG. 147B, the plastic plugs 446 have been removed and anchor rods 30 have been attached to the four additional threaded boss openings 3.

Figure 148B:
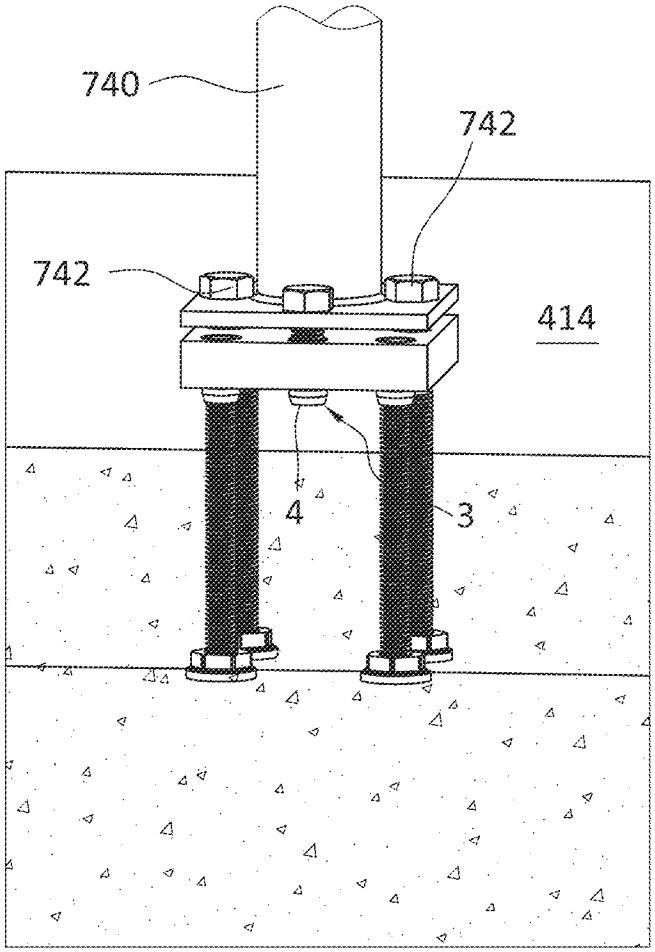
Figure 148A:
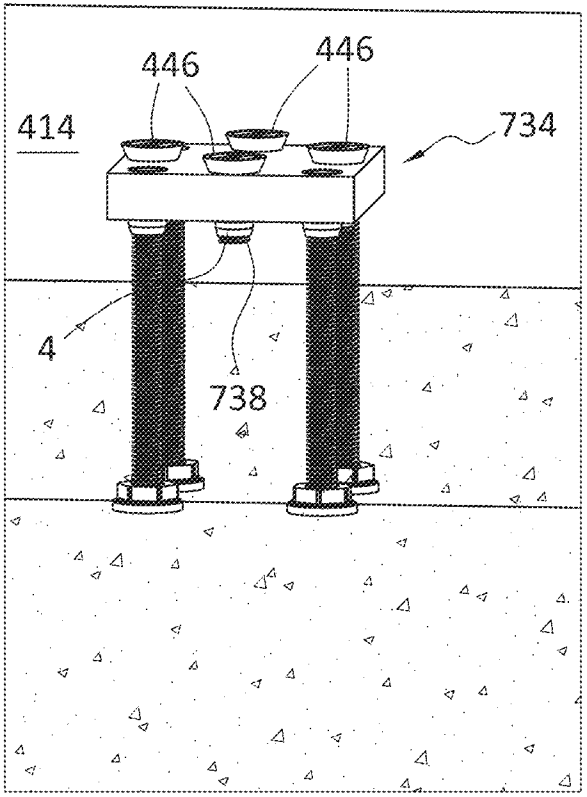

Referring to FIG. 148A, the end portion 738 of the threaded stem portion 448 extends outside of the boss section 4 to further seal the openings against the wet concrete. The extension into the concrete further provides additional room for the anchor rods, bolts or other fasteners to extend beyond the boss sections 4 to ensure complete thread engagement of the anchor rods, bolts or other fasteners with the threaded boss openings 3.

Referring to FIG. 148B, a column 740 is shown attached to the anchor assembly 734 with bolts threaded to the four additional threaded boss openings 3.

Figure 149B:
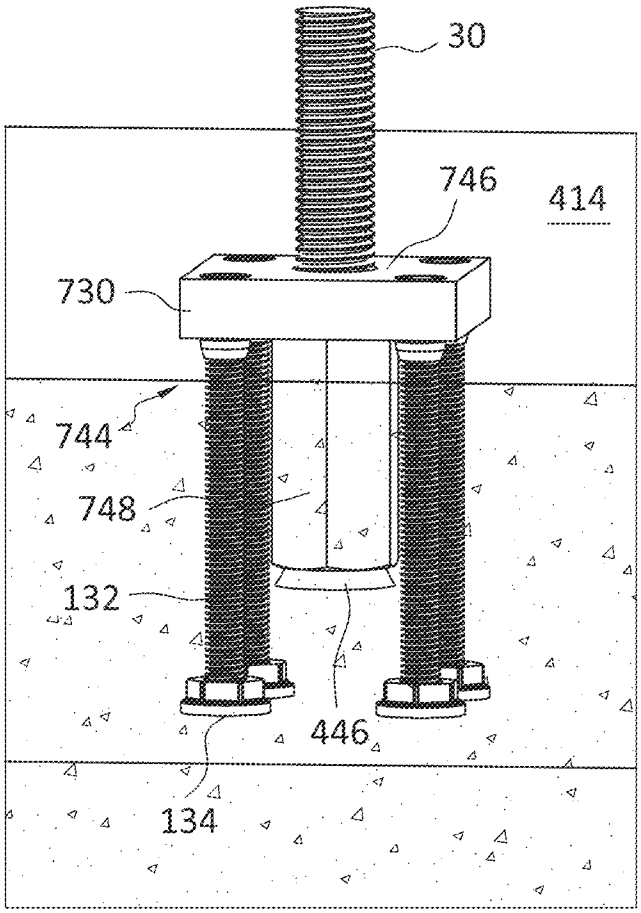
FIGS. 149A-151C show several anchor assemblies embedded in concrete using a coupler whose opening is accessible from outside the concrete structure for attachment of a threaded rod.
Figure 149A:
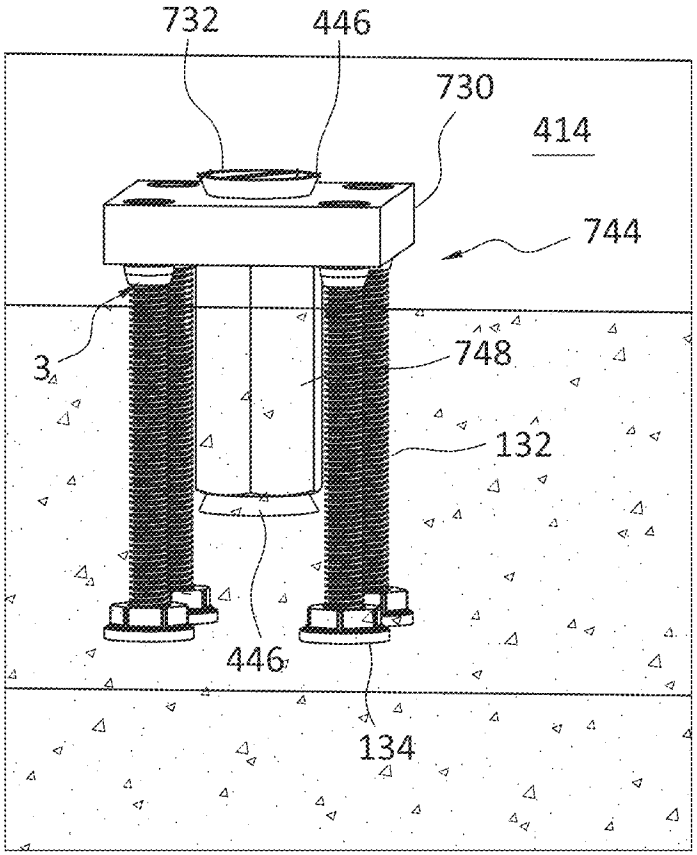

Referring to FIG. 149A, the anchor assembly 728 shown in FIG. 146A is modified as anchor assembly 744. Instead of a central threaded boss opening, an unthreaded central opening 746 is provided in the metal plate 730. The upper plastic plug 446 is threaded to a hexagonal coupler 748 to attach the coupler 748 to the metal plate 730. The coupler 748 has a central threaded opening 749 (see FIG. 151B). The upper plastic plug 446 has a longer stem portion 448 that extends below the metal plate 730 (see FIG. 151B) so as to connect to the coupler 748. A lower plastic plug 446 is threaded to the bottom portion of the coupler 748 to seal the inside of the coupler 748. The top 732 of the upper plastic plug 446 is preferably flush with the top of the concrete structure 414 so as for the upper plastic plug 446 to be accessible for removal after the concrete has dried.

Referring to FIG. 149B, the upper plastic plug 446 has been removed and an anchor rod 30 has been attached to the coupler 748.

Figure 150B:
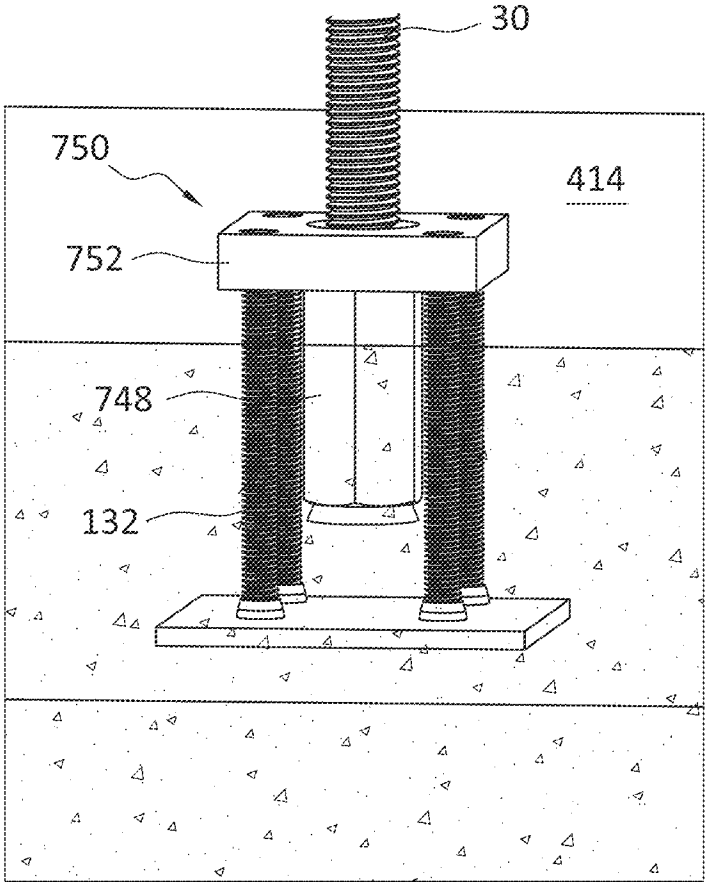
Figure 150A:
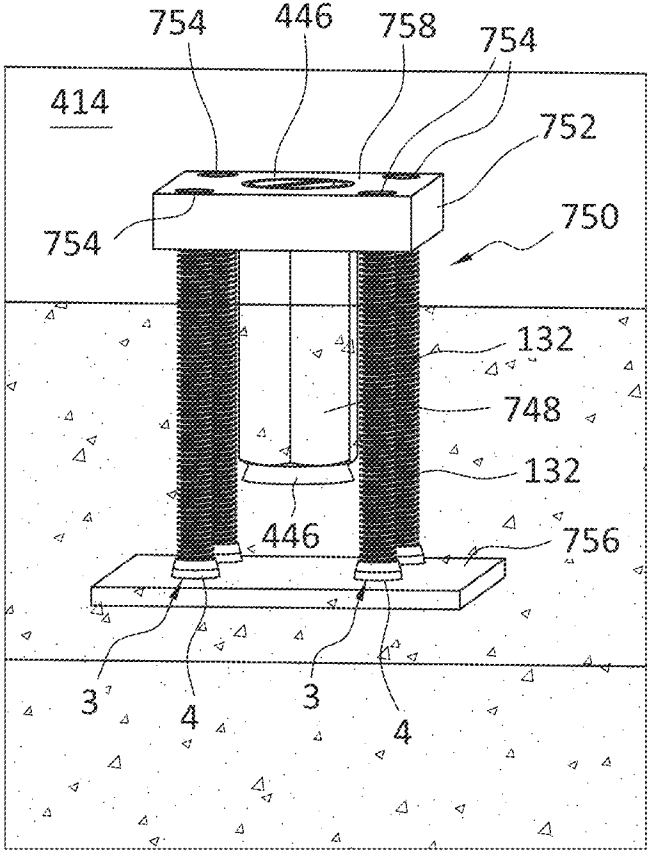

Referring to FIG. 150A, an anchor assembly 750 is shown embedded in concrete structure 414. The anchor assembly 750 includes a metal plate 752, preferably rectangular, with threaded openings 754 one on each corner of the plate 752. Stud bolts 132 are attached to the openings 754. The bottom ends of the stud bolts 132 are attached to a metal plate 756 with four threaded boss openings 3 with their boss sections 4 extending upwardly. The coupler 748 is attached to the metal plate 752 with the upper plastic plug 446, which its base portion 450 recessed into the metal plate 752. The top 758 of the metal plate 752 is preferably flush with top of the concrete structure 414 so as for the upper plastic plug 446 to be to be accessible for removal after the concrete has dried. The bottom end of the coupler 748 is sealed by the lower plastic plug 446.

Referring to FIG. 150B, the upper plastic plug 446 has been removed and an anchor rod 30 has been attached to the coupler 748.

Figure 151C:
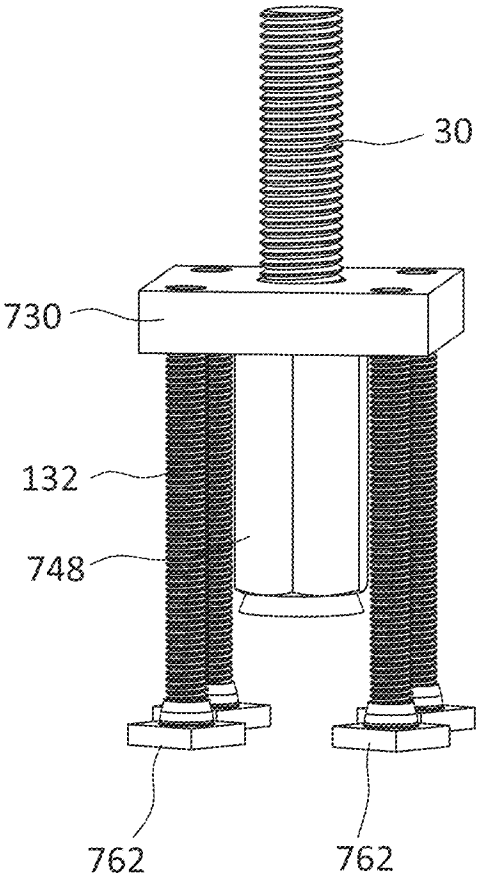
Figure 151A:
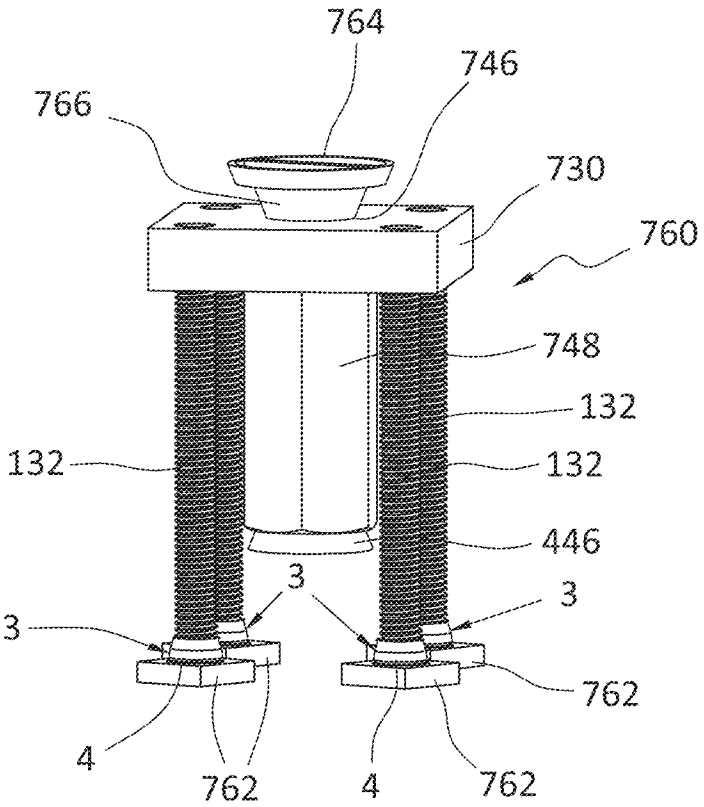
Figure 151B:
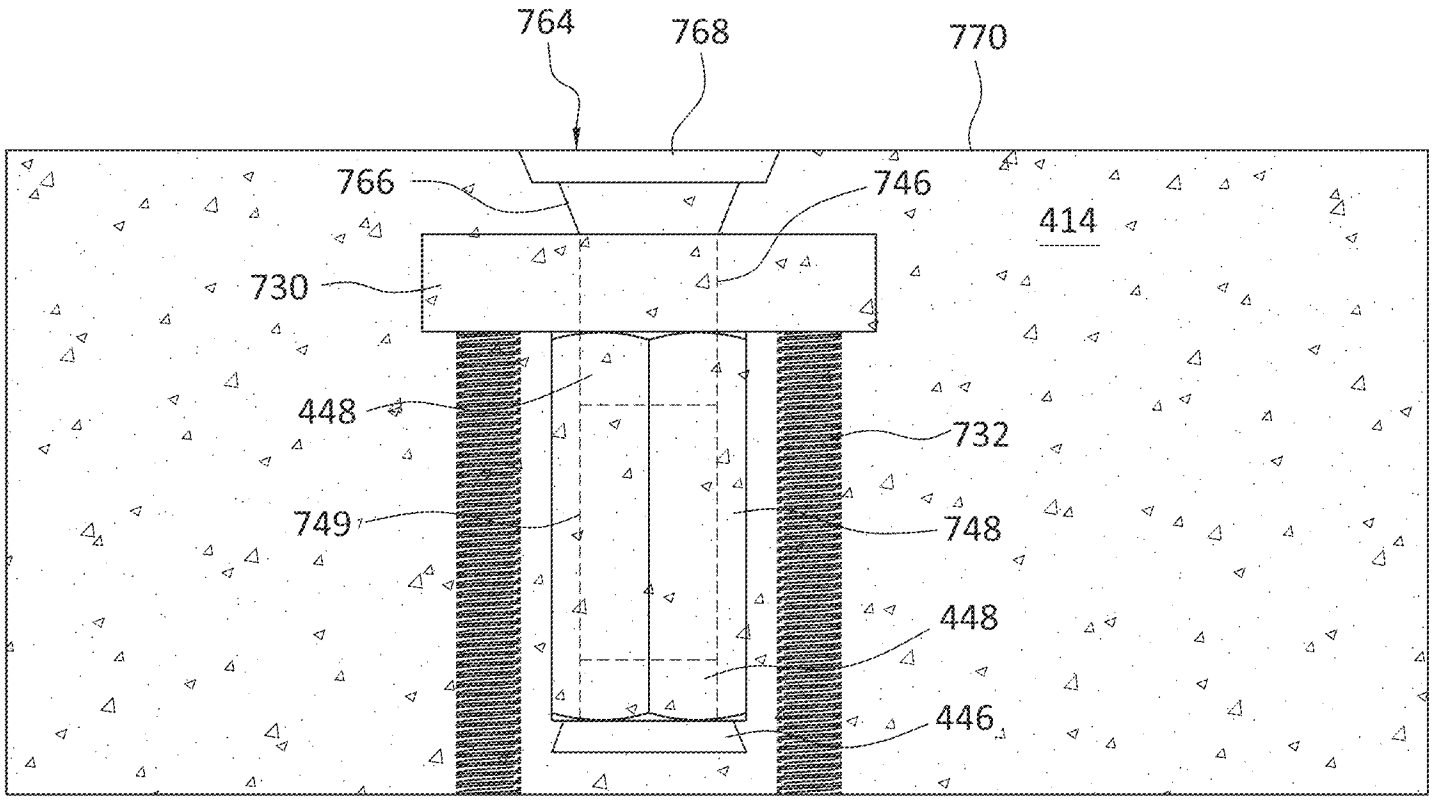

Referring to FIGS. 151A and 151B, the anchor assembly 750 shown in FIG. 150A is modified as anchor assembly 760. The metal plate 756 is replaced with four individual metal plates 762 with respective threaded boss openings 3 with their boss sections 4 extending upwardly. The upper plastic plug 446 is modified as plastic plug 764 with an extended conical stem portion 766 to allow the plate 730 to be deeper into the concrete structure 414 so that the plate 730 is able to contribute to the anchor assembly's anchoring strength. The top 768 of the upper plastic plug 764 is preferably flush with the top 770 of the concrete structure 414 so as for the upper plastic plug 764 to be accessible for removal after the concrete has dried.

Referring to FIG. 151C, the upper plastic plug 764 has been removed and an anchor rod 30 has been attached to the coupler 748.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. An anchor for being embedded in concrete, comprising:
a) a first metal plate including a first opening, the first metal plate including a thickness between a first top surface and a first bottom surface;
b) the first opening including a first wall extending from the first metal plate to a height, the first wall being integral and part of the first metal plate, the first wall including an outside surface directly intersecting one of the first top surface and the first bottom surface;
c) the first opening within the thickness and the first wall being threaded to provide threaded engagement with a threaded member;
d) the first metal plate including the first wall is embedded and in contact with the concrete to support a load attached to the threaded member; and
e) the first metal plate extending from the first wall longer than a thickness of the first wall at the first top surface or the first bottom surface of the first metal plate.

2. An anchor for being embedded in concrete, comprising:
a) a metal plate including an opening and a rod operably attached to the opening, the metal plate including a top surface and a bottom surface, the metal plate is configured to be embedded in concrete to support a load attached to the rod;
b) the opening including a wall extending from the metal plate to a height, the wall including an outside surface directly intersecting one of the top surface and the bottom surface, the wall being integral and part of the metal plate;
c) the metal plate including the wall is configured to be embedded and in contact with the concrete; and
d) the metal plate extending from the wall longer than a thickness of the wall at the top surface or the bottom surface of the metal plate.

3. An anchor for being embedded in concrete, comprising:
a) a first metal plate formed into a support including a base with a first opening, the base including a top side and a bottom side;
b) the first opening including a first wall extending from the top side, the first wall being integral and part of the base, the first opening being threaded;
c) a second metal plate having a second opening, the second metal plate is disposed on the top side, the first wall is received inside the second opening; and
d) a threaded rod is attached to the first opening.

4. An anchor for being embedded in concrete, comprising:
a) a first metal plate including a first opening, the first metal plate including a thickness between a first top surface and a first bottom surface;
b) the first opening including a first wall extending from the first metal plate, the first wall being integral and part of the first metal plate;
c) the first opening within the thickness and the first wall being threaded;
d) the first wall is configured to be embedded and in contact with the concrete;
e) the first metal plate being formed into a support including a base with the first opening, the base including the first top surface and the first bottom surface;
f) the first wall extending from the base; and
g) a threaded rod threaded to the first opening.

5. An anchor for being embedded in concrete, comprising:
a) a metal plate including an opening, the metal plate including a thickness between a top surface and a bottom surface;
b) the opening including a wall extending from the metal plate, the wall being integral and part of the metal plate;
c) the opening within the thickness and the wall being threaded to provide threaded engagement with a threaded member;
d) the wall is configured to be embedded and in contact with the concrete; and
e) the metal plate being formed into a U-shaped support including a base with the opening, the base including the top surface and the bottom surface.

6. An anchor for being embedded in concrete, comprising:
a) a metal plate including an opening, the metal plate including a thickness between a top surface and a bottom surface;
b) the opening including a wall extending from the metal plate, the wall being integral and part of the metal plate;
c) the opening within the thickness and the wall being threaded;
d) a threaded member attached to the opening;
e) the metal plate including the wall is configured to be embedded and in contact with the concrete; and
f) a support operably attached to the metal plate.

7. An anchor for being embedded in concrete, comprising:
a) a metal plate including an opening, the metal plate including a thickness between a top surface and a bottom surface;
b) the opening including a wall extending from the metal plate to a height, the wall being integral and part of the metal plate, the wall including an outside surface directly intersecting one of the top surface and the bottom surface, the wall being tapered wide to narrow as the wall extends from the metal plate to the height;
c) the opening within the thickness and the first wall being threaded to provide threaded engagement with a threaded member;
d) the metal plate including the wall is configured to be embedded and in contact with the concrete; and
e) the metal plate extending from the wall longer than the a thickness of the wall at the top surface or the bottom surface of the metal plate.

8. An anchor for being embedded in concrete, comprising:
a) a metal plate including an opening and a rod operably attached to the opening, the metal plate including a top surface and a bottom surface, the metal plate is configured to be embedded in concrete to support a load attached to the rod;
b) the opening including a wall extending from the metal plate to a height, the wall including an outside surface directly intersecting one of the top surface and the bottom surface, the wall being integral and part of the metal plate;
c) the metal plate including the wall is configured to be embedded and in contact with the concrete; and d) the metal plate being thicker than a thickness of the wall at the top surface or the bottom surface of the metal plate.

9. The anchor as in claim 1, wherein the first wall is tapered.

10. The anchor as in claim 1, and further comprising a threaded rod threaded to the first opening.

11. The anchor as in claim 2, and further comprising: a) a first nut attached to the rod engaging a top portion of the wall; and b) a second nut attached to the rod, the second nut engaging the bottom surface of the metal plate.

12. The anchor as in claim 10, wherein the first wall extends above the first top surface.

13. The anchor as in claim 12, wherein a bottom portion of the threaded rod is flush with the first bottom surface of the first metal plate.

14. The anchor as in claim 12, wherein a bottom portion of the threaded rod extends past the first bottom surface of the first metal plate.

15. The anchor as in claim 12, and further comprising a support operably attached to the first metal plate.

16. The anchor as in claim 15, wherein the support includes a base and a plurality of legs extending downwardly from the base.

17. The anchor as in claim 16, wherein:

a) the support is U-shaped; and b) an end portion of the threaded rod extends through the base.

18. The anchor as in claim 16, wherein:

a) the support is U-shaped;

b) the base includes a top side and a bottom side;

c) the first metal plate is attached to the bottom side with the first wall extending downwardly away from the bottom side; and e) a nut attached to the threaded rod and engaging the top side.

19. The anchor as in claim 4, and further comprising a nut threaded to the threaded rod.

20. The anchor as in claim 4, and further comprising a nut threaded to the threaded rod and engaging the first wall.

21. The anchor as in claim 4, and further comprising:

a) a second metal plate including a threaded second opening, the second metal plate including a second top surface and a second bottom surface;

b) the second opening including a second wall extending from the second metal plate; and c) the second metal plate is threaded to the threaded rod with the second bottom surface engaging the first top surface.

22. The anchor as in claim 21, wherein the second metal plate is rectangular.

23. The anchor as in claim 21, wherein the second metal plate is circular.

24. The anchor as in claim 21, wherein the second metal plate is hexagonal.

25. The anchor as in claim 10, wherein the threaded rod includes an unthreaded middle portion.

26. The anchor as in claim 3, wherein:

a) the second opening includes a side wall; and b) the side wall is conformed to the first wall.

27. The anchor as in claim 3, wherein the first wall extends above the second metal plate.

28. The anchor as in claim 3, and further comprising a nut threaded to the threaded rod and engaging a top surface of the second metal plate.

29. The anchor as in claim 5, wherein the support includes first and second legs extending downwardly from the base.

30. The anchor as in claim 29, wherein the base includes openings for nails or screws.

31. The anchor as in claim 29, wherein:

a) the support includes feet extending laterally from the respective first and second legs; and b) the feet include openings for nails or screws.

32. The anchor as in claim 4, wherein the base includes a plurality of the first openings arranged in a pattern.

33. The anchor as in claim 32, wherein:

a) the base is square;

b) one of the plurality of the first openings is a central first opening disposed at a center of the square; and c) four of the plurality of the first openings are arranged equidistant from each other and the central first opening.

34. The anchor as in claim 33, and further comprising stud bolts attached respectively to the four of the plurality of the first openings.

35. The anchor as in claim 34, wherein anchor bodies are attached respectively to the stud bolts.

36. The anchor as in claim 35, wherein the anchor bodies are integral to the stud bolts.

37. The anchor as in claim 32, wherein:

a) the first wall of one of the plurality of the first openings extends from the first bottom surface;

b) a second metal plate including a second opening, the second metal plate including a second top surface and a second bottom surface; and c) the second opening including a second wall extending from the second metal plate.

38. The anchor as in claim 32, wherein the pattern is square.

39. The anchor as in claim 4, wherein:

a) the base includes a plurality of arms radiating from a central portion; and b) the base includes a plurality of the first openings arranged in the arms.

40. The anchor as in claim 39, wherein one of the first openings is disposed in the central portion.

41. The anchor as in claim 1, wherein:

a) the first metal plate includes a base wall including the first top surface and the first bottom surface;

b) the base wall includes a plurality of the first openings for holding a plurality of threaded members, the first wall of each of the first openings extending from the first top surface; and c) the first openings are arranged in a pattern.

42. The anchor as in claim 1, wherein:

a) the first metal plate is longitudinal including a plurality of the first openings;

b) the first wall of each of the plurality of the first openings extending from the first metal plate; and c) threaded members are attached to the respective first openings.

43. The anchor as in claim 1, and further comprising a first support for elevating the first metal plate above a formboard, the first support including a first base portion and a first post portion extending from the first base portion, the first post portion including a first end portion attached to the first opening.

44. The anchor as in claim 1, wherein:

a) the first metal plate includes a second opening;

b) the first wall extends from the first bottom surface;

c) a first threaded rod extends downwardly from the first metal plate, the first threaded rod having one end being attached to the first opening and a second end attached to a threaded body;

d) the second opening is threaded for receiving an anchor rod; and e) a first plug including a first base portion and a first stem portion extending from the first base portion, the first stem portion being received in the second opening, the first plug being removable from the concrete in which the anchor assembly is embedded to expose the second opening for attachment of the anchor rod.

45. The anchor as in claim 1, wherein the first opening is tapered.

46. The anchor as in claim 1, wherein a radius is provided where the first wall meets the first metal plate.

47. The anchor as in claim 1, wherein the first wall is non-circular in cross-section.

48. The anchor as in claim 4, wherein the threaded rod includes a head portion.

49. The anchor as in claim 1, wherein the first opening includes a single diameter.

* * * * *